US009746293B2

(12) United States Patent
Cummings

(10) Patent No.: US 9,746,293 B2
(45) Date of Patent: Aug. 29, 2017

(54) SHAFTED PROJECTILES HAVING A HEAD

(71) Applicant: KMA Concepts Limited, Tsim Sha Tsui (HK)

(72) Inventor: Peter J. Cummings, Kowloon (HK)

(73) Assignee: KMA Concepts Limited, Tsim Sha Tsui (HK)

( * ) Notice: Subject to any disclaimer, the term of this patent is extended or adjusted under 35 U.S.C. 154(b) by 0 days.

(21) Appl. No.: 14/810,407

(22) Filed: Jul. 27, 2015

(65) Prior Publication Data

US 2015/0369575 A1 Dec. 24, 2015

Related U.S. Application Data

(63) Continuation of application No. 14/591,860, filed on Jan. 7, 2015, now Pat. No. 9,091,514, which is a (Continued)

(30) Foreign Application Priority Data

Apr. 4, 2014 (WO) ..... PCT/CN2014/074870

(51) Int. Cl.
*A63B 65/02* (2006.01)
*F42B 6/06* (2006.01)
(Continued)

(52) U.S. Cl.
CPC ..... *F42B 6/06* (2013.01); *A63F 9/0278* (2013.01); *F42B 6/003* (2013.01); *F42B 6/02* (2013.01);
(Continued)

(58) Field of Classification Search
CPC .... F42B 6/003; F42B 6/02; F42B 6/04; F42B 6/06; F42B 6/08
See application file for complete search history.

(56) References Cited

U.S. PATENT DOCUMENTS 613,386 A 11/1898 McKenney
667,630 A 2/1901 Kratz-Boussac
(Continued)

FOREIGN PATENT DOCUMENTS

CA 2240141 6/1998
CN 2339261 Y 5/1998
(Continued)

OTHER PUBLICATIONS

Dave & Busters, Kmart, Farmer'S Catalog, Canadian Toy Fair, Photographs of Similar Products, at least as early as Sep. 30, 2015, 11 pages.
(Continued)

*Primary Examiner* — John Ricci
(74) *Attorney, Agent, or Firm* — Law Office of Karen Dana Oster, LLC

(57) ABSTRACT

Mechanically attachable fletching is disclosed herein for a projectile having a shaft having an exterior surface. The mechanically attachable fletching includes at least one fin, a connection section bordering the at least one fin, and at least one mechanical fastener for attaching the fletching to the exterior surface of the shaft via the connection section. Also disclosed herein are methods for mechanically attaching fletching to the shaft of the projectile. Also disclosed herein are illuminated projectiles. Also described herein is a projectile having a shaft, a projectile head, and at least one fin. The projectile head preferably has a plurality of layers, the head end preferably being associated with the projectile head. Also described herein is a projectile that includes a shaft, a suction head, an outer head casing, and at least one fin. The suction head is preferably associated with the head end. The at least one launcher engager is preferably associated with the suction head. Two halves of the outer head
(Continued)

casing preferably sandwich the suction head and the head end.

30 Claims, 78 Drawing Sheets

Related U.S. Application Data continuation of application No. 14/245,494, filed on Apr. 4, 2014, now Pat. No. 9,341,448, application No. 14/810,407, which is a continuation of application No. 14/245,494, filed on Apr. 4, 2014, now Pat. No. 9,341,448.

(51) Int. Cl.

| | |
|---|---|
| ***F42B 6/00*** | (2006.01) |
| ***A63F 9/02*** | (2006.01) |
| ***F42B 6/02*** | (2006.01) |
| ***F42B 12/36*** | (2006.01) |
| ***F42B 12/42*** | (2006.01) |

(52) U.S. Cl.

CPC ..... *F42B 12/362* (2013.01); *F42B 12/42* (2013.01); *A63F 2009/0282* (2013.01); *Y10T 29/49895* (2015.01)

(56) References Cited

U.S. PATENT DOCUMENTS

| | | | |
|---|---|---|---|
| 1,545,476 | A | 7/1925 | Austerman |
| 2,268,487 | A | 12/1941 | Jacobs et al. |
| 2,417,267 | A | 3/1947 | Porter |
| 2,525,332 | A | 10/1950 | Alger et al. |
| 2,555,420 | A | 6/1951 | Richardson |
| 2,621,441 | A | 12/1952 | Worden |
| 2,666,643 | A | 1/1954 | William Miller John |
| 2,709,290 | A | 5/1955 | Harry |
| 2,748,529 | A | 6/1956 | Swan |
| 2,782,036 | A | 2/1957 | Folberth, Jr. et al. |
| 2,796,262 | A | 6/1957 | Folberth, Jr. et al. |
| 2,876,485 | A | 3/1959 | Cowles |
| 2,882,055 | A | 4/1959 | Meyer |
| 2,997,809 | A | 8/1961 | Gladen |
| 3,014,308 | A | 12/1961 | Leo et al. |
| 3,036,396 | A | 5/1962 | Swails |
| 3,050,805 | A | 8/1962 | Clyne |
| 3,168,961 | A | 2/1965 | Yates |
| 3,390,480 | A | 7/1968 | Turner |
| 3,445,954 | A | 5/1969 | Wahl et al. |
| 3,465,472 | A | 9/1969 | Novotny |
| 3,539,187 | A | 11/1970 | Smith |
| 3,667,758 | A | 6/1972 | Bengtsson |
| 3,759,519 | A | 9/1973 | Palma |
| 3,855,991 | A | 12/1974 | Imatt et al. |
| 3,954,266 | A | 5/1976 | Carrano et al. |
| 4,003,576 | A | 1/1977 | Carella |
| 4,258,689 | A | 3/1981 | Barnett |
| 4,340,930 | A | 7/1982 | Carissimi |
| 4,369,013 | A | 1/1983 | Abildgaard et al. |
| 4,458,658 | A | 7/1984 | Blair |
| 4,671,249 | A | 6/1987 | Troncoso |
| 4,697,228 | A | 9/1987 | Mui et al. |
| 4,795,165 | A | 1/1989 | Tehan |
| 4,856,792 | A | 8/1989 | Hardison |
| 4,900,037 | A | 2/1990 | Miller |
| 4,989,881 | A | 2/1991 | Gamble |
| 5,066,017 | A | 11/1991 | Kurland |
| 5,072,715 | A | 12/1991 | Barr |
| 5,230,650 | A | 7/1993 | Brayton |
| 5,247,920 | A | 9/1993 | Harbin |
| 5,279,513 | A | 1/1994 | Connelly |
| 5,282,453 | A | 2/1994 | Chia |
| D355,231 | S | 2/1995 | Chien |
| 5,415,151 | A | 5/1995 | Fusi et al. |
| 5,443,273 | A | 8/1995 | Lovorn |
| 5,830,029 | A | 11/1998 | Siegel |
| 6,042,494 | A | 3/2000 | Rappaport et al. |
| 6,247,990 | B1 | 6/2001 | Moorhouse |
| 6,500,042 | B1 | 12/2002 | LaPointe |
| 6,533,688 | B1 | 3/2003 | Huang |
| 6,682,448 | B2 | 1/2004 | Jamison |
| 7,001,292 | B1 | 2/2006 | Rappaport |
| 7,229,371 | B2 | 6/2007 | Walsh |
| 7,640,922 | B2 | 1/2010 | Siebelink |
| 7,686,002 | B2 | 3/2010 | Andrews |
| 7,748,369 | B2 | 7/2010 | Chee |
| D622,325 | S | 8/2010 | Walterscheid |
| 7,803,033 | B1 | 9/2010 | Walterscheid |
| 7,806,746 | B2 | 10/2010 | Walterscheid |
| 7,862,457 | B1 | 1/2011 | Urcheck |
| 7,874,947 | B1 | 1/2011 | Wolfinbarger et al. |
| D637,239 | S | 5/2011 | Walterscheid |
| D641,433 | S | 7/2011 | Walterscheid |
| 8,012,049 | B1 | 9/2011 | Walterscheid |
| 8,287,034 | B2 | 10/2012 | Smith et al. |
| 8,348,789 | B1 | 1/2013 | Walterscheid |
| 8,366,573 | B2 | 2/2013 | Hunt |
| 8,371,899 | B1 | 2/2013 | Walterscheid |
| 8,382,616 | B2 | 2/2013 | Marshall |
| 8,485,168 | B2 | 7/2013 | Walterscheid |
| 8,540,594 | B2 | 9/2013 | Chu |
| D698,872 | S | 2/2014 | Cummings |
| 8,662,060 | B2 | 3/2014 | Walterscheid et al. |
| 8,689,773 | B2 | 4/2014 | Walterscheid et al. |
| 8,852,038 | B1 | 10/2014 | Hyde |
| 9,091,514 | B1 * | 7/2015 | Cummings ..... F42B 6/02 |
| 2006/0011189 | A1 | 1/2006 | Simo |
| 2008/0156307 | A1 | 7/2008 | Myers |
| 2008/0295816 | A1 | 12/2008 | Edwards |
| 2009/0032002 | A1 | 2/2009 | Howard et al. |
| 2009/0301455 | A1 | 12/2009 | Yamashiro et al. |
| 2009/0314272 | A1 | 12/2009 | Lin |
| 2010/0255939 | A1 | 10/2010 | York |
| 2011/0041820 | A1 | 2/2011 | Stanziale |
| 2012/0060807 | A1 | 3/2012 | Walterscheid |
| 2012/0160224 | A1 | 6/2012 | Walterscheid |
| 2012/0174345 | A1 | 7/2012 | Scroggie et al. |
| 2013/0031756 | A1 | 2/2013 | Yuen |
| 2013/0055994 | A1 | 3/2013 | Walterscheid |
| 2013/0167819 | A1 | 7/2013 | Walterscheid |
| 2013/0263838 | A1 | 10/2013 | Cummings |
| 2014/0000577 | A1 | 1/2014 | Cummings |
| 2014/0256479 | A1 | 9/2014 | Bynum, Jr. |

FOREIGN PATENT DOCUMENTS

| | | | |
|---|---|---|---|
| CN | 2536273 | Y | 9/2001 |
| CN | 2595415 | | 12/2002 |
| CN | 2676978 | Y | 12/2003 |
| CN | 101266121 | A | 3/2007 |
| CN | 202052300 | U | 4/2011 |
| FR | 2761610 | | 10/1998 |
| GB | 2255289 | | 4/1992 |
| JP | 2008229285 | A | 3/2007 |
| TW | 509093 | U | 9/2001 |
| WO | WO2013133853 | | 9/2013 |

OTHER PUBLICATIONS

Merchsource, "HSL-2nd Shot Arrow," email communication with attachments, at least as early as Nov. 4, 2013, 4 pages.

"LED Light Arrow Rocket Helicopter Flying Toy," Amazon.com, www.amazon.com/Amazing-Rocket-Helicopter-Flying-Elastic/dp/B00CV3NN4E/ref=pd_sbs_t_1, at least as early as Jan. 6, 2014, 7 pages.

"LED Arrow Helicopter," DHgate,com, copyright © 2004-2013 DHgate.com, at least as early as Dec. 6, 2013, 9 pages.

"Arrowcopter Flying Light," Amazon.com, www.amazon.com/Sling-Copter-Arrowcopter-Flying-Light/dp/B003LYIT10/ref=pd_sbs_t_9, at least as early at Jan. 6, 2014, 3 pages.

(56) References Cited

OTHER PUBLICATIONS

"Marble Copters Light Up Helicopter," Skullduggery, Amazon.com, www.amazon.com/Skullduggery-Marble-Copters-Light-Helicopter/dp/B007XWSLGI, at least as early as Jan. 6, 2014, 4 pages.
"Nockturnal™ Lighted Arrow X Nock—3-Pack," www.cabelas.com, © 1996-2014 Cabela's Inc., 1 page.
"K-Resin® Styrene-Butadiene Copolymers, The Smart Choice™," Chevron Phillips Chemical Company LP, www.cpchem.com, www.k-resin.com, Mar. 2011, 13 pages.
"BestDealUSA Slingshot Helicopter LED Flashing Children Fly 50m High," Sling Copter, Amazon.com, www.amazon.com/BestDealUSA-Slingshot-Helicopter-Flashing-Children/dp/B008JA0MBK/ref=sr_1_10, at least as early as Jan. 6, 2014, 2 pages.
"Flexo® Super Duty Heavy Duty Technical Data Sheet," Techflex, www.techflex.com, ©2009 Techflex, Inc., 2 pages.
"T-H Flex™ Expandable Braided Sleeving," www.thmarine.com, © 2001-2013 T-H Marine Supplies, at least as early as Nov. 14, 2013, 1 page.
ISA/US, "International Search Report," Jun. 22, 2012, Patent Cooperation Treaty, 2 pages.
Groupon, "The Black Series Toy Bow and Target Set. Free Returns," web page, http://www.groupon.com/deals/gg-th-black-series-toy-bow-and-target-set, at least as early as Dec. 29, 2014, 3 pages.
Bed Bath & Beyond, "Black Series Bow and Arrow Set with Targets," web page, http://www.bedbathandbeyond.com/1/1/255930-black-series-bow-arrow-set-targets.html, at least as early as Oct. 27, 2014, 3 pages.
Phoenix Behavior.com, "7 Piece Archery Target Set," web page, http://phoenixbehavior.com/sale-product-online/db0ee0f38edb31acf3500a49dfb2241ff06a2286db994/the-black-series-indoor-outdoor-7-piece-archery-set, 4 pages.
Marek, Alison, "More Than 180 Videos From Pomona!," Apr. 2009, TDmonthly®, Copyright © 2014 TDmonthly®, a division of ToyDirectory.com®, Inc., 10 pages.
TDmonthly®, Copyright © 2015 TDmonthly®, a division of ToyDirectory.com®, Inc., at least as early as Apr. 2009, 3 pages of screen captures, http://www.toydirectory.com/monthly/video/video2.asp?clip=1TRADESHOW/Pomona09/ZingT-Zartz.swf.
Marek, Alison and Jones Julie L., "Fast, Cheap and Under Control," Jul. 2007, TDmonthly®, Copyright © 2014 TDmonthly®, a division of ToyDirectory.com®, Inc., 26 pages.
TDmonthly®, Copyright © 2015 TDmonthly®, a division of ToyDirectory.com®, Inc., at least as early as Jul. 2007, 2 pages of screen captures, http://www.toydirectory.com/monthly/video/video.asp?clip=22640.
Shao, Jiamu, "A Structure Improvement of the Dartlike Weapon," CN2339261Y, filed May 25, 1998, machine translation, State Intellectual Property Office of the P.R.C., Aug. 10, 2015, 5 pages.
Huang Guohua, "The Luminous Rotatable Dartlike Weapon of the Dartlike Weapon Wing That Reaches," CN2536273Y, filed Sep. 25, 2001, machine translation, State Intellectual Property Office of the P.R.C., Aug. 11, 2015, 14 pages.
Wu Yunmi, "The Combined Typoe Strengthens the Body to Dart," CN2595415, filed Dec. 17, 2002, machine translation, State Intellectual Property Office of the P.R.C., Aug. 10, 2015, 5 pages.
Fuxiang Industrial Co., Ltd., "The Flash of Light Dartlike Weapon," CN2676978Y, filed Dec. 10, 2003, machine translation, State Intellectual Property Office of the P.R.C., Aug. 11, 2015, 18 pages.
Nie Xiaoqing, "A Link Construction that the Dartlike Weapon Pole and the Dartlike Weapon Wing of Dartlike Weapon," CN101266121A, filed Mar. 12, 2007, machine translation, State Intellectual Property Office of the P.R.C., Aug. 10, 2015, 31 pages.
Ju Erlin, "A Dartlike Weapon Fin," CN202052300U, filed Apr. 18, 2011, machine translation, State Intellectual Property Office of the P.R.C., Aug. 10, 2015, 9 pages.
Jinta Serizawa, "Dart Flight," JP2008229285A, filed Oct. 2, 2008, machine translation, Japan Platform for Patent Information, Aug. 11, 2015, 16 pages.
Huang Guohua, "Darts and Dart Having a Light Emitting Structure of the Wing Can be Rotated," TW509093U, filed Sep. 13, 2001, machine translation, Taiwan Intellectual Property Office via Google Translate, Aug. 10, 2015, 18 pages.
International Search Report and Written Opinion, Patent Cooperation Treaty (PCT), PCT/CN2014/074870, filed Apr. 4, 2014 (Apr. 4, 2014), dated Dec. 31, 2014 (Dec. 31, 2914), 11 pages.

* cited by examiner

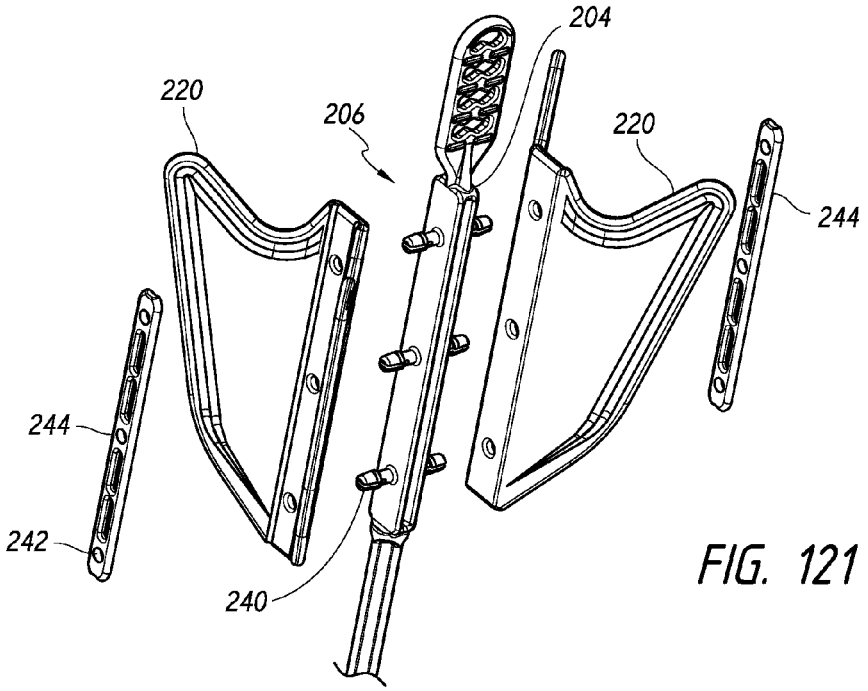
FIG. 121
FIG. 122
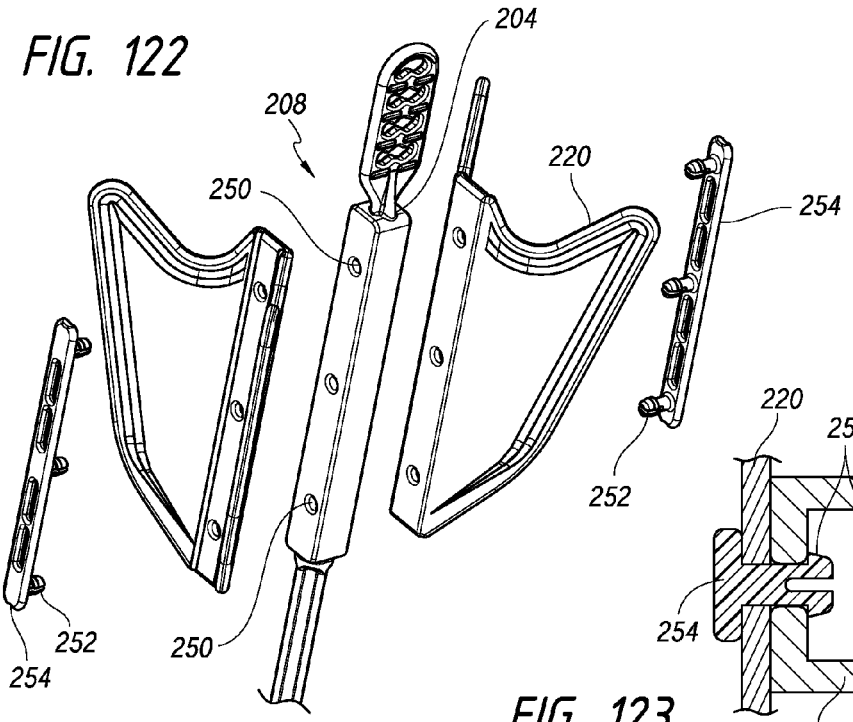
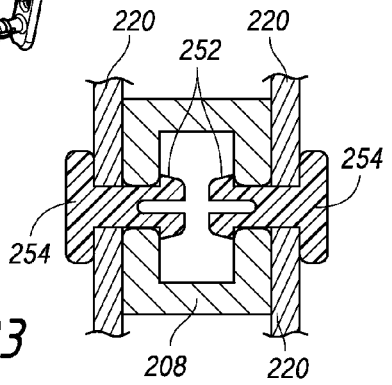
FIG. 123

SHAFTED PROJECTILES HAVING A HEAD

The present application is a continuation of U.S. patent application Ser. No. 14/591,860, filed Jan. 7, 2015, which issued as U.S. Pat. No. 9,091,514 on Jul. 28, 2015. U.S. patent application Ser. No. 14/591,860, which issued as U.S. Pat. No. 9,091,514 on Jul. 28, 2015, is a continuation of U.S. patent application Ser. No. 14/245,494, filed Apr. 4, 2014. U.S. patent application Ser. No. 14/245,494, filed Apr. 4, 2014 is a continuation of PCT Application No. PCT/CN2014/074870, filed Apr. 4, 2014. The present application is a continuation of U.S. patent application Ser. No. 14/245,494, filed Apr. 4, 2014. U.S. patent application Ser. No. 14/245,494, filed Apr. 4, 2014, is a continuation of PCT Application No. PCT/CN2014/074870, filed Apr. 4, 2014. The present application is based on and claims priority from these applications, the disclosures of which are hereby expressly incorporated herein by reference.

BACKGROUND OF THE INVENTION

Described herein are shafted projectiles having a head and, more specifically, projectiles having at least one new and unique individual feature selected from the group consisting of a shaft, a head, a launcher engager, a tail, and an illuminator.

Projectiles can be broadly defined as devices that fly through the air. In most cases, the projectile is launched into its flying state using a launcher. A shafted projectile is a type of projectile that has a shaft that, in most cases, is an elongated shaft. Exemplary shafted projectiles include, but are not limited to, arrows, rockets, or darts. Exemplary shafted projectiles include U.S. Pat. No. 7,874,947 to Wolfinbarger et al., U.S. Pat. No. 6,042,494 to Rappaport et al., U.S. Pat. No. 4,856,792 to Hardison, U.S. Pat. No. 8,540,594 to Chu, U.S. Pat. No. 8,366,573 to Hunt, and U.S. Pat. No. 4,340,930 to Carissimi. Exemplary launchers include, but are not limited to, bows, mechanical launchers, slingshots, catapults, slings, and/or the human hand.

An arrow is a shafted projectile that is shot with a bow or similar device. For purposes of discussion, an arrow can be discussed in terms of its composite parts: an elongated shaft, a head, and fletching (stabilizing fins). The head is associated with a first leading end of the shaft (the head end) and the fletching is associated with the second trailing end of the shaft (the tail end). Traditional heads are "points" (sharp pieces that may be used for piercing objects at the end of the flight of the arrow), but alternative heads may be suction heads, and blunt plastic heads. The fletching assists in the flight of the arrow, and is traditionally attached to the back end of the shaft. The fletching may be, for example, stabilizing fins (also called feathers, airfoils, or vanes). A traditional arrow also includes a "nock" (e.g. a notch or slot) that may be used to attach the arrow to the bow string. The nock traditionally is associated with the trailing end of the arrow at or near the fletching. The fletching may be made from natural (e.g. feathers) or synthetic materials. An exemplary synthetic material is discussed in U.S. Pat. No. 3,539,187 to Smith.

A traditional way to apply the fletching to the shaft is by adhering each fin to the shaft with adhesive or glue. Using glue to adhere the fletching is extremely time consuming. Moreover, as the fletching's primary purpose is to assist in the aerodynamics of the arrow's flight, applying the fletching must be done in a precise manner. If there are flaws or errors in attaching the fletching, the arrow may not fly straight or will otherwise not fly as intended.

Alternative methods to attach the fletching to the shaft include inserting one or more fin sections into a longitudinal slot in the trailing end of the shaft, such as described in U.S. Pat. No. 2,882,055 to Meyer, U.S. Pat. No. 2,525,332 to Alger et al., and U.S. Pat. No. 613,386 to McKenney. Methods that leave the trailing end of the shaft open such as the Meyer and McKenney references may be less secure than desirable, as the fins may fall out of the shaft end. The Alger reference describes a method of stapling the nock at the trailing end of the arrow shaft to act as a securer that secures the previously inserted fin sections. This latter method contains small parts such as a wire staple that may be unsuitable for a children's toy. Thus, an improved method for attaching fins is desirable.

It has been recognized that it is advantageous to light or illuminate a projectile. This feature is desirable, for example, to help locate or recover the projectile if it is flown at night or is lost in dense brush, leaves, or the like. The Hardison reference discusses insertion of a light-emitting chemical light stick into the cavity of the nock. The Hunt reference discusses placement of a light-emitting material on arrow components such as vanes and nocks, light provided by a photo-luminescent material, a chemi-luminescent material, a refractive material, a reflective material, another light-emitting material, or a composite of these. The Chu reference discusses a nock assembly containing a light-emitting diode or like light source that illuminates the nock and nock housing. Additionally, the Carissimi reference contains a manual switch to control the light assembly by opening and closing an electric circuit, a light source being housed within the nock similar to the Chu reference.

There are several toy projectiles that have external illumination and helicopter structure. One example is the "LED Amazing Arrow Helicopter Flying Umbrella" that has an LED adjacent to the shaft that indirectly shines a light on the shaft. Another example is a "Marble Copter" that is available at www.sculldugger y.com that has a light-up marble at one end of a shaft and the shaft "glows." To use the Marble Copter one can "Fling the copter high into the air using the rubber band wand. It flies up to 50 feet in the nighttime sky, lights up and glows, as the light reflects off the hologram wings, and then helicopters to the ground." One of the reviews of this toy suggested that it had a multi color strobe in the marble at the end of the shaft.

BRIEF SUMMARY OF THE INVENTION

Described herein is a projectile having a shaft, a projectile head, and at least one fin. The shaft preferably has a head end and a tail end. The projectile head preferably has a plurality of layers, the head end preferably being associated with at least one layer of the projectile head. The at least one fin is preferably attached to the tail end.

The shaft may have an O-shaped cross-section and/or may be hollow.

The shaft may have an extension associated with the head end, the extension may be embedded within the at least one layer of the projectile head.

The projectile head may be secured to the shaft using an adhesive selected from the group consisting of glue, sonic welding, and insert molding.

At least one launch engager may be associated with the projectile head. More specifically, the at least one launch engager may be embedded in the projectile head.

The plurality of layers may include a central layer and two outside layers, and the head end may be associated with the central layer. In one projectile, the plurality of layers is a central layer and two outside layers, the head end being associated with the central layer. If the shaft has an extension associated with the head end, the extension may be embedded within the central layer.

A flexible tab may be attached to the tail end.

Also described herein is a projectile that includes a shaft, a suction head, an outer head casing, and at least one fin. The shaft preferably has a head end and a tail end. The suction head is preferably associated with the head end. The at least one launcher engager is preferably associated with the suction head. The outer head casing preferably has two halves, the halves of the outer head casing sandwiching the suction head and the head end. The at least one fin is preferably attached to the tail end.

The at least one launch engager may be two hooks.

A flexible tab may be attached to the tail end.

Also disclosed herein, is mechanically attachable fletching for a projectile having a shaft having an exterior surface. The mechanically attachable fletching includes at least one fin, a connection section bordering the at least one fin, and at least one mechanical fastener for attaching the fletching to the exterior surface of the shaft via the connection section.

The mechanically attachable fletching may also be characterized in one or more of the following ways:

- the at least one fin is two fins separated by the connection section.
- the at least one fin is at least one double fletching that has two fins and the connection section is positioned between the fins. At least one aperture is preferably defined in the connection section, and the at least one mechanical fastener is for attaching the double fletching to the exterior surface of the shaft via the at least one aperture.
- the at least one mechanical fastener is at least one projecting prong fastener that interacts with at least one aperture of a mating apertured fastener.
- the at least one mechanical fastener is at least one projecting prong fastener that interacts with at least one aperture of a mating apertured fastener, the at least one projecting prong fastener projecting outwardly from the shaft.
- the at least one mechanical fastener is at least one projecting split-prong fastener that interacts with at least one aperture of a mating apertured fastener, the at least one projecting split-prong fastener projecting outwardly from the shaft.

The mechanically attachable fletching may further include fletching connection structure associated with the connection section. The at least one mechanical fastener may be used for attaching the fletching to the exterior surface of the shaft via the fletching connection structure. The at least one mechanical fastener may be used for attaching the fletching to the exterior surface of the shaft via the at least one aperture. The at least one fin may be two fins separated by the connection section, the at least one mechanical fastener may be used for attaching the fletching to the exterior surface of the shaft via the fletching connection structure. The fletching connection structure may be at least one aperture defined in the connection section, the at least one mechanical fastener may have at least one prong, and the at least one prong may be insertable through the at least one aperture.

The mechanically attachable fletching is preferably characterized in that the shaft functions as a light pipe such that light from an at least one source of illumination travels along the shaft and at least partially illuminates the shaft.

Also disclosed herein is a method for mechanically attaching fletching to a shaft of a projectile, the shaft having a head end and a tail end, the shaft having an exterior surface. The method comprising the steps of: (a) aligning at least one double fletching having a connection section such that fletching connection structure associated with the connection section is aligned with the tail end of the shaft; (b) aligning at least one mechanical fastener with the connection section and the tail end of the shaft; and (c) fastening the at least one mechanical fastener to attach the at least one double fletching to the exterior surface of the shaft via the fletching connection structure.

The method may be characterized in that the step of aligning at least one mechanical fastener with the connection section and the tail end of the shaft further comprising the step of aligning at least one prong of the at least one mechanical fastener with at least one aperture of the connection section and the tail end of the shaft; and the step of fastening the at least one mechanical fastener to attach the at least one double fletching to the exterior surface of the shaft further comprising the step of inserting at least one prong through the at least one aperture and fastening the at least one prong.

The method may be characterized in that the step of aligning at least one mechanical fastener with the connection section and the tail end of the shaft further comprising the step of aligning at least one prong projecting from the tail end of the shaft with at least one aperture of the connection section; and the step of fastening the at least one mechanical fastener to attach the at least one double fletching to the exterior surface of the shaft further comprising the step of inserting at least one prong through the at least one aperture and fastening the at least one prong.

The method may be characterized in that the step of aligning at least one mechanical fastener with the connection section and the tail end of the shaft further comprising the step of aligning at least one prong projecting from the tail end of the shaft with at least one aperture of the connection section; and the step of fastening the at least one mechanical fastener to attach the at least one double fletching to the exterior surface of the shaft further comprising the step of inserting at least one prong through the at least one aperture and fastening the at least one prong to a mating apertured fastener.

The method may be characterized in that the step of aligning at least one mechanical fastener with the connection section and the tail end of the shaft further comprising the step of aligning at least one split-prong projecting from the tail end of the shaft with at least one aperture of the connection section; and the step of fastening the at least one mechanical fastener to attach the at least one double fletching to the exterior surface of the shaft further comprising the step of inserting at least one split-prong through the at least one aperture and fastening the at least one split-prong.

The method may be characterized in that the step of aligning at least one mechanical fastener with the connection section and the tail end of the shaft further comprising the step of aligning at least one split-prong projecting outwardly from the tail end of the shaft with at least one aperture of the connection section; and the step of fastening the at least one mechanical fastener to attach the at least one double fletching to the exterior surface of the shaft further comprising the step of inserting at least one split-prong through the at least one aperture and fastening the at least one split-prong to a mating apertured fastener.

Also disclosed herein is an illuminated projectile having a shaft, the shaft having a head end and a tail end, the head end having a head. The illuminated projectile preferably includes (a) at least one illumination system having at least one source of illumination, at least one power source, and circuitry; (b) the at least one source of illumination positioned generally within the projectile at least near the head end; (c) the at least one source of illumination directed generally toward the tail end; and (d) the shaft functioning as a light pipe such that light from the at least one source of illumination travels along the shaft and at least partially illuminates the shaft.

The subject matter described herein is particularly pointed out and distinctly claimed in the concluding portion of this specification. Objectives, features, combinations, and advantages described and implied herein will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary projectiles or features thereof and/or provide teachings by which the various exemplary projectiles or features thereof are more readily understood.

FIG. 119 is a bottom plan view of the projectile of FIG. 113.

FIG. 120 is an exploded view of the projectile of FIG. 113.

FIG. 121 is a perspective exploded view of a first exemplary tail end with a rod shaft and mechanically attached double fletching, the rod shaft having at least one outwardly projecting split-prong fastener that interacts with at least one aperture of a mating apertured fastener to secure one of the double fletching to the rod shaft.

FIG. 122 is a perspective exploded view of a second exemplary tail end with a rod shaft and mechanically attached double fletching, the rod shaft having at least one aperture into which an associated at least one projecting split-prong fastener of a mating fastener may be inserted to secure one of the double fletching to the rod shaft.

FIG. 123 is a cross-section of the double fletching secured between the rod shaft and the fastener of FIG. 122.

Figure 124:
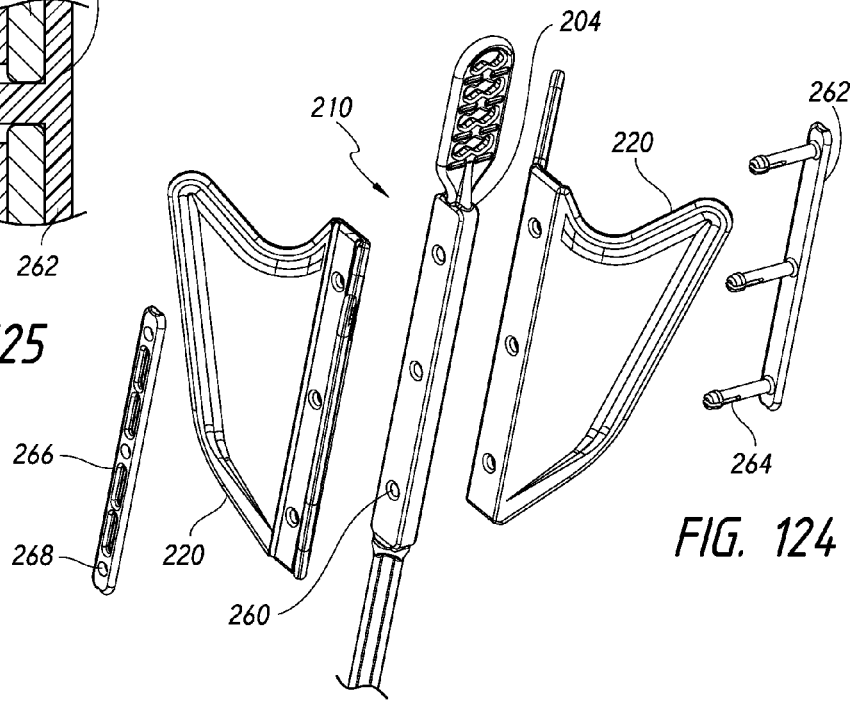

FIG. 124 is a perspective exploded view of a third exemplary tail end with a rod shaft and mechanically attached double fletching, the rod shaft having at least one through aperture through which an associated at least one projecting split-prong fastener of a pronged mating fastener may be inserted to secure one of the double fletching to the rod shaft, the at least one projecting split-prong fastener extending through at least one aperture of an apertured mating fastener to secure one of the double fletching to the rod shaft.

Figure 125:
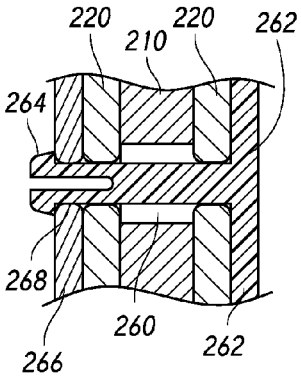

FIG. 125 is a cross-section of the double fletching secured between the rod shaft and the fasteners of FIG. 124.

Figure 126:
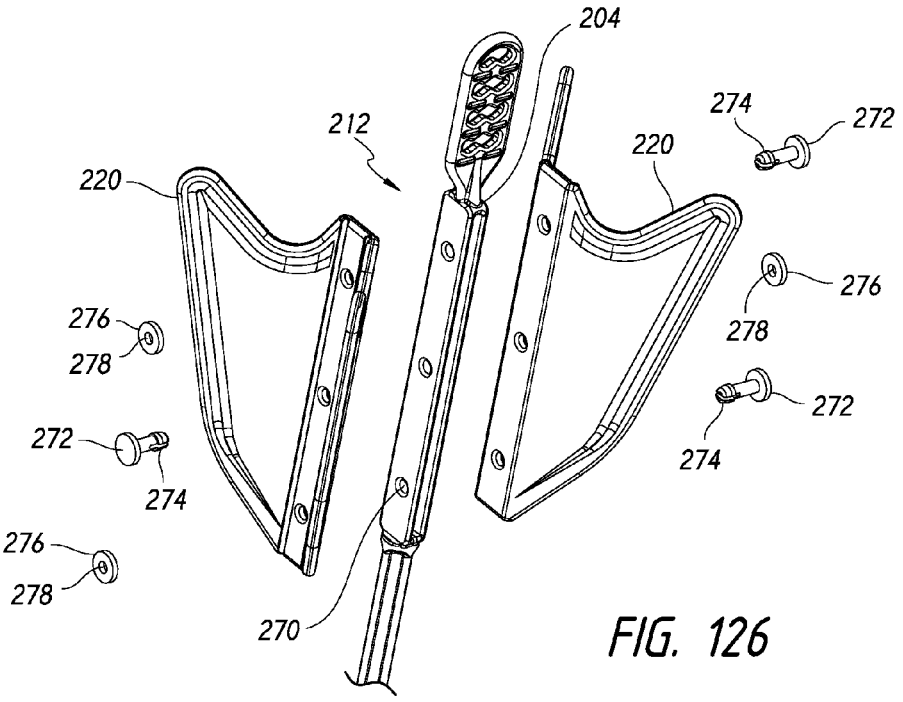

FIG. 126 is a perspective exploded view of a fourth exemplary tail end with a rod shaft and mechanically attached double fletching, the rod shaft having at least one aperture into which an associated at least one single-pronged projecting split-prong fastener of a mating fastener may be inserted to secure the double fletching to the rod shaft.

Figure 127:
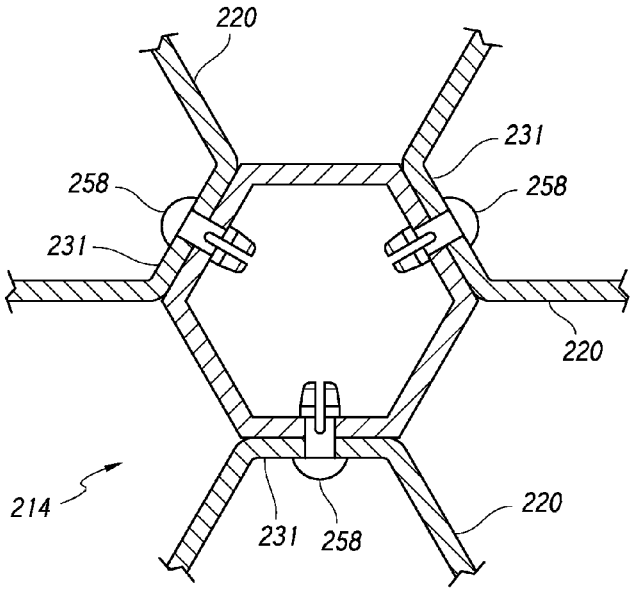

FIG. 127 is a cross-sectional view of an alternative exemplary tail end of a rod shaft having three sets of mechanically attached double fletching.

Figure 128:
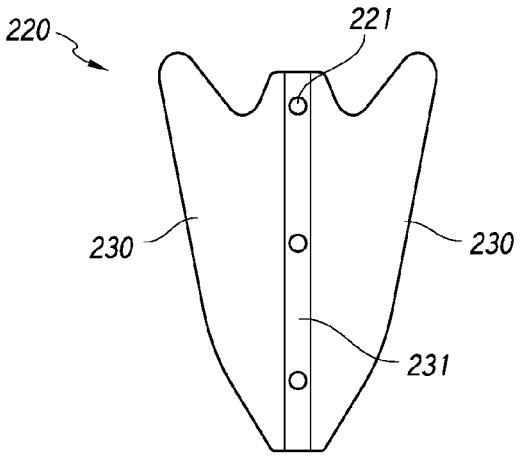

FIG. 128 is a plan view of a first exemplary double fletching.

Figure 129:
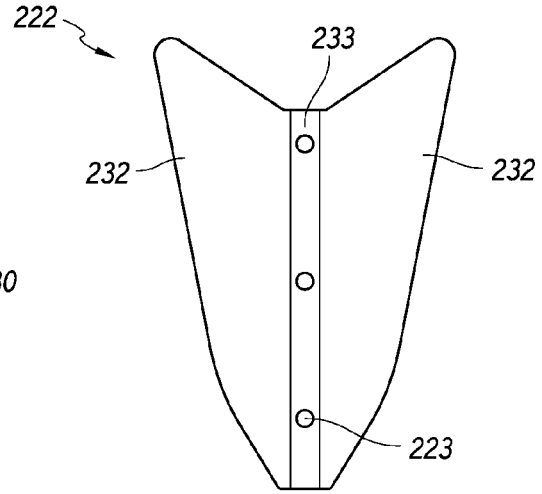

FIG. 129 is a plan view of a second exemplary double fletching.

Figure 130:
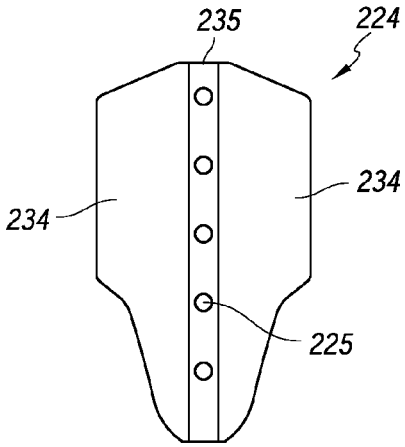

FIG. 130 is a plan view of a third exemplary double fletching.

Figure 131:
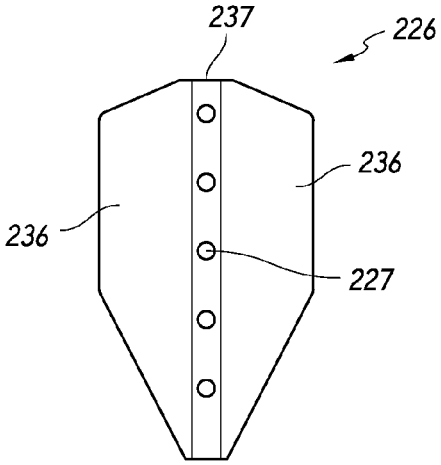

FIG. 131 is a plan view of a fourth exemplary double fletching.

Figure 132:
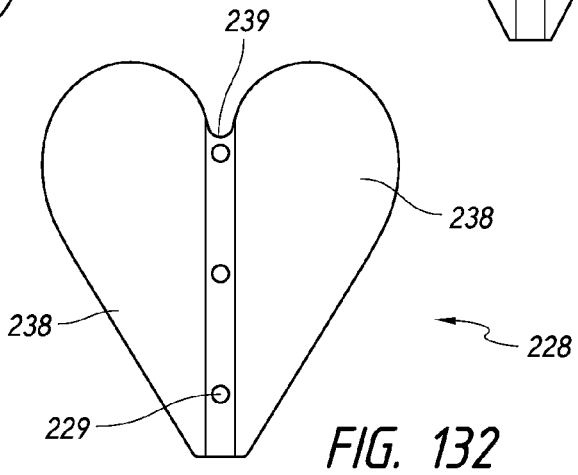

FIG. 132 is a plan view of a fifth exemplary double fletching.

Figure 133:
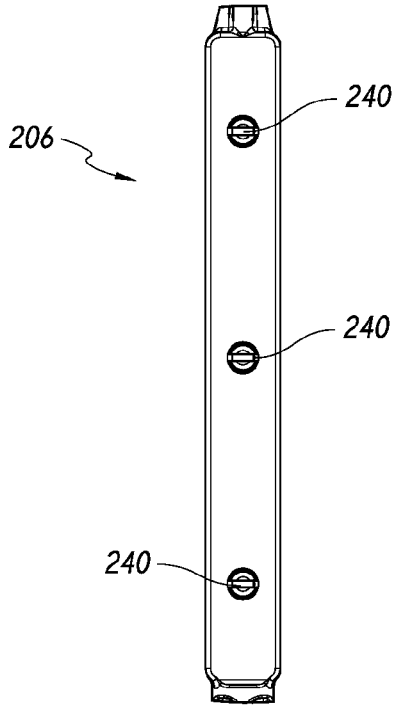

FIG. 133 is a partial enlarged view, of an exemplary tail end of a rod shaft showing split prongs projecting outwardly therefrom.

Figure 134:
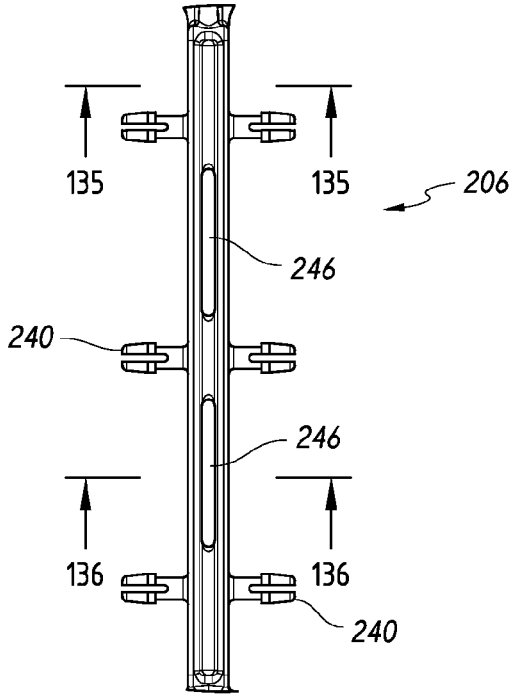

FIG. 134 is a partial enlarged view of an exemplary tail end of a rod shaft taken from a side perpendicular to the side shown in FIG. 133, showing outwardly projecting split prongs.

Figure 135:
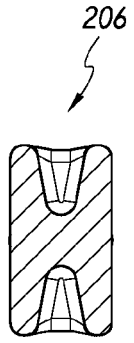

FIG. 135 is a cross-sectional view of the exemplary tail end of a rod shaft of FIGS. 133 and 134 taken along line 135-135.

Figure 136:
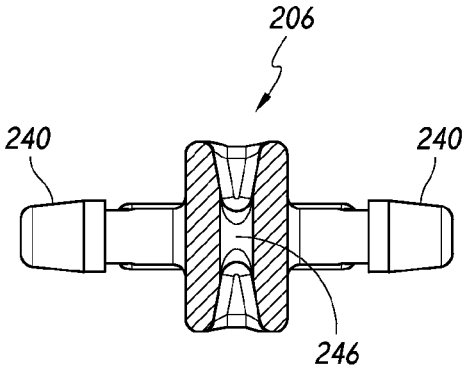

FIG. 136 is a cross-sectional view of the exemplary tail end of a rod shaft of FIGS. 133 and 134 taken along line 136-136.

Figure 137:
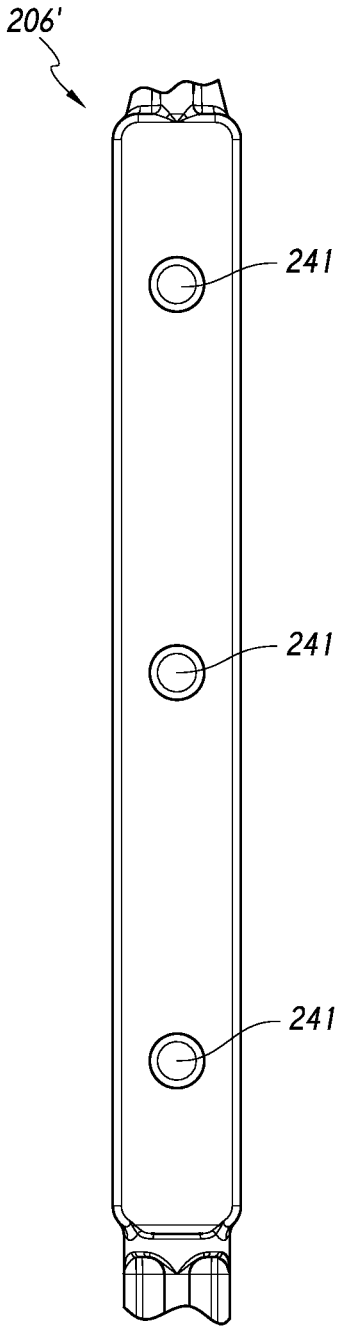

FIG. 137 is a partial enlarged view of an exemplary tail end of a rod shaft showing solid prongs projecting outwardly therefrom.

Figure 138:
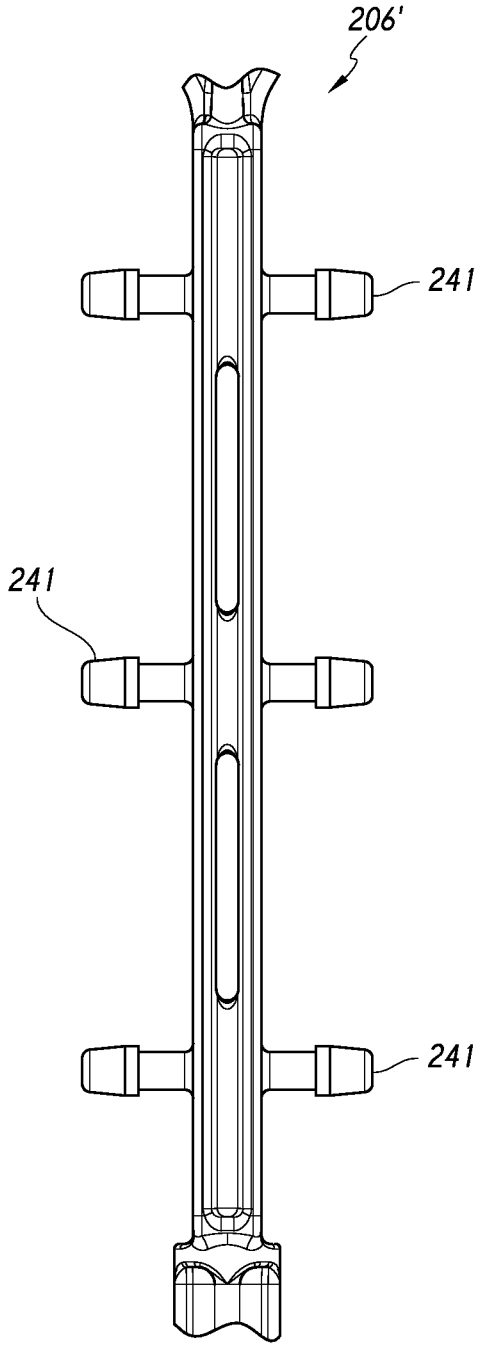

FIG. 138 is a partial enlarged view, taken from a side perpendicular to the side shown in FIG. 137, of an exemplary tail end of a rod shaft showing outwardly projecting solid prongs.

Figure 139:
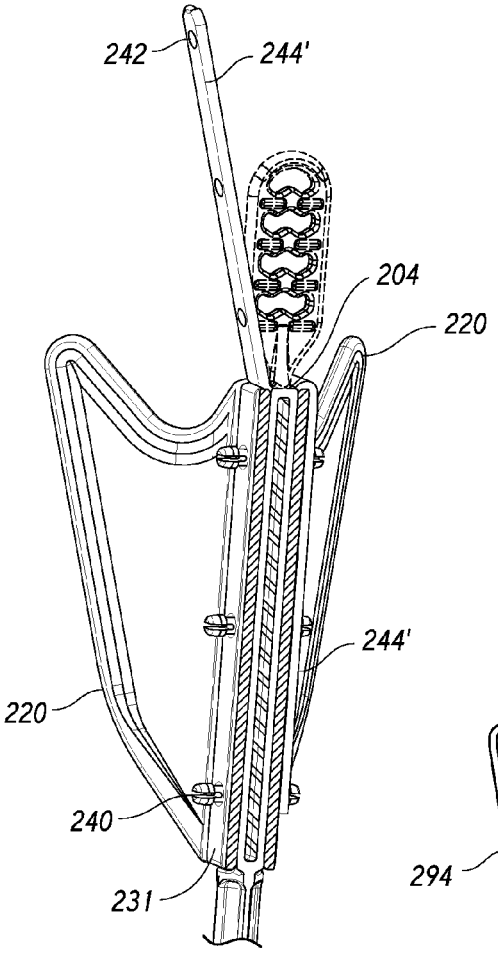

FIG. 139 is a perspective view of a modified first exemplary tail end with a rod shaft and mechanically attached double fletching similar to that shown in FIG. 121, the fastener being an attached fastener.

Figure 140:
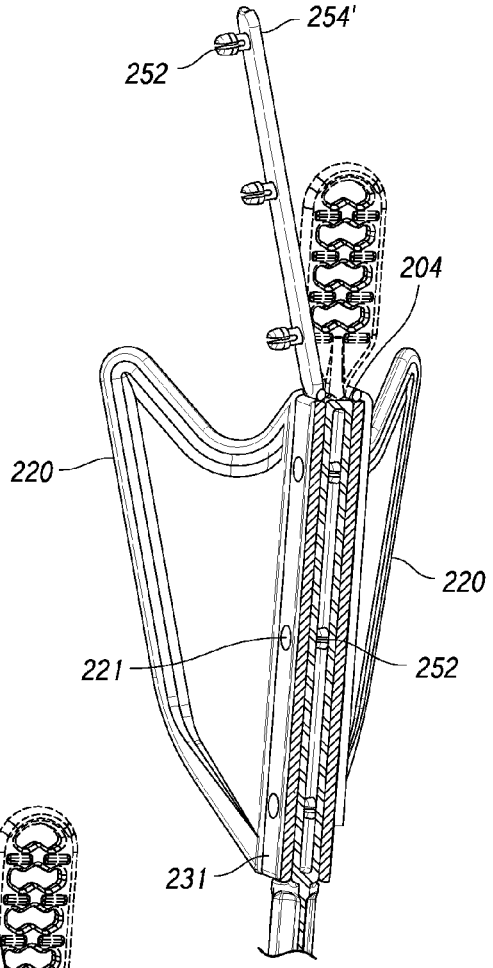

FIG. 140 is a perspective view of a modified second exemplary tail end with a rod shaft and mechanically attached double fletching similar to that shown in FIG. 122, the fastener being an attached fastener.

Figure 141:
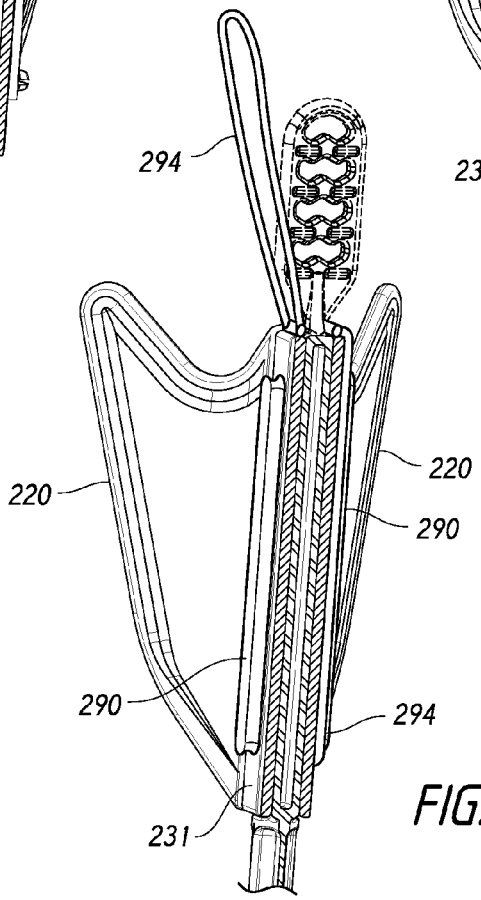

FIG. 141 is a perspective view of an exemplary tail end with a rod shaft and mechanically attached double fletching, the fastener being an attached fastener and, specifically, an elastic strap attached fastener that attaches to a single elongated prong.

Figure 142:
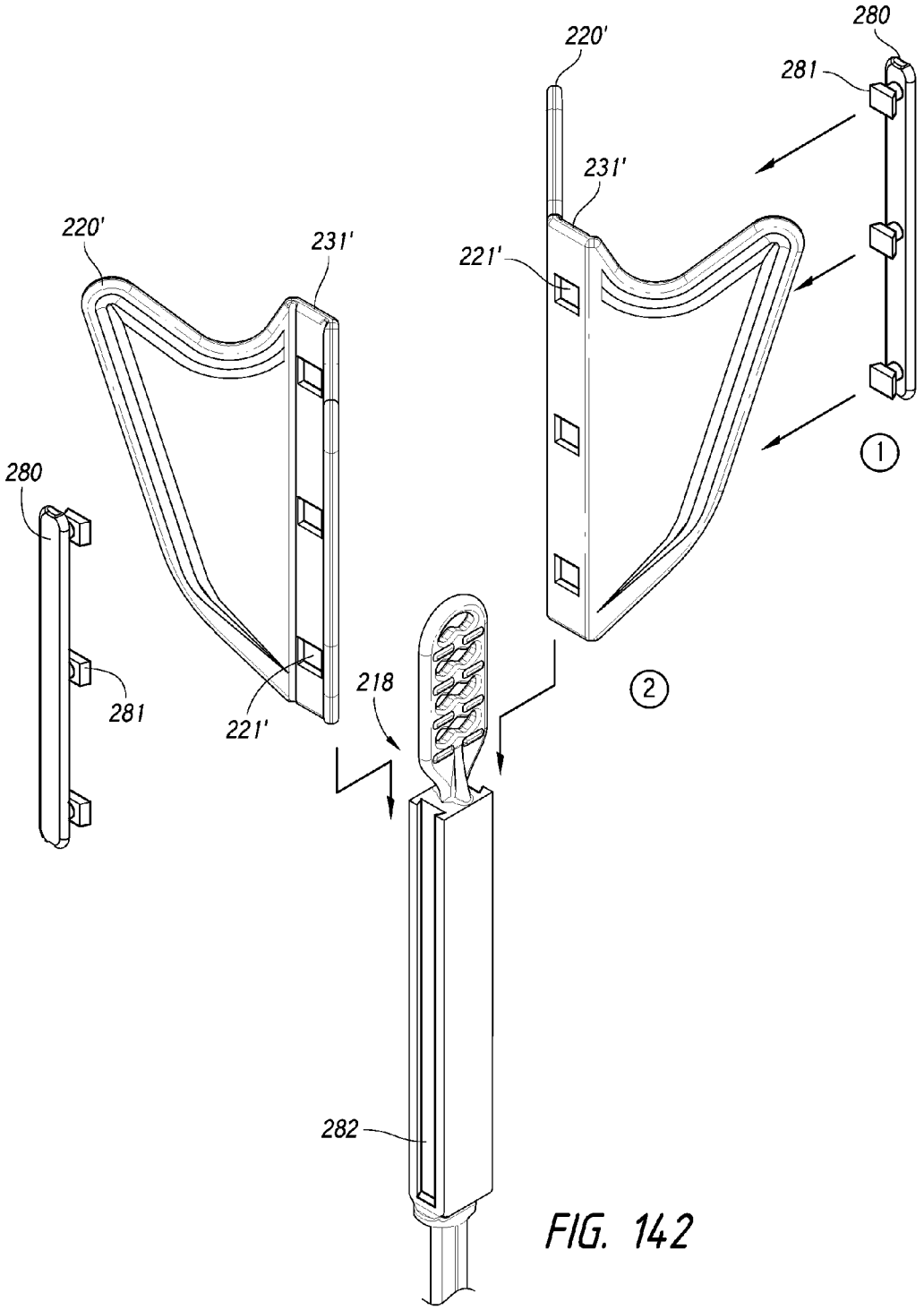

FIG. 142 is a perspective exploded view of an exemplary tail end with a rod shaft and mechanically attached double fletching, the rod shaft having opposing channels with generally trapezoidal cross-sections, the channels for interacting with the mating fastener having at least one trapezoidal-shaped prong that slides through the trapezoidal channel to secure the double fletching to the rod shaft.

Figure 143:
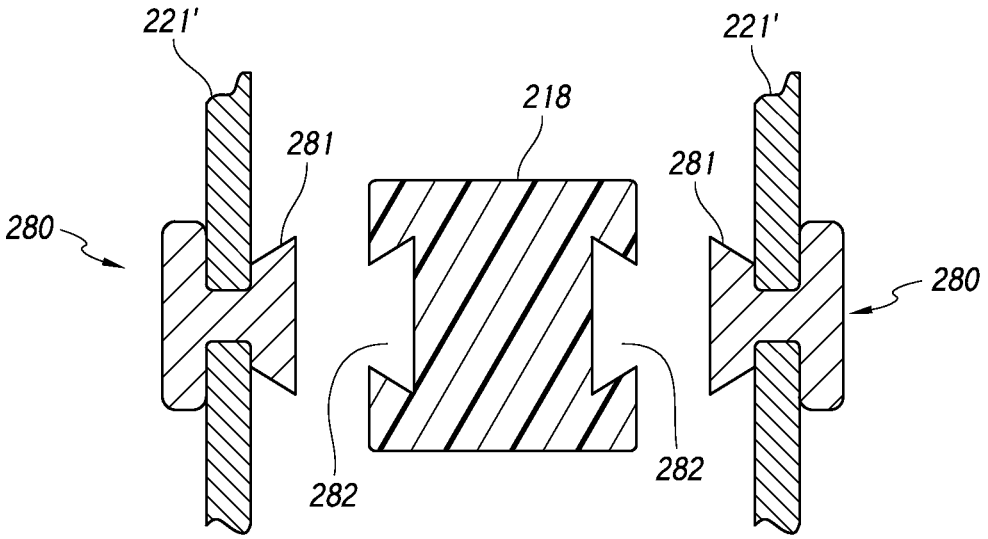

FIG. 143 is a cross-sectional view of the tail end of FIG. 142 showing trapezoidal prongs of the fasteners inserted through the fletching connection structure of the double fletching, and showing the trapezoidal prongs prior to the association with the trapezoidal channels of the rod shaft.

Figure 144:
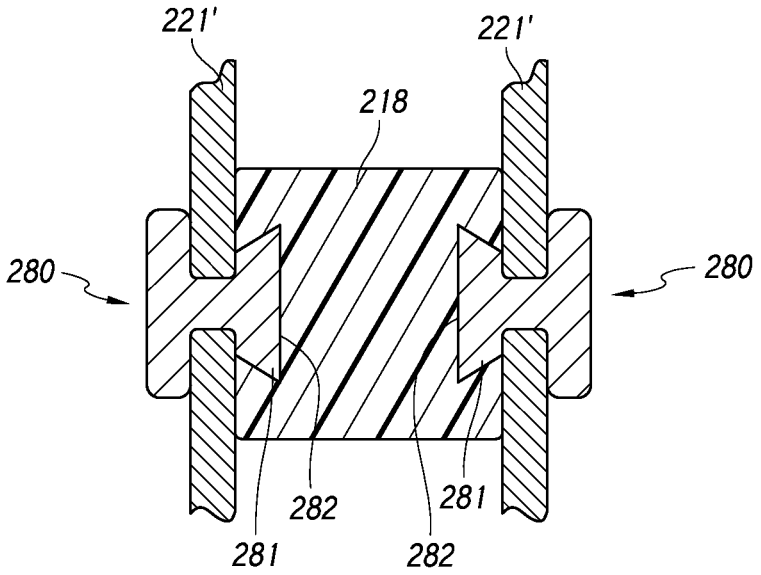

FIG. 144 is a cross-sectional view of the tail end of FIG. 142 showing trapezoidal prongs of the fasteners inserted through the fletching connection structure of the double fletching, and showing the trapezoidal prongs associated with the trapezoidal channels of the rod shaft so that the double fletching are secured to the rod shaft.

Figure 145:
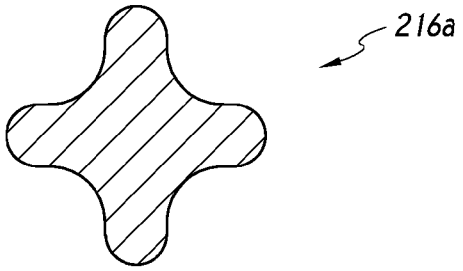

FIG. 145 is a cross-sectional view of a first exemplary head end portion of the rod shaft taken between the fletching and the head, the head end portion having a substantially "+" or "plus" shape.

Figure 146:
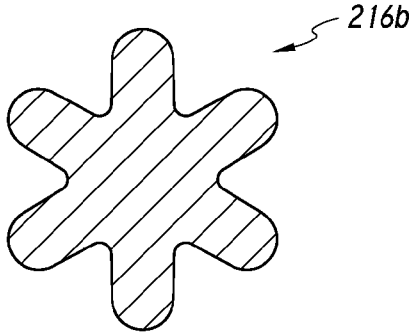

FIG. 146 is a cross-sectional view of a second exemplary head end portion of the rod shaft taken between the fletching and the head, the head end portion having a substantially "star" or "asterisk" shape.

Figure 147:
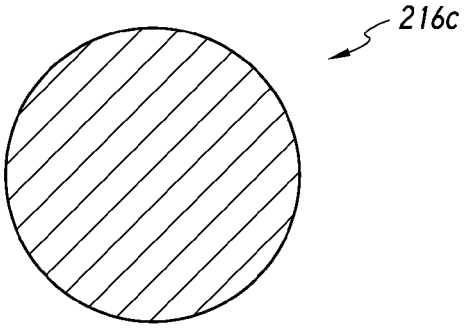

FIG. 147 is a cross-sectional view of a third exemplary head end portion of the rod shaft taken between the fletching and the head, the head end portion having a substantially "circular" shape.

Figure 148:
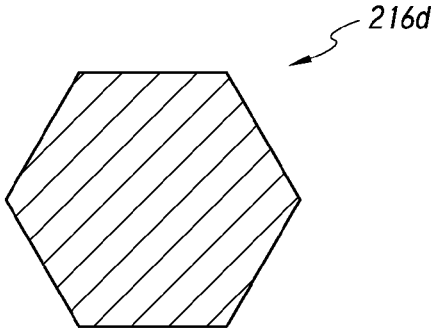

FIG. 148 is a cross-sectional view of a fourth exemplary head end portion of the rod shaft taken between the fletching and the head, the head end portion having a substantially "polygon" shape.

Figure 149:
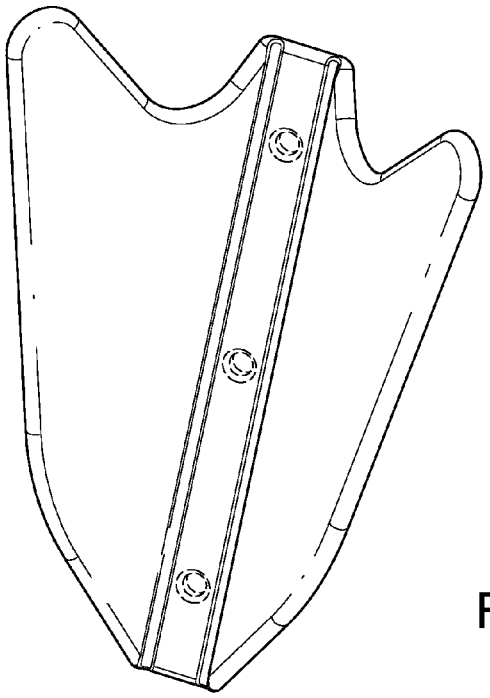

FIG. 149 is a perspective view of the first exemplary double fletching of FIG. 128.

Figure 150A:
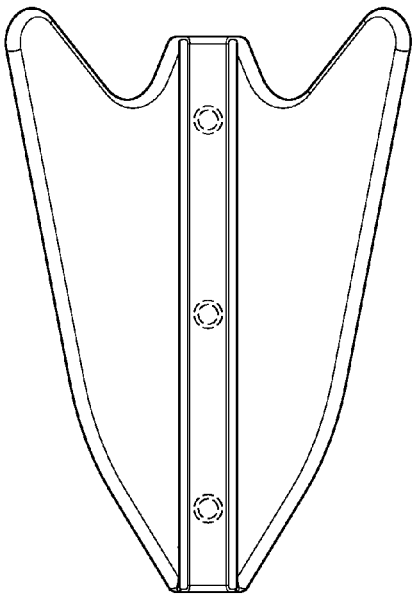

FIG. 150A is a front view of the first exemplary double fletching of FIG. 128.

Figure 150B:
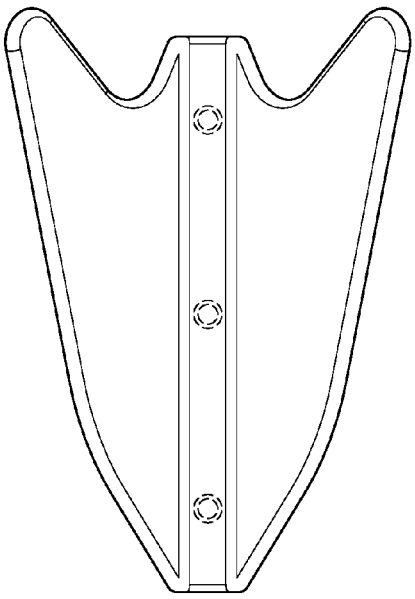

FIG. 150B is a back view of the first exemplary double fletching of FIG. 128.

Figure 151:
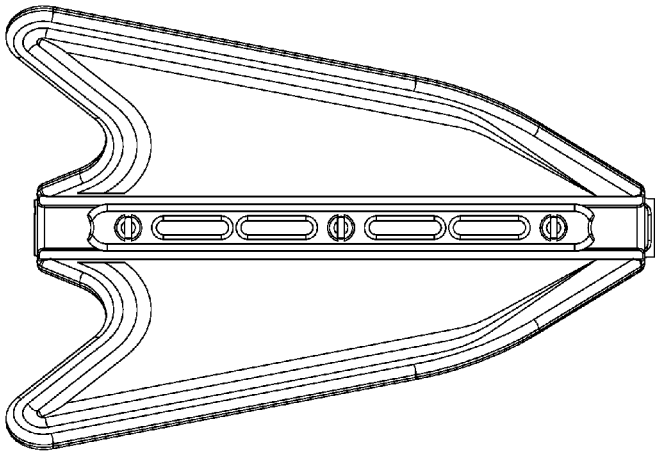

FIG. 151 shows an exemplary double fletching.

Figure 152:
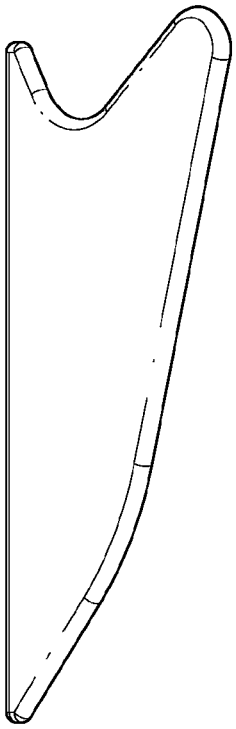

FIG. 152 is one side view of the first exemplary double fletching of FIG. 128, the opposite side view being a mirror image thereof.

Figure 153:
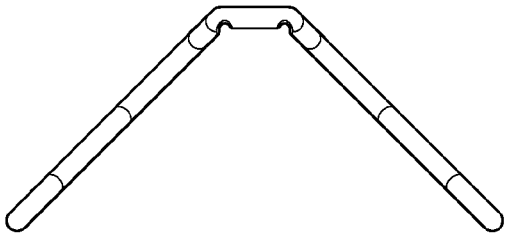

FIG. 153 is a top plan view of the projectile of FIG. 128.

Figure 154:
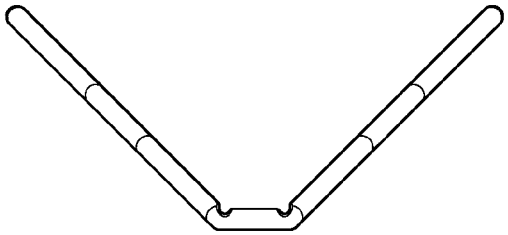

FIG. 154 is a bottom plan view of the projectile of FIG. 128.

Figure 155:
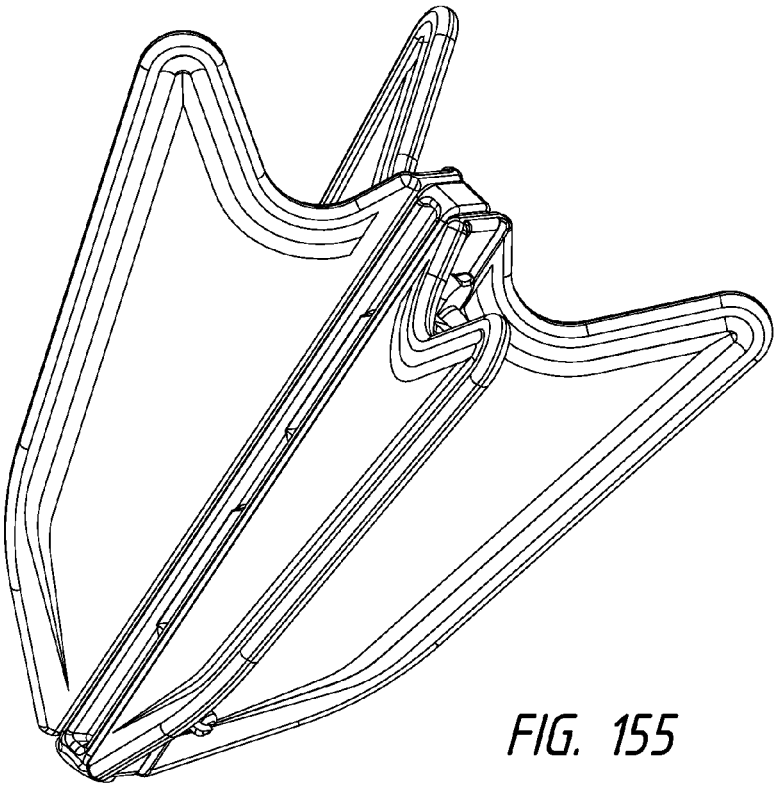

FIG. 155 is a perspective view, taken generally from the side, of an exemplary tail end with mechanically attached fletching.

Figure 156:
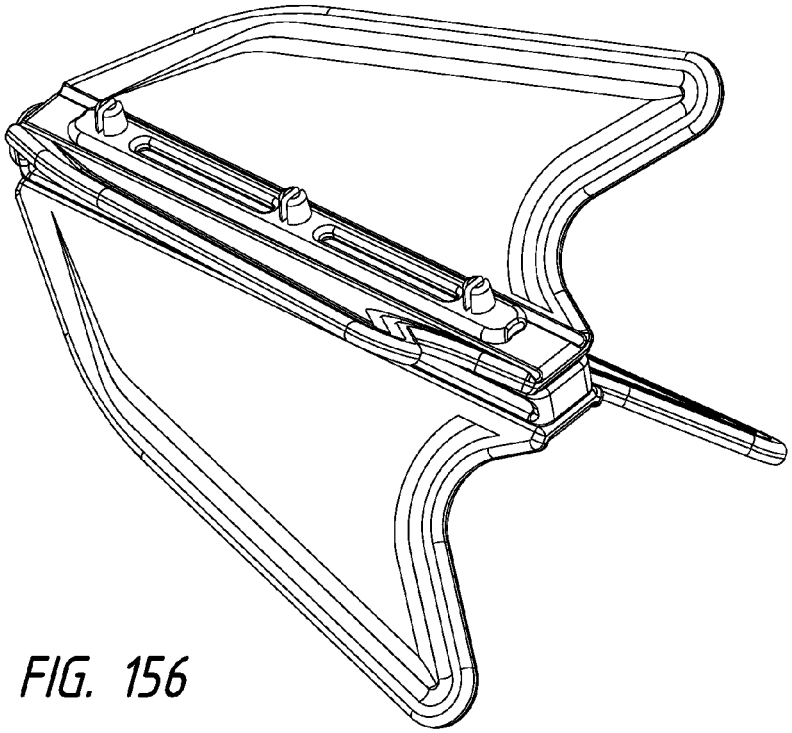

FIG. 156 is a perspective view, taken generally from the front, of the exemplary tail end of FIG. 155.

Figure 157:
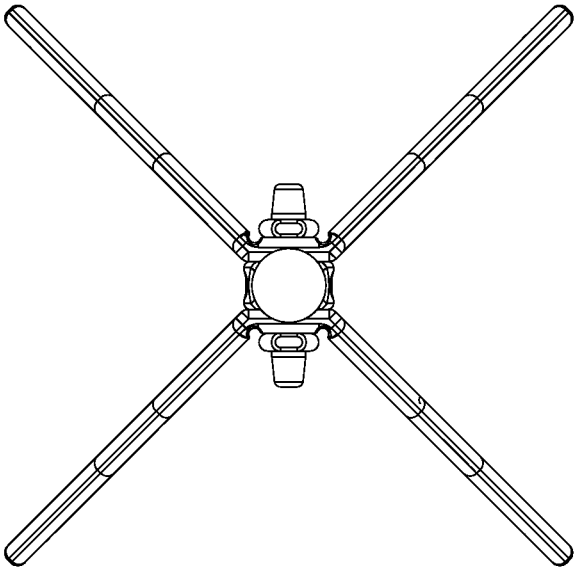

FIG. 157 is a top plan view of the exemplary tail end of FIG. 155.

Figure 158:
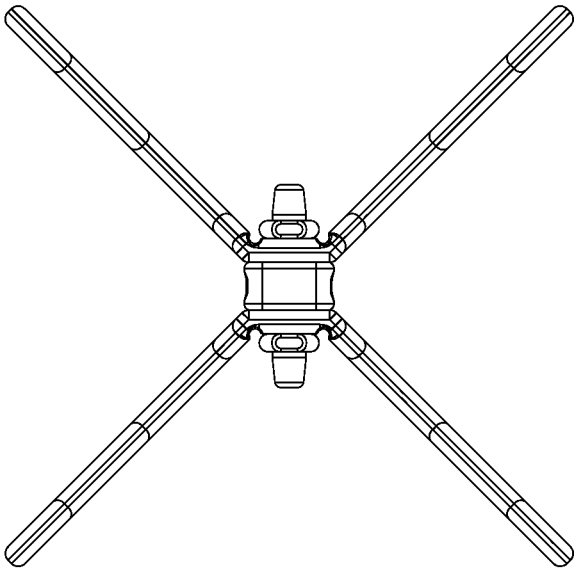

FIG. 158 is a bottom plan view of the exemplary tail end of FIG. 155.

Figure 159:
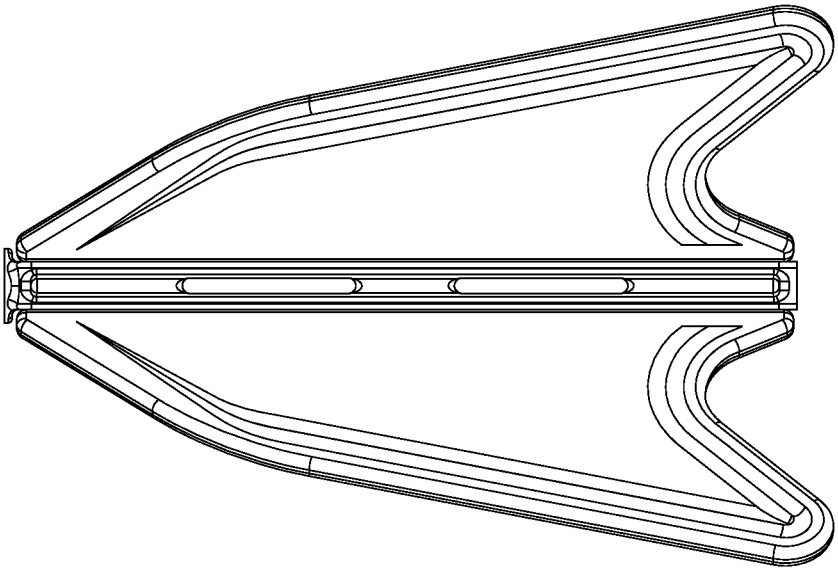

FIG. 159 is one side view of the exemplary tail end of FIG. 155.

Figure 160:
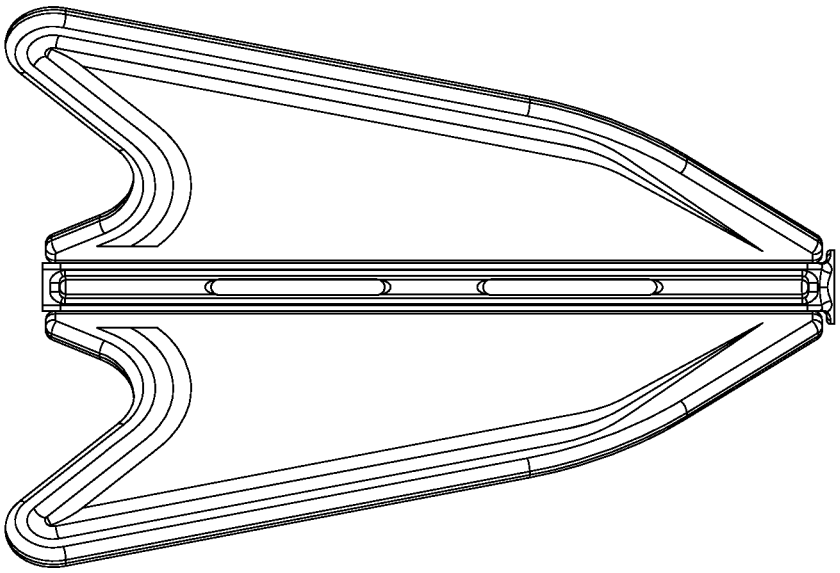

FIG. 160 is the opposite side view of the exemplary tail end of FIG. 155.

Figure 161:
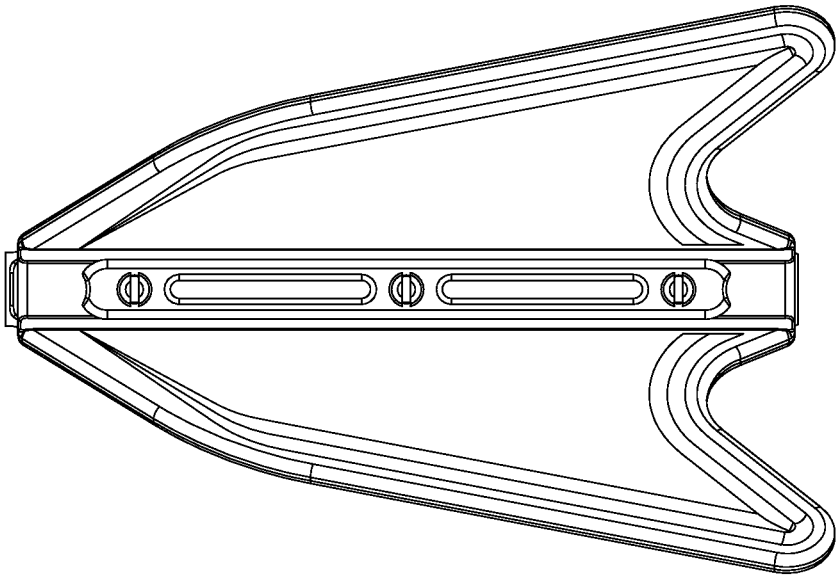

FIG. 161 is a front plan view of the exemplary tail end of FIG. 155.

Figure 162:
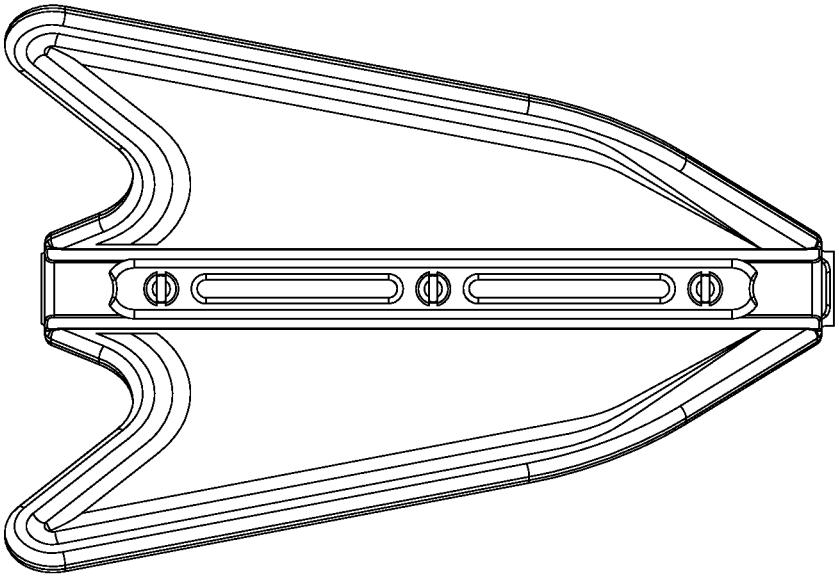

FIG. 162 is a back plan view of the exemplary tail end of FIG. 155.

Figure 163:
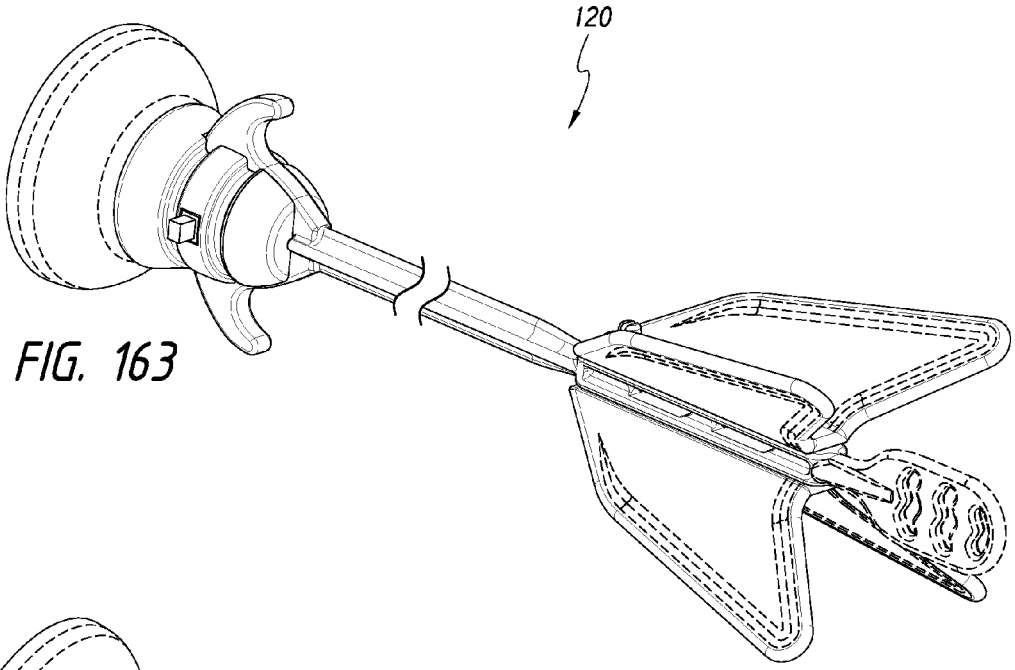

FIG. 163 is a perspective view, taken generally from the front, of a projectile having a rod shaft, a suction head, two hooks, and mechanically attached fletching.

Figure 164:
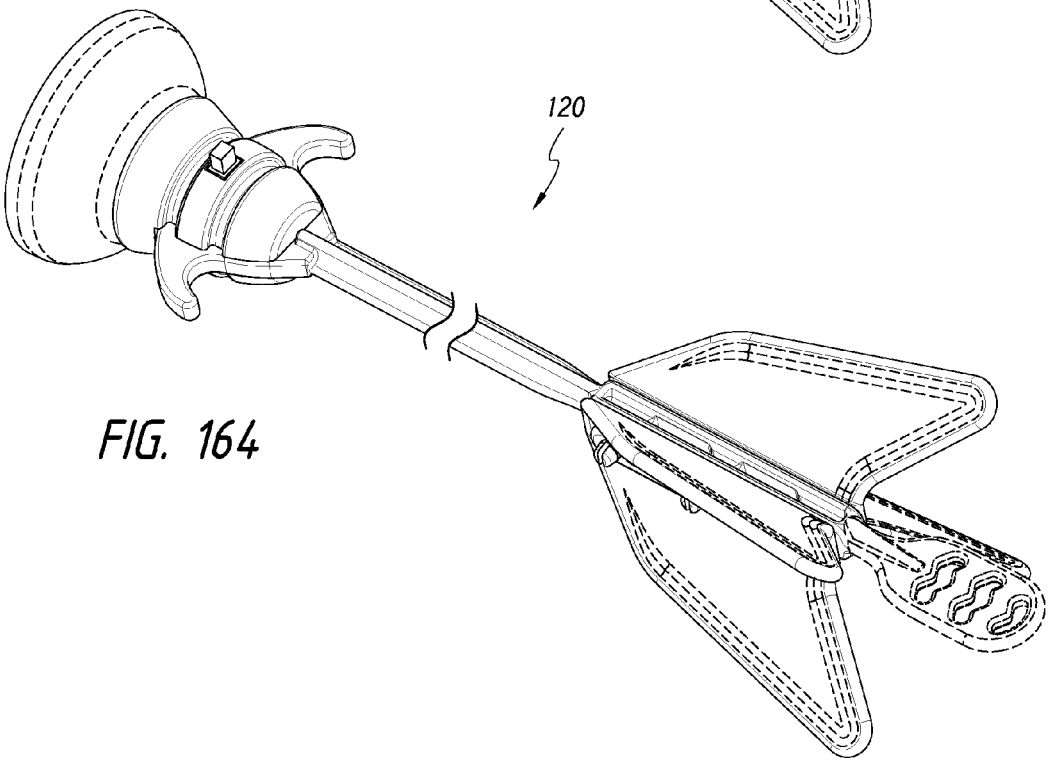

FIG. 164 is a perspective view, taken generally from the side, of the exemplary projectile of FIG. 163.

Figure 165:
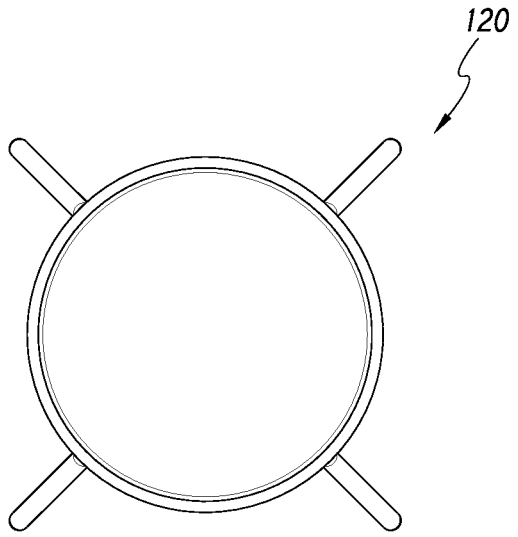

FIG. 165 is a top plan view of the exemplary projectile of FIG. 163.

Figure 166:
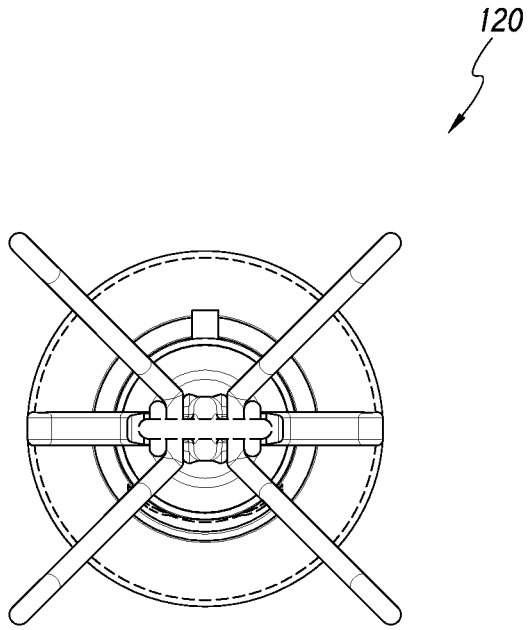

FIG. 166 is a bottom plan view of the exemplary projectile of FIG. 163.

Figure 167:
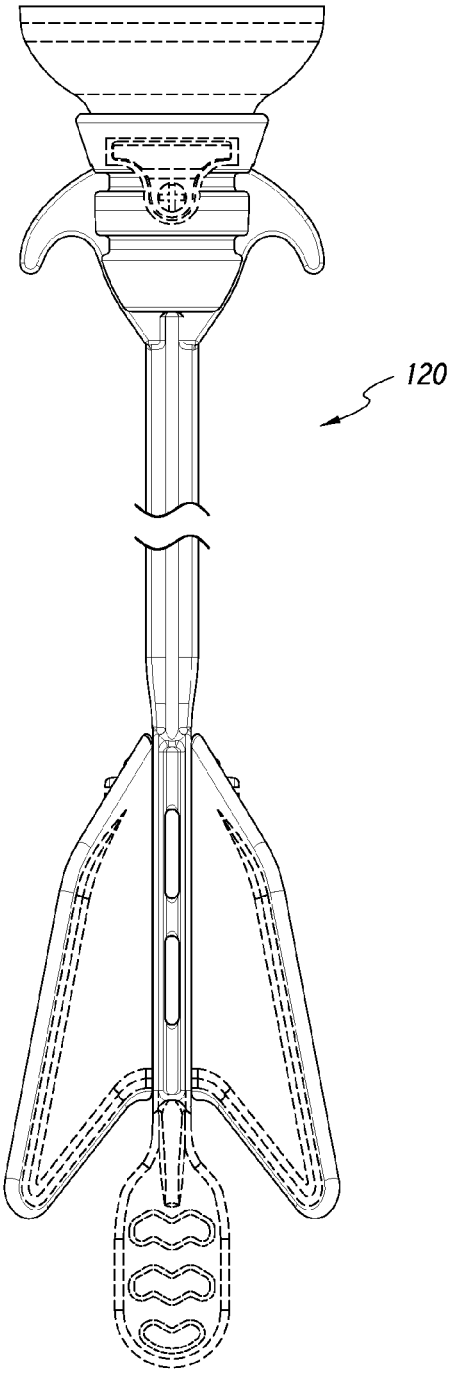

FIG. 167 is a back view of the exemplary projectile of FIG. 163.

Figure 168:
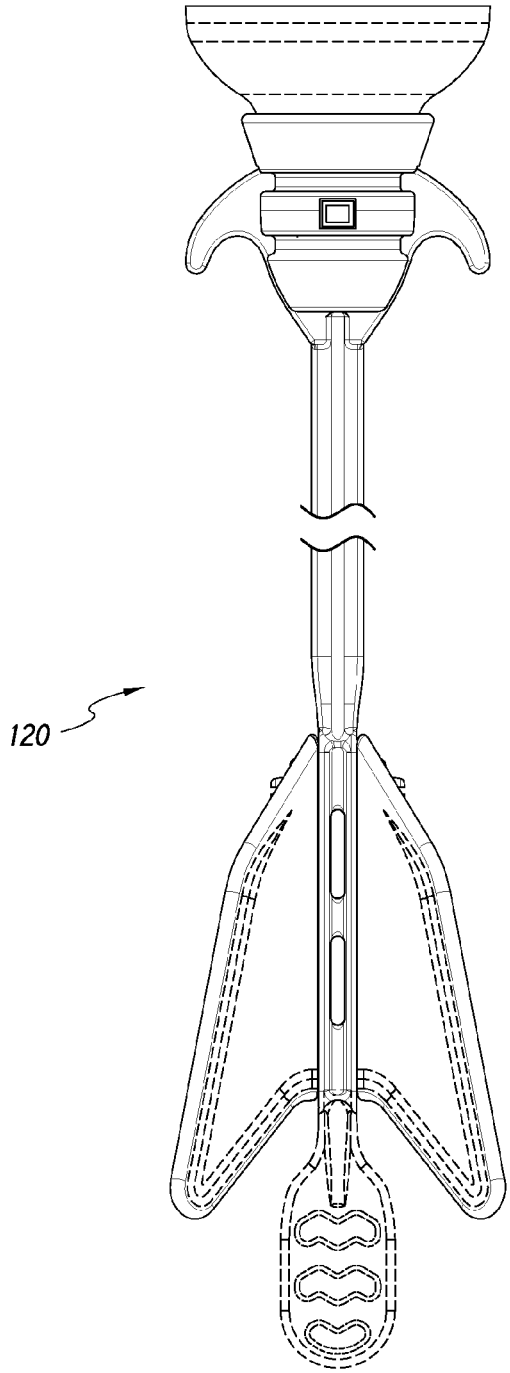

FIG. 168 is a front view of the exemplary projectile of FIG. 163.

Figure 169:
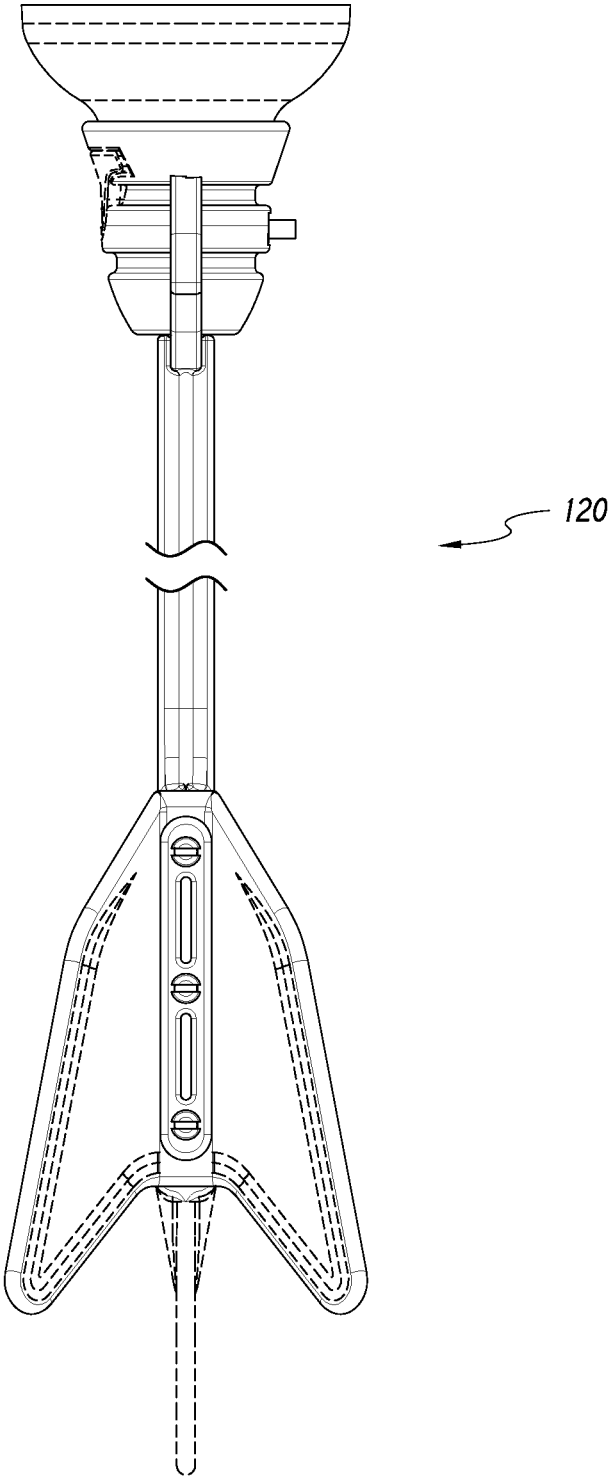

FIG. 169 is one side view of the exemplary projectile of FIG. 163, the opposite side being a mirror image thereof.

Figure 170:
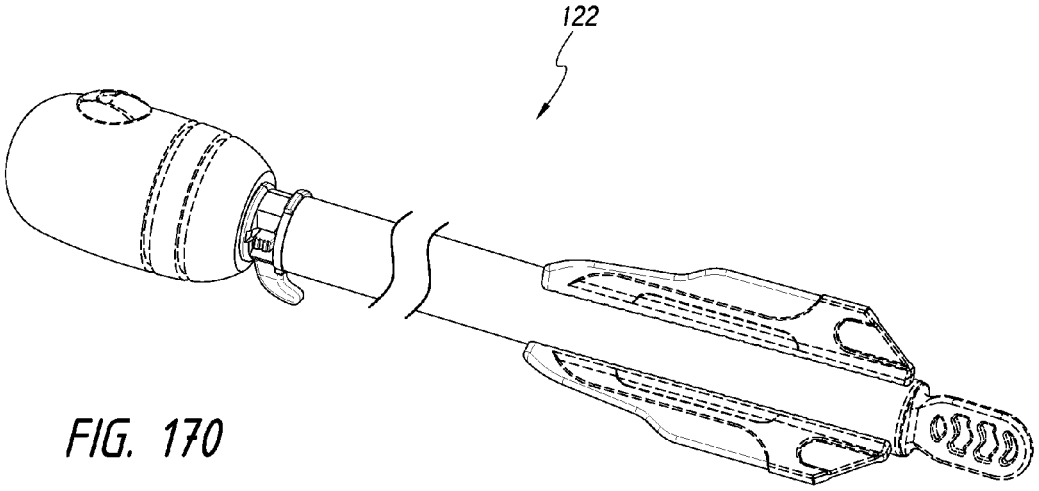

FIG. 170 is a perspective view, taken generally from the side, of a projectile having a tubular shaft, a bounce-back head, one hook, adhered fletching, and an illuminator.

Figure 171:
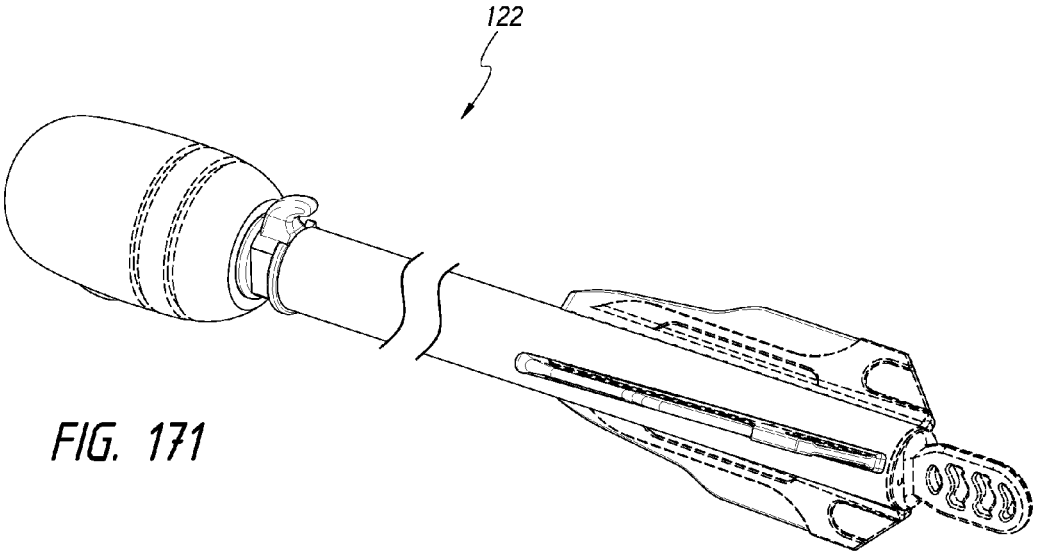

FIG. 171 is a perspective view, taken generally from the front, of the exemplary projectile of FIG. 170.

Figure 172:
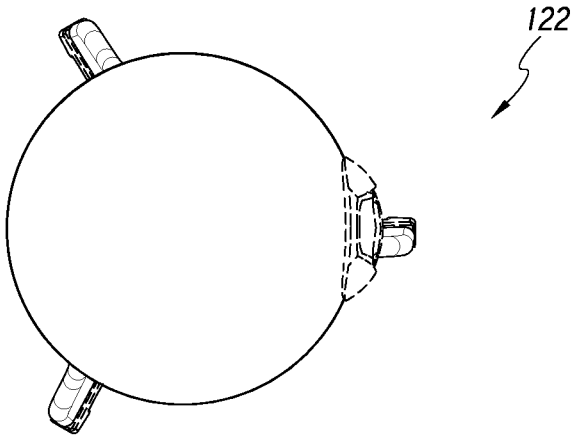

FIG. 172 is a top plan view of the exemplary projectile of FIG. 170.

Figure 173:
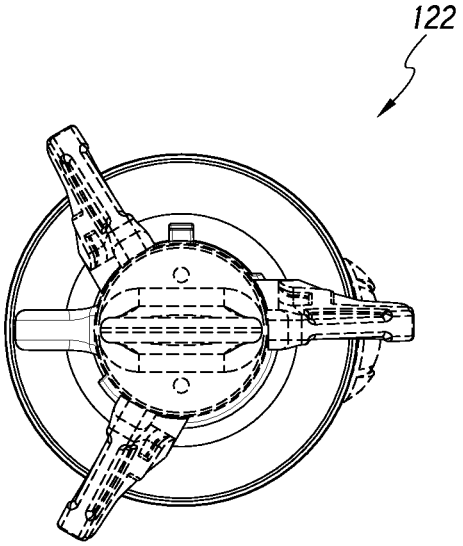

FIG. 173 is a bottom plan view of the exemplary projectile of FIG. 170.

Figure 174:
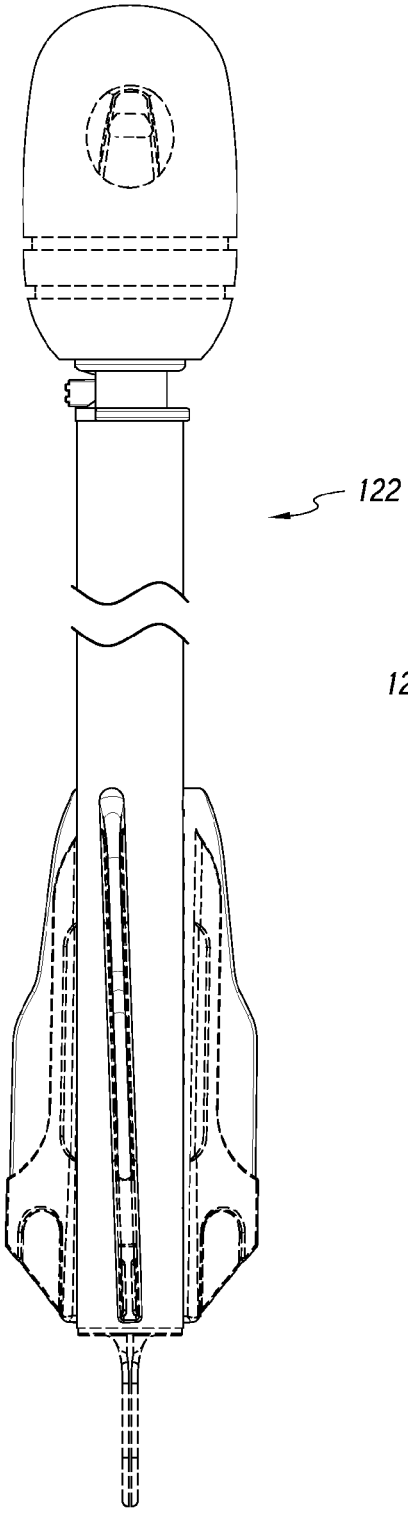

FIG. 174 is a back view of the exemplary projectile of FIG. 170.

Figure 175:
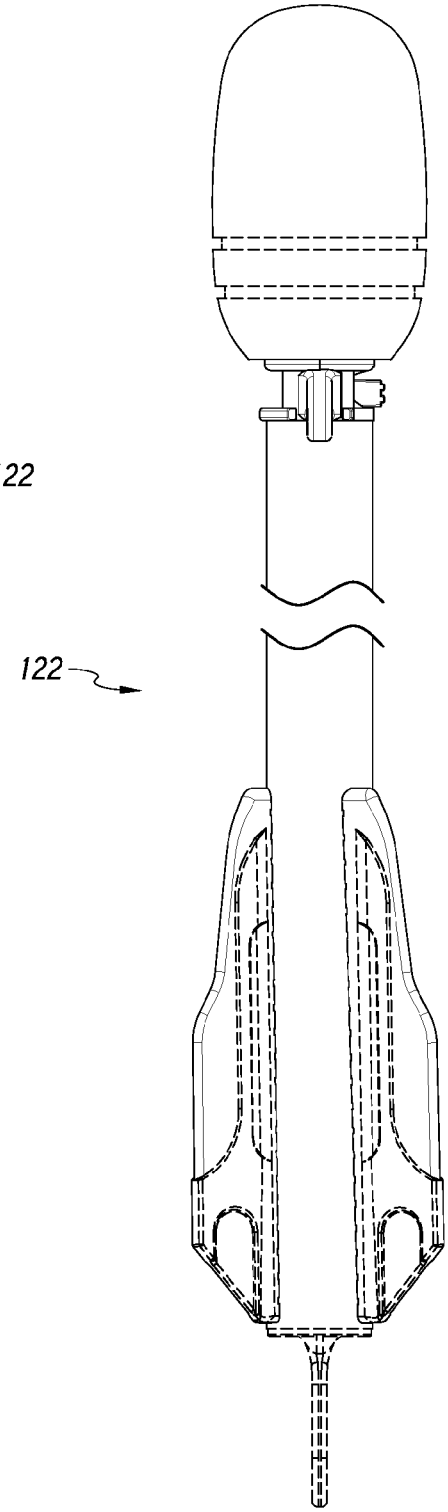

FIG. 175 is a front view of the exemplary projectile of FIG. 170.

Figure 176:
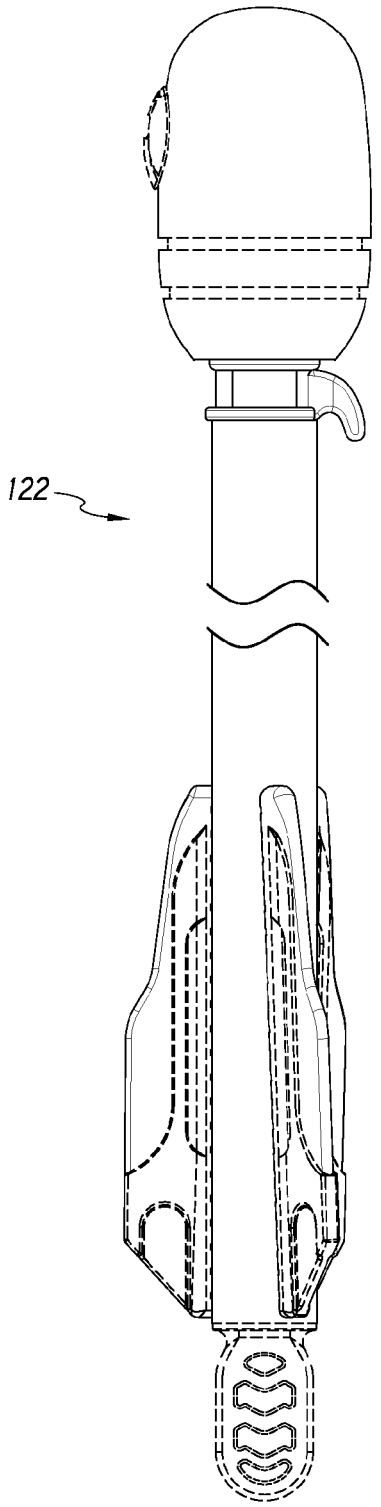

FIG. 176 is one side view of the exemplary projectile of FIG. 170.

Figure 177:
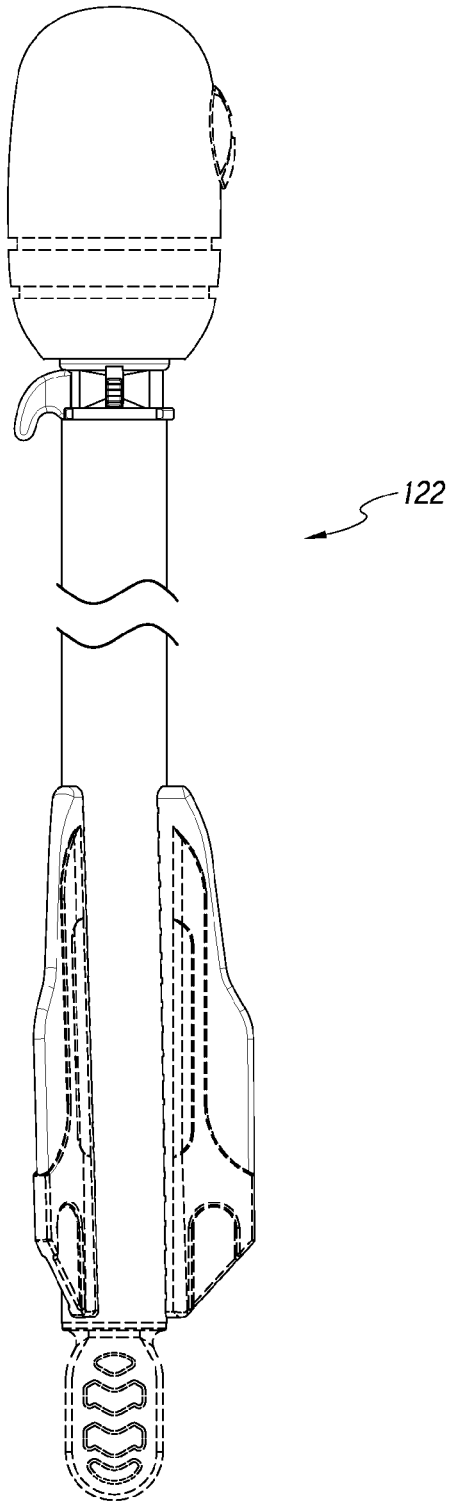

FIG. 177 is an opposite side view of the exemplary projectile of FIG. 170.

Figure 178:
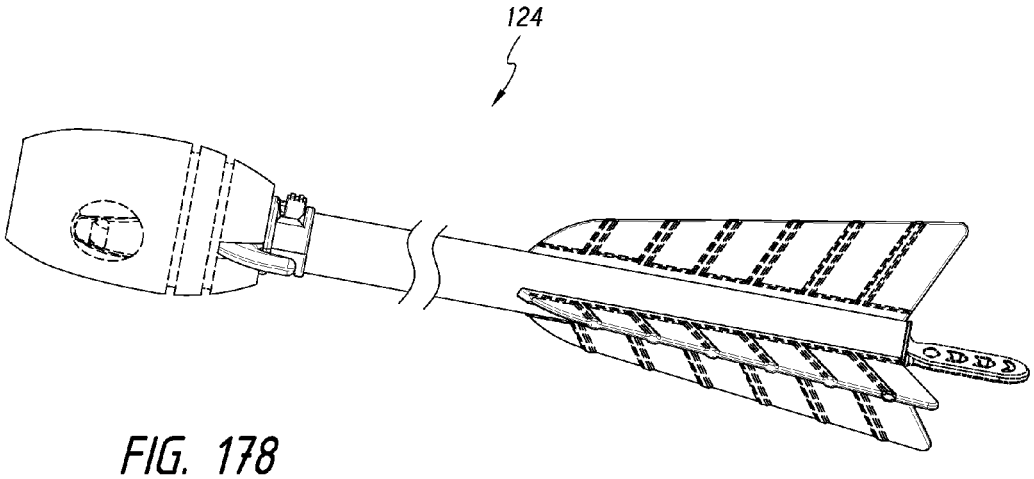

FIG. 178 is a perspective view, taken generally from the side, of a projectile having a tubular shaft, a bounce-back head, two hooks, adhered fletching, and an illuminator.

Figure 179:
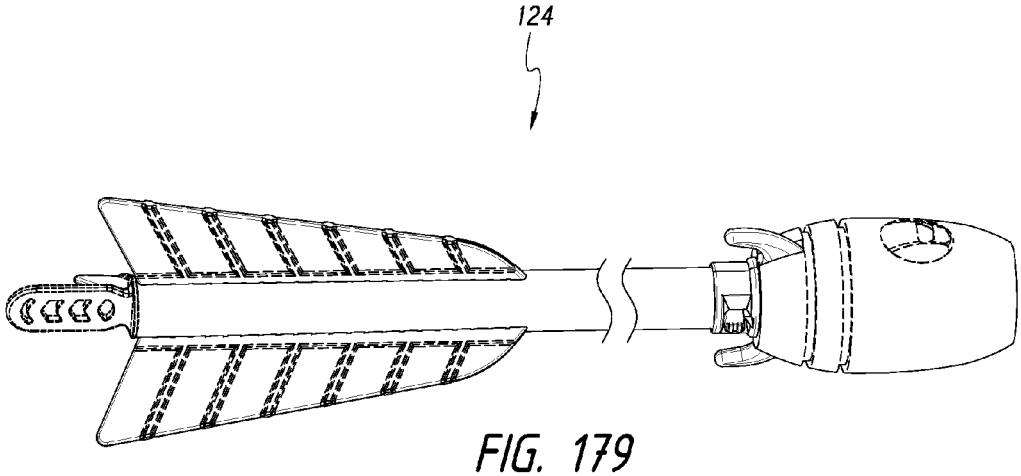

FIG. 179 is a perspective view, taken generally from the front, of the exemplary projectile of FIG. 178.

Figure 180:
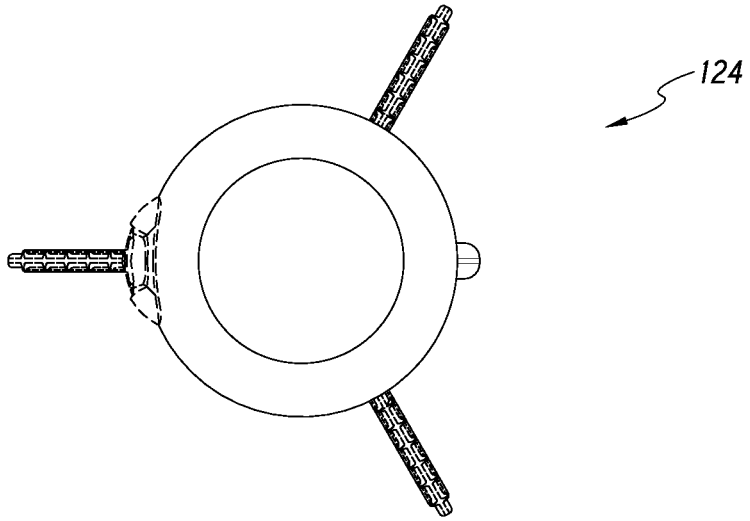

FIG. 180 is a top plan view of the exemplary projectile of FIG. 178.

Figure 181:
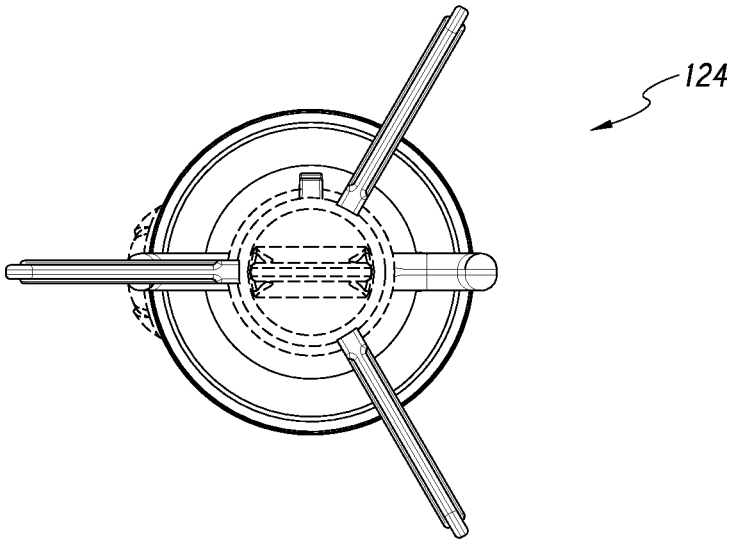

FIG. 181 is a bottom plan view of the exemplary projectile of FIG. 178.

Figure 182:
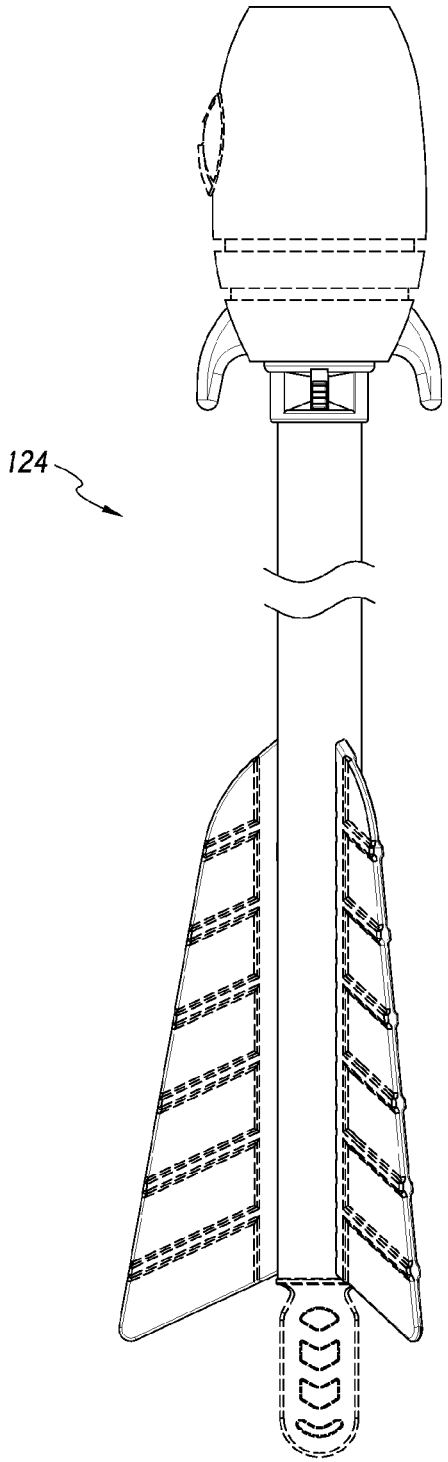

FIG. 182 is a front view of the exemplary projectile of FIG. 178.

Figure 183:
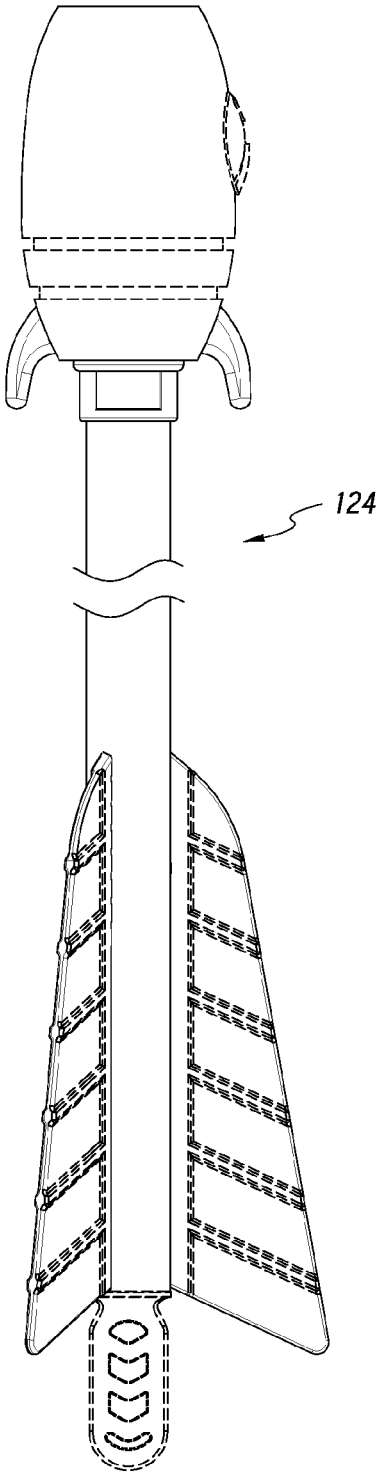

FIG. 183 is a bottom view of the exemplary projectile of FIG. 178.

Figure 184:
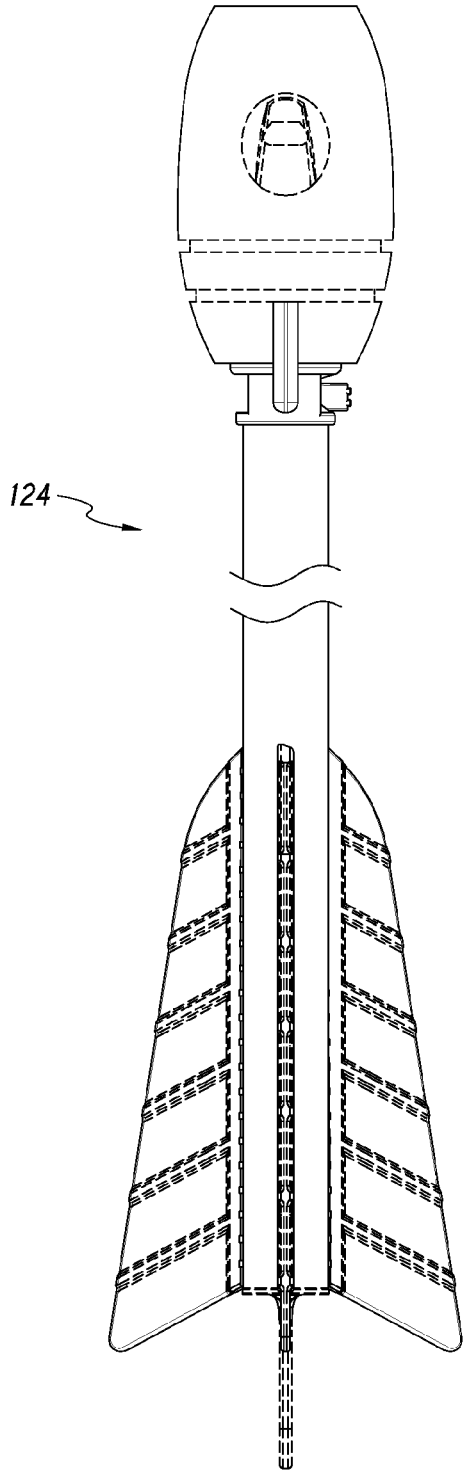

FIG. 184 is one side view of the exemplary projectile of FIG. 178.

Figure 185:
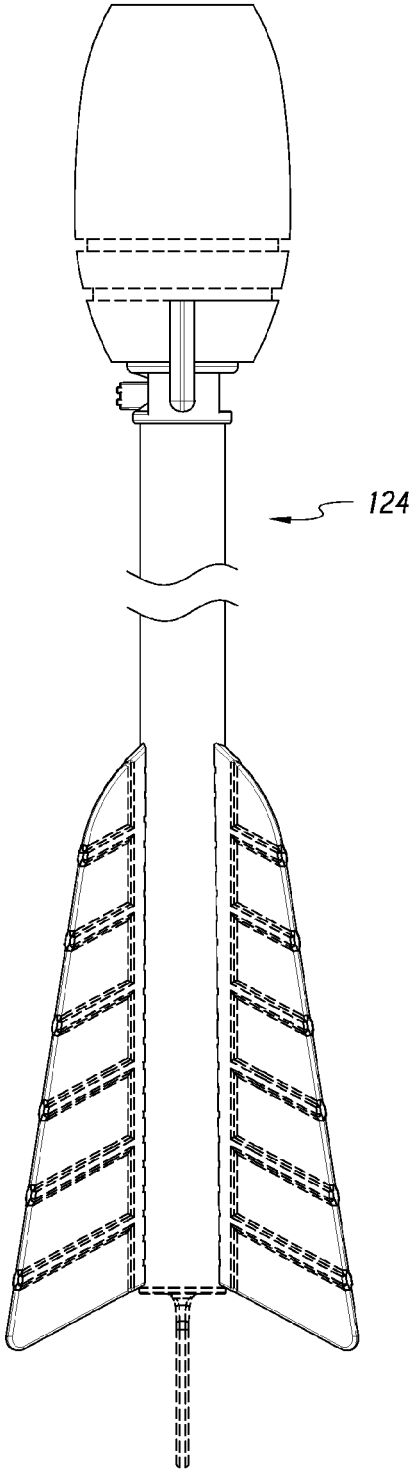

FIG. 185 is an opposite side view of the exemplary projectile of FIG. 178.

Figure 186:
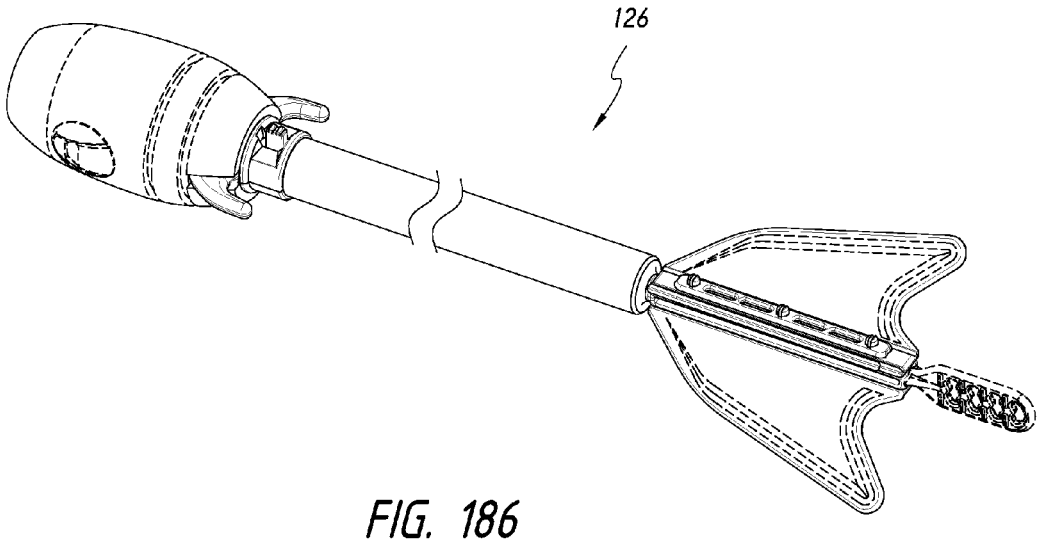

FIG. 186 is a perspective view, taken generally from the side, of a projectile having a hybrid (both a tubular shaft and a rod shaft) shaft, a bounce-back head, two hooks, a cap, mechanically attached fletching, and an illuminator.

Figure 187:
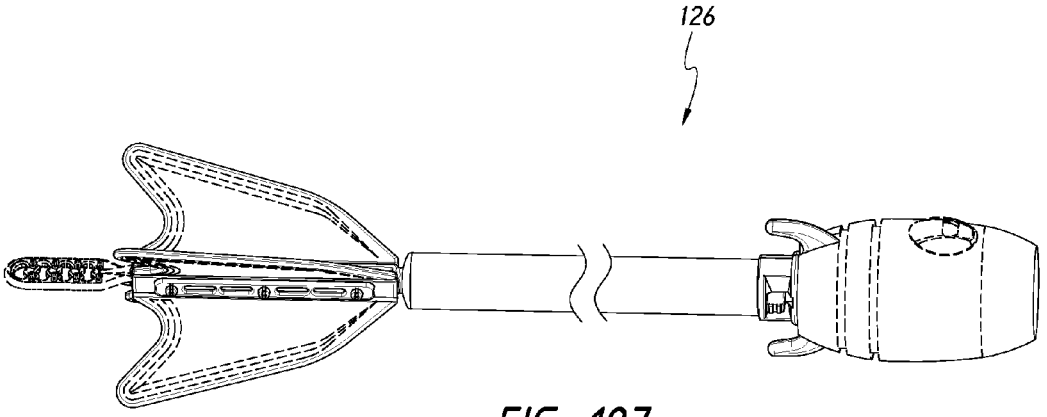

FIG. 187 is a perspective view, taken generally from the front, of the exemplary projectile of FIG. 186.

Figure 188:
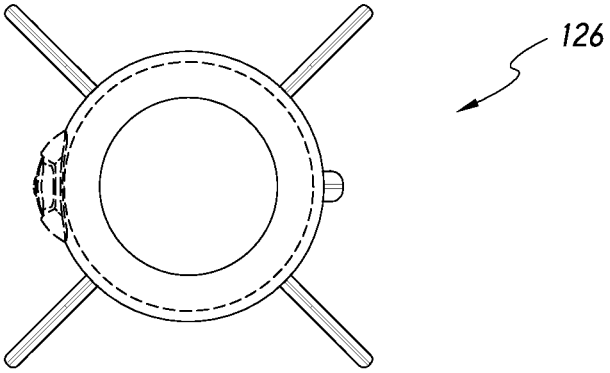

FIG. 188 is a top plan view of the exemplary projectile of FIG. 186.

Figure 189:
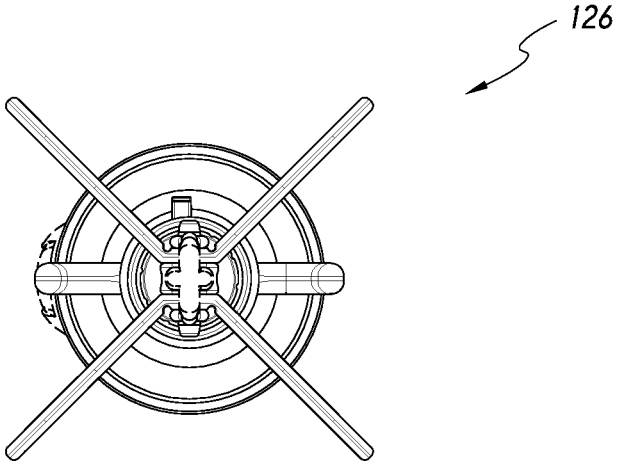

FIG. 189 is a bottom plan view of the exemplary projectile of FIG. 186.

Figure 190:
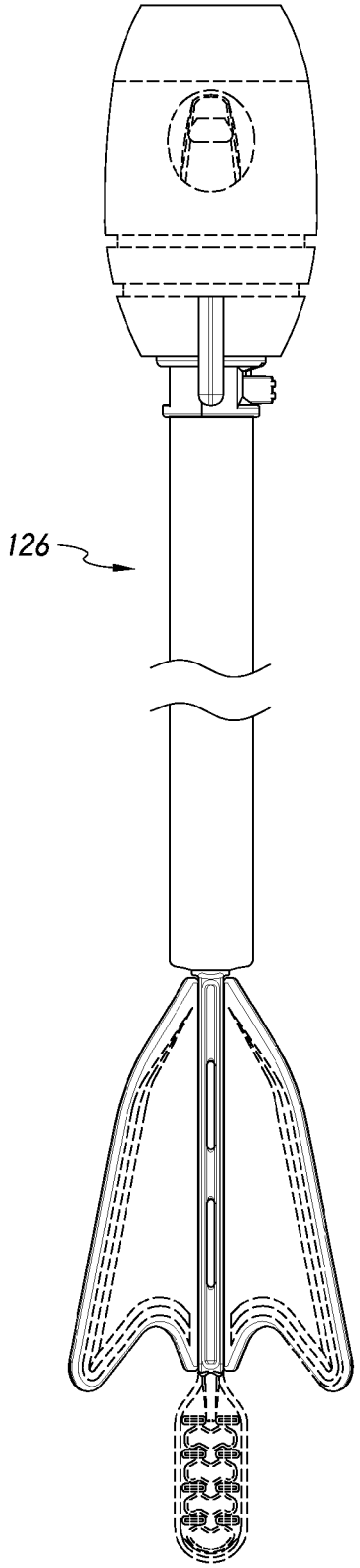

FIG. 190 is one side view of the exemplary projectile of FIG. 186.

Figure 191:
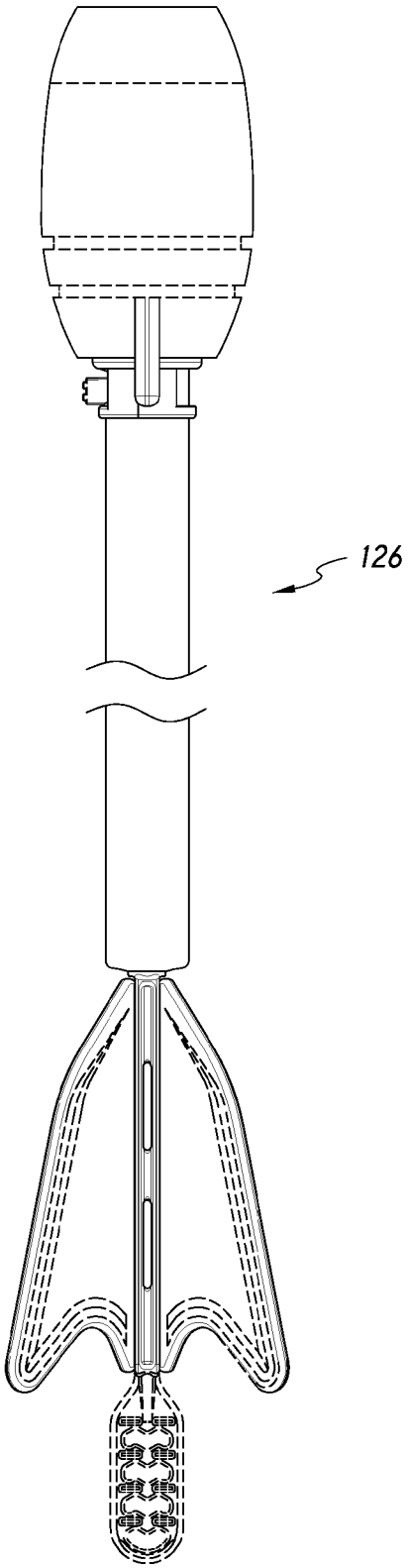

FIG. 191 is an opposite side view of the exemplary projectile of FIG. 186.

Figure 192:
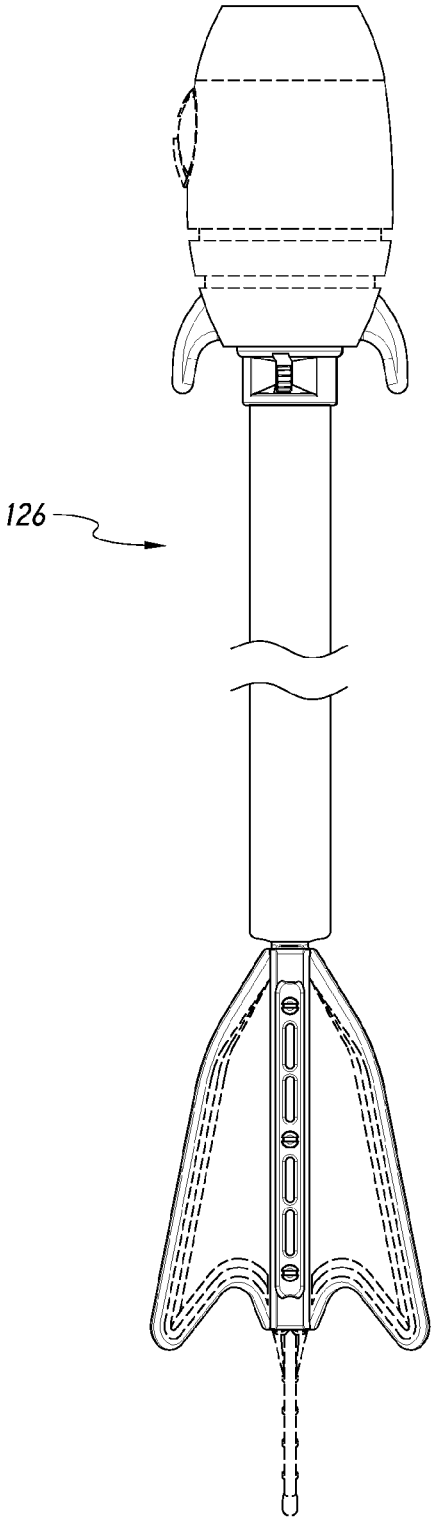

FIG. 192 is a front view of the exemplary projectile of FIG. 186.

Figure 193:
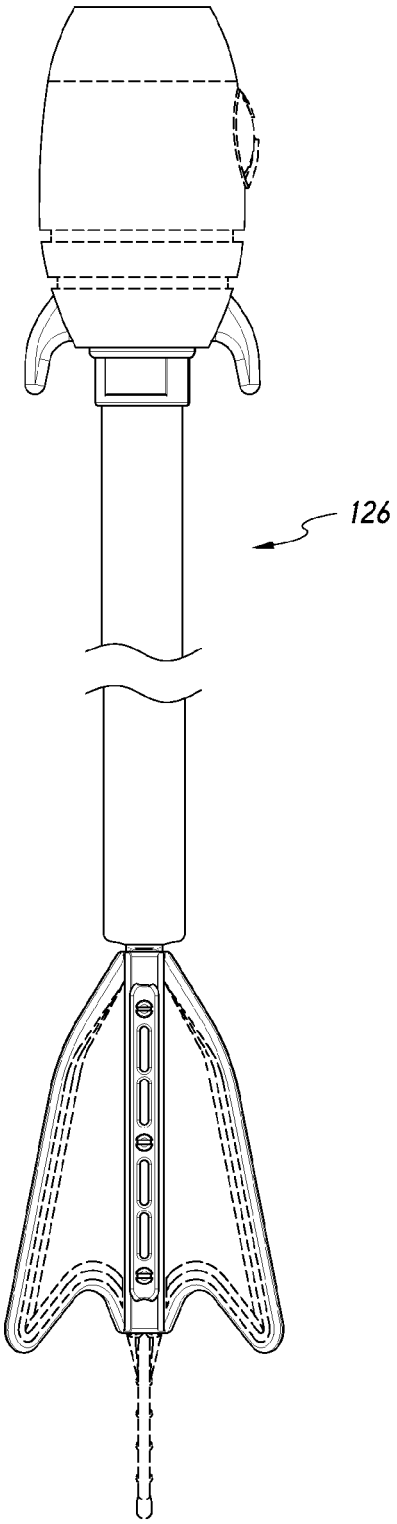

FIG. 193 is a back view of the exemplary projectile of FIG. 186.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

Referring to the figures and disclosed herein, are various types of mechanically attachable fletching (shown as double fletching 220, 222, 224, 226, 228) for a projectile 100, 102, 104, 112, 118, 120, 126 having a shaft 200, 300 having an exterior surface. The mechanically attachable fletching includes at least one fin 230, 232, 234, 236, 238, a connection section 231, 231', 233, 235, 237, 239 bordering the at least one fin, and at least one mechanical fastener 240, 241, 244, 244', 250, 254, 254', 262, 266, 272, 276, 280, 282, 290, 294 for attaching the fletching to the exterior surface of the shaft via the connection section.

Described herein is a family of shafted projectiles, each shafted projectile having multiple new and unique individual features and/or combination of features. The features will be discussed individually as a shaft (e.g. a rod shaft, a tubular shaft, and a mesh shaft), a head (e.g. a bounce-back head, a suction head, and a "football" head), a launcher engager (e.g. one hook, two hooks, and slots), a tail (e.g. fletching and copter), and an illuminator. Some of the features are incorporated in specific examples.

Eight exemplary projectiles are shown herein. The following brief descriptions describe these exemplary projectiles:

- FIGS. 1-10: A projectile 100 having a rod shaft, a suction head, two hooks, and mechanically attached fletching.
- FIGS. 11-21: A projectile 102 having a rod shaft, a suction head, two hooks, mechanically attached fletching, and an illuminator. (An alternative design is shown as projectile 120 shown in FIGS. 163-169.)
- FIGS. 22-32: A projectile 104 having a rod shaft, a bounce-back head, two hooks, and mechanically attached fletching.
- FIGS. 33-47: A projectile 106 having a tubular shaft, a bounce-back head, one hook, and adhered fletching.
- FIGS. 48-59: A projectile 108 having a tubular shaft, a bounce-back head, one hook, adhered fletching, and an illuminator. (An alternative design is shown as projectile 122 shown in FIGS. 170-177.)
- FIGS. 60-71: A projectile 110 having a tubular shaft, a bounce-back head, two hooks, adhered fletching, and an illuminator. (An alternative design is shown as projectile 124 shown in FIGS. 178-185.)
- FIGS. 72-82: A projectile 112 having a hybrid shaft (both a tubular shaft and a rod shaft), a bounce-back head, two hooks, a cap end to the rod shaft, mechanically attached fletching, and an illuminator. (An alternative design is shown as projectile 126 shown in FIGS. 186-193.)
- FIGS. 83-96: A projectile 114 having a tubular shaft, a bounce-back head, one hook, adhered fletching, and a copter tail.
- FIGS. 97-112: A projectile 116 having a mesh shaft, a suction head, two slots, and an illuminator.
- FIGS. 113-120: A projectile 118 having a rod shaft, a "football" head, and mechanically attached fletching.

Exemplary projectiles may be better understood with reference to the drawings, but these exemplary projectiles are not intended to be of a limiting nature. For example, an exemplary projectile shown with a tubular shaft and a set of other features may be made with a rod shaft instead of the tubular shaft. Another example is that a projectile shown with a bounce-back head and a set of other features may be made with a suction head instead of the bounce-back head. Although not completely interchangeable (e.g. a mesh shaft would most likely not be made with a fletching or copter tail), the shown combinations are not meant to be limiting.

Before reviewing specific exemplary projectiles, several of the features (and variations thereof) will be examined separately.

Shafts

A shafted projectile is a type of projectile that has a central member (shaft) that, in most cases, is elongated. Three basic types of shafts are discussed herein: a rod shaft 200 (FIGS. 1-32 and 113-120), a tubular shaft 300 (FIGS. 33-96), and a mesh shaft 400 (FIGS. 97-112). FIGS. 72-82 show a hybrid of two types of shafts, the rod shaft 200 and the tubular shaft 300. The shafted projectiles each have a head end 202, 302, 402 and a tail end 204, 304, 404. A projectile head 500, 550, 570 is associated with the head end 202, 302, 402, the head connection structure 510, 520, 560, 580, the head reinforcer 350*a*, 350*b* and/or the cap 358*a*, 358*b*. Some projectiles also have tail features that are associated with (including nearby) the tail end 204, 304, 404.

The exemplary rod shafts 200 shown in FIGS. 1-32 and 113-120 each have a head end 202 and a tail end 204. A projectile head 500, 550, 570 is associated with the head end 202 and tail features are associated with (including nearby) the tail end 204. FIGS. 10, 21, 32, and 120 (as well as other figures) show head connection structure 510, 520, 560, 580 used to connect the head end 202 to the head. Each rod shaft 200, however, preferably has a head end portion 216 substantially between the head 500, 550, 570 (or the head connection structure 510, 520, 560, 580) and the tail end portions 206, 208, 210, 212. FIGS. 121-126 detail exemplary alternative preferred rod shafts 200 near the tail end 204 (examples of the tail end portions are labeled as 206 (FIG. 121), 208 (FIG. 122), 210 (FIG. 124), 212 (FIG. 126)) where the double fletching 220 (examples of which are shown in FIGS. 128-132 as double fletching 220, 222, 224, 226, 228) is secured to the tail end portions 206, 208, 210, 212. Each tail end portion 206, 208, 210, 212 has associated mechanical fastener structure (e.g. apertures or prongs) that interacts with at least one other mechanical fastener structure that together secure the fletching 220 to the tail end portions 206, 208, 210, 212. It should be noted that preferred exemplary rod shafts 200 have head end portions 216 that may be significantly different in cross-section than the tail end portions 206, 208, 210, 212.

FIGS. 10, 21, 32, and 120 (as well as other figures) show a head connection structure 510, 520, 560, 580 (discussed herein) used to connect the head end 202 to the head. Each rod shaft 200 has a head end portion 216 substantially between the head (or the head connection structure 510, 520, 560, 580) and the tail end portions 206, 208, 210, 212. The shown head end portion 216 has a substantially "+" or "plus" cross-section shown in FIG. 145 as cross-section 216*a*. Alternative cross-sections could be possible. For example, FIG. 146 shows an exemplary cross-section of the head end portion 216 having a substantially "star" or "asterisk" shape shown as cross-section 216*b*, FIG. 147 shows an exemplary cross-section of the head end portion 216 having a substantially "circular" shape shown as cross-section 216*c*, and FIG. 148 shows an exemplary cross-section of the head end portion 216 having a substantially "polygon" shape shown as cross-section 216*c*. These cross-sectional shapes are meant to be exemplary and are not meant to limit the scope of the invention. For example, alternative cross-sections could be O-shaped (having a hollow interior), square, triangular, or any shape having appropriate structural stability (which may depend on materials).

FIG. 121 shows a first exemplary tail end 204 with a rod shaft tail end portion 206 and mechanically attached double fletching 220. The tail end portion 206 has at least one outwardly projecting split-prong fastener 240 (shown as three prong fasteners on each of two faces of the rod shaft tail end portion 206, although this is meant to be exemplary) that interacts with at least one aperture 242 of a mating apertured fastener 244 (shown as an apertured fastener 244 for each of the two faces of the rod shaft tail end portion 206, although this is meant to be exemplary) to secure the double fletching 220 to the rod shaft 200. Each outwardly projecting split-prong fastener 240 is shown as having a gap defined between two prong fingers. The gap extends at least partially along the length of the prong fastener 240. The fingers together have an enlarged prong tip (also split by the gap). There is a shoulder on the outer periphery (not within the gap) that separates the enlarged prong tip from the remainder of the fingers. To attach a double fletching 220, the outwardly projecting split-prong fasteners 240 are inserted through the double fletching 220 (as described herein) and the apertures 242 of the mating apertured fastener 244. As the enlarged prong tips are inserted through the apertures 242, they compress inwardly, narrowing the gap. Once through the apertures 242, the gap widens and pushes the enlarged prong tips outwardly so that the shoulder interacts with (engages) the outer periphery of the apertures 242. This structure secures the double fletching 220 between the rod shaft tail end portion 206 and the fastener 244. FIGS. 133-136 show various views of a portion of the rod shaft tail end portion 206. The use of openings 246 in the rod shaft tail end portion 206 may help with both the manufacturing process (e.g. to help with shrinkage in manufacturing processes such as injection molding) and with weight issues (e.g. to compensate for the added weight of the fasteners). FIGS. 137 and 138 show an alternative to the tail end portion 206 with the split-prong fastener 240 as a tail end portion 206' with at least one outwardly projecting solid-prong fastener 241 (shown as three prong fasteners on each of two faces of the rod shaft tail end portion 206', although this is meant to be exemplary). The solid-prong fasteners 241 may be made of a slightly compressible material or the associated apertures (not shown) may be such that they can expand to accommodate the solid-prong fasteners 241. Unless specified otherwise, the solid-prong fasteners 241 may be used in place of the shown split-prong fasteners 240.

FIGS. 122 and 123 show a second exemplary tail end 204 with a rod shaft tail end portion 208 and mechanically attached double fletching 220. The tail end portion 208 has at least one aperture 250 (shown as three apertures 250 on each of two faces of the rod shaft tail end portion 208 that provide access to a shaft interior, although this is meant to be exemplary) that interacts with at least one projecting split-prong fastener 252 (or a solid-prong fastener) of a mating fastener 254 (shown as fastener 254 for each of the two faces of the rod shaft tail end portion 208, although this is meant to be exemplary) to secure the double fletching 220 to the rod shaft 200. Each split-prong fastener 252 is shown as having a gap defined between two prong fingers. The gap extends at least partially along the length of the prong fastener 252. The fingers together have an enlarged prong tip (also split by the gap). There is a shoulder on the outer periphery (not within the gap) that separates the enlarged prong tip from the remainder of the fingers. To attach a double fletching 220, the split-prong fasteners 252 are inserted through the double fletching 220 (as described herein) and into the apertures 250 defined in the tail end portion 208. As the enlarged prong tips are inserted through the apertures 250, they compress inwardly, narrowing the gap. Once through the apertures 250, the gap widens and pushes the enlarged prong tips outwardly so that the shoulder interacts with (engages) the outer periphery of the apertures 250 with the tips in the shaft interior. This structure secures the double fletching 220 between the rod shaft tail end portion 208 and the mating fastener 254. As opposed to the square or rectangular cross-section of the rod shaft tail end portion 208, FIG. 127 shows a rod shaft tail end portion 214 that has an alternative cross-section of a six-sided polygon. Such a polygon allows for the use of three sets of double fletching 220. Individual projecting split-prong fasteners 258 (or solid-prong fasteners) may be used that have tips that are inserted into the shaft interior.

FIGS. 124 and 125 show a third exemplary tail end 204 with a rod shaft tail end portion 210 and mechanically attached double fletching 220. The tail end portion 210 has at least one through aperture 260 (shown as three through apertures 260, each of which spans the distance between two opposite faces of the rod shaft tail end portion 210, although this is meant to be exemplary). Also shown in FIGS. 124 and 125 are a first part of a mating fastener (a pronged mating fastener 262 having at least one projecting split-prong fastener 264 (or at least one solid-prong fastener)) and a second part of a mating fastener (an apertured mating fastener 266 having at least one aperture 268). Each split-prong fastener 264 is shown as having a gap defined between two prong fingers. The gap extends at least partially along the length of the prong fastener 264. The fingers together have an enlarged prong tip (also split by the gap). There is a shoulder on the outer periphery (not within the gap) that separates the enlarged prong tip from the remainder of the fingers. To attach a double fletching 220, the split-prong fastener 264 is inserted through a first double fletching 220 (as described herein), through the through apertures 260 defined in the tail end portion 210, through a second double fletching 220 (as described herein), and through the apertures 268 of the apertured mating fastener 266. As the enlarged prong tips are inserted through the apertures 268, they compress inwardly, narrowing the gap. Once through the apertures 268, the gap widens and pushes the enlarged prong tips outwardly so that the shoulder interacts with (engages) the outer periphery of the apertures 268. This structure secures a first double fletching 220 between the rod shaft tail end portion 210 and the pronged mating fastener 262 and a second double fletching 220 between the rod shaft tail end portion 210 and the apertured mating fastener 266.

FIG. 126 shows a fourth exemplary tail end 204 with a rod shaft tail end portion 212 and mechanically attached double fletching 220. The tail end portion 212 has at least one through aperture 270 (shown as three through apertures 270, each of which spans the distance between two opposite faces of the rod shaft tail end portion 212, although this is meant to be exemplary). Also shown in FIG. 126 are three first parts of a mating fastener (a pronged mating fastener 272 having a single projecting split-prong fastener 274 (or a solid-prong fastener)) and three second parts of a mating fastener (an apertured mating fastener 276 having a single aperture 278). More or less mating fasteners 272, 276 may be used. Each split-prong fastener 274 is shown as having a gap defined between two prong fingers. The gap extends at least partially along the length of the prong fastener 274. The fingers together have an enlarged prong tip (also split by the gap). There is a shoulder on the outer periphery (not within the gap) that separates the enlarged prong tip from the remainder of the fingers. To attach a double fletching 220, the split-prong fasteners 274 are inserted through a first double fletching 220 (as described herein), through the through apertures 270 defined in the tail end portion 212, through a second double fletching 220 (as described herein), and through the apertures 278 of the respective apertured mating fastener 276. As the enlarged prong tips are inserted through the apertures 278, they compress inwardly, narrowing the gap. Once through the apertures 278, the gap widens and pushes the enlarged prong tips outwardly so that the shoulder interacts with (engages) the outer periphery of the apertures 278. This structure secures a first double fletching 220 between the rod shaft tail end portion 212 and the pronged mating fastener 272 and a second double fletching 220 between the rod shaft tail end portion 212 and the apertured mating fastener 276.

The tail end 204 of the exemplary rod shafts 200 shown in FIGS. 1-32, 113-120, and 121-126 may include or be associated with a toss lever and/or flexible tab 284 that allows the projectile to be tossed. U.S. Pat. Design No. D698,872 to Cummings and U.S. Pat. No. 8,012,049 to Walterscheid provide additional information pertaining to the toss lever and/or flexible tab 284.

Preferred exemplary rod shafts 200 are lightweight, strong, and flexible. Preferred exemplary rod shafts 200 may have flexibility that can be described as having an original state that can easily be bent (repeatedly) with minimal pressure (but more than gravity or the weight of the head and/or the tail features) in any (or multiple) direction, but that automatically returns to its original state when the pressure is removed. Alternative preferred exemplary rod shafts 200 may have flexibility that can be described as having an original state that can easily be bent (repeatedly) with a medium amount of pressure (e.g. a small child's hands could easily create such a pressure) in any (or multiple) direction, but that automatically returns to its original state when the pressure is removed.

Preferred exemplary rod shafts 200 may be made of nylon, polycarbonite, styrene-butadiene copolymers (e.g. K Resin®), acrylonitrile butadiene styrene (ABS), polypropylene (PP), polyethylene (PE), a combination of PP and PE (or a combination of other materials), and/or any material (or combination of materials) known or yet to be discovered that can create lightweight, strong, and/or flexible rod shafts. Some rod shafts 200, depending on their intended use or intended users, may have other physical characteristics including, but not limited to, one or more of the following: transparent, translucent, glow-in-the-dark, colored, patterned, textured, sparkles (glitter), and other characteristics that may be attractive to a user or suitable for an intended use. As an example, using a combination of PP and PE as the shaft material provides flexibility (from the PE) and strength (from the PP) such that kids can repeatedly twist it, move it back and forth, and otherwise without breaking. It should be noted that the flexibility of the rod shaft 200 is a very unique feature. Prior art arrows are designed to work with traditional bows in which the back end of the arrow is associated with the bow string and the archer pulls the arrow back end and the bow string back together. The bow string essentially pushes the back end of the arrow forward. For this to work, however, the arrow must be relatively rigid. Because the projectiles of the present invention associate the head end (front) with the "string" or "loops" (the string essentially pushing the front end) the back end essentially goes along for the ride. The shaft of the projectile, therefore, can be flexible without negatively impacting flight. The rod shaft material may be child-safe and/or anti-bacterial. PP has significant advantages as it is economical and very tough (and when it breaks it does not create sharp edges or points). The materials listed above and materials disclosed in references incorporated by reference may be used as a rod shaft material if they meet the properties of the intended use of the projectile. For example, for a projectile not intended for a child's use, the material would not have to be child-safe.

Preferred exemplary rod shafts 200 use materials and processes that simplify the manufacturing process. Preferred exemplary processes for creating the rod shafts 200 include, but are not limited to, molding (e.g. blow molding, compression molding, and/or injection molding), ultrasonics, and/or other processes known or yet to be discovered. Using appropriate measures (including using openings) may help with material shrinkage. This is important when using materials such as PP that have high shrinkage rates.

Additional information and details of rod shafts described herein or alternative rod shafts may be found in U.S. patent application Ser. No. 14/016,164 to Cummings, International Application No. PCT/US2012/031812 to Walterscheid, U.S. patent application Ser. No. 13/411,951 to Walterscheid, U.S. Pat. No. 8,485,168 to Walterscheid, U.S. Pat. No. 8,662,060 to Walterscheid et al., U.S. Pat. No. 8,348,789 to Walterscheid, U.S. Pat. No. D622,325 to Walterscheid, and U.S. Pat. No. 3,855,991 to Imatt et al.

Figure 1:
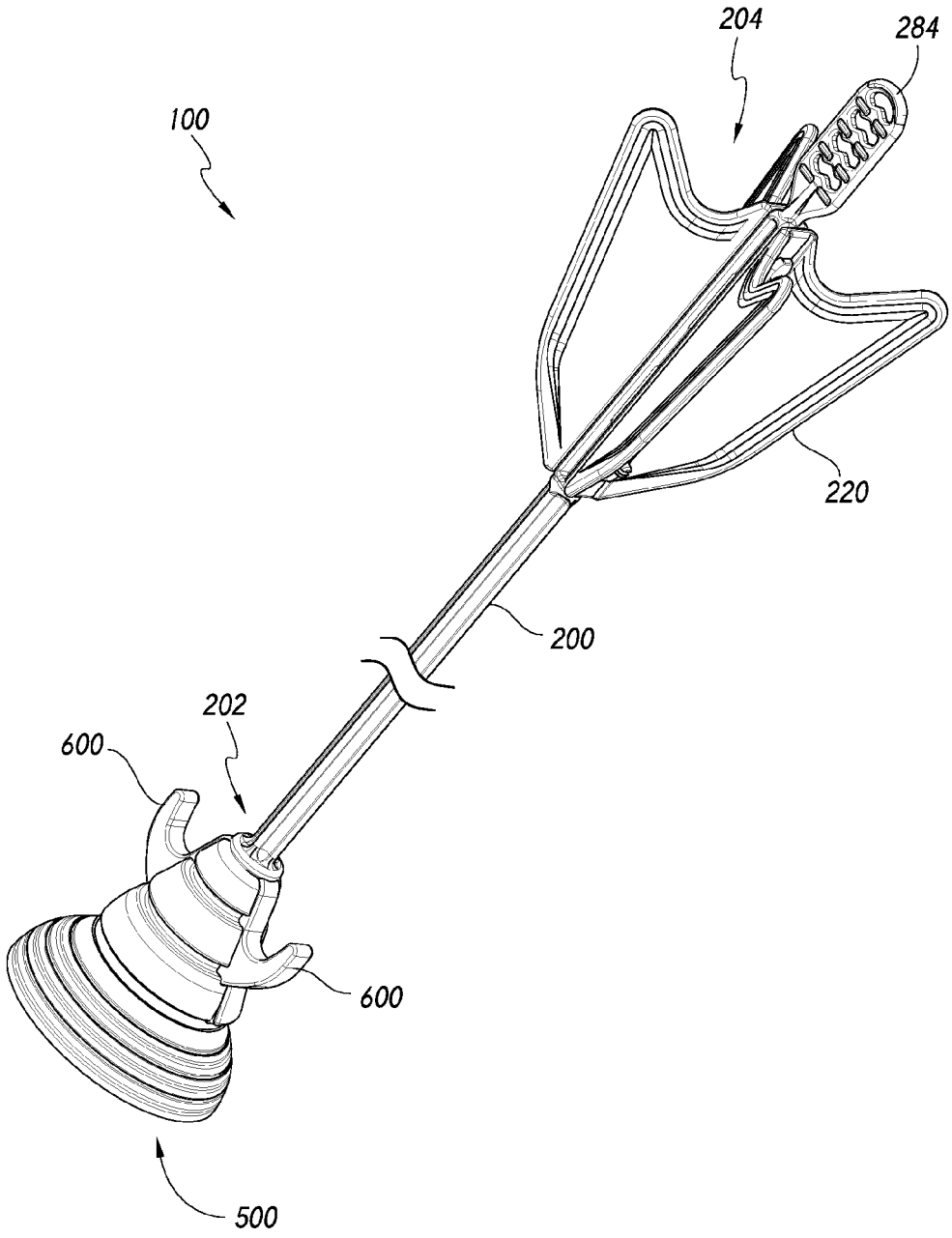
FIG. 1 is a perspective view of a projectile having a rod shaft, a suction head, two hooks, and mechanically attached fletching.
Figure 2:
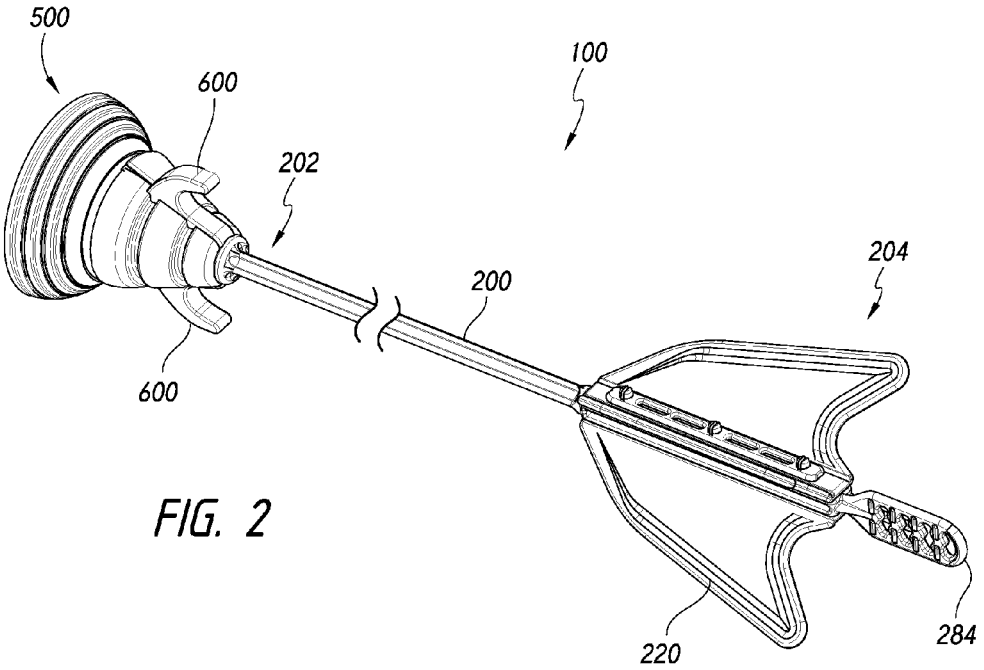
FIG. 2 is a perspective view, slightly rotated from the view of FIG. 1, of the projectile of FIG. 1.
Figure 3:
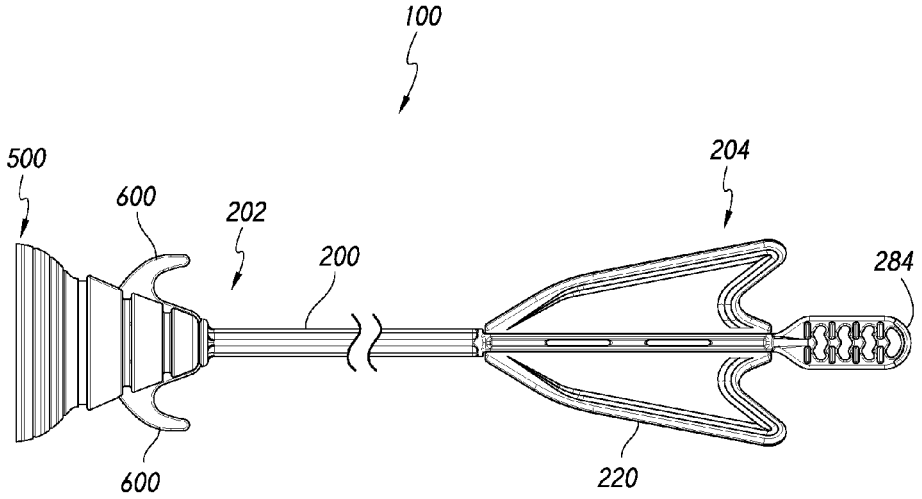
FIG. 3 is a front plan view of the projectile of FIG. 1, the back plan view being a mirror image thereof.
Figure 4:
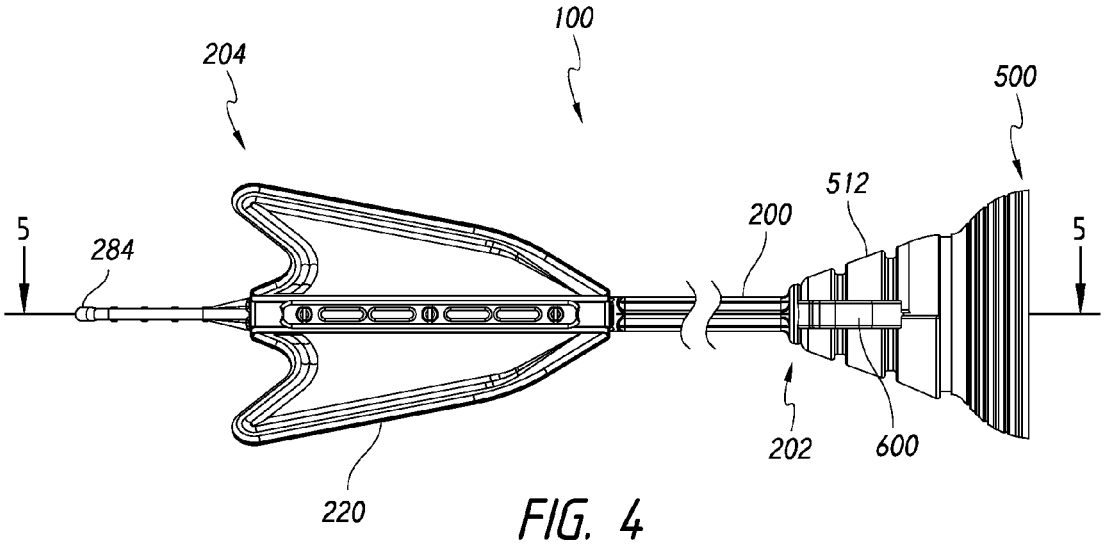
FIG. 4 is one side view of the projectile of FIG. 1, the opposite side being a mirror image thereof.
Figure 5:
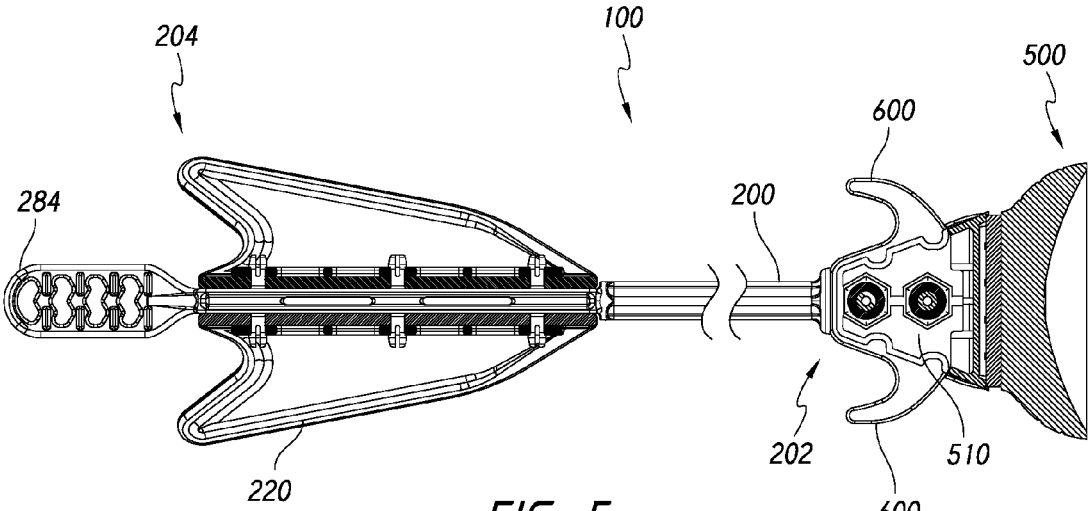
FIG. 5 is a cross-sectional view of the projectile of FIG. 1, taken along line 5-5 of FIG. 4.
Figure 6:
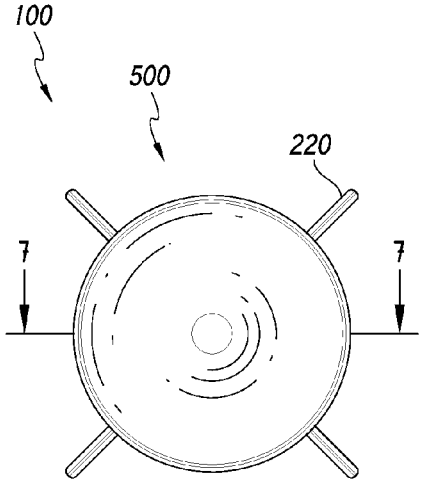
FIG. 6 is a top plan view of the projectile of FIG. 1.
Figure 8:
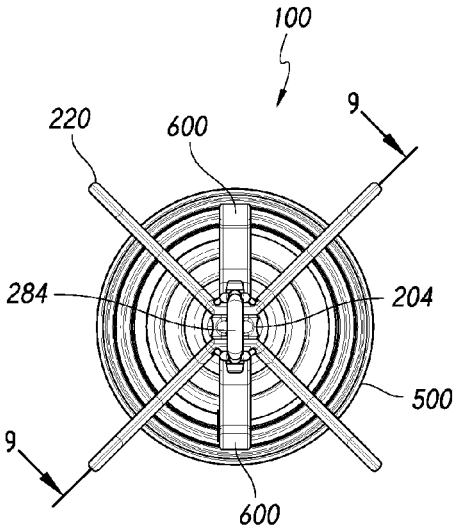
FIG. 8 is a bottom plan view of the projectile of FIG. 1.
Figure 7:
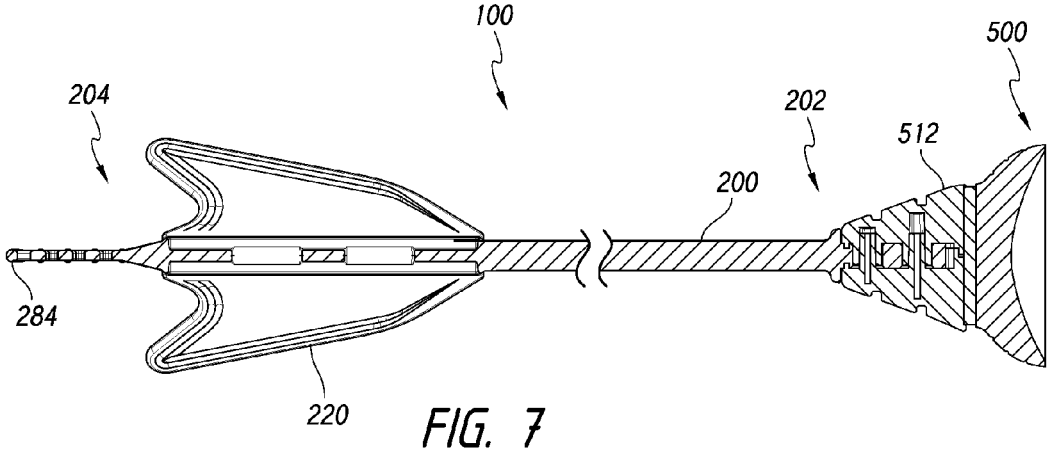
FIG. 7 is a cross-sectional view of the projectile of FIG. 1, taken along line 7-7 of FIG. 6.
Figure 9:
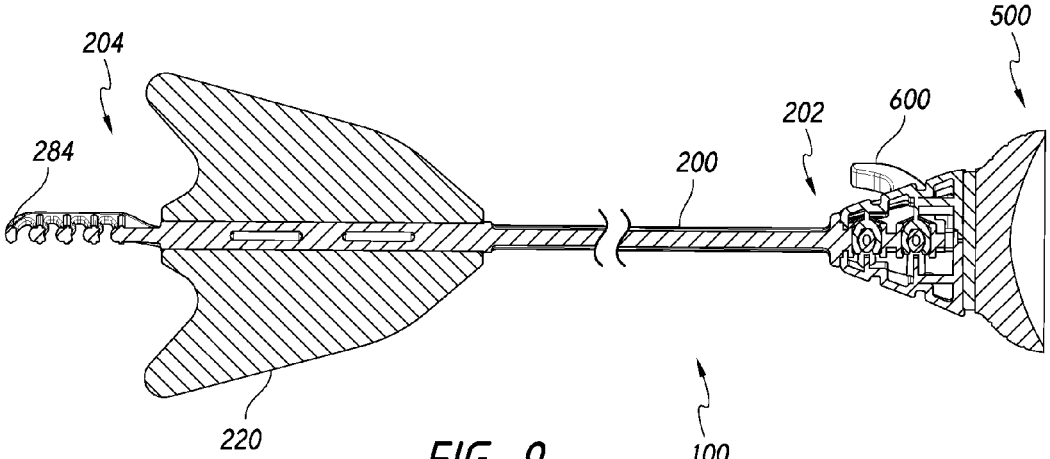
FIG. 9 is a cross-sectional view of the projectile of FIG. 1, taken along line 9-9 of FIG. 8.
Figure 10:
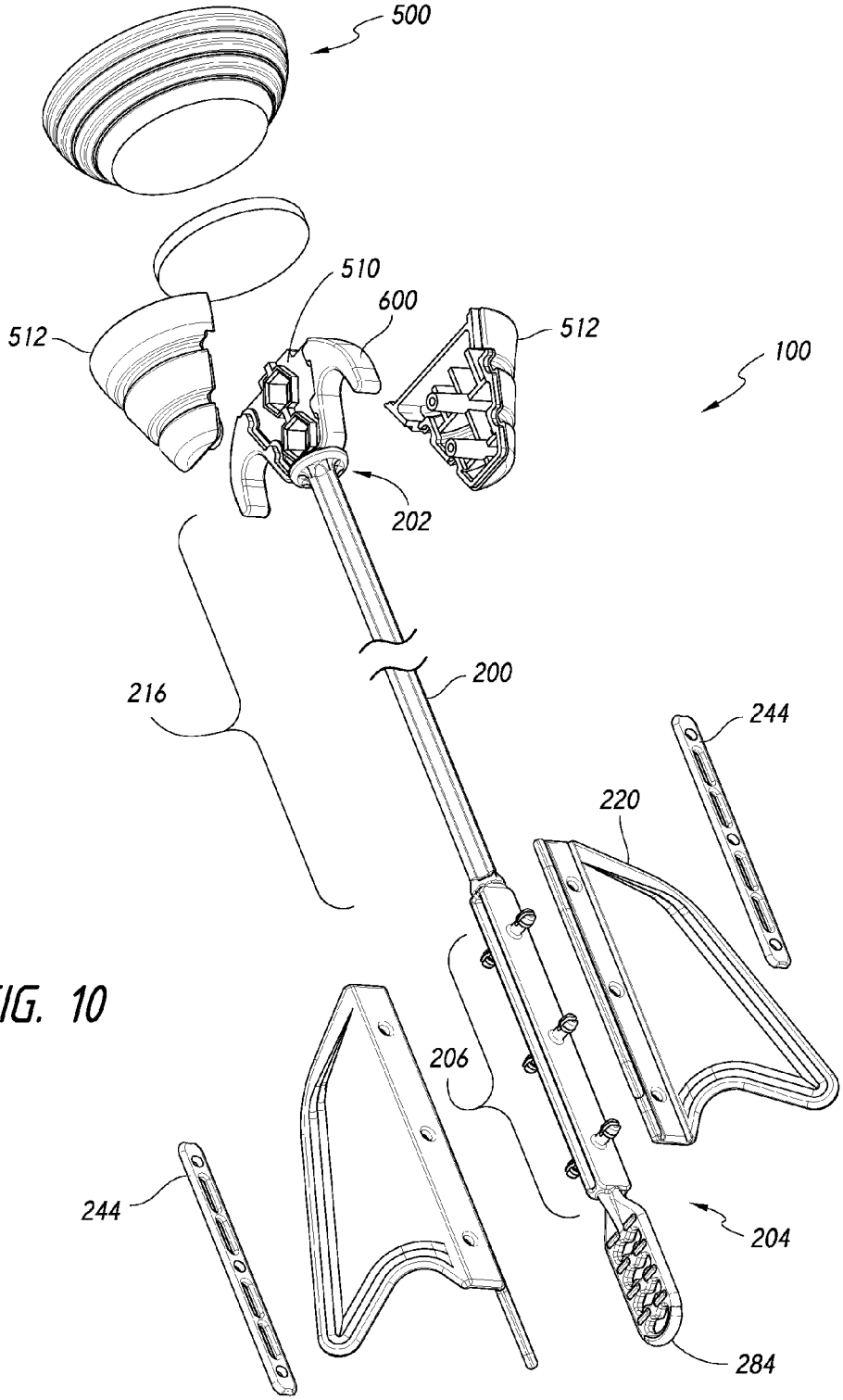
FIG. 10 is an exploded view of the projectile of FIG. 1.
Figure 11:
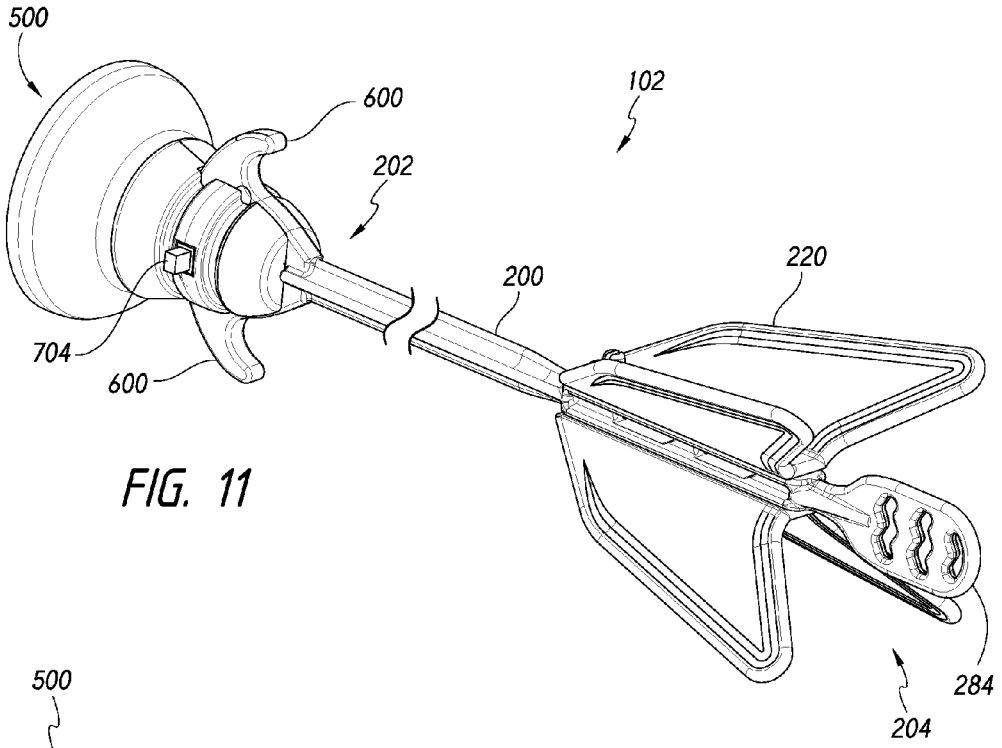
FIG. 11 is a perspective view, taken generally from the front, of a projectile having a rod shaft, a suction head, two hooks, mechanically attached fletching, and an illuminator.
Figure 12:
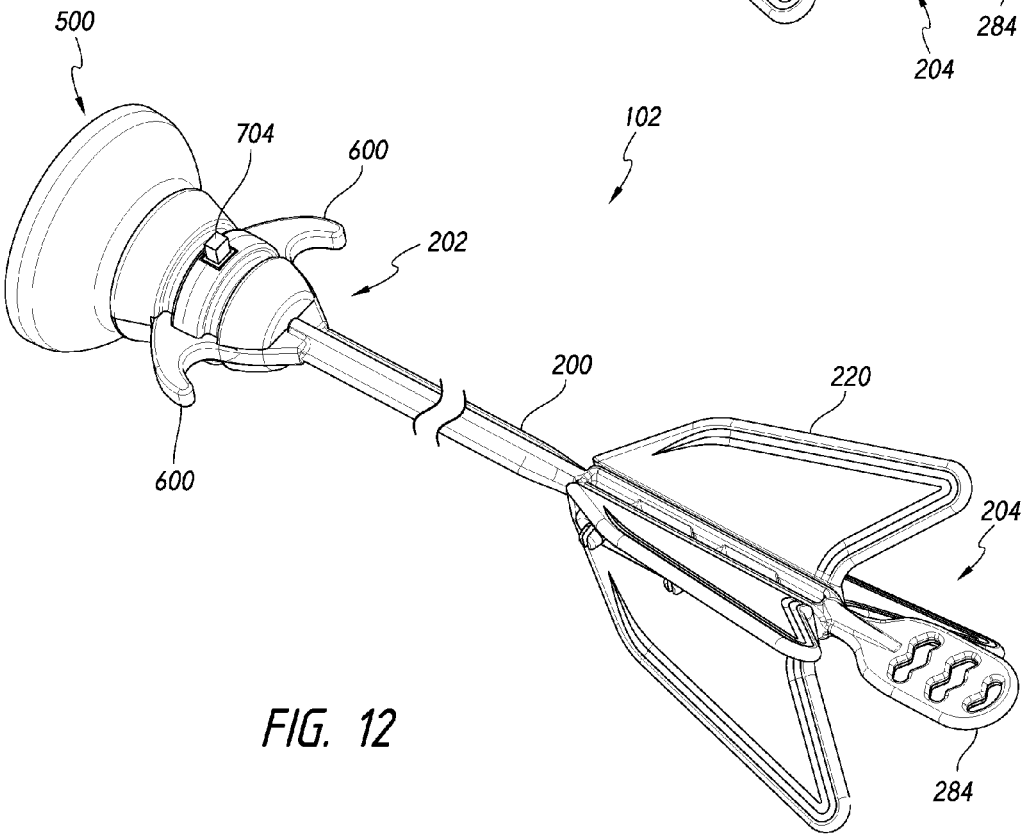
FIG. 12 is a perspective view, taken generally from the side, of the projectile of FIG. 11.
Figure 13:
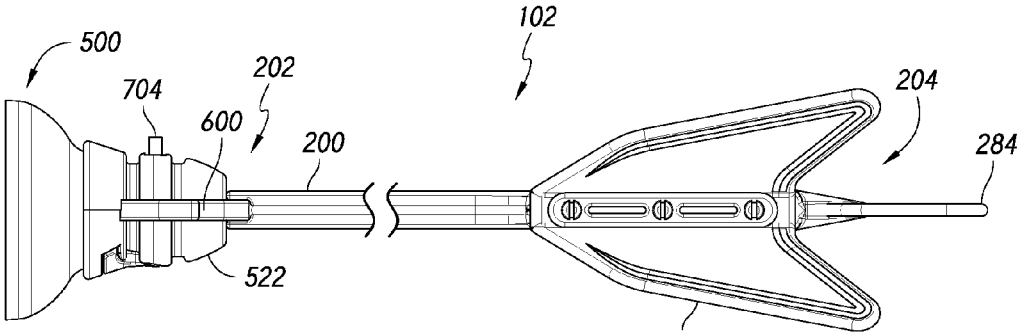
FIG. 13 is one side view of the projectile of FIG. 11, the opposite side being a mirror image thereof.
Figure 14:
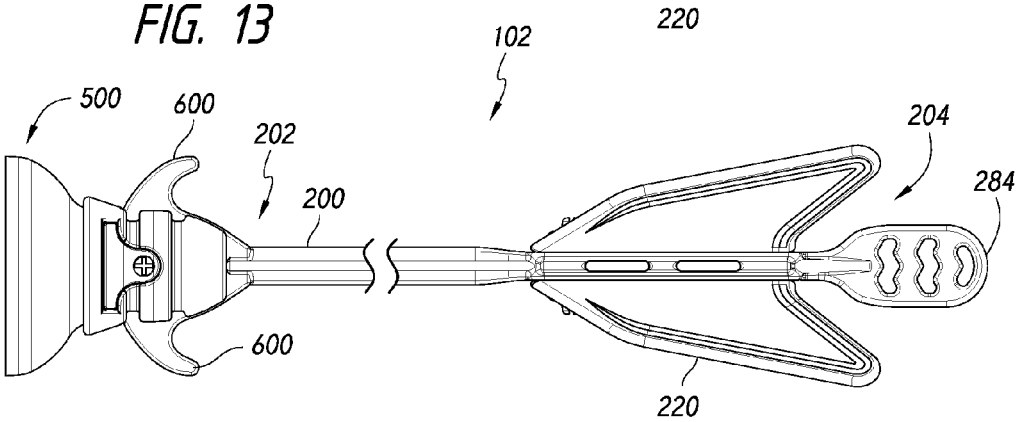
FIG. 14 is a back plan view of the projectile of FIG. 11.
Figure 15:
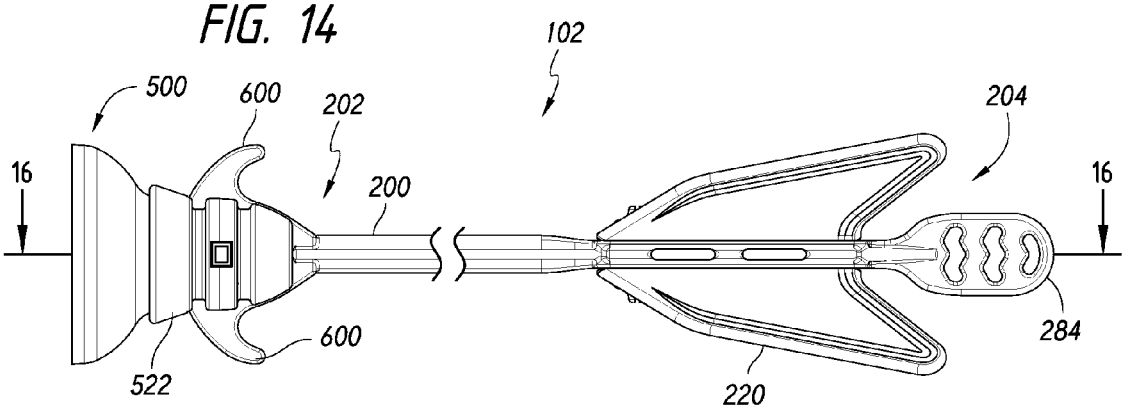
FIG. 15 is a front plan view of the projectile of FIG. 11.
Figure 16:
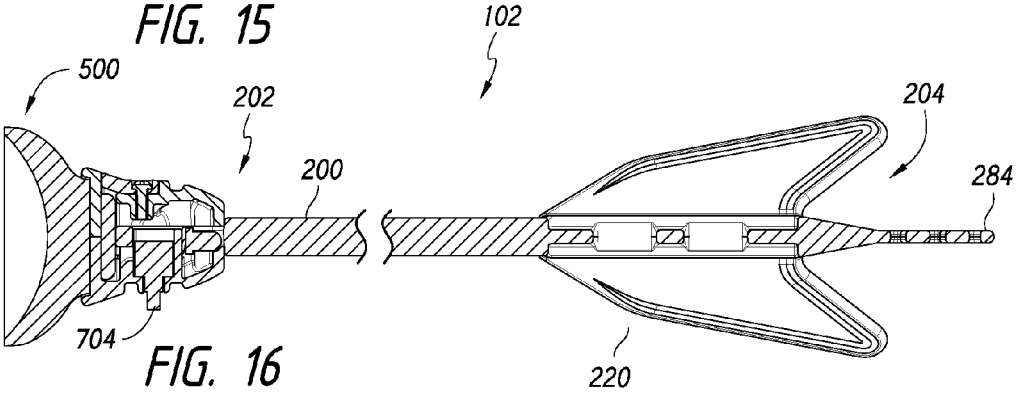
FIG. 16 is a cross-sectional view of the projectile of FIG. 11, taken along line 16-16 of FIG. 15.
Figure 17:
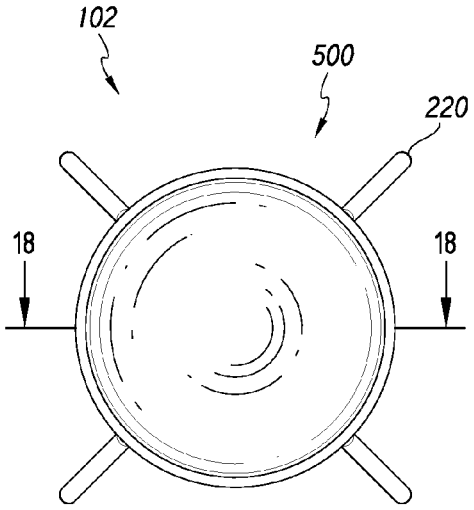
FIG. 17 is a top plan view of the projectile of FIG. 11.
Figure 19:
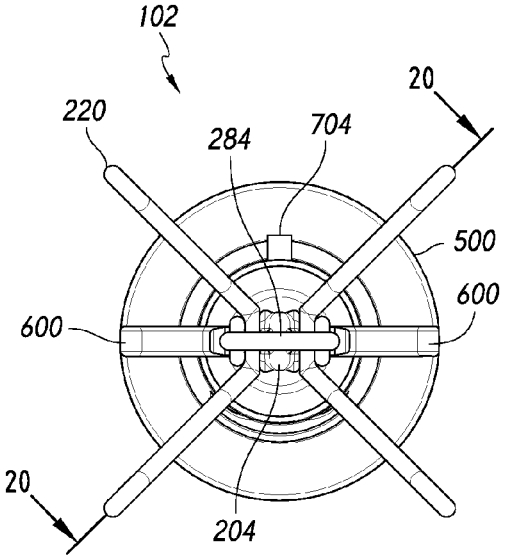
FIG. 19 is a bottom plan view of the projectile of FIG. 11.
Figure 18:
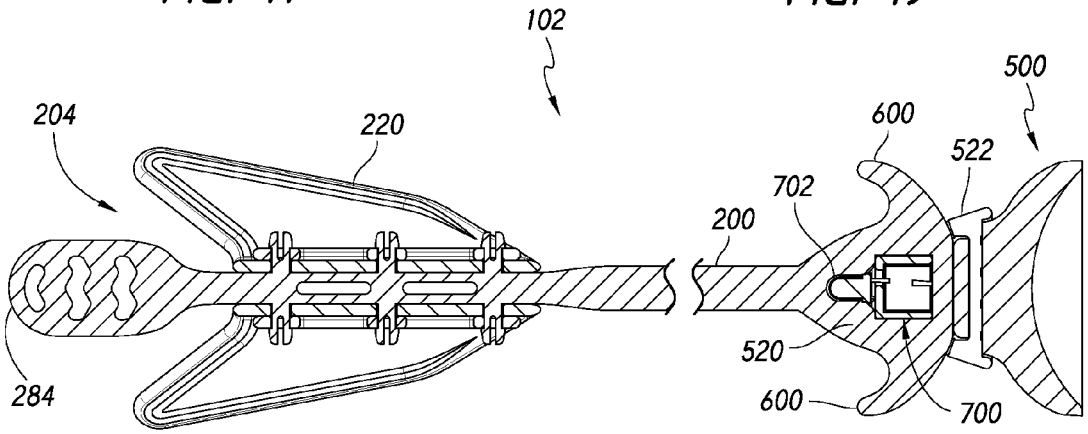
FIG. 18 is a cross-sectional view of the projectile of FIG. 11, taken along line 18-18 of FIG. 17.
Figure 20:
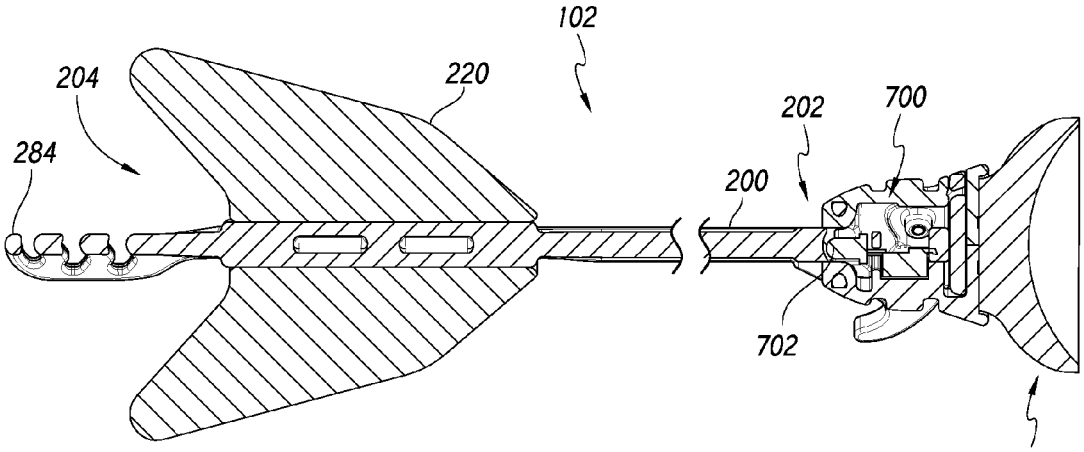
FIG. 20 is a cross-sectional view of the projectile of FIG. 11, taken along line 20-20 of FIG. 19.
Figure 21:
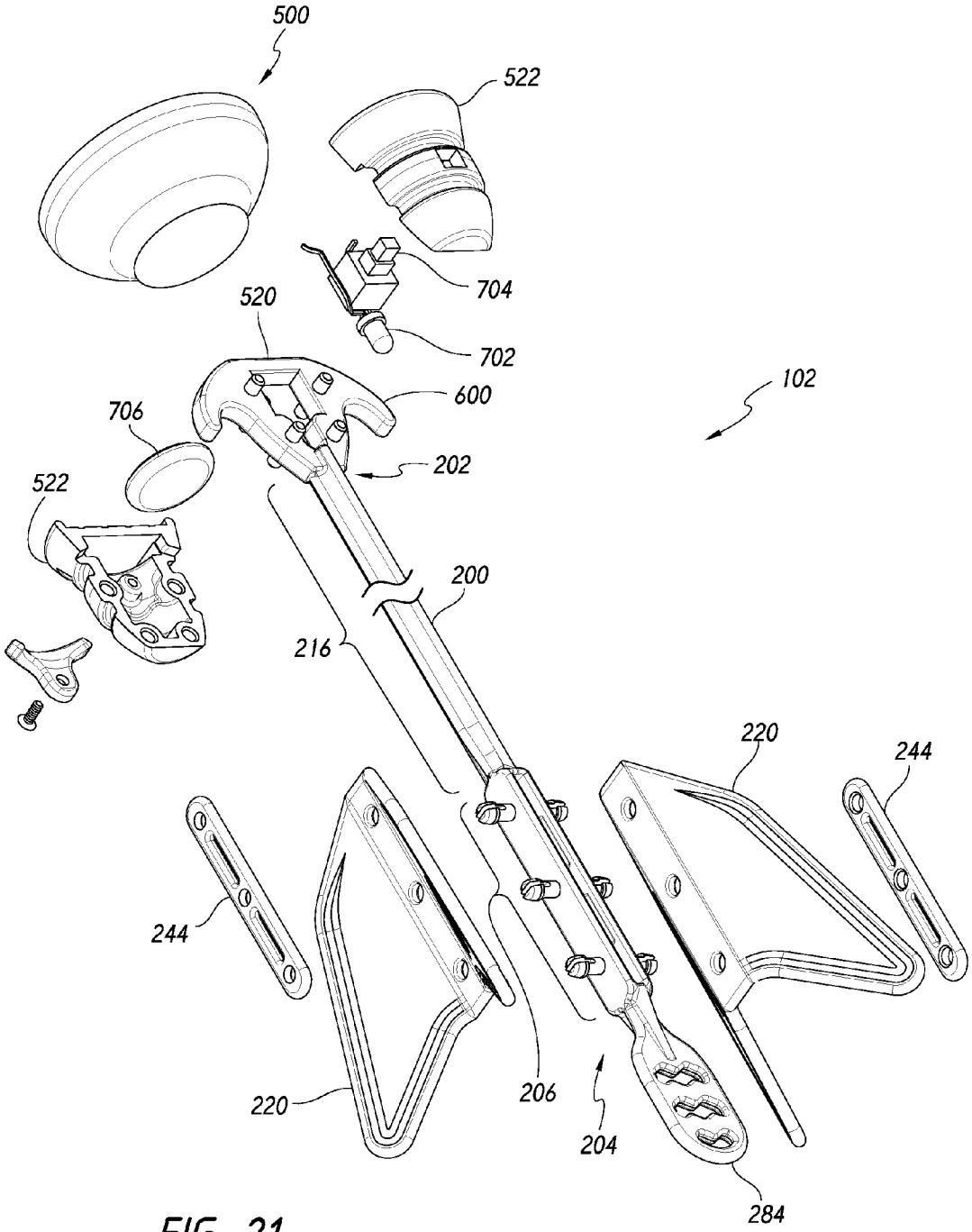
FIG. 21 is an exploded view of the projectile of FIG. 11.
Figure 22:
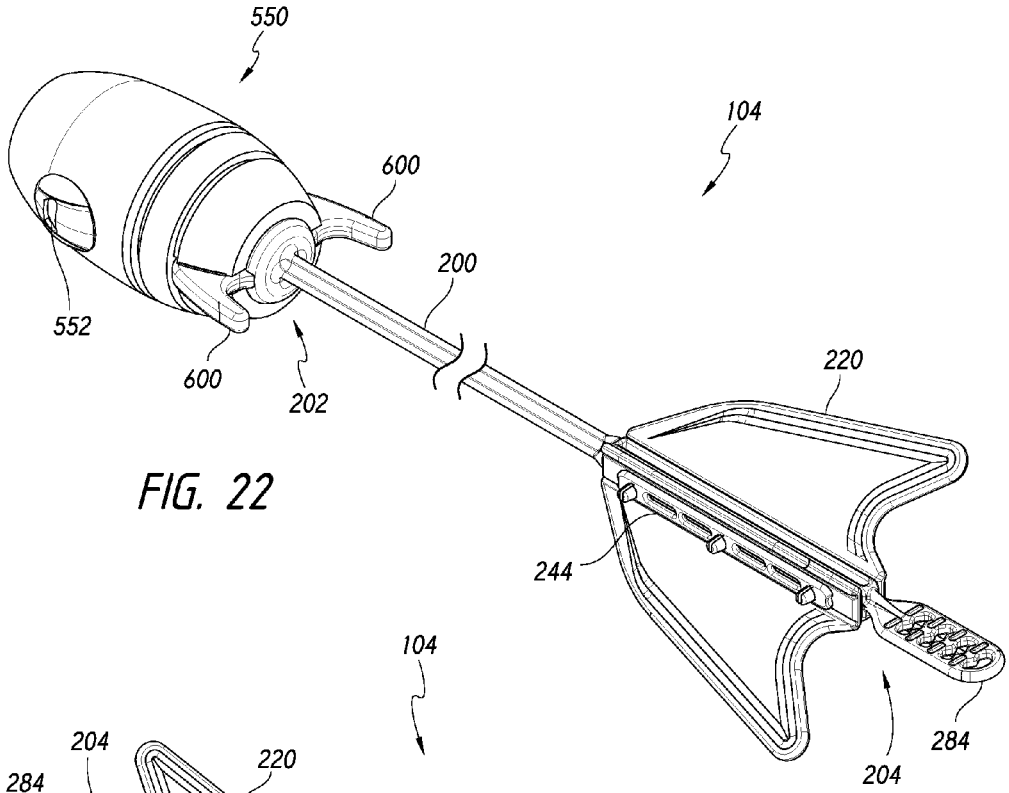
FIG. 22 is a perspective view, taken generally from the front, of a projectile having a rod shaft, a bounce-back head, two hooks, and mechanically attached fletching.
Figure 23:
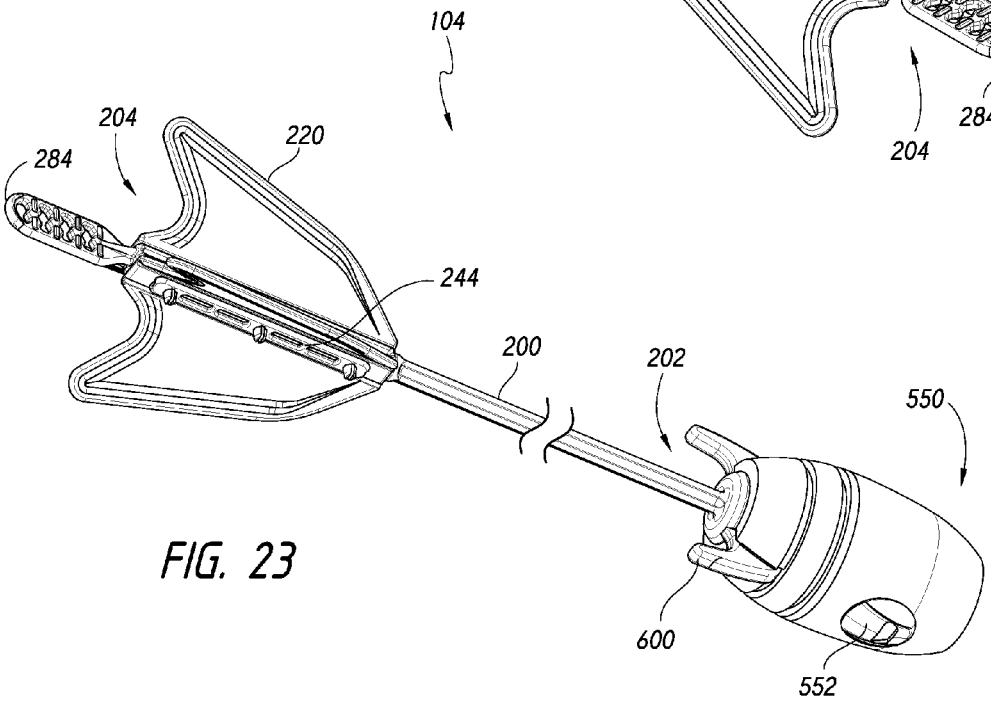
FIG. 23 is a perspective view, rotated from the view of FIG. 22, of the projectile of FIG. 22.
Figure 24:
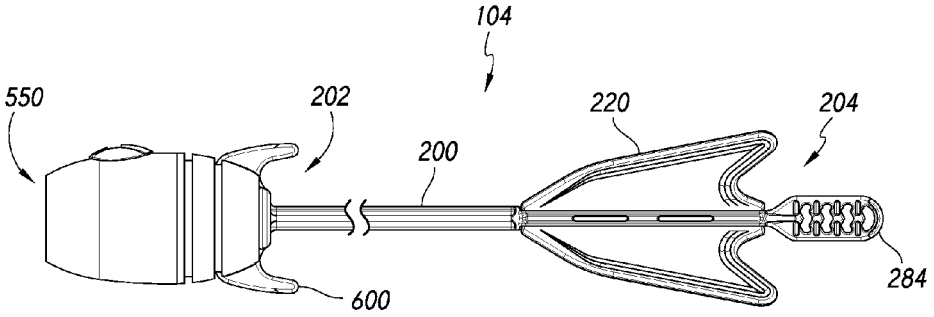
FIG. 24 is one side view of the projectile of FIG. 22, the opposite side being a mirror image thereof.
Figure 25:
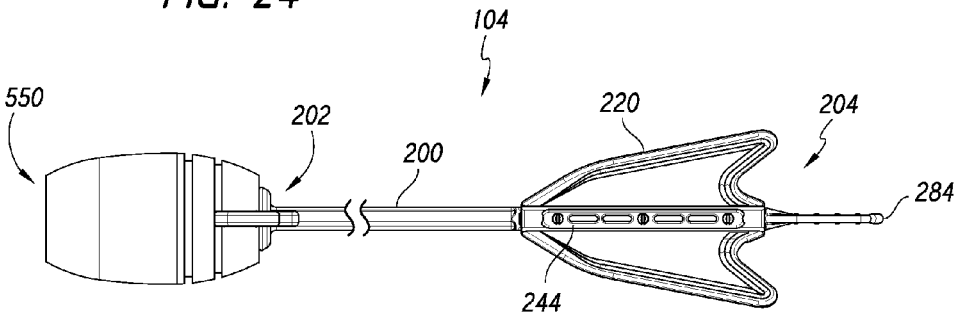
FIG. 25 is a back plan view of the projectile of FIG. 22.
Figure 26:
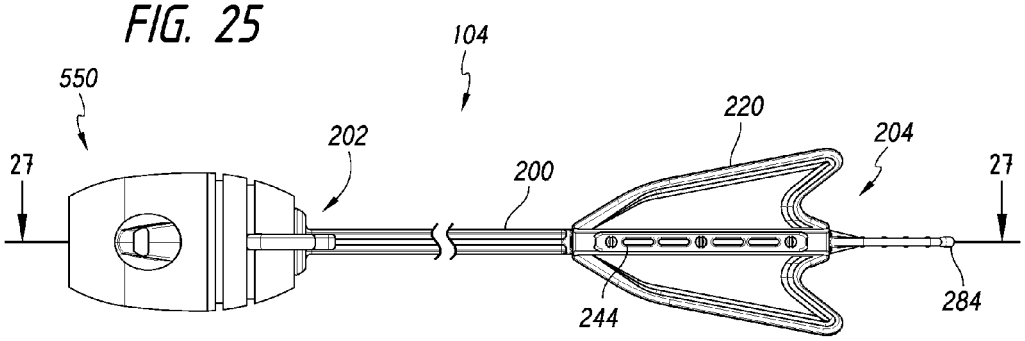
FIG. 26 is a front plan view of the projectile of FIG. 22.
Figure 27:
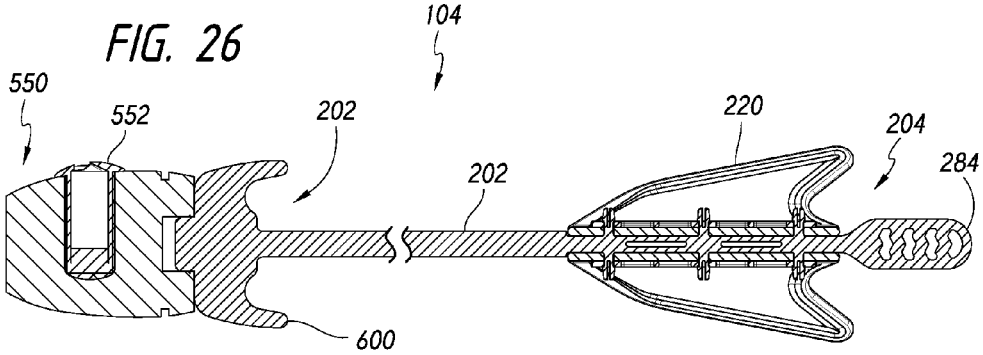
FIG. 27 is a cross-sectional view of the projectile of FIG. 22, taken along line 27-27 of FIG. 26.
Figure 28:
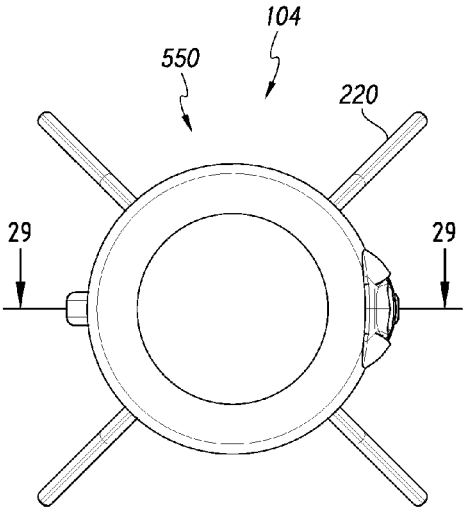
FIG. 28 is a top plan view of the projectile of FIG. 22.
Figure 30:
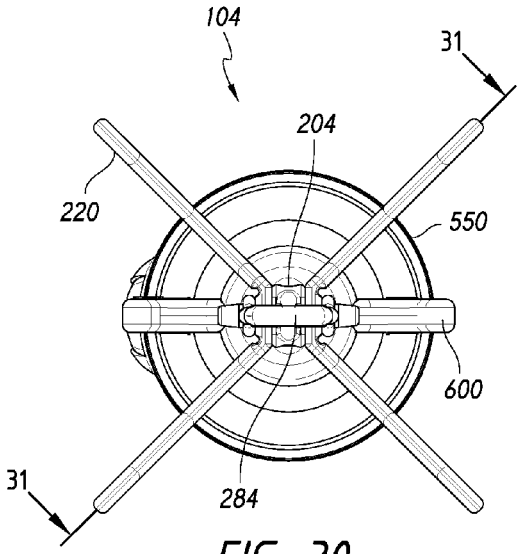
FIG. 30 is a bottom plan view of the projectile of FIG. 22.
Figure 29:
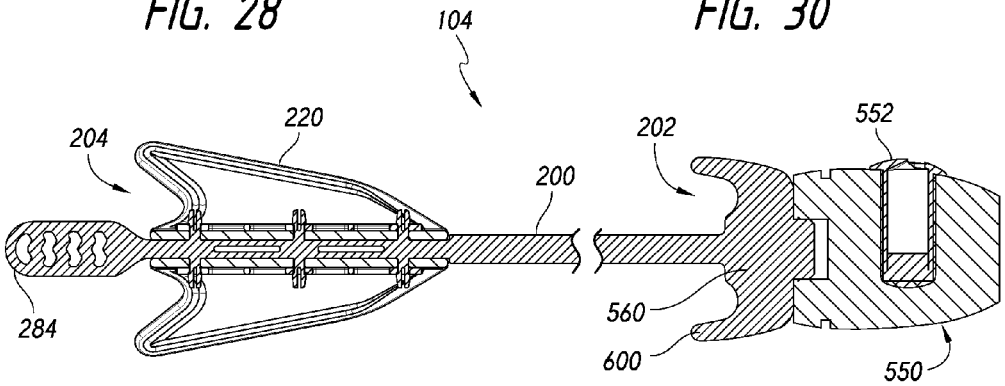
FIG. 29 is a cross-sectional view of the projectile of FIG. 22, taken along line 29-29 of FIG. 28.
Figure 31:
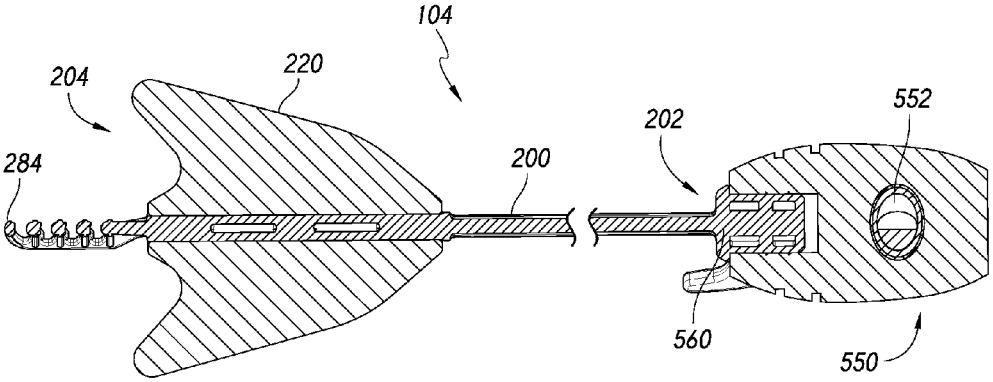
FIG. 31 is a cross-sectional view of the projectile of FIG. 22, taken along line 31-31 of FIG. 30.
Figure 32:
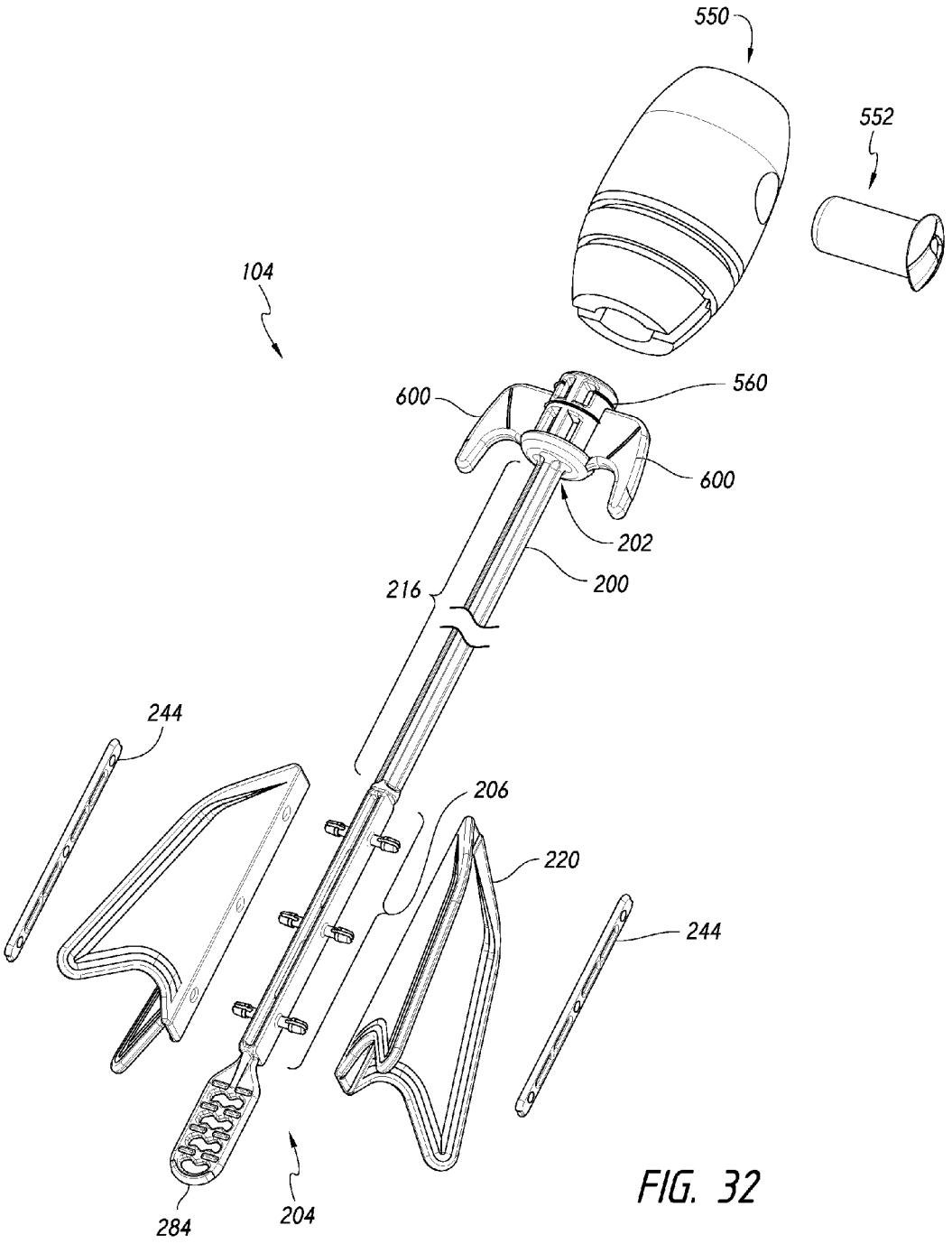
FIG. 32 is an exploded view of the projectile of FIG. 22.
Figures 33, 34, 35:
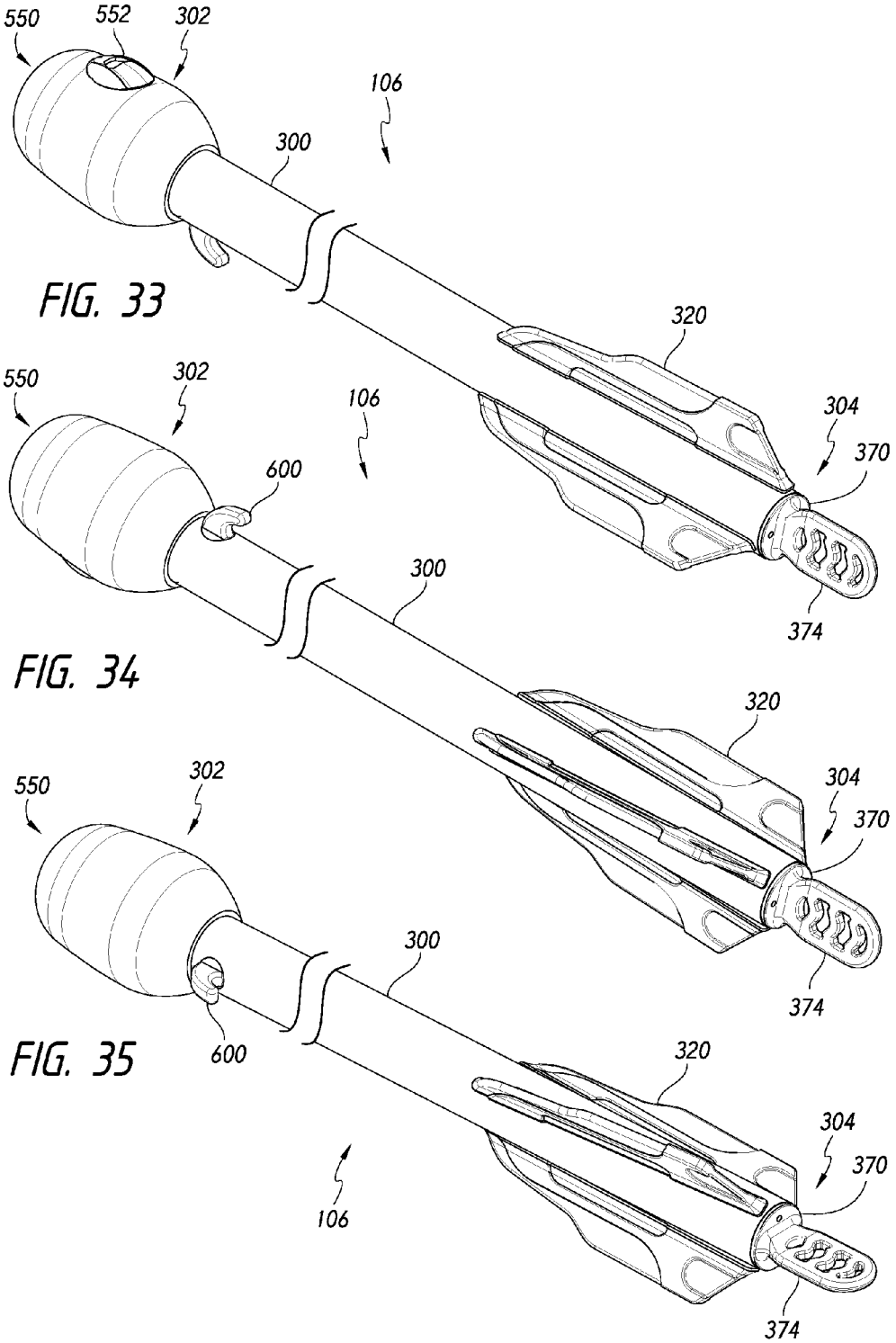
FIG. 33 is a perspective view, taken generally from the side, of a projectile having a tubular shaft, a bounce-back head, one hook, and adhered fletching.
FIG. 34 is a perspective view, taken generally from the front, of the projectile of FIG. 33.
FIG. 35 is a perspective view, taken generally from the back, of the projectile of FIG. 33.
Figure 36:
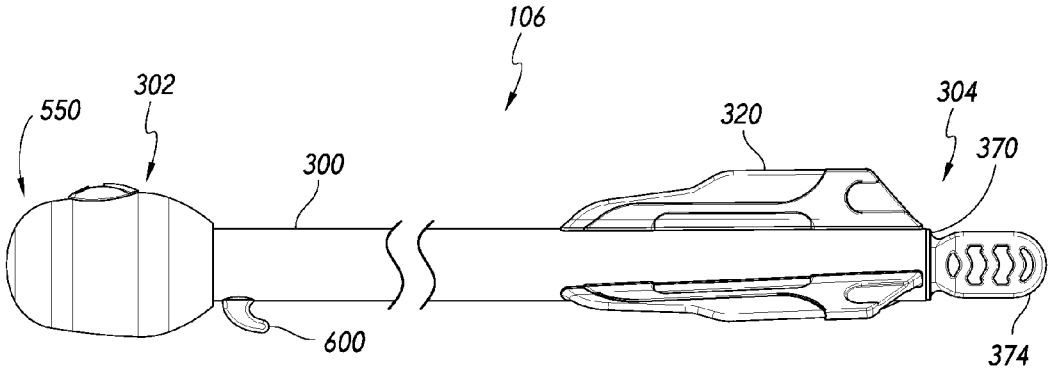
FIG. 36 is one side view of the projectile of FIG. 33.
Figure 37:
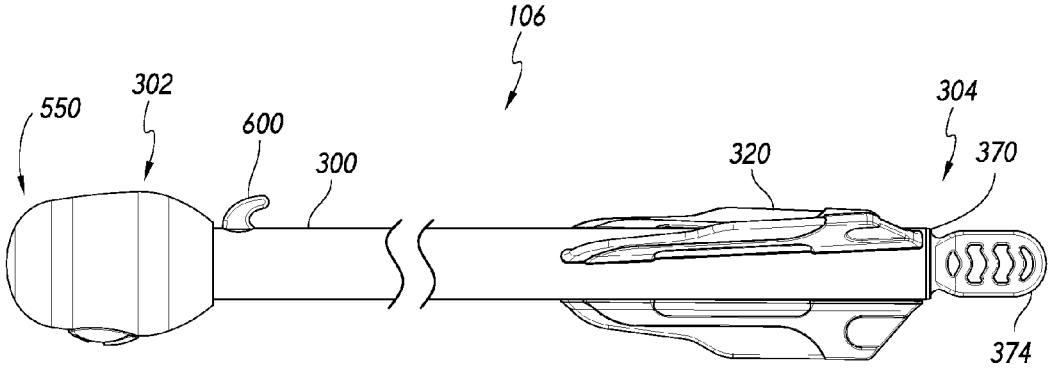
FIG. 37 is an opposite side view of the projectile of FIG. 33.
Figure 38:
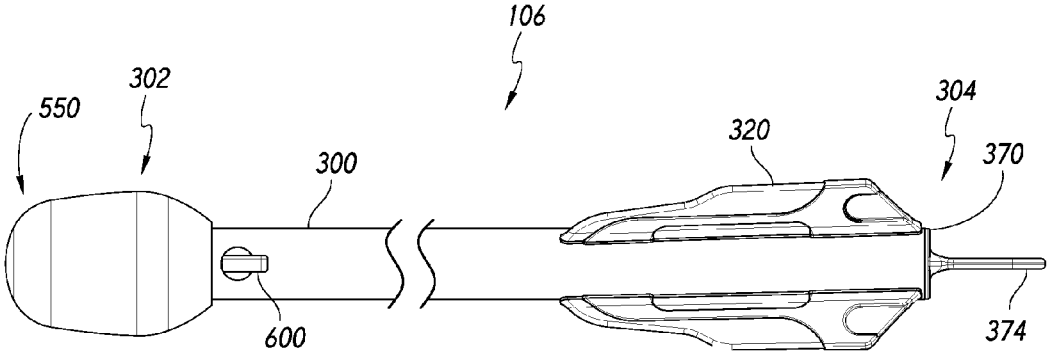
FIG. 38 is a front plan view of the projectile of FIG. 33.
Figure 39:
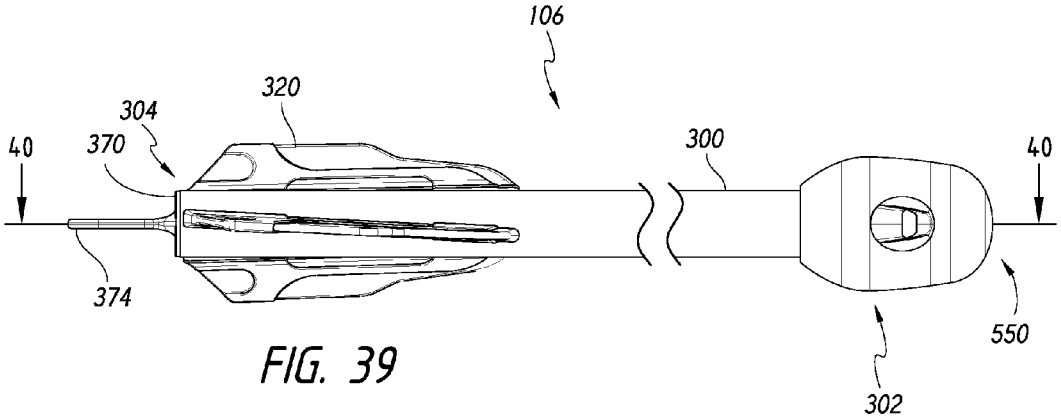
FIG. 39 is a back plan view of the projectile of FIG. 33.
Figure 40:
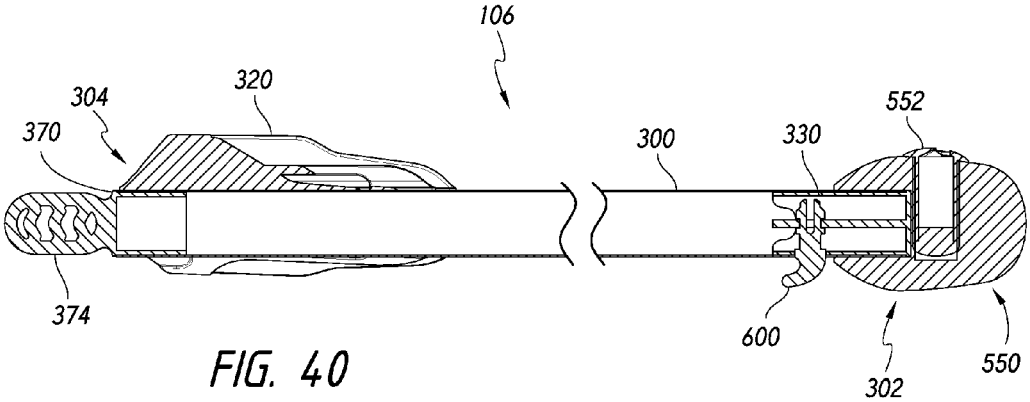
FIG. 40 is a cross-sectional view of the projectile of FIG. 33, taken along line 40-40 of FIG. 39.
Figure 41:
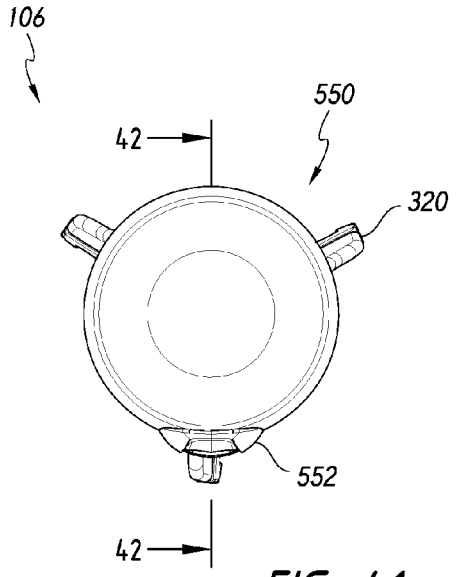
FIG. 41 is a top plan view of the projectile of FIG. 33.
Figure 43:
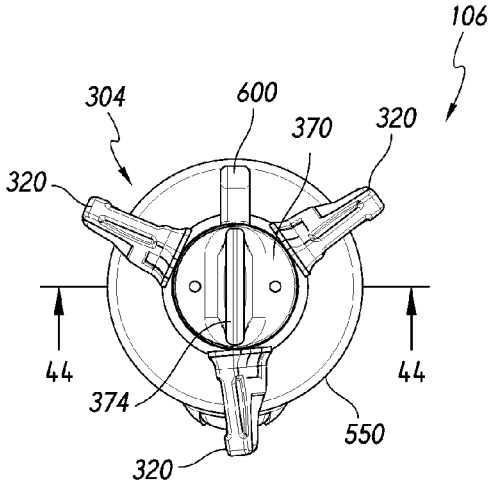
FIG. 43 is a bottom plan view of the projectile of FIG. 33.
Figure 42:
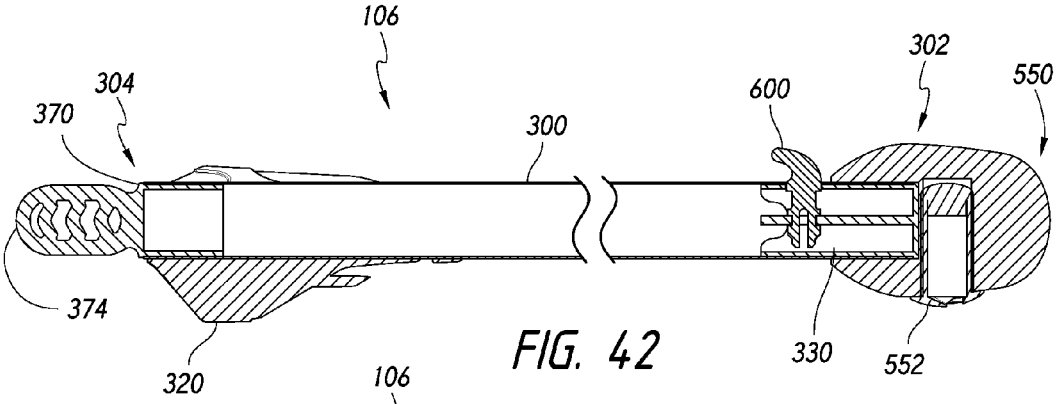
FIG. 42 is a cross-sectional view of the projectile of FIG. 33, taken along line 42-42 of FIG. 41.
Figure 44:
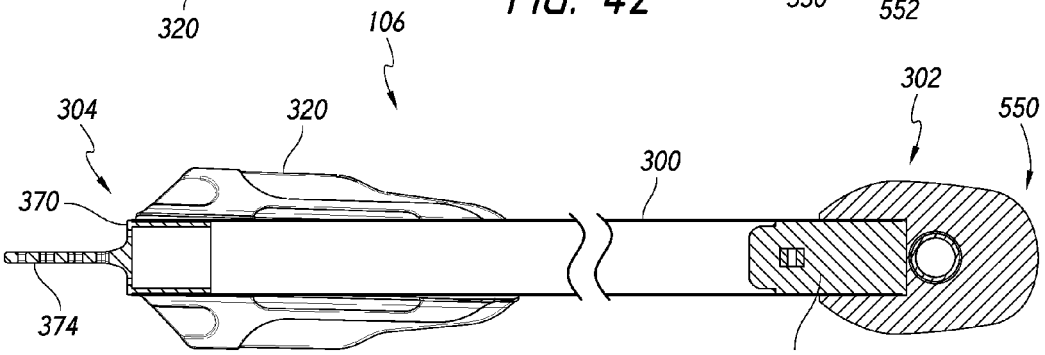
FIG. 44 is a cross-sectional view of the projectile of FIG. 33, taken along line 44-44 of FIG. 43.
Figure 45:
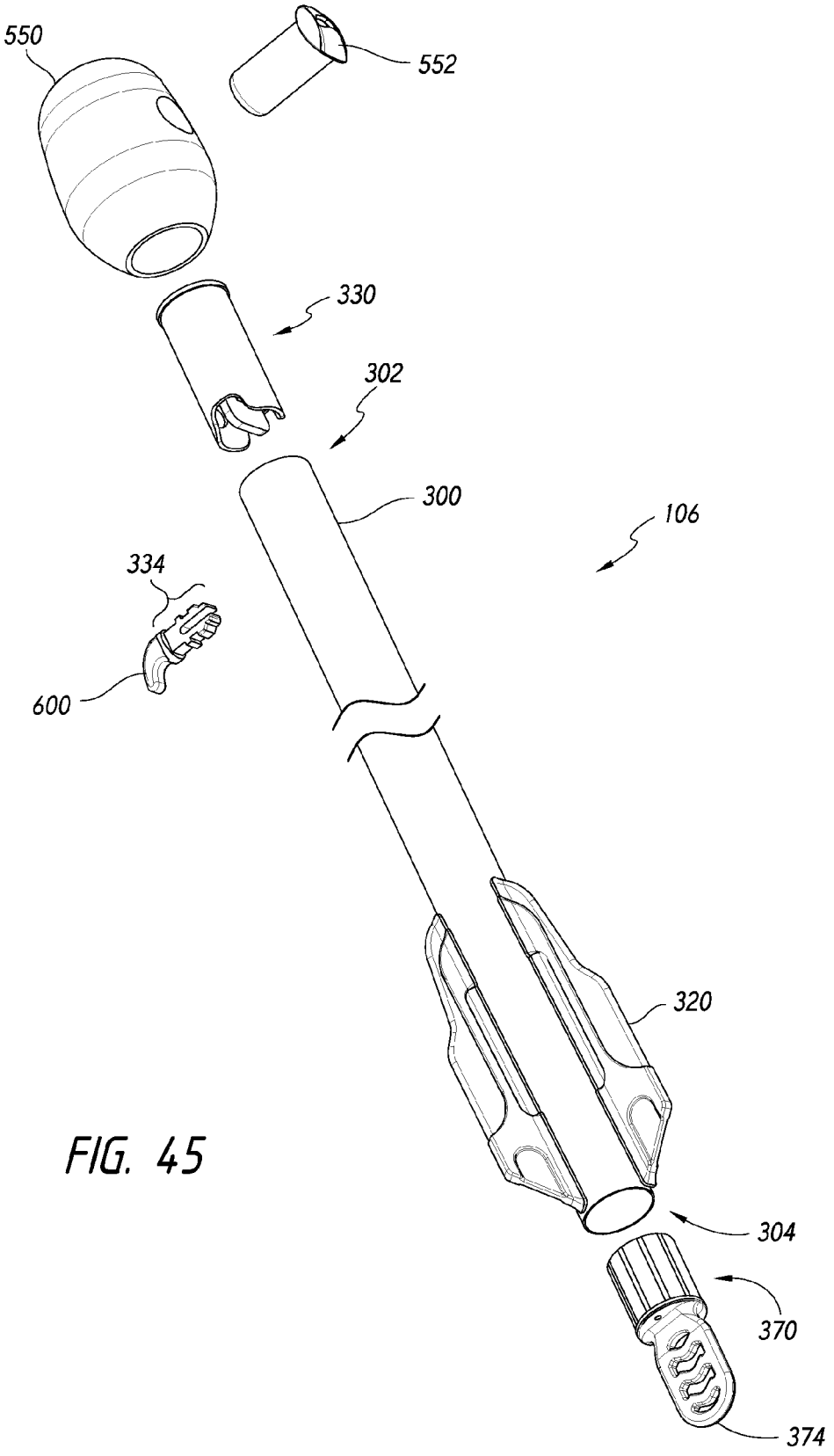
FIG. 45 is an exploded view of the projectile of FIG. 33.
Figure 46:
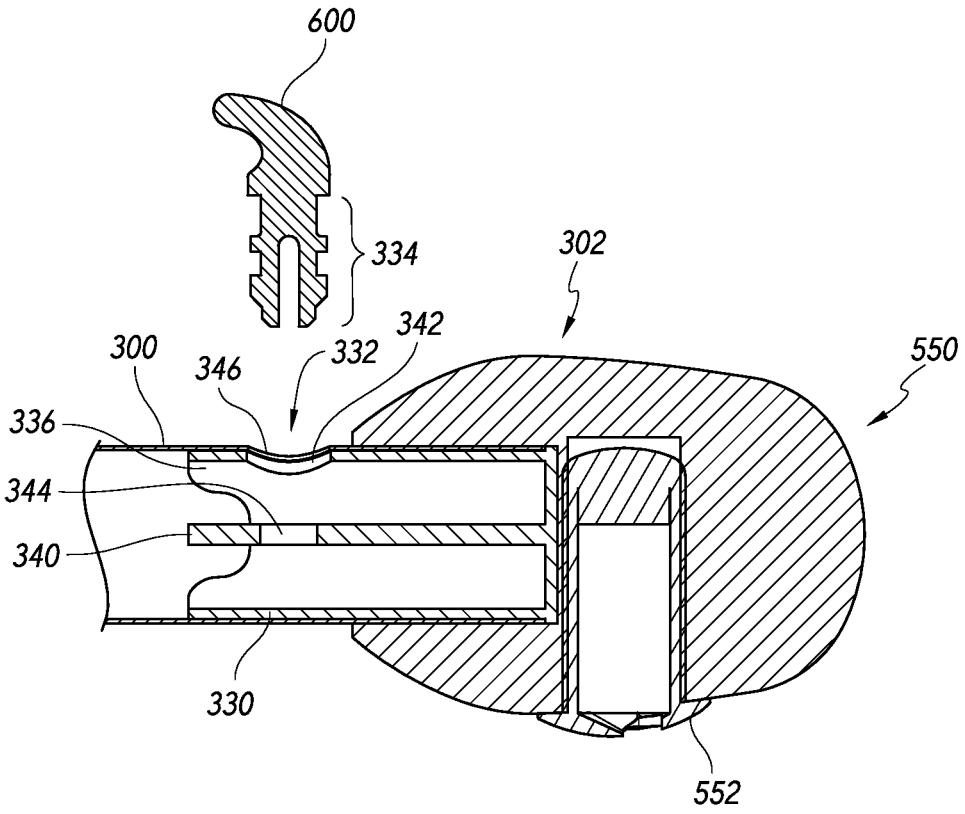
FIG. 46 is an enlarged cross-sectional view, taken from the side, of the head end of the projectile of FIG. 33, and detailing a hooked securer for securing the tubular shaft to the reinforced end piece, the hooked securer being shown just prior to insertion.
Figure 47:
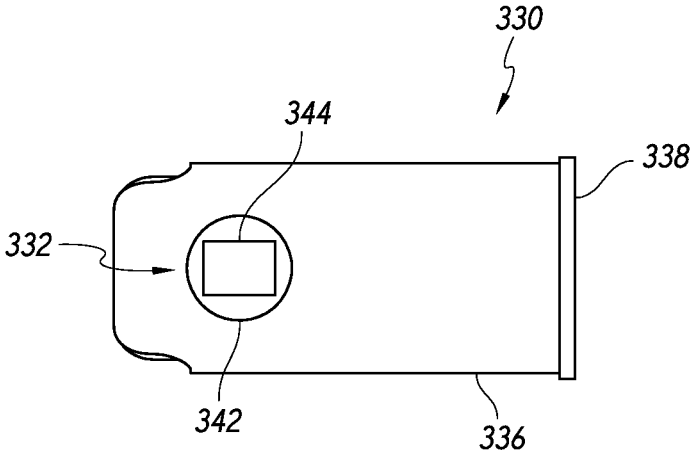
FIG. 47 is an enlarged front view of the reinforced head end piece, the reinforced head end piece having an opening defined in its outer periphery and an opening defined in its reinforced member.
Figure 48:
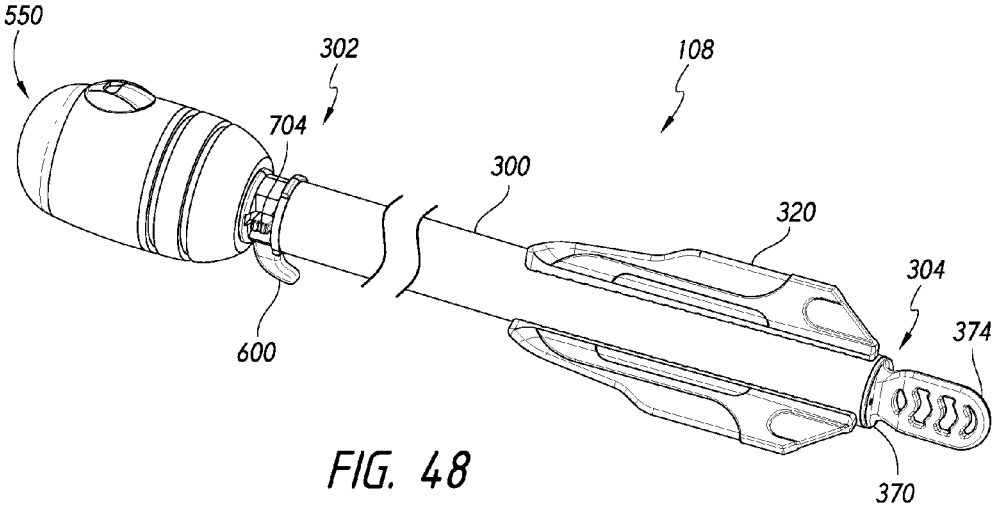
FIG. 48 is a perspective view, taken generally from the side, of a projectile having a tubular shaft, a bounce-back head, one hook, adhered fletching, and an illuminator.
Figure 49:
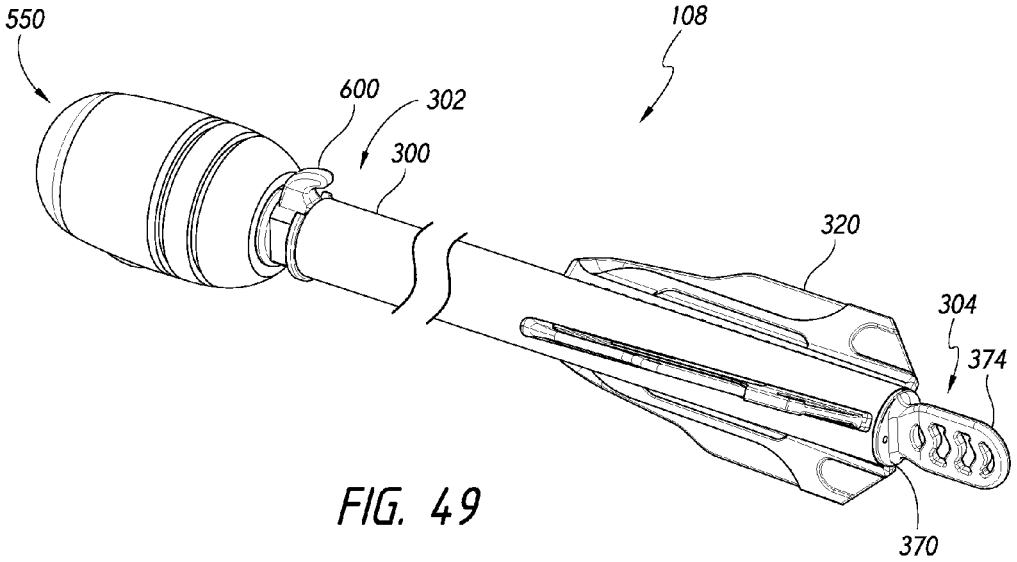
FIG. 49 is a perspective view, taken generally from the front, of the projectile of FIG. 48.
Figure 50:
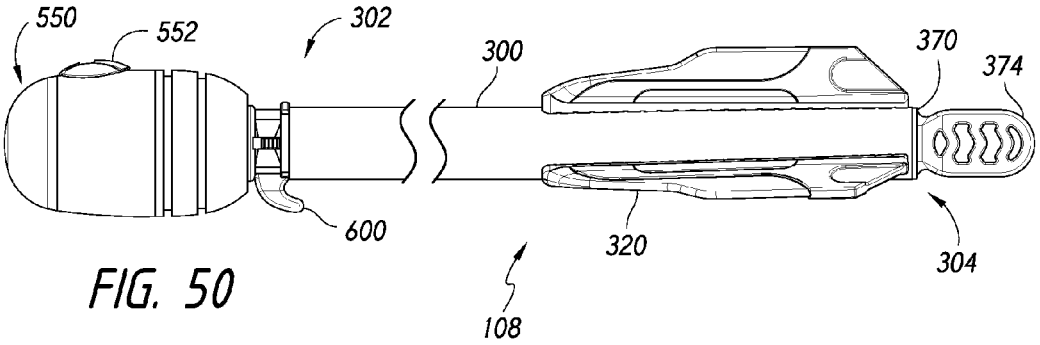
FIG. 50 is one side view of the projectile of FIG. 48.
Figure 51:
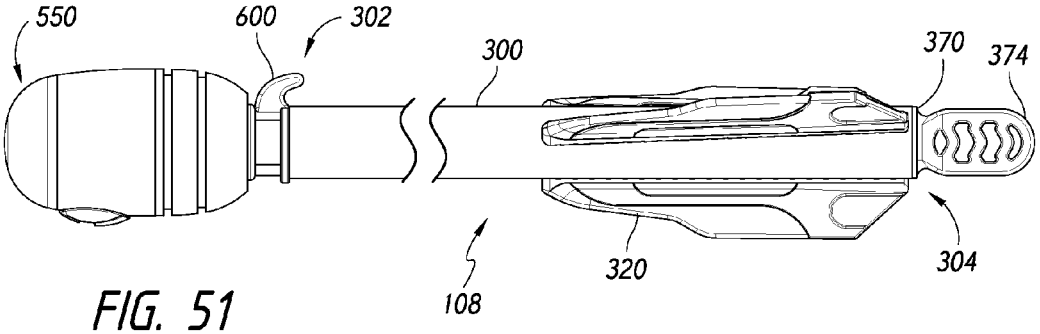
FIG. 51 is an opposite side view of the projectile of FIG. 48.
Figure 52:
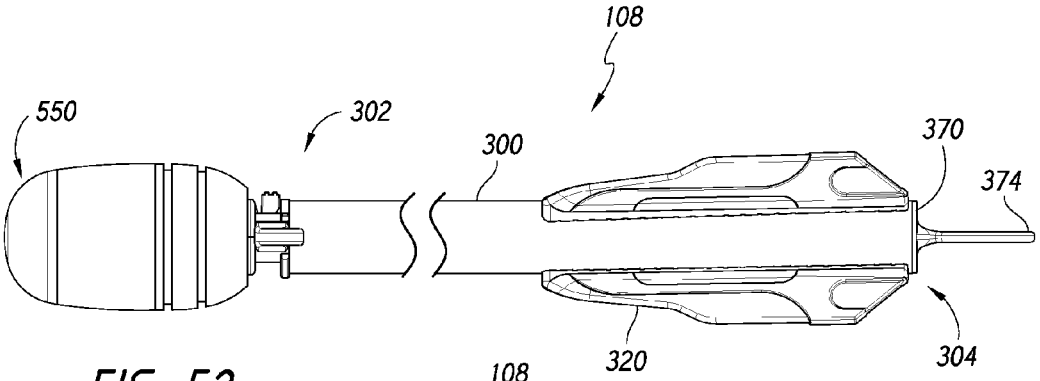
FIG. 52 is a front plan view of the projectile of FIG. 48.
Figure 53:
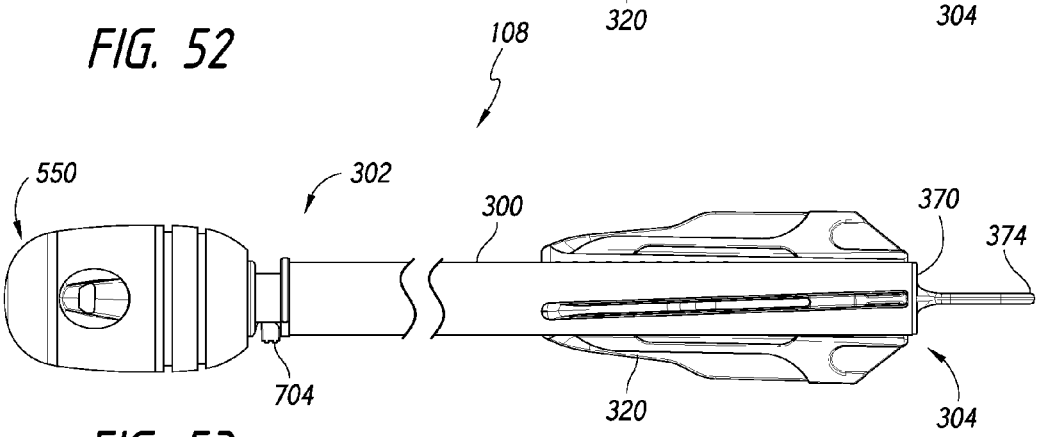
FIG. 53 is a back plan view of the projectile of FIG. 48.
Figure 54:
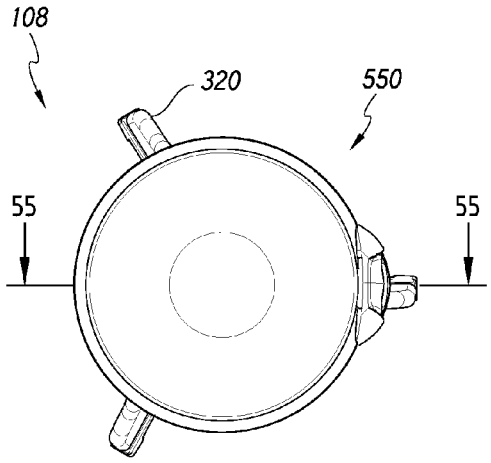
FIG. 54 is a top plan view of the projectile of FIG. 48.
Figure 56:
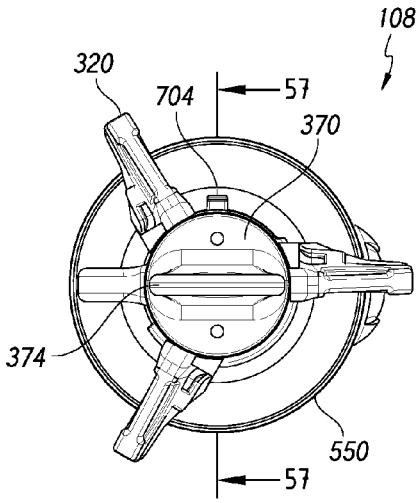
FIG. 56 is a bottom plan view of the projectile of FIG. 48.
Figure 55:
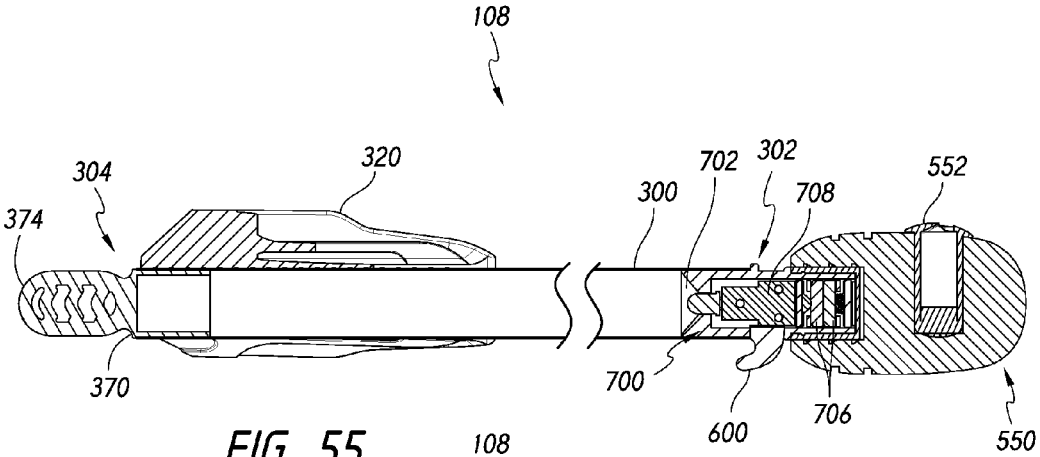
FIG. 55 is a cross-sectional view of the projectile of FIG. 48, taken along line 55-55 of FIG. 54.
Figure 57:
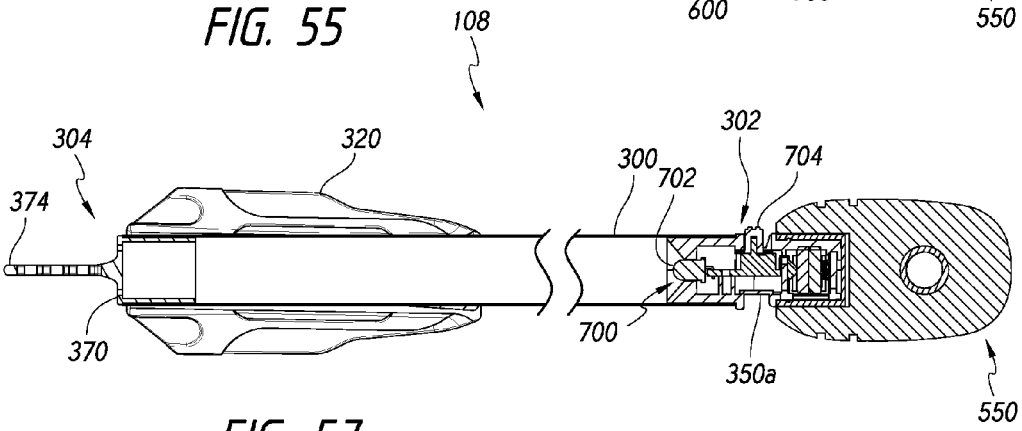
FIG. 57 is a cross-sectional view of the projectile of FIG. 48, taken along line 57-57 of FIG. 56.
Figure 85:
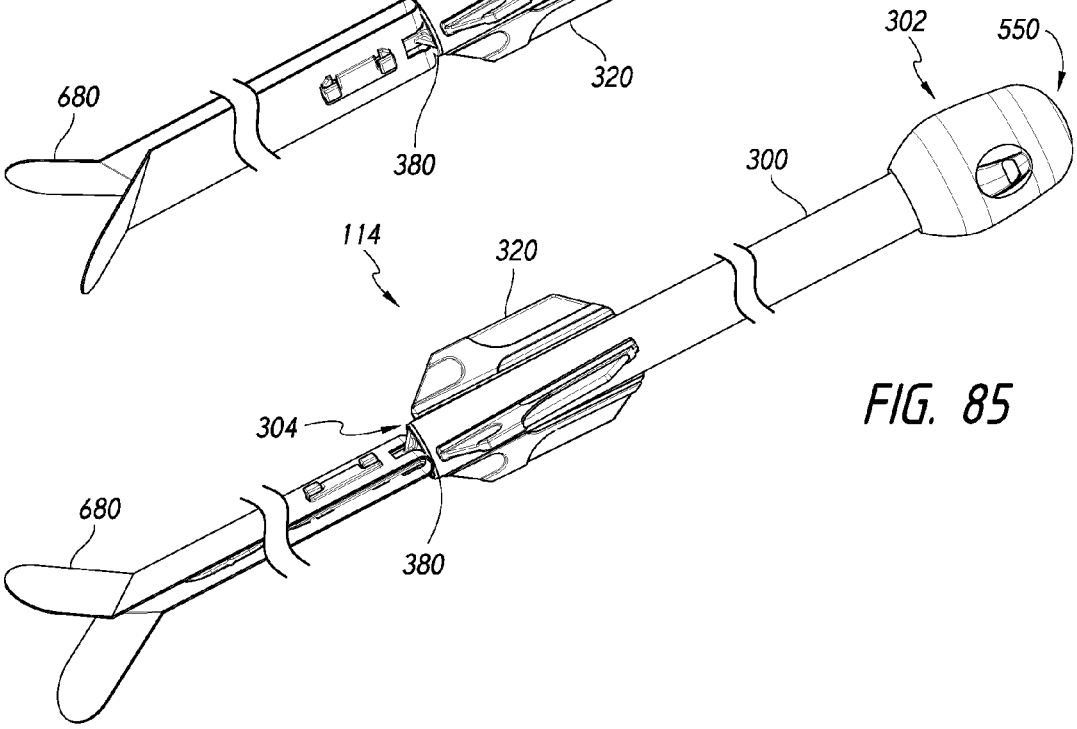
FIG. 85 is a perspective view, taken generally from the back, of the projectile of FIG. 83.
Figure 86:
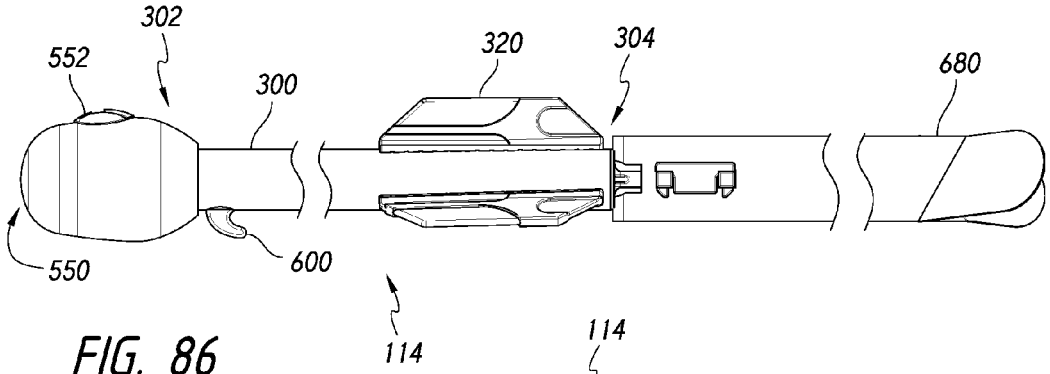
FIG. 86 is one side view of the projectile of FIG. 83.
Figure 87:
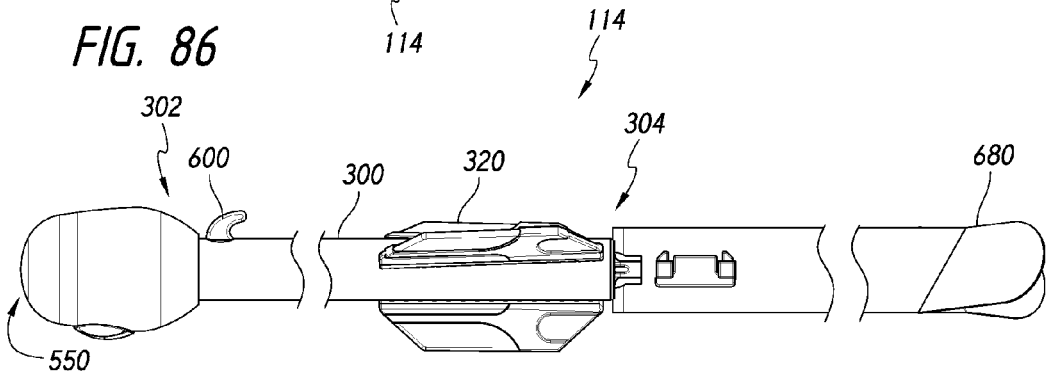
FIG. 87 is the opposite side view of the projectile of FIG. 83.
Figure 88:
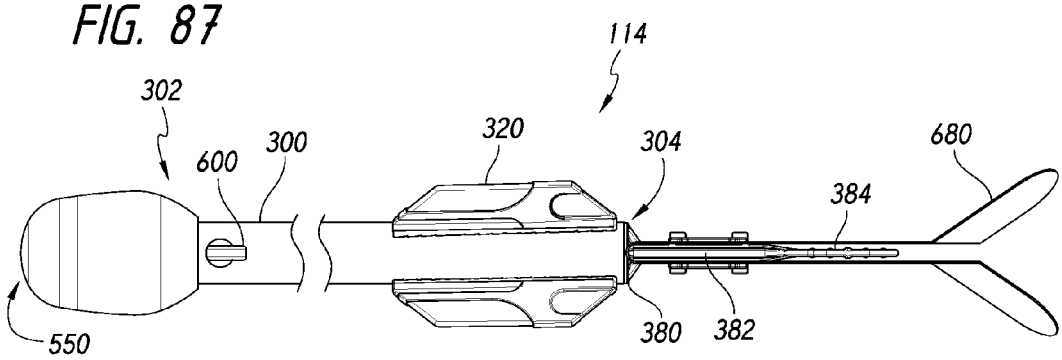
FIG. 88 is a front plan view of the projectile of FIG. 83.
Figure 89:
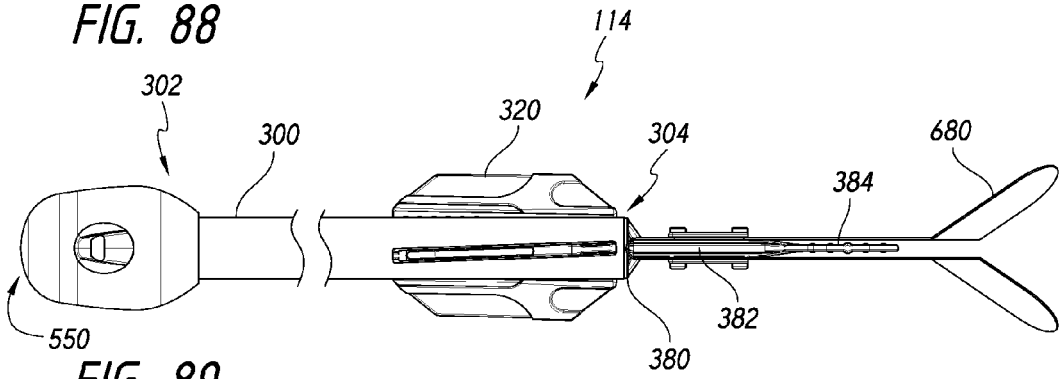
FIG. 89 is a back plan view of the projectile of FIG. 83.
Figure 90:
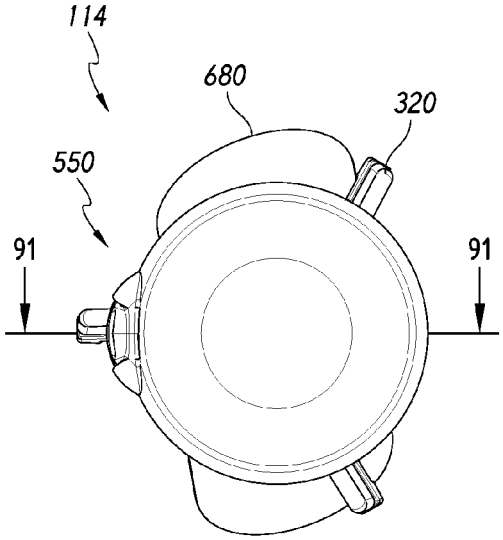
FIG. 90 is a top plan view of the projectile of FIG. 83.
Figure 92:
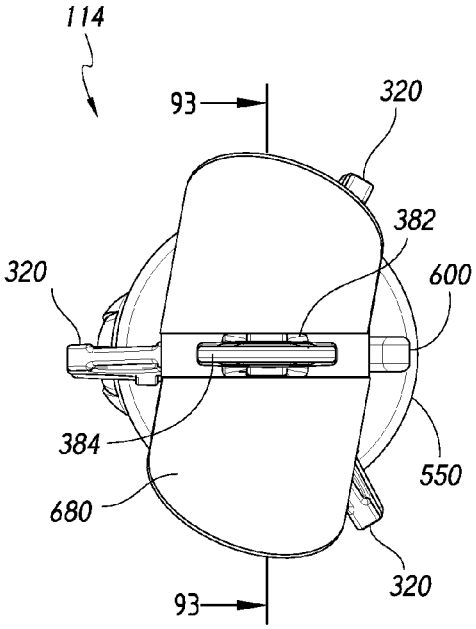
FIG. 92 is a bottom plan view of the projectile of FIG. 83.
Figure 91:
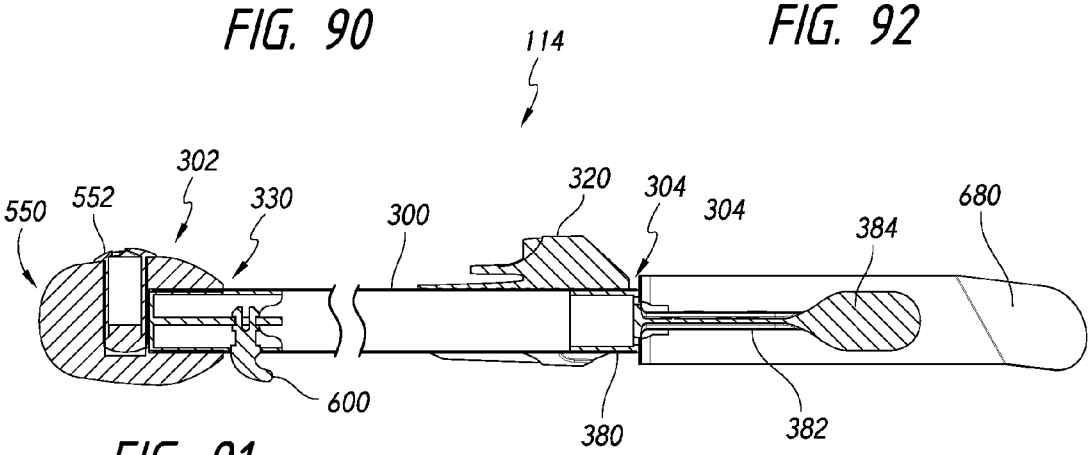
FIG. 91 is a cross-sectional view of the projectile of FIG. 83, taken along line 91-91 of FIG. 90.
Figure 93:
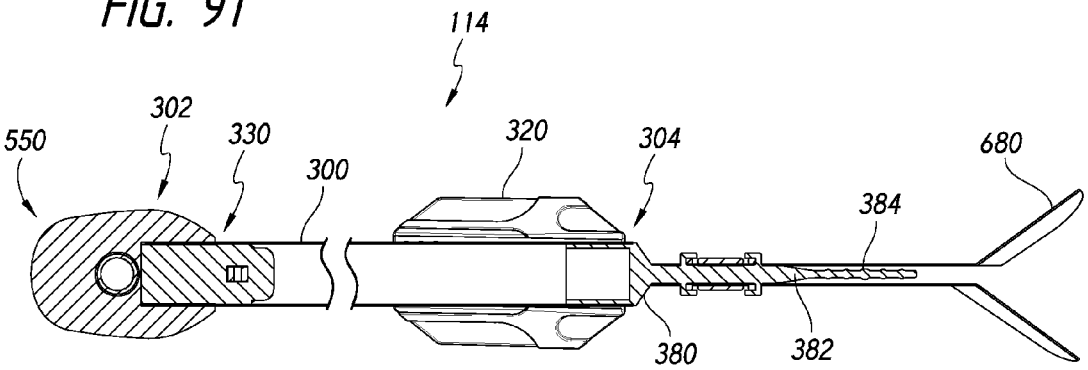
FIG. 93 is a cross-sectional view of the projectile of FIG. 83, taken along line 93-93 of FIG. 92.
Figure 94:
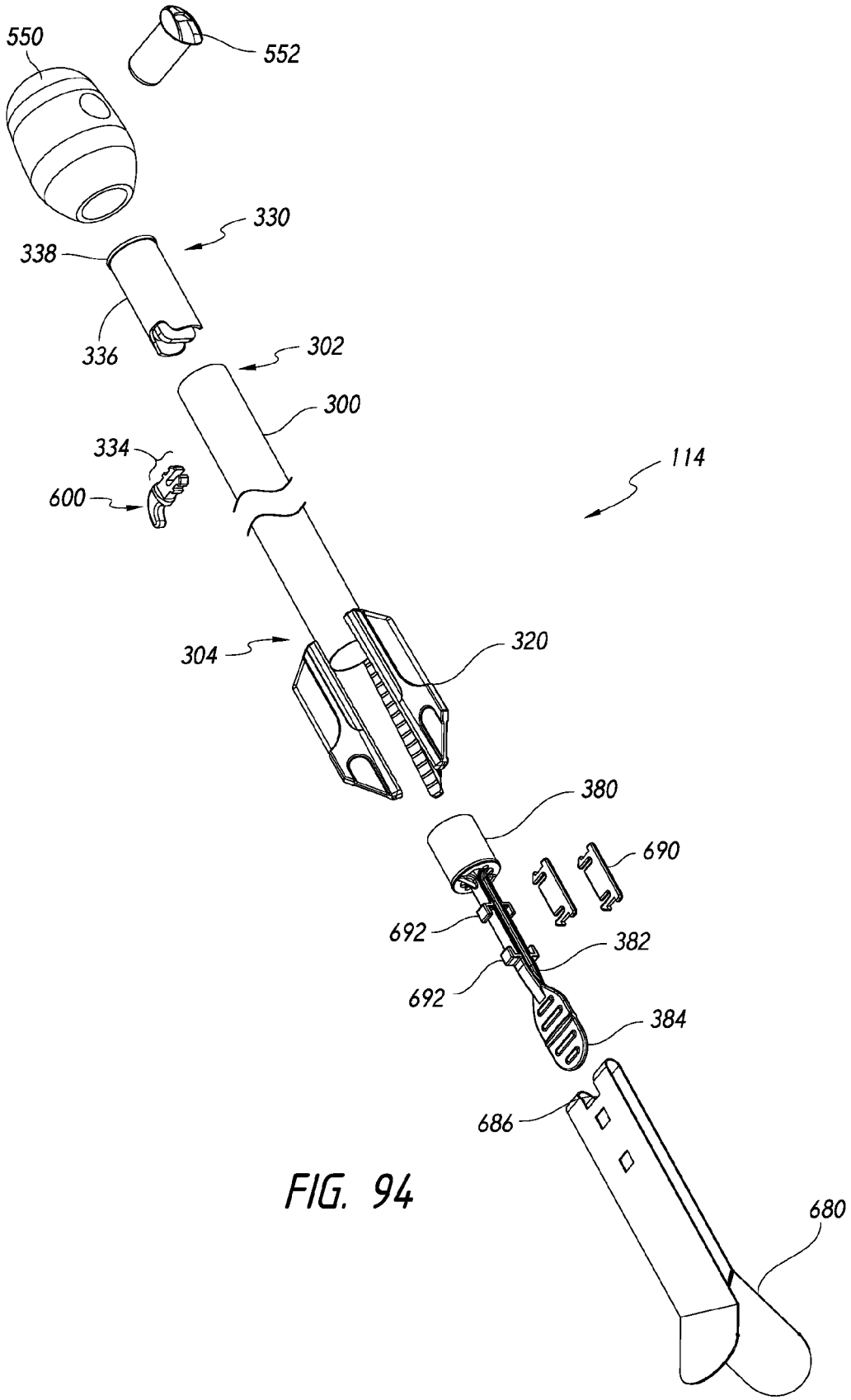
FIG. 94 is an exploded view of the projectile of FIG. 83.

The exemplary tubular shafts 300 shown in FIGS. 33-85 each have a head end 302 and a tail end 304. A projectile head is associated with the head end 302 and tail features are associated with (including nearby) the tail end 304. The tubular shaft 302 of FIGS. 33-47 has a bounce-back head at the head end 302, a launcher engager (one hook) 600 near the head end 302, and adhered fletching at the tail end 304. The tubular shaft 302 of FIGS. 48-59 has a bounce-back head at the head end 302, a launcher engager (one hook) 600 and an illuminator 700 near the head end 302, and adhered fletching at the tail end 304. The tubular shaft 302 of FIGS. 60-71 has a bounce-back head at the head end 302, a launcher engager (two hooks) 600 and an illuminator 700 near the head end 302, and adhered fletching at the tail end 304. The tubular shaft 302 of FIGS. 83-96 has a bounce-back head at the head end 302, a launcher engager (one hook) 600 near the head end 302, adhered fletching and a copter tail at the tail end 304. Additional tubular shafts are shown and described in U.S. Pat. Design No. D698,872 to Cummings and U.S. Pat. No. 8,012,049 to Walterscheid. All of these configurations with tubular shafts 300 are meant to be exemplary and various features may be replaced with other features described herein.

The shown exemplary tubular shafts 300 include a reinforcement structure at both its head end 302 and its tail end 304. The head reinforcer 330 of FIGS. 33-47 and FIGS. 83-96 also serves as the first part of a two-part locking mechanism 332, 334. The head reinforcer 350 of FIGS. 48-59 and FIGS. 60-71 (shown as head reinforcer **350*a* in FIGS. 48-59 and head reinforcer 350*b* in FIGS. 60-71, but jointly referred to as head reinforcer 350) also serves as illuminator 700. The tail part of a casing for a reinforcer 370 of FIGS. 33-47, FIGS. 48-59, and FIGS. 60-71 also serves as (or has an added) toss lever and/or flexible tab 374 that allows the projectile to be tossed. The tail reinforcer 380 of FIGS. 83-96 also serves as part of and/or a transition to a copter shaft 382. An advantage to using a lightweight tubular shaft along with a head reinforcer 330, 350 and a tail reinforcer 370, 380** is that the total weight is reduced (as compared to a unified tube/reinforcer that spans the length of the tubular shaft).

As set forth, the shown head reinforcer 330 of FIGS. 33-47 and FIGS. 83-96 acts as a reinforcer (to provide structural support) to the head end 302 of the tubular shaft 300 and, in addition, acts as the first part of a two-part locking mechanism 332, 334. The head reinforcer 330 preferably has an outer casing 336 (shown as an at least substantially cylindrical tube). A "lid" 338 (shown as a disc) may close off one end of the outer casing 336. The shown lid 338 has a diameter just longer than the diameter of the outer casing 336 such that the lid 338 produces a small shoulder around the periphery of the outer casing 336. This shoulder prevents the tubular shaft 300 from "creeping" past the outer casing 336 as the projectile has repeated impacts. A "strengthener" 340 (shown as being substantially rectangular) preferably is positioned along the middle longitudinal axis of the outer casing 336 such that the strengthener 340 longitudinally bisects the head reinforcer 330. The strengthener 340 provides both structure and strength to the head reinforcer 330. The outer casing 336 has an aperture 342 (shown as a substantially circular aperture) defined along its outer periphery and the strengthener 340 has an aperture 344 (shown as a substantially rectangular aperture) defined therein. It is these apertures 342, 344 (and, in particular, strengthener aperture 344) that act as the first part of the two-part locking mechanism 332. The second part of the two-part locking mechanism 334 is shown as part of the launcher engager (single hook 600) and, more specifically, the second part of the two-part locking mechanism 334 is shown as a plurality of fingers divided by a gap that extends at least partially along its length. The fingers together have at least one enlarged barb (shown as three-dimensional detail on at least part of the periphery of the fingers). There is a shoulder on at least part of the outer periphery (not within the gap) that separates the enlarged barb from the remainder of the fingers. In use, the head reinforcer 330 is inserted into the head end 302 of the tubular shaft 300 such that the apertures 342, 344 align with an aperture 346 (shown as circular) in the outer periphery of the head end 302 of the tubular shaft 300. Then, the second part of the two-part locking mechanism 334 is inserted through the shaft aperture 346 and into the first part of the two-part locking mechanism 332 (apertures 342, 344). As the enlarged barbs are inserted through the apertures 342, 344, 346 (and, in particular, the strengthener aperture 344), the enlarged barbs compress inwardly, narrowing the gap. Once through the strengthener aperture 344, the gap widens and pushes the enlarged barbs outwardly so that the shoulder interacts with (engages) the outer periphery of the strengthener aperture 344. This structure keeps the launcher engager (single hook) 600, the head end 302 of the tubular shaft 300, and the head reinforcer 330 in the proper position relative to each other without the need for adhesives or additional structure.

As set forth, the shown head reinforcer **350*a* in FIGS. 48-59 and head reinforcer 350*b* in FIGS. 60-71 (jointly referred to as head reinforcer 350) act as reinforcers (to provide structural support) to the head end 302 of the tubular shaft 300 and, in addition, act as part of a casing for an illuminator 700 and will be discussed in connection with the illuminator 700**.

Figure 58:
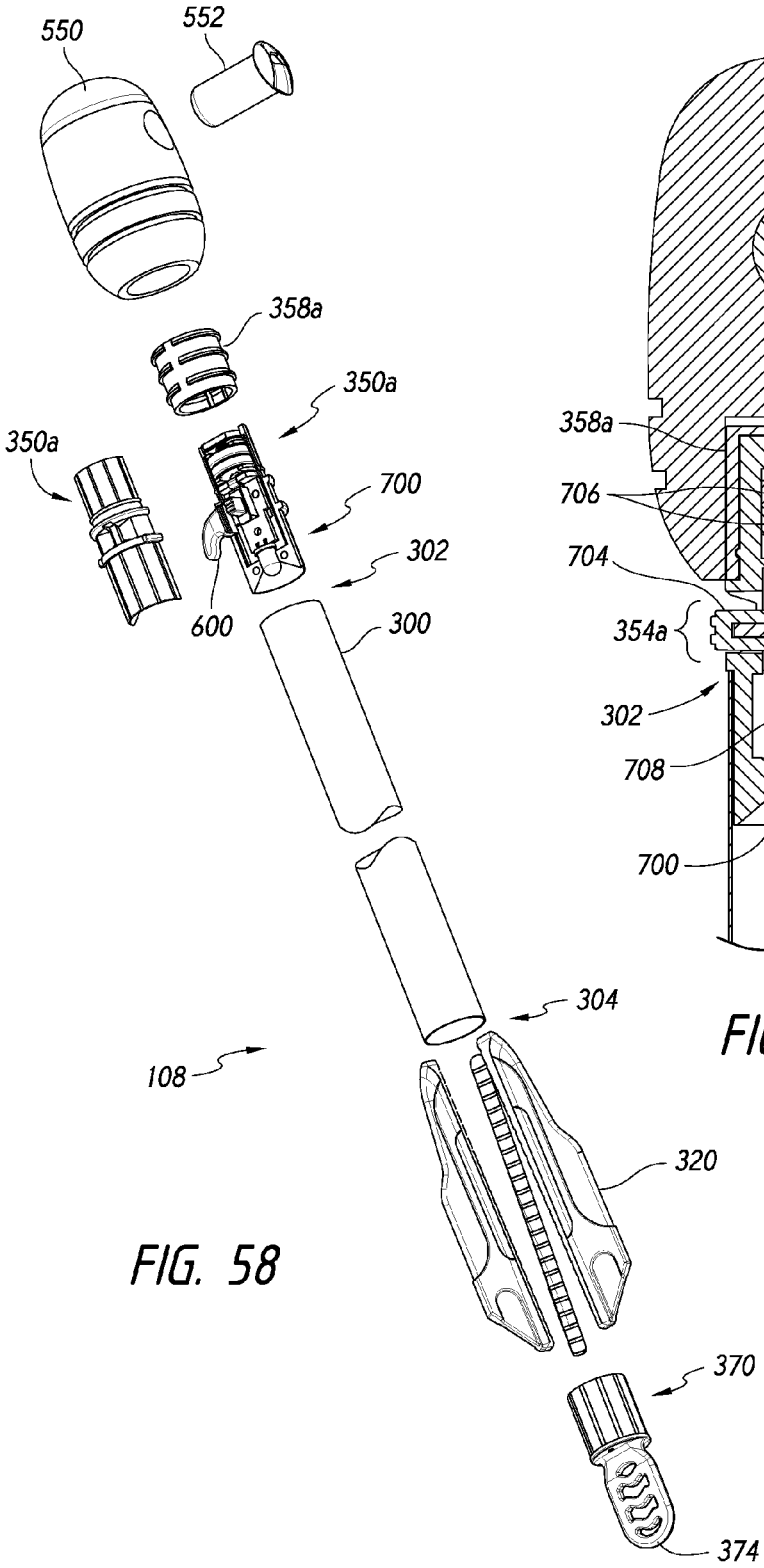
FIG. 58 is an exploded view of the projectile of FIG. 48.
Figure 59:
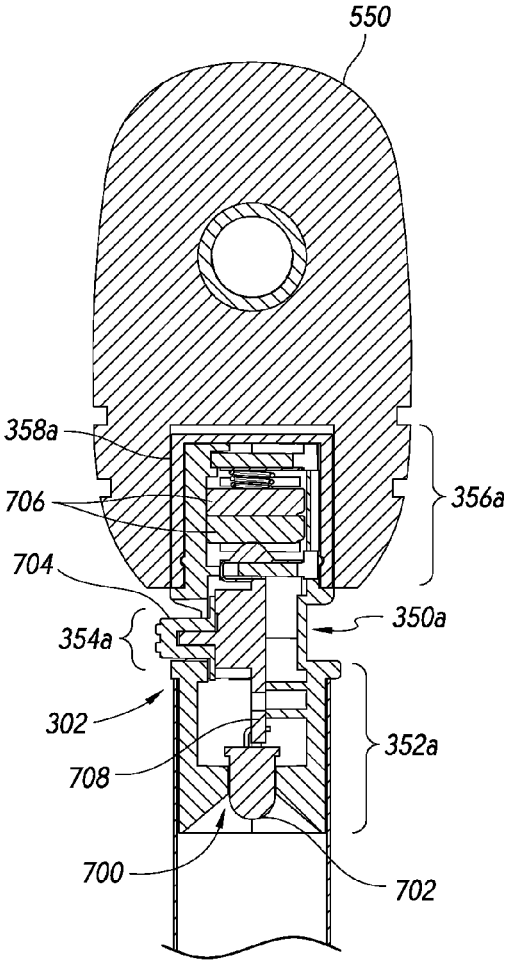
FIG. 59 is an enlarged cross-sectional view of the head end of the projectile of FIG. 48, and detailing exemplary electronics associated with the illuminator.
Figure 60:
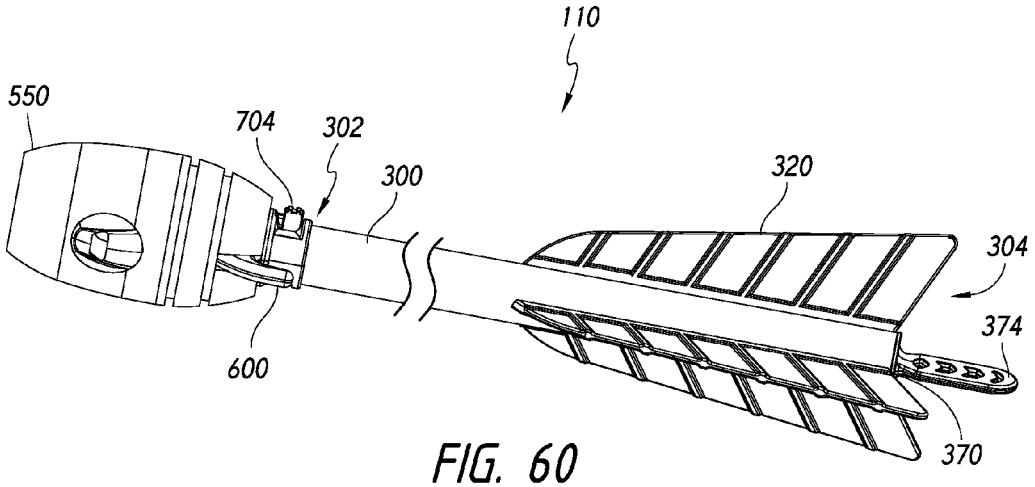
FIG. 60 is a perspective view, taken generally from the side, of a projectile having a tubular shaft, a bounce-back head, two hooks, adhered fletching, and an illuminator.
Figure 61:
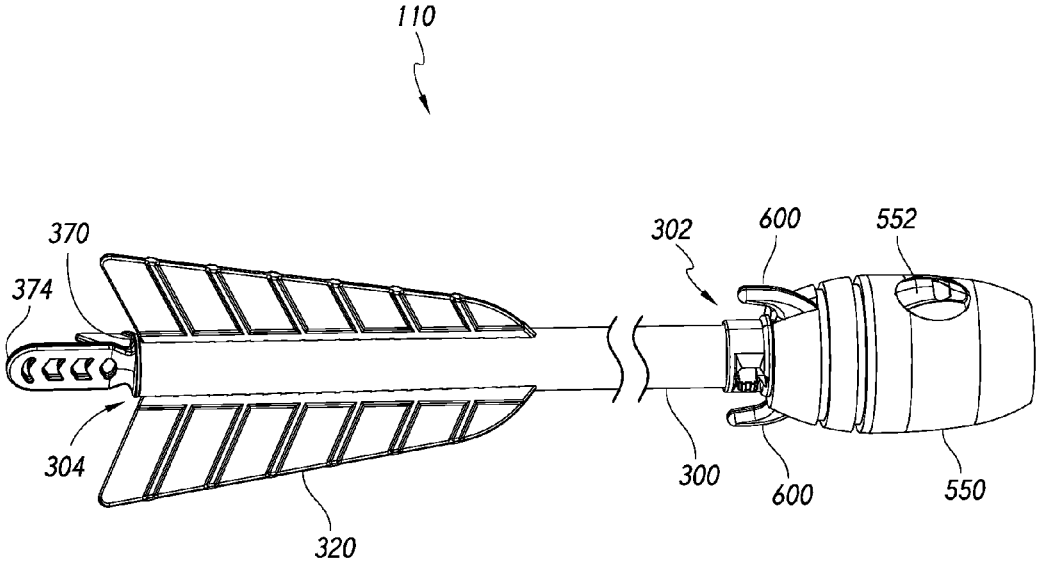
FIG. 61 is a perspective view, taken generally from the front, of the projectile of FIG. 60.
Figure 62:
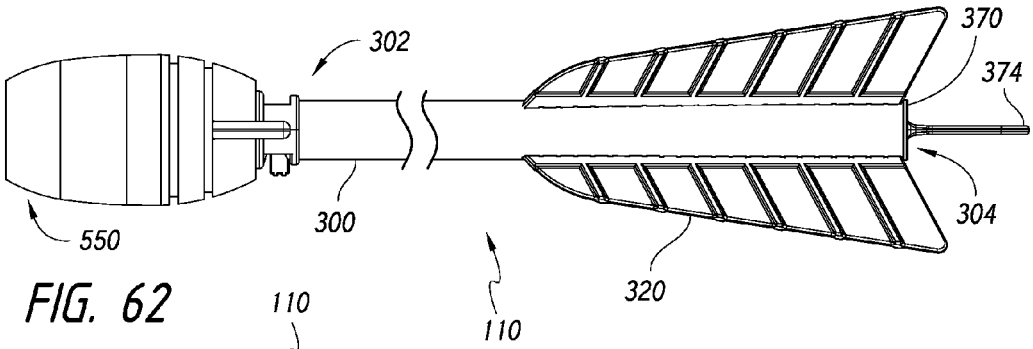
FIG. 62 is one side view of the projectile of FIG. 60.
Figure 63:
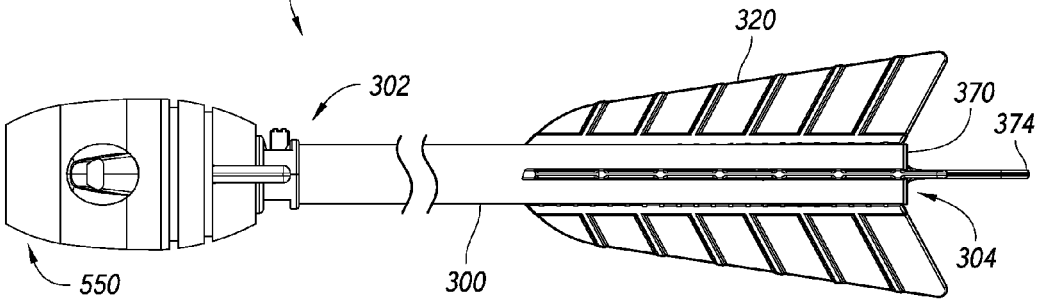
FIG. 63 is an opposite side view of the projectile of FIG. 60.
Figure 64:
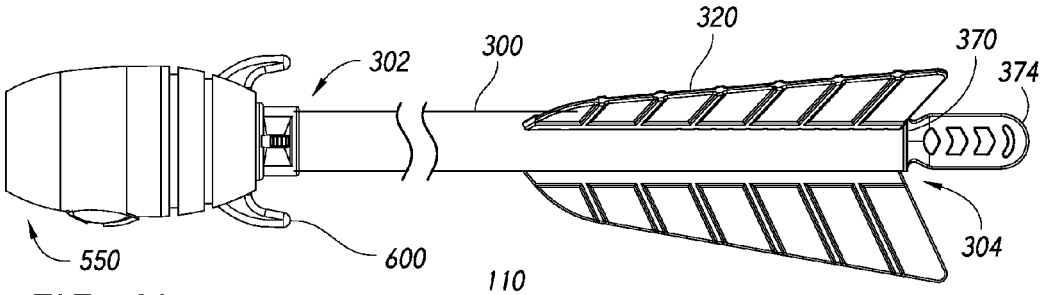
FIG. 64 is a front plan view of the projectile of FIG. 60.
Figure 65:
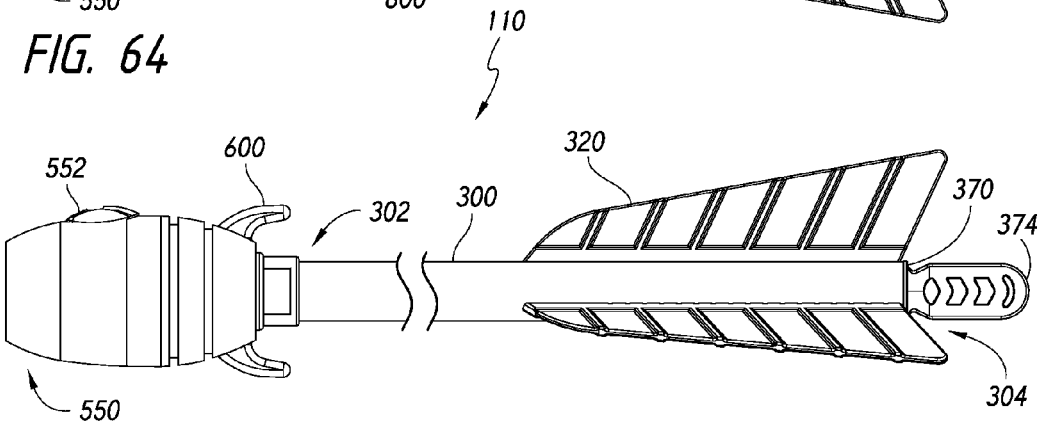
FIG. 65 is a back plan view of the projectile of FIG. 60.
Figure 66:
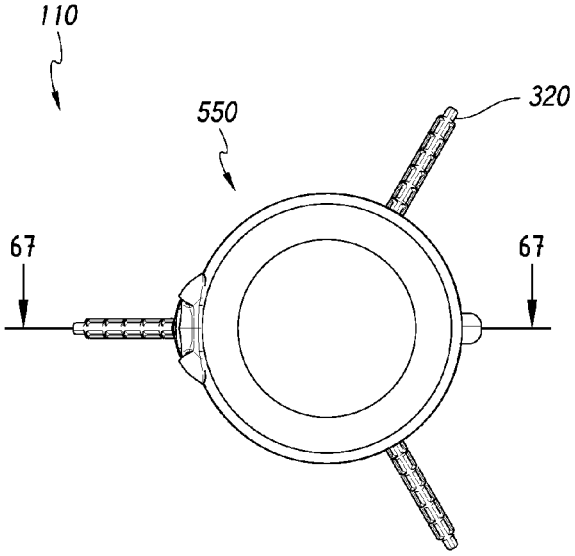
FIG. 66 is a top plan view of the projectile of FIG. 60.
Figure 68:
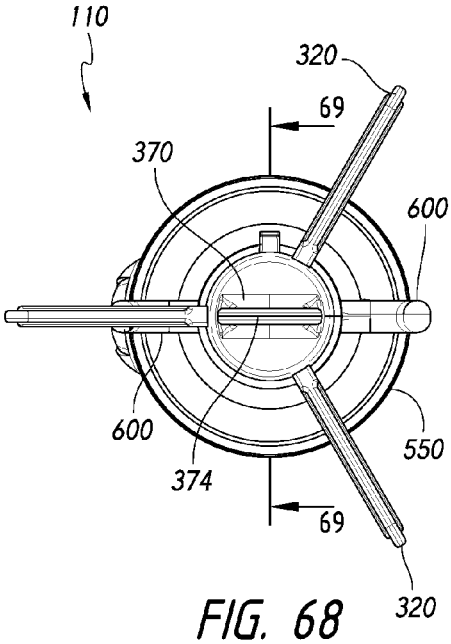
FIG. 68 is a bottom plan view of the projectile of FIG. 60.
Figure 67:
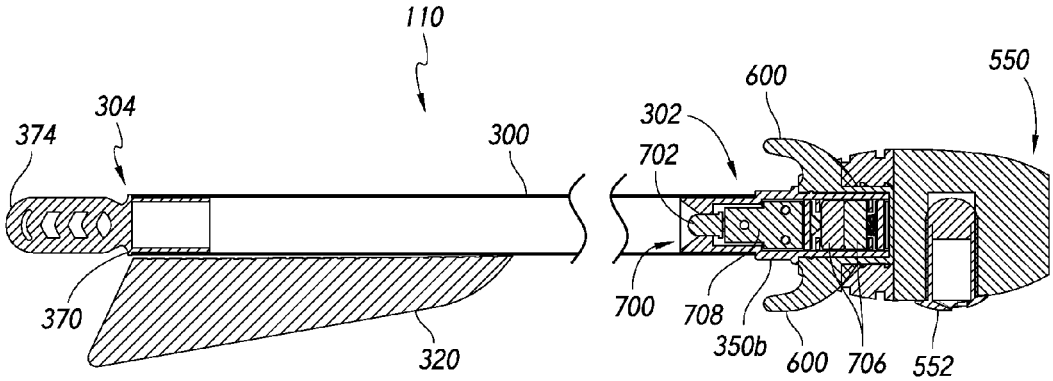
FIG. 67 is a cross-sectional view of the projectile of FIG. 60, taken along line 67-67 of FIG. 66.
Figure 69:
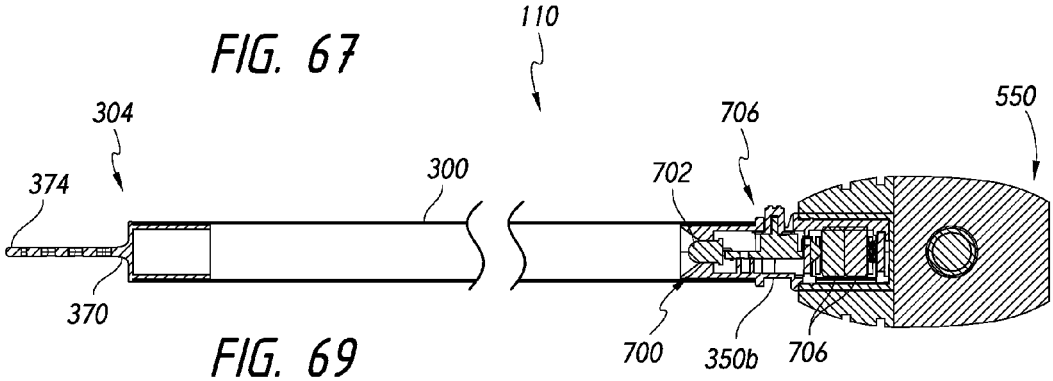
FIG. 69 is a cross-sectional view of the projectile of FIG. 60, taken along line 69-69 of FIG. 68.

Turning to the head reinforcer **350*a* shown in FIGS. 48-59, the reinforcer 350*a* may be a two-piece generally tubular (when assembled) multi-purpose part that has a shaft portion 352*a*, a middle portion 354*a*, and a head portion 356*a* (shown, for example, in FIGS. 58-59). When the projectile is assembled, the exterior surface of the shaft portion 352*a* is associated with the shaft 300 and an illuminator 700 is positioned inside the shaft portion 352*a* such that the source of illumination 702 points into the shaft 300. When the projectile is assembled, the middle portion 354*a* is associated with a launcher engager 600 and an illuminator switch activator 704. When the projectile is assembled, the exterior surface of the head portion 356*a* is associated with a head 550 and a power source 706 is positioned within the head portion 356*a*. A cap 358*a* may be positioned between the head 550 and the head portion 356*a* of the head reinforcer 350*a*. There may also be walls or fingers within the head portion 356*a* to cushion the source of illumination 702, the illuminator switch activator 704, the power source 706, and other internal components. For example, the power source 706 may be in its own compartment within the head portion 356***a*, divided from the other components by a wall and further held in place by projecting fingers.

Figure 70:
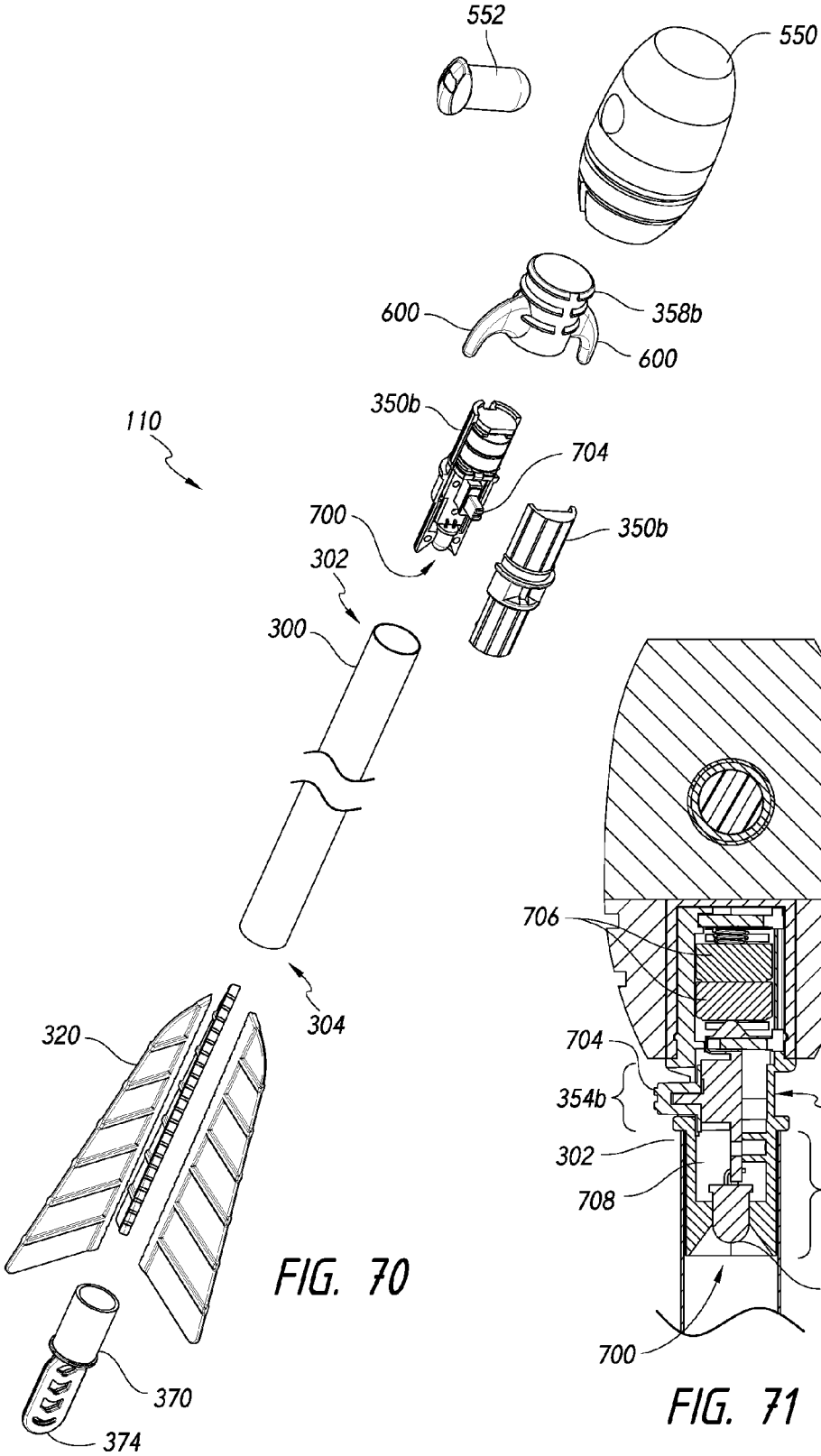
FIG. 70 is an exploded view of the projectile of FIG. 60.
Figure 71:
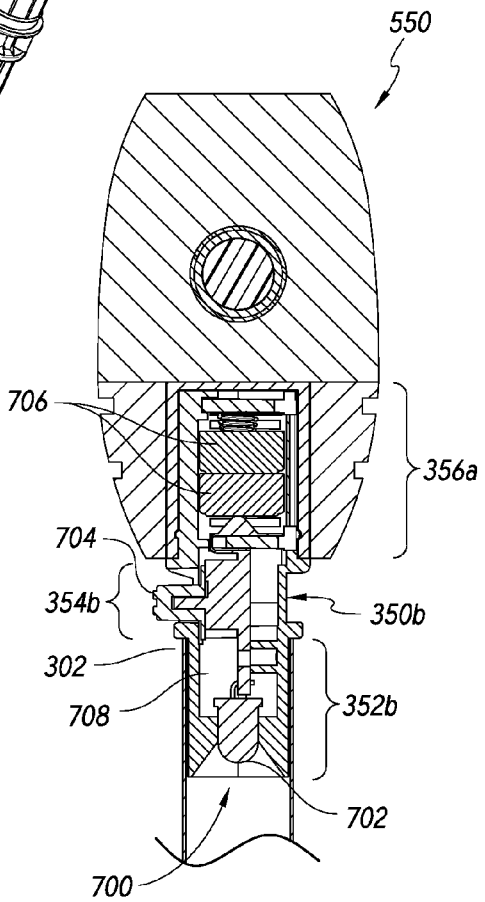
FIG. 71 is an enlarged cross-sectional view of the head end of the projectile of FIG. 60, and detailing exemplary electronics associated with the illuminator.
Figure 72:
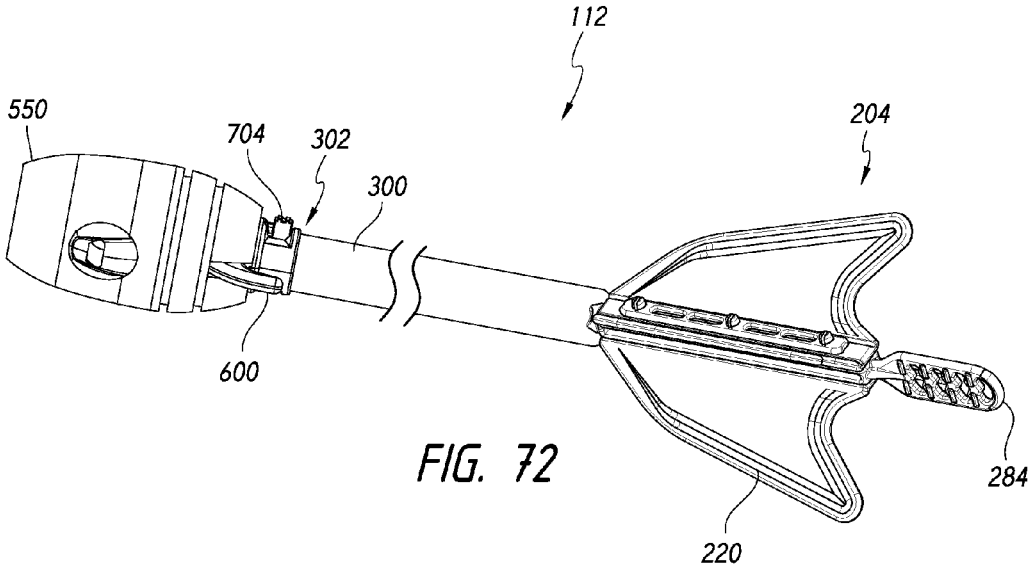
FIG. 72 is a perspective view, taken generally from the side, of a projectile having a hybrid (both a tubular shaft and a rod shaft) shaft, a bounce-back head, two hooks, a cap, mechanically attached fletching, and an illuminator.
Figure 73:
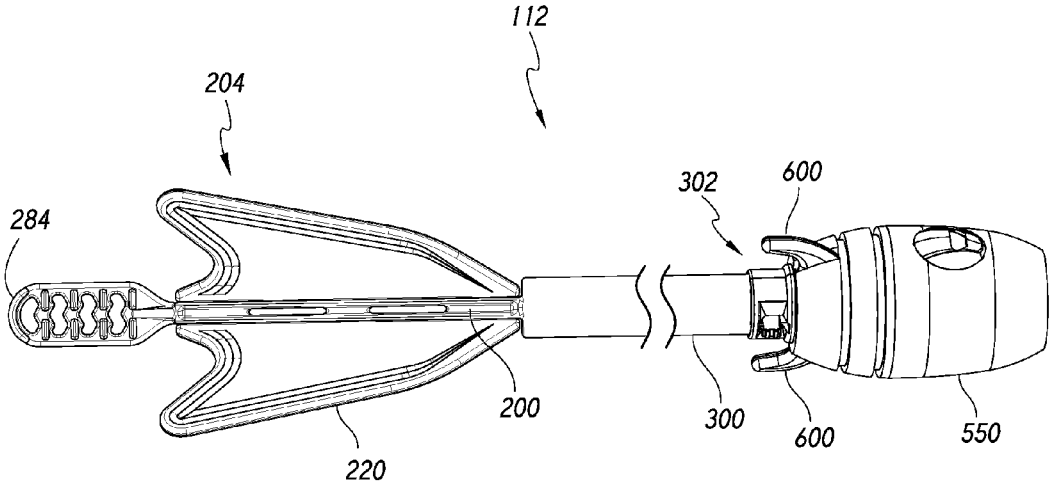
FIG. 73 is a perspective view, taken generally from the front, of the projectile of FIG. 72.
Figure 74:
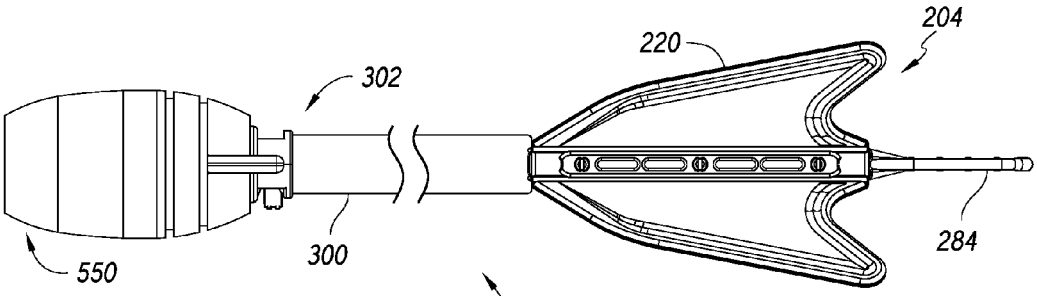
FIG. 74 is one side view of the projectile of FIG. 72.
Figure 75:
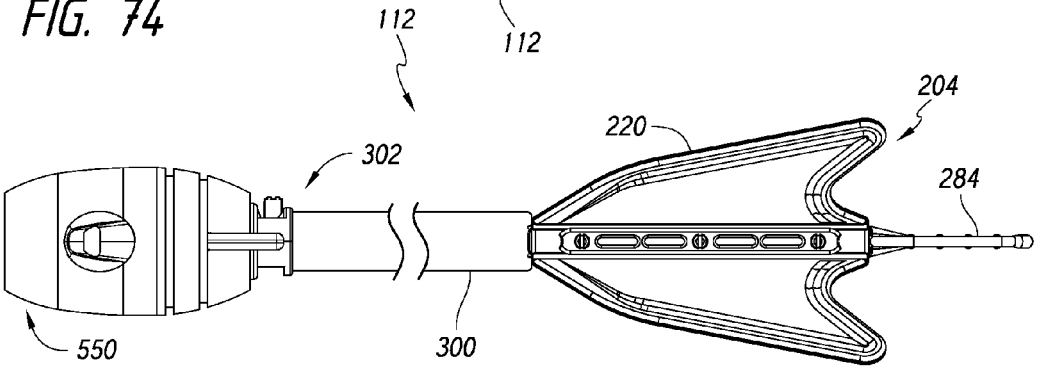
FIG. 75 is the opposite side view of the projectile of FIG. 72.
Figure 76:
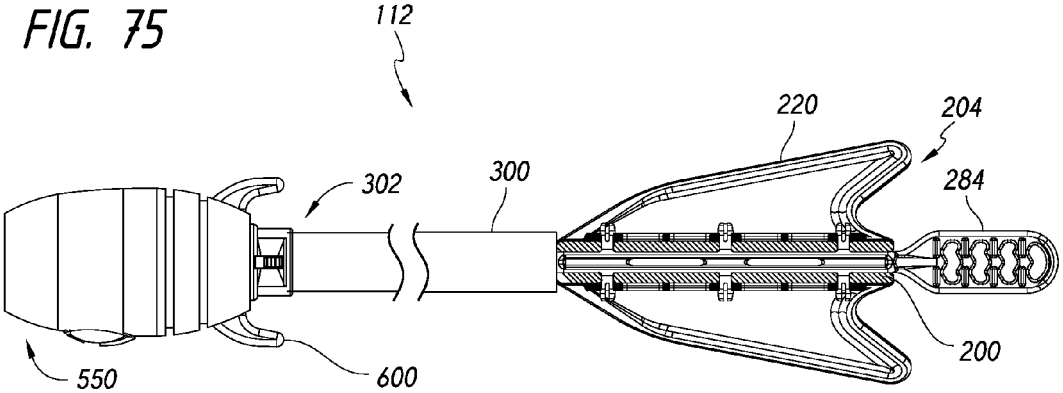
FIG. 76 is a front plan view of the projectile of FIG. 72.
Figure 77:
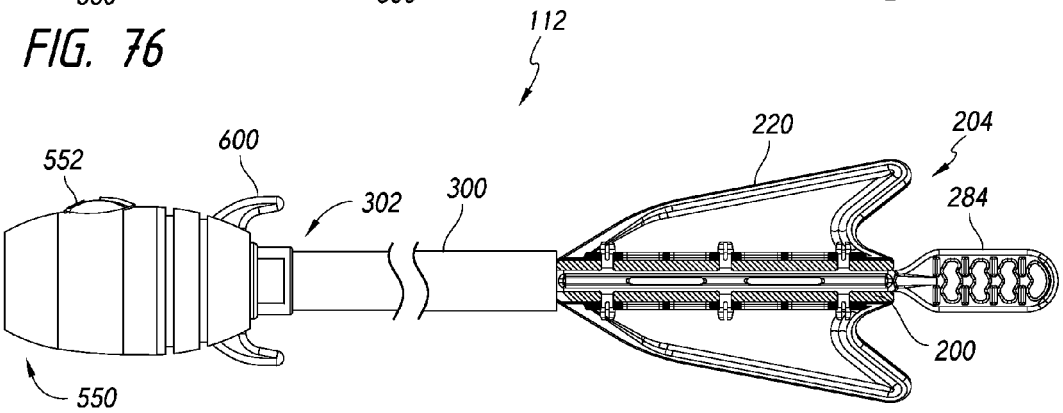
FIG. 77 is a back plan view of the projectile of FIG. 72.
Figure 78:
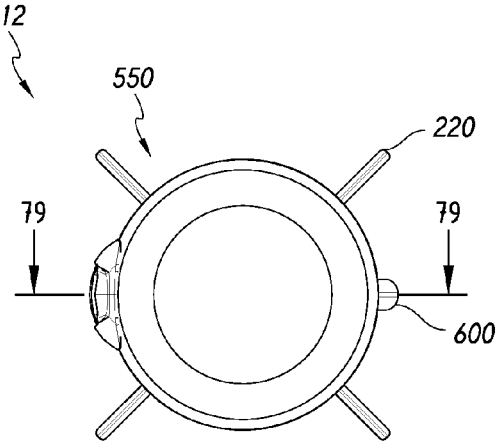
FIG. 78 is a top plan view of the projectile of FIG. 72.
Figure 80:
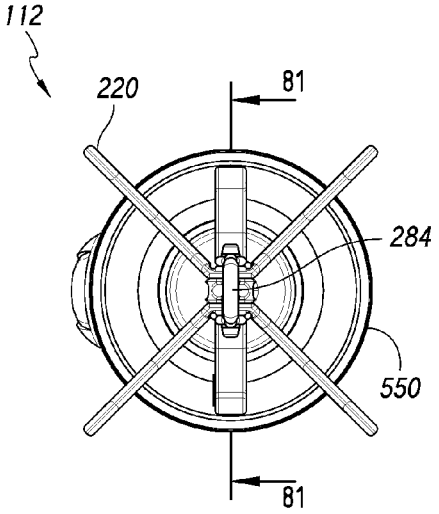
FIG. 80 is a bottom plan view of the projectile of FIG. 72.
Figure 79:
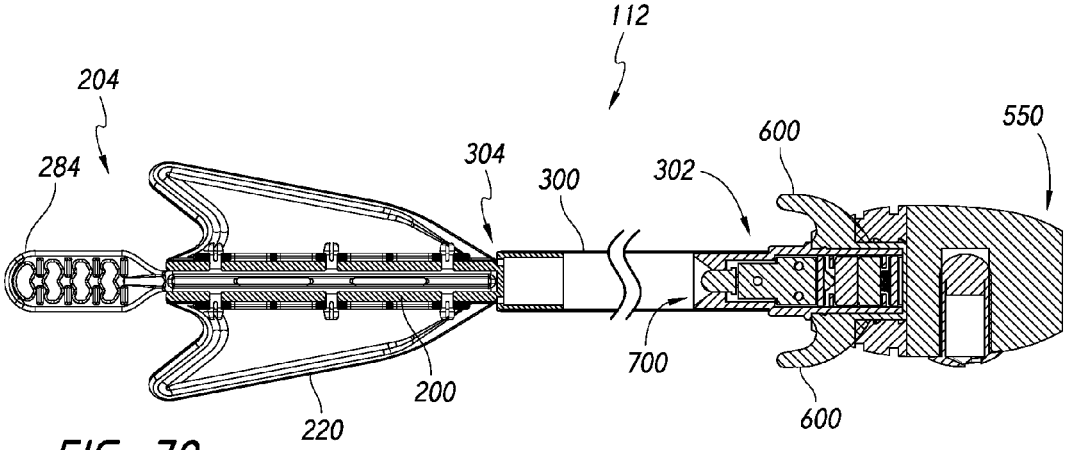
FIG. 79 is a cross-sectional view of the projectile of FIG. 72, taken along line 79-79 of FIG. 78.
Figure 81:
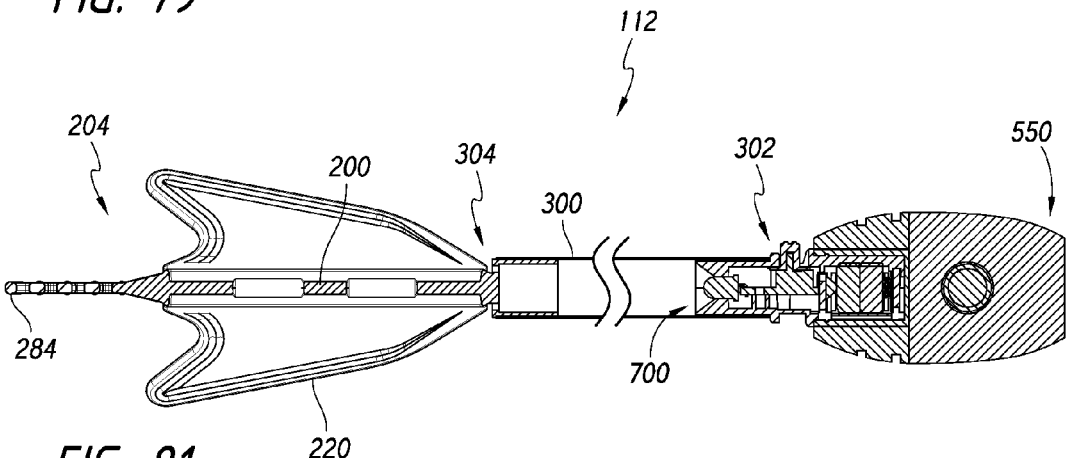
FIG. 81 is a cross-sectional view of the projectile of FIG. 72, taken along line 81-81 of FIG. 80.
Figure 82:
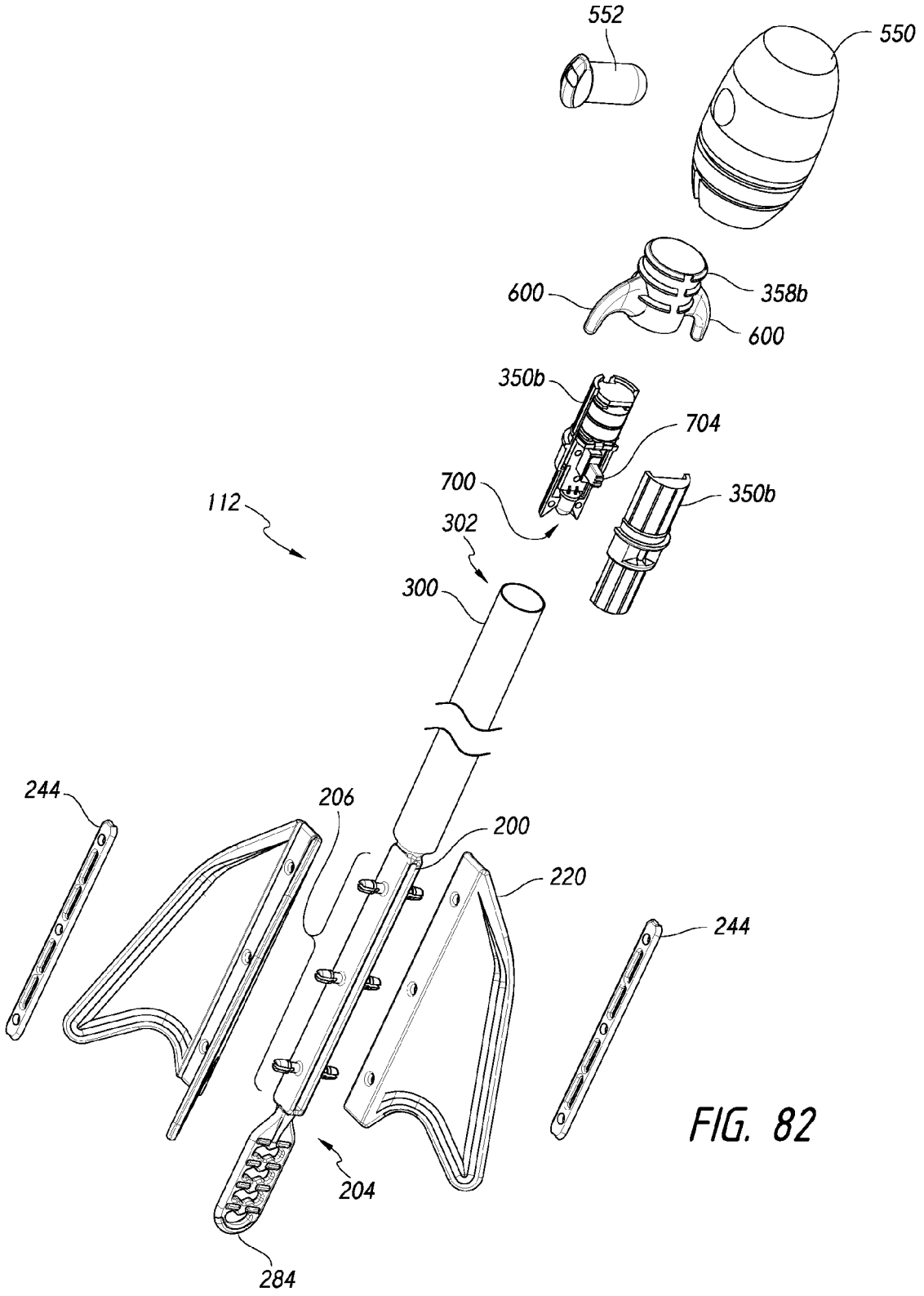
FIG. 82 is an exploded view of the projectile of FIG. 72.
Figure 83:
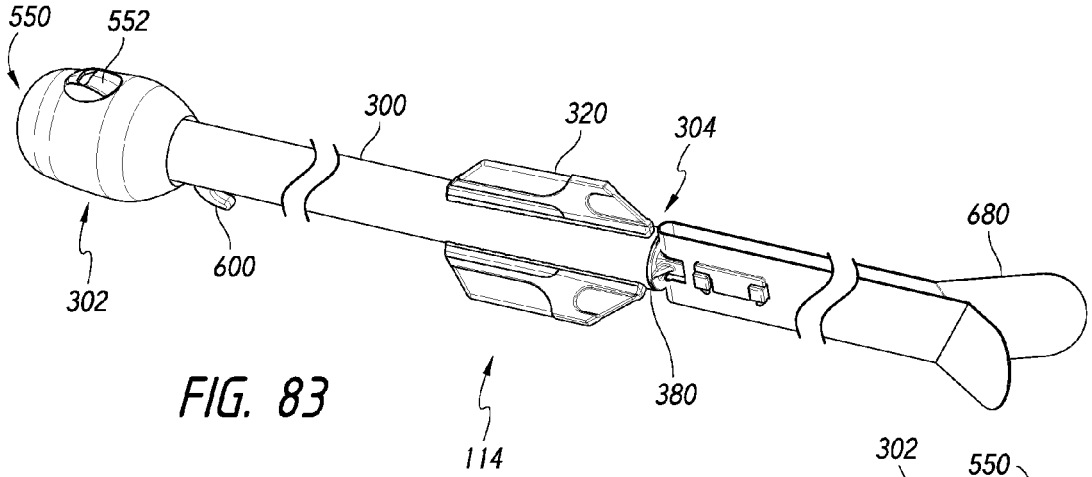
FIG. 83 is a perspective view, taken generally from the side, of a projectile having a tubular shaft, a bounce-back head, one hook, adhered fletching, and a copter tail, the copter tail being in a closed position.
Figure 84:
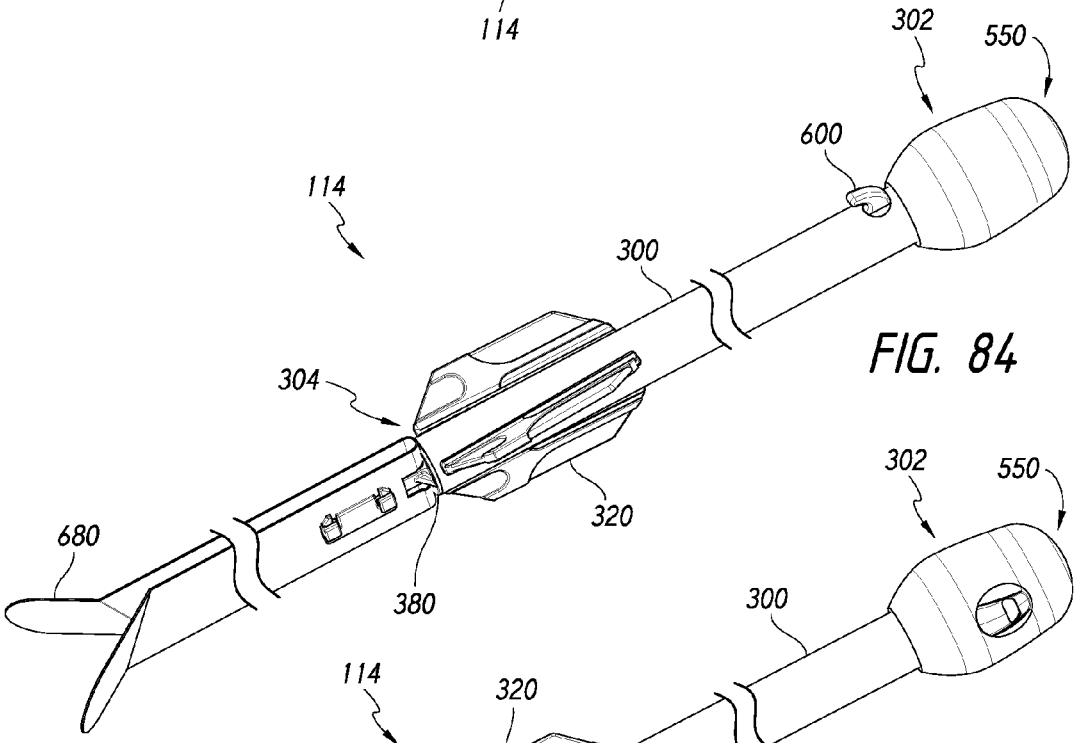
FIG. 84 is a perspective view, taken generally from the front, of the projectile of FIG. 83.

Turning to the head reinforcer 350*b* shown in FIGS. 60-71, the reinforcer 350*b* may be a two-piece generally tubular (when assembled) multi-purpose part that has a shaft portion 352*b*, a middle portion 354*b*, and a head portion 356*b* (shown best in FIGS. 70-71). The shown shaft portion 352*b* is narrower than the shown head portion 356*b* to facilitate a narrower shaft 300. When the projectile is assembled, the exterior surface of the shaft portion 352*b* is associated with the shaft 300 and an illuminator 700 is positioned inside the shaft portion 352*b* such that the source of illumination 702 points into the shaft 300. When the projectile is assembled, middle portion 354*b* has an illuminator switch activator 704. Unlike the middle portion 354*a* that has an associated launcher engager 600, the head reinforcer 350*b* does not have an associated launcher engager 600. Instead, the launcher engager 600 of the projectile shown in FIGS. 60-71 is associated with a cap 358*b*. When the projectile is assembled, the exterior surface of the head portion 356*b* is associated with a head 550 and a power source 706 is positioned within the head portion 356*b*. The cap 358*b* (with the associated launcher engager 600) may be positioned between the head and the head portion 356*b* of the head reinforcer 350*b*. There may also be walls or fingers within the head portion 356*b* to cushion the source of illumination 702, the illuminator switch activator 704, the power source 706, and other internal components. For example, the power source 706 may be in its own compartment within the head portion 356*b*, divided from the other components by a wall and further held in place by projecting fingers.

As set forth, the shown tail reinforcer 370 of FIGS. 33-47, FIGS. 48-59, and FIGS. 60-71 acts as a reinforcer (to provide structural support) to the tail end 304 of the tubular shaft 300. The tail reinforcer 370 may also include or be associated with a toss lever and/or flexible tab 374 that allows the projectile to be tossed. The shown tail reinforcer 370 is a generally tubular outer casing with a lid. The outer casing may have a textured or ribbed exterior surface that facilitates bonding (with adhesives or glue) with the smooth interior surface of the tubular shaft 300. The shown lid has a diameter just longer than the diameter of the outer casing such that the lid produces a small shoulder around the periphery of the outer casing. The diameter of the lid and the diameter of the exterior surface of the tubular shaft 300 are preferably the same such that the lid does not extend past the tubular shaft 300. U.S. Pat. Design No. D698,872 to Cummings and U.S. Pat. No. 8,012,049 to Walterscheid provide additional information pertaining to the toss lever and/or flexible tab 374.

As set forth, the tail reinforcer 380 of FIGS. 83-96 acts as a reinforcer (to provide structural support) to the tail end 304 of the tubular shaft 300 and, in addition, acts as part of and/or a transition to a copter shaft 382. The copter shaft 382 may also have a flexible tab 384 similar to the flexible tab 374 of FIGS. 33-47, FIGS. 48-59, and FIGS. 60-71.

FIGS. 72-82 show a hybrid of two types of shafts: the rod shaft 200 and the tubular shaft 300. As shown, the part of the overall length of the shafted projectile towards the projectile head is a tubular shaft 300 and the part of the overall length of the shafted projectile towards the tail end is a rod shaft 200. A bounce-back head 550 is shown at the head end 302, but other projectile heads (e.g. suction heads 500 or a "football" head 570) could be used. The rod shaft 200 substantially forms the tail end portion 206 (although alternative tail end portions 208, 210, 212 could be used) with mechanically attached fletching 220. The specifics and advantages of combining the rod shaft 200 and tubular shaft 300 are discussed herein in detail. It should be noted, however, that the use of a rod shaft 200 as the tail end makes mechanical attachment of the fletching 220 and mechanical attachment, among other advantages, significantly simplifies the assembly process.

Figure 109:
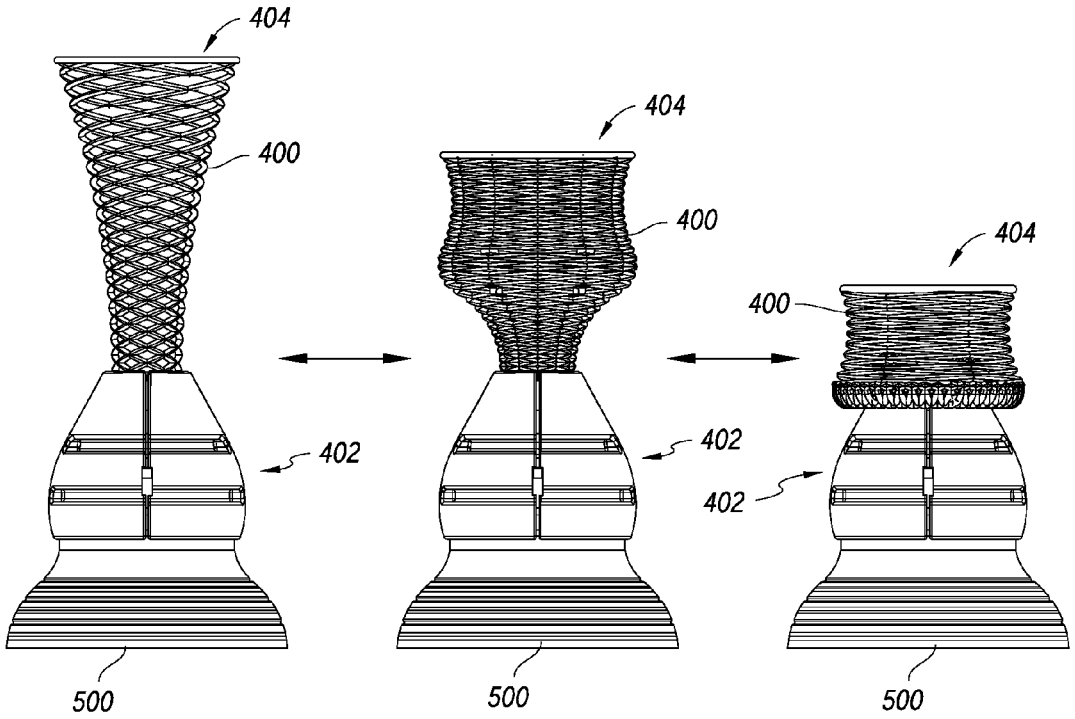
FIG. 109 is a series of front views of the projectile of FIG. 97 transitioning between the expanded state, a midway state, and the collapsed state.
Figure 110:
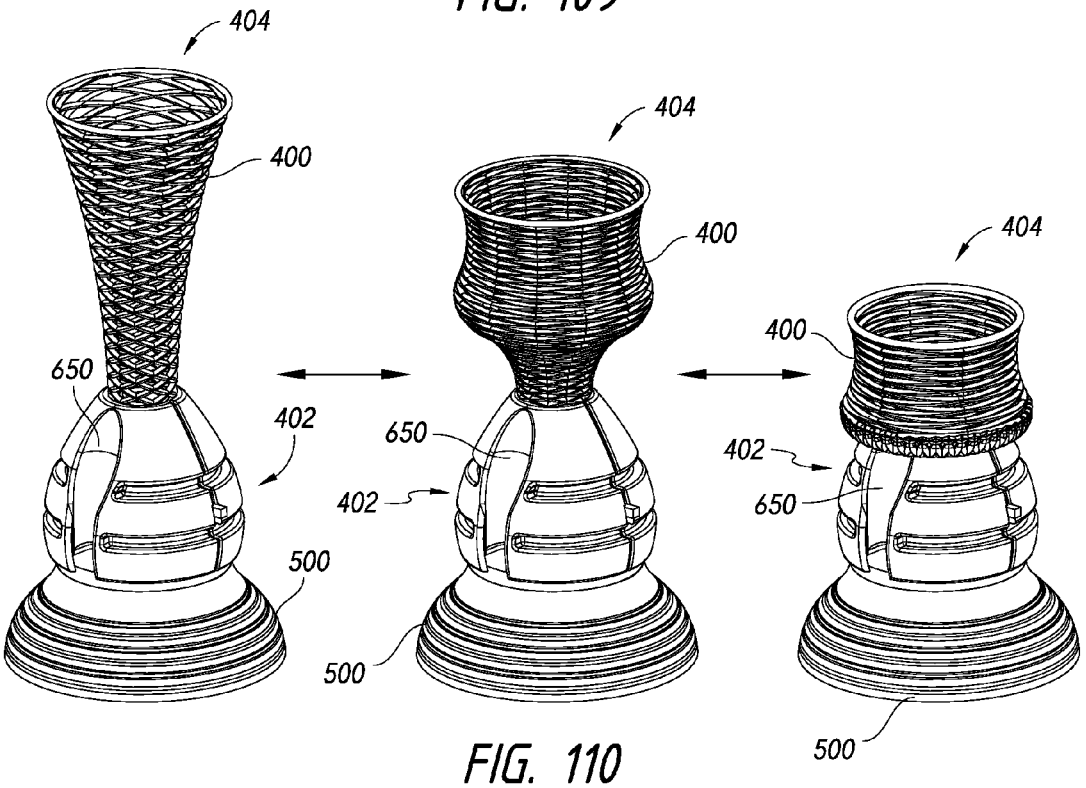
FIG. 110 is a series of perspective side views of the projectile of FIG. 97 transitioning between the expanded state, a midway state, and the collapsed state.
Figure 111:
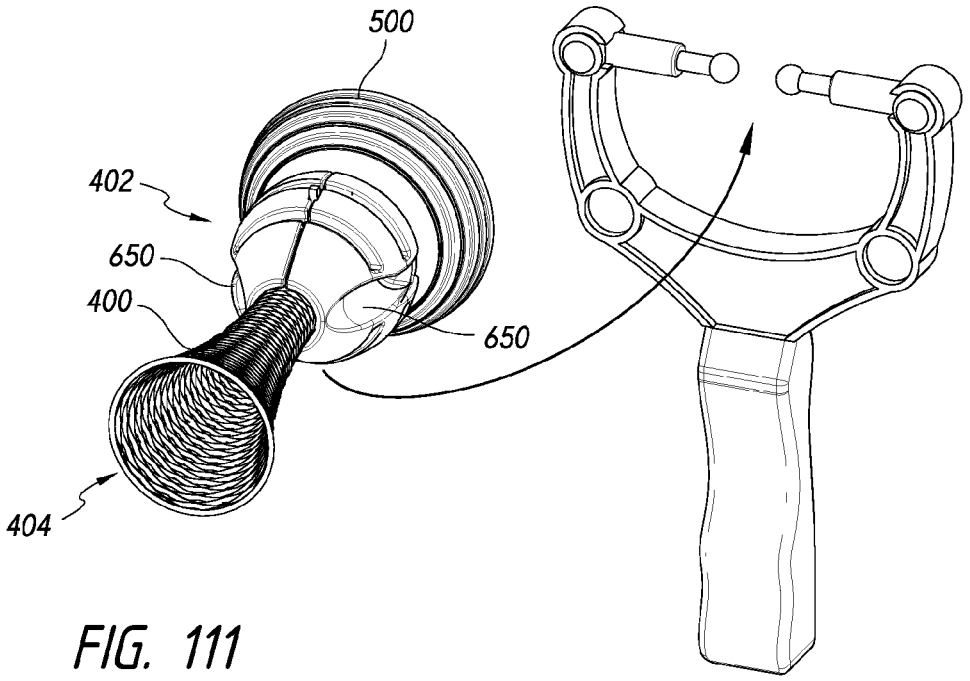
FIG. 111 is a perspective view of the projectile of FIG. 97 prior to associating with a launcher.
Figure 112:
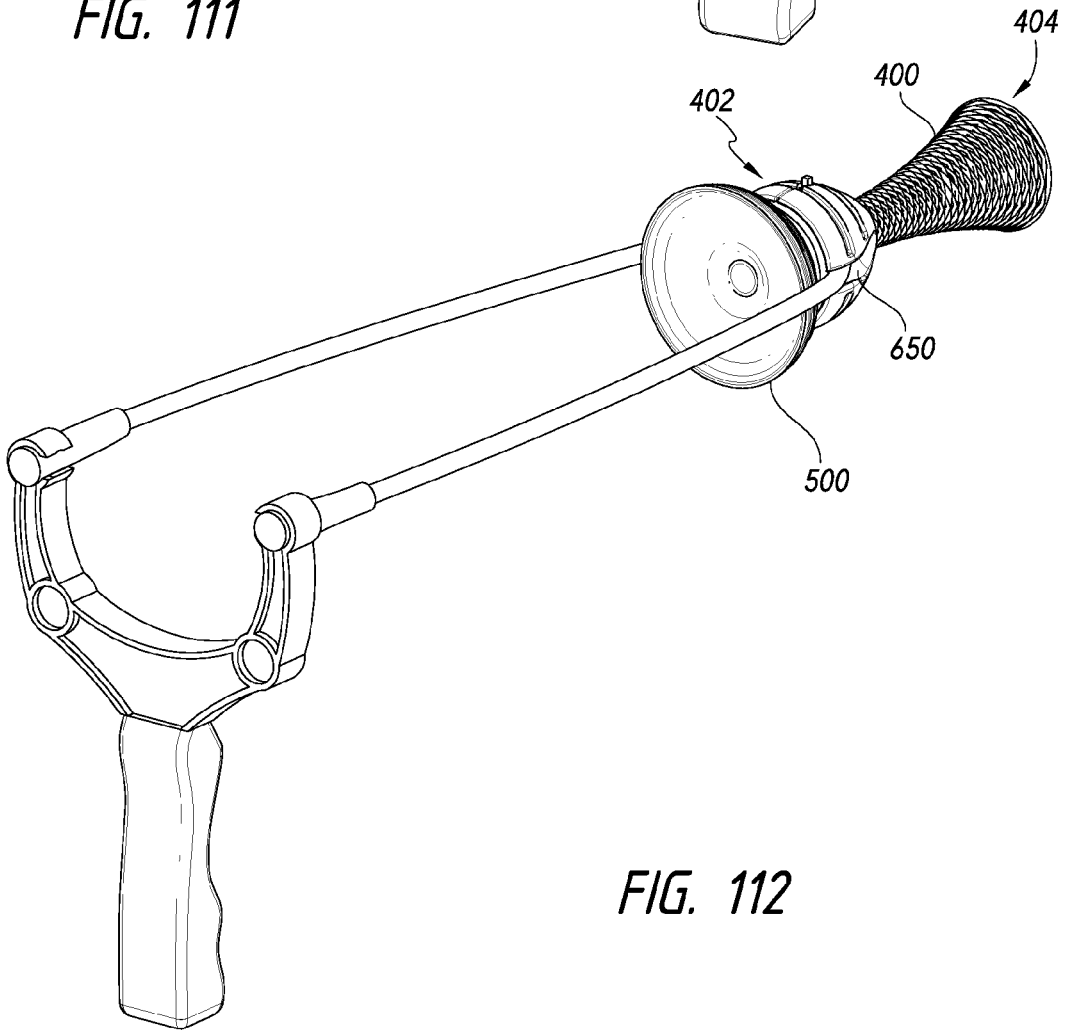
FIG. 112 is a perspective view of the projectile of FIG. 97 after association with a launcher and ready for launch.
Figure 113:
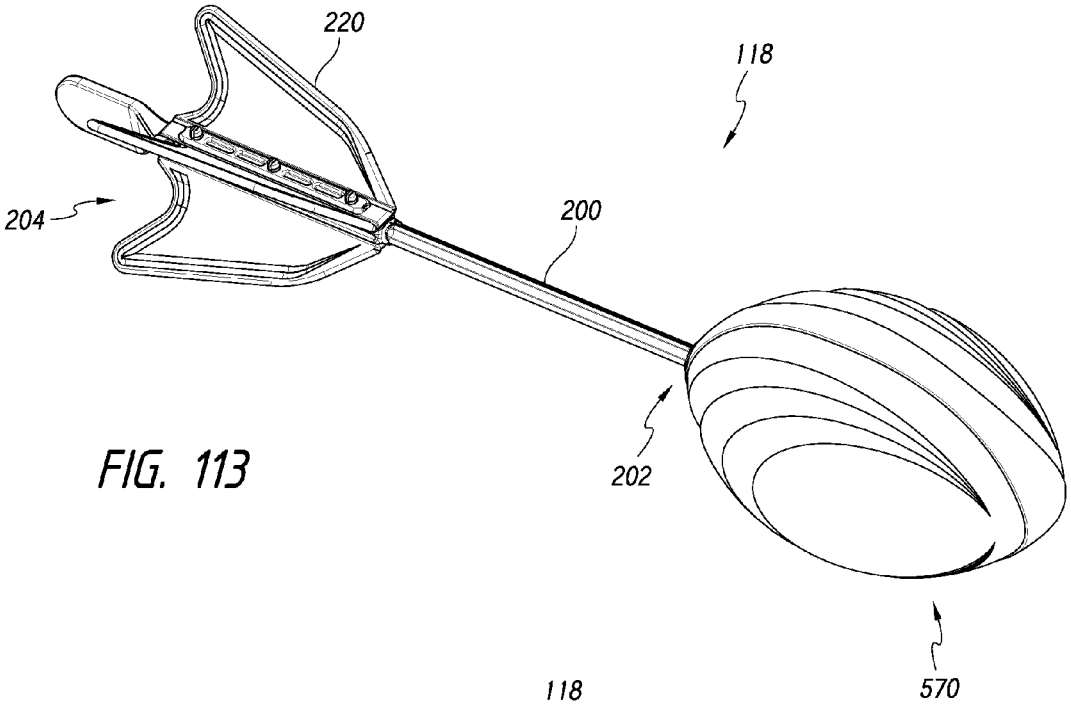
FIG. 113 is a perspective view of a projectile having a rod shaft, a "football" head, and mechanically attached fletching.
Figure 114:
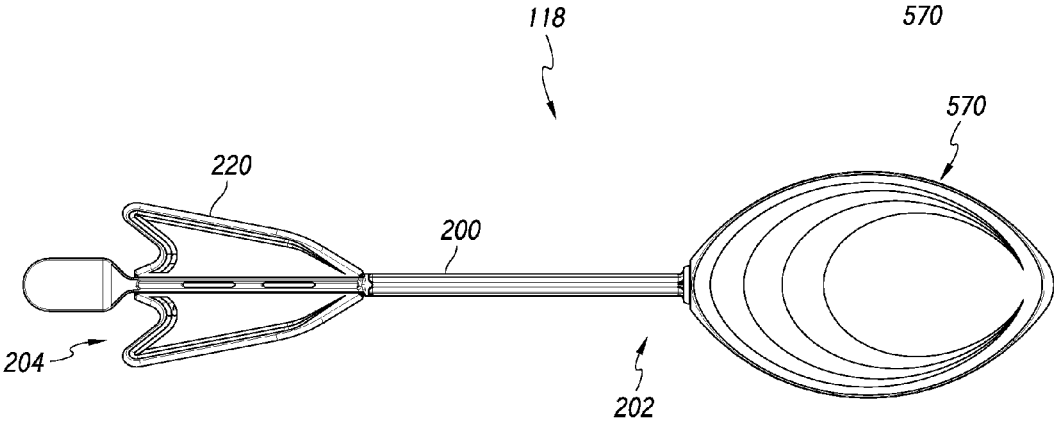
FIG. 114 is a front plan view of the projectile of FIG. 113, the back plan view being a mirror image thereof.
Figure 115:
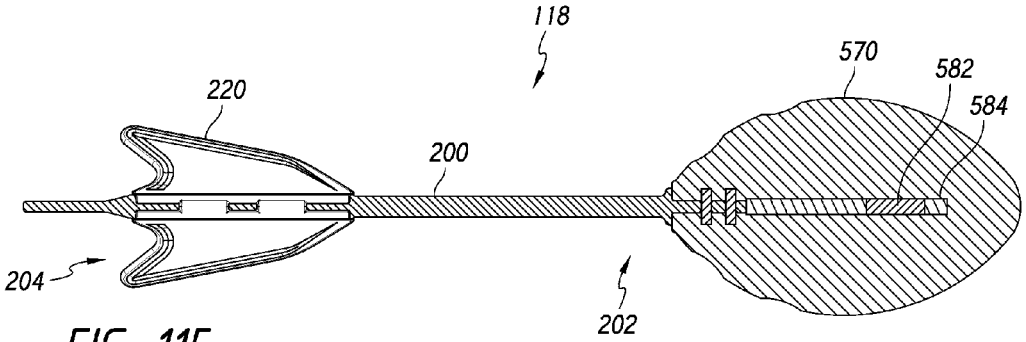
FIG. 115 is a cross-sectional view of the projectile of FIG. 113, taken along line 115-115 of FIG. 114.
Figure 116:
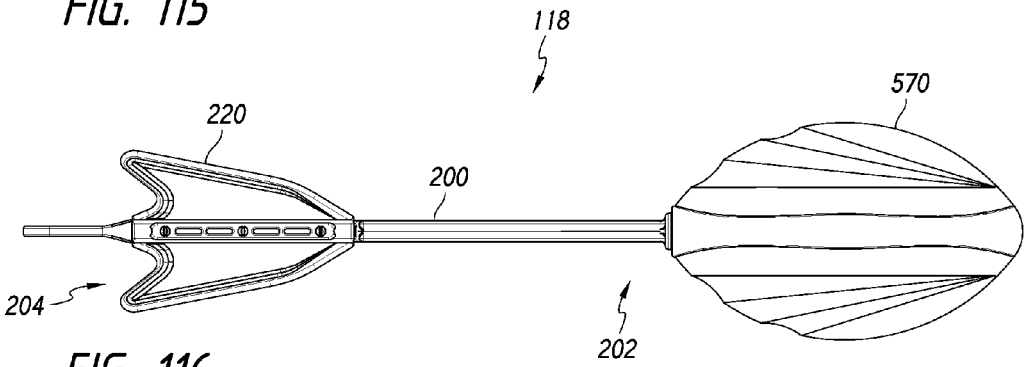
FIG. 116 is one side view of the projectile of FIG. 113, the opposite side being a mirror image thereof.
Figure 117:
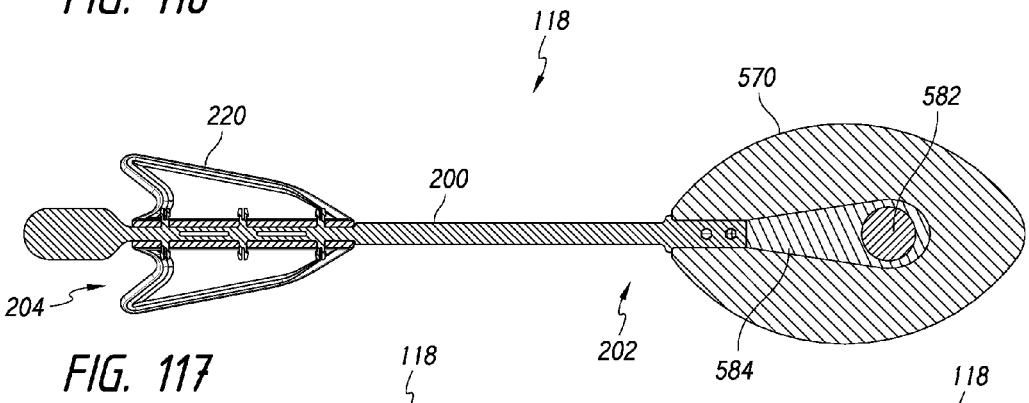
FIG. 117 is a cross-sectional view of the projectile of FIG. 113, taken along line 117-117 of FIG. 116.
Figure 118:
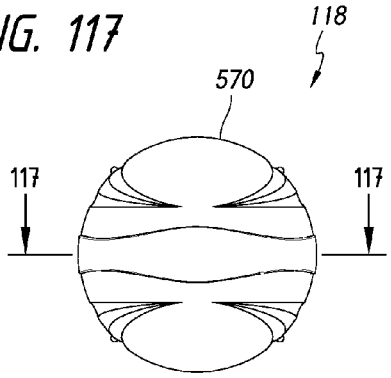
FIG. 118 is a top plan view of the projectile of FIG. 113.
Figure 119:
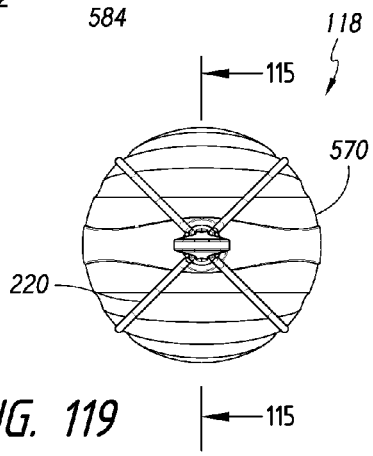
Figure 120:
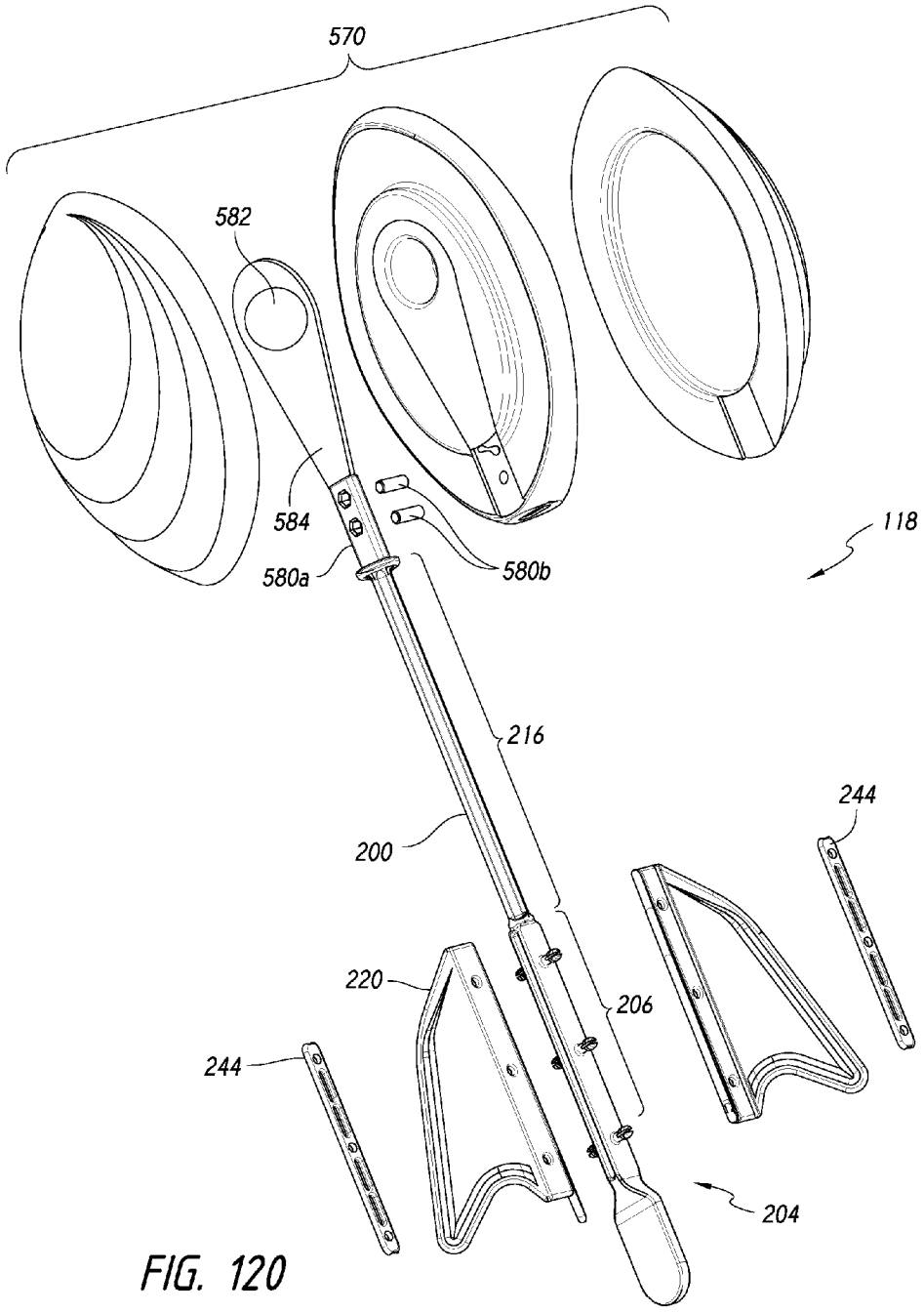

The exemplary mesh shaft 400 shown in FIGS. 97-112 has a head end 402 and a tail end 404. A projectile head (shown as a suction head 500, although a bounce-back head 550 could also be used) is associated with the head end 402. The mesh shaft 400 is relatively soft and flexible making it ideal for use as a safe projectile. The mesh shaft 400 has both an expanded state (FIGS. 97-100) and a collapsed state (FIGS. 101-104) that are "stable" in that once they are in that state they will stay in that state unless acted upon. There is also a midway state (the middle figure of FIGS. 109 and 110) that is actually any position between the expanded state and the collapsed state. Unlike the expanded state and the collapsed state, the midway state is unstable in that it will transition to the expanded state or the collapsed state rather than remaining in the midway state, regardless of whether it is acted upon. As shown in FIGS. 109 and 110, the mesh shaft 400 can be transitioned "easily" between the expanded state, through the midway state, and into the collapsed state (moving from left to right) or between the collapsed state, through the midway state, and into the expanded state (moving from right to left). The term "easily" is meant to mean that with only a minimum amount of pressure (i.e. easily accomplished by a child in the age range for which the projectile is intended).

Figure 107:
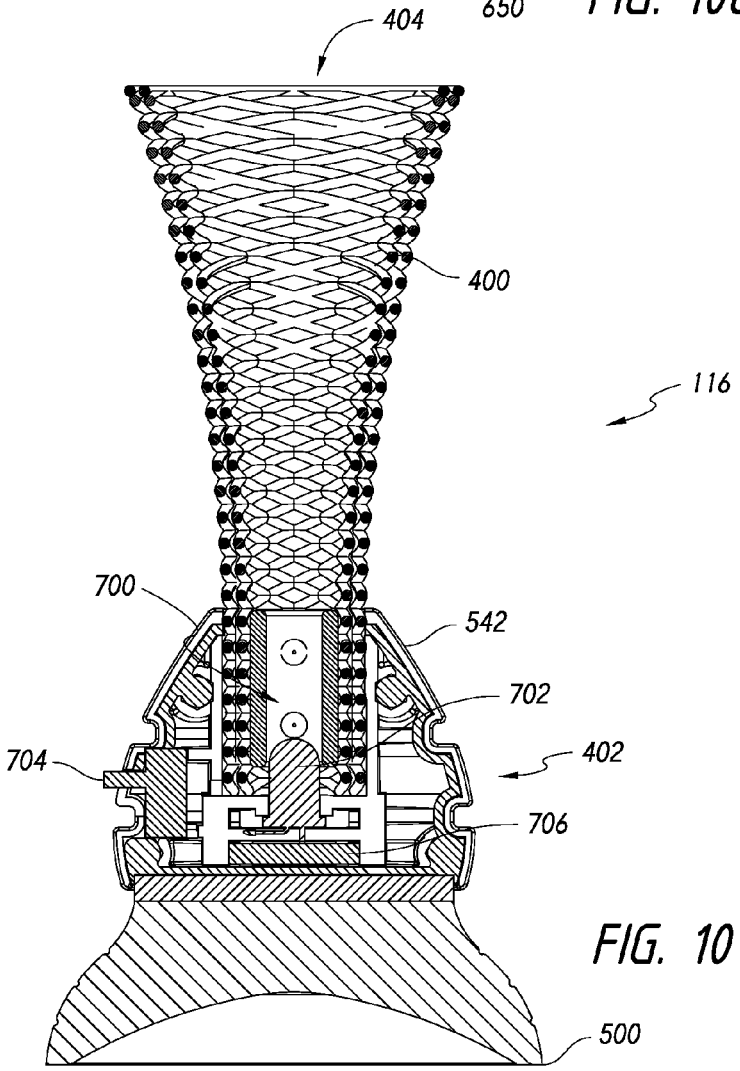
FIG. 107 is a cross-sectional view of the projectile of FIG. 97.
Figure 108:
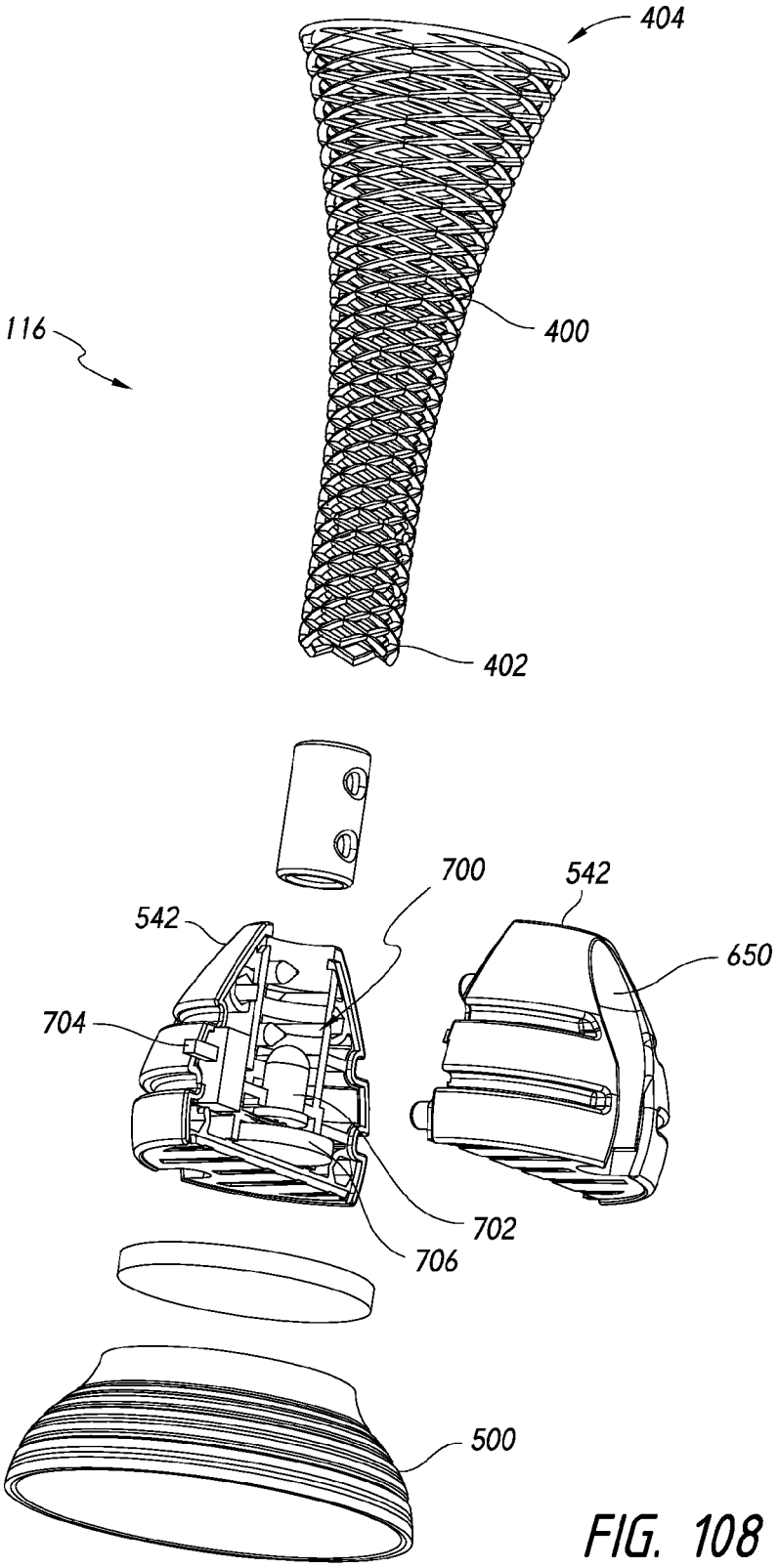
FIG. 108 is an exploded view of the projectile of FIG. 97.

FIG. 107 shows that the mesh shaft 400 is preferably a folded mesh tube. A "fold" (annular fold) is at the tail end 404. The two ends of the folded mesh tube are positioned at the head end 402. This results in two layers of mesh with an annular fold at the tail end 404. The mesh may be, for example, braided, woven, or otherwise constructed to be both light and strong. The mesh tube may be made of, for example, polyethylene terephthalate (PET), nylon, thermoplastic elastomer (TPE), or any other materials known or yet to be discovered that are strong, light weight, and flexible. Factors such as the material, the length, the structure (e.g. folded layers), and specific weave pattern, make the mesh shaft have the properties necessary to create the stable expanded state and the collapsed state, and an unstable midway state.

The mesh shaft 400 is made from the same or similar tubing as also described in U.S. patent application Ser. No. 13/902,968 to Cummings, U.S. Pat. No. 8,662,060 to Walterscheid et al., U.S. Pat. No. D637,239 to Walterscheid, U.S. Pat. No. D641,433 to Walterscheid, U.S. Pat. No. 8,371,899 to Walterscheid, U.S. Pat. No. 7,803,033 to Walterscheid, and U.S. Pat. No. 7,806,746 to Walterscheid.

Heads

There are three primary projectile "heads": a suction head 500 (FIGS. 1-10, FIGS. 11-21, FIGS. 97-112), a bounce-back head 550 (FIGS. 22-32, FIGS. 33-47, FIGS. 48-59, FIGS. 60-71, FIGS. 72-82, FIGS. 83-96), and a "football" head 570 (FIGS. 113-120).

Suction heads 500 allow the arrow to "stick" to flat surfaces such as a window, door, or wall. In addition to the suction heads 500 shown herein, additional or alternative suction heads are shown and described in references such as U.S. Pat. No. D622,325 to Walterscheid, U.S. Pat. No. 8,012,049 to Walterscheid, and U.S. Pat. No. 3,954,266 to Carrano et al.

Bounce-back heads 550 may be blunt or rounded but, regardless of shape, bounce-back heads 550 would harmlessly "bounce" off of whatever they hit. In addition to the bounce-back heads 550 shown herein, additional or alternative bounce-back heads are shown and described in references such as U.S. patent application Ser. No. 14/016,164 to Cummings, U.S. Pat. Design No. D698,872 to Cummings, International Application No. PCT/US2012/031812 to Walterscheid, U.S. patent application Ser. No. 13/411,951 to Walterscheid, U.S. Pat. No. 8,662,060 to Walterscheid et al., and U.S. Pat. No. 8,348,789 to Walterscheid.

"Football" heads 570 may be used, for example, with a projectile that is designed to be thrown by hand. A weight (not shown) may be associated with (e.g. internal to) the "football" heads 570. In addition to the "football" heads 570 shown herein, additional or alternative football heads are shown and described in references such as U.S. Pat. No. D637,239 to Walterscheid and U.S. Pat. No. 8,348,789 to Walterscheid.

The projectile heads 500, 550, 570 are associated with the head end 202, 302, 402 (or head connection structure 510, 520, 560, 580, head portion 356*a*, 356*b*, and/or cap 358*a*, 358*b* associated with the head end 202, 302, 402) of the shaft 200, 300, 400 of the projectile. The heads 500, 550, 570 may be secured to the projectile using a variety of internal and/or external head securing means including, but not limited to, outer head casings 512, 522, 542, mechanical securers (e.g. screws, clips), adhesives (e.g. glue, sonic welding, and insert molding), internal joint structure (where male/female members join together internally), and/or securing means or combination of securing means known or yet to be discovered. In some projectiles, at least one launcher engager 600, 650 is associated with the heads 500, 550, 570. Additional head features such as a whistle 552 (a vented slit through which air passes to make a whistling sound) and/or at least one illuminator 700 may be associated either fully or partially within or associated with the heads 500, 550, 570. Exemplary combinations of these elements are shown, but it would be appreciated that these exemplary combinations are meant to be exemplary and not limiting.

The manner in which a projectile head attaches to the shaft may vary and only a limited sampling of manners are shown herein.

FIGS. 1-10, for example, show a projectile having a rod shaft 200, a suction head 500, and a launcher engager 600 (shown as two hooks). The rod shaft 200 has head connection structure 510 that includes the launcher engager 600 at the head end 202. Outer head casings 512 (shown as two halves) sandwich both the suction head 500 and the head connection structure 510. The two halves of the outer head casings 512 may have structure that is inserted through the head connection structure 510 (e.g. through apertures that may be, for example, hexagonal or circular in shape). The two halves of the outer head casings 512 may have mechanical fasteners that mechanically secure the two halves of the outer head casings 512. Alternatively, the two halves of the outer head casings 512 may be secured using adhesives (e.g. glue, sonic welding, and insert molding). Alternatively, the two halves of the outer head casings 512 may be secured using a combination of mechanical fasteners and adhesives. Sandwiching both the suction head 500 and the head connection structure 510 between the outer head casings 512 functionally and securely attaches the suction head 500 to the rod shaft 200.

FIGS. 11-21, for example, show a projectile having a rod shaft 200, a suction head 500, a launcher engager 600 (shown as two hooks), and an illuminator 700. The rod shaft 200 has head connection structure 520 that includes the launcher engager 600 at the head end 202. Outer head casings 522 (shown as two halves) sandwich the suction head 500, the head connection structure 520, and at least part of the illuminator 700. As with the projectile of FIGS. 1-10, the two halves of the outer head casings 522 may be secured using mechanical fasteners and/or adhesives. In the shown example, however, the head connection structure 520 has at least one nub on both sides that interact with respective at least one cavity on the inner surface(s) of the respective half of the outer head casings 522. Sandwiching the suction head 500, the head connection structure 520, and the illuminator 700 between the outer head casings 522 functionally and securely attaches the suction head 500 and illuminator 700 to the rod shaft 200.

FIGS. 22-32, for example, show a projectile having a rod shaft 200, a bounce-back head 550, and a launcher engager 600 (shown as two hooks). The rod shaft 200 has head connection structure 560 that includes the launcher engager 600 at the head end 202. The bounce-back head 550 (which is shown as including a whistle 552) defines a cavity into which the head connection structure 560 may be inserted. (The bounce-back head 550, alternatively, could be a multiple piece construction that sandwiches the head connection structure 560.) In this shown projectile, the launcher engager 600 associated with the head connection structure 560 is positioned such that the hooks extend out from the annular sides of the bounce-back head 550 near the rod shaft 200. The head connection structure 560 may be secured within the cavity of the bounce-back head 550 using mechanical fasteners and/or adhesives to functionally and securely attach the bounce-back head 550 to the rod shaft 200.

FIGS. 33-47, for example, show a projectile having a tubular shaft 300, a bounce-back head 550, and a launcher engager 600 (shown as one hook). The annular exterior surface of the head end 302 of the tubular shaft 300 functions as the head connection structure. The head end 302 of the tubular shaft 300 is inserted into a cavity defined in the bounce-back head 550 and secured therein using mechanical fasteners and/or adhesives to functionally and securely attach the bounce-back head 550 to the tubular shaft 300. (The bounce-back head 550, alternatively, could be a multiple piece construction that sandwiches the head end 302 of the tubular shaft 300.) As described, the head reinforcer 330 (and, particularly, the first part of the two-part locking mechanism 332) and the launcher engager 600 (and, particularly, the second part of the two-part locking mechanism 334) used to further secure the tubular shaft 300, the launcher engager 600, and the bounce-back head 550 in a functional and secure relationship. Summarily, the head reinforcer 330 is inserted into the head end 302 of the tubular shaft 300 such that the apertures 342, 344 align with an aperture 346 in the outer periphery of the head end 302 of the tubular shaft 300. Then, the second part of the two-part locking mechanism 334 is inserted through the shaft aperture 346 and into the first part of the two-part locking mechanism 332 (apertures 342, 344). This structure keeps the launcher engager (single hook) 600, the head end 302 of the tubular shaft 300, and the head reinforcer 330 in the proper position relative to each other without the need for adhesives or additional structure.

FIGS. 48-59, for example, show a projectile having a tubular shaft 300, a bounce-back head 550, a launcher engager 600 (shown as one hook integral with a head reinforcer 350*a*), and an illuminator 700. As shown, the shaft portion 352*a* of the head reinforcer 350*a* is associated with the head end 302 of the shaft 300 and an illuminator 700 is positioned inside the shaft portion 352*a* such that the source of illumination 702 points into the shaft 300. The outer annular surface of the shaft portion 352*a* may be functionally and securely attached to the inner annular surface of the shaft 300 using mechanical fasteners and/or adhesives. As shown, the middle portion 354*a* is associated with the launcher engager 600 and an illuminator switch activator 704. As shown, the outer annular surface of the head portion 356*a* (with the power source 706 positioned therein) is associated with the inner annular surface of the cap 358*a* using mechanical fasteners and/or adhesives, and the outer annular surface of the cap 358*a* is associated with the inner annular surface of a cavity defined in the bounce-back head 550 using mechanical fasteners and/or adhesives. These annular surfaces function as the head connection structure and may have texture or ribbing thereon. (The bounce-back head 550, alternatively, could be a multiple piece construction that sandwiches head portion 356*a* and/or the cap 358*a*.)

FIGS. 60-71, for example, show a projectile having a tubular shaft 300, a bounce-back head 550, a launcher engager 600 (shown as two hooks integral with a cap 358*b* associated with a head reinforcer 350*b*), and an illuminator 700. As shown, the shaft portion 352*b* of the head reinforcer 350*b* is associated with the head end 302 of the shaft 300 and an illuminator 700 is positioned inside the shaft portion 352*b* such that the source of illumination 702 points into the shaft 300. The outer annular surface of the shaft portion 352*b* may be functionally and securely attached to the inner annular surface of the shaft 300 using mechanical fasteners and/or adhesives. As shown, the middle portion 354*b* is associated with an illuminator switch activator 704. As shown, the outer annular surface of the head portion 356*b* (with the power source 706 positioned therein) is associated with the inner annular surface of the cap 358*b* using mechanical fasteners and/or adhesives, and the outer annular surface of the cap 358*b* is associated with the inner annular surface of a cavity defined in the bounce-back head 550 using mechanical fasteners and/or adhesives. These annular surfaces function as the head connection structure and may have texture or ribbing thereon. (The bounce-back head 550, alternatively, could be a multiple piece construction that sandwiches head portion 356*b* and/or the cap 358*b*.) In this shown projectile, the launcher engager 600 associated with the cap 358*b* is positioned such that the hooks extend out from the annular sides of the bounce-back head 550 near the rod shaft 200.

FIGS. 72-82 show a "hybrid" of two types of shafts: the rod shaft 200 and the tubular shaft 300. The part of the overall length of the shown exemplary hybrid that is towards the projectile head (and including the projectile head) has structure similar to the equivalent portion of the projectile of FIGS. 60-71. For example, the shown hybrid has a bounce-back head 550, a launcher engager 600 (shown as two hooks integral with a cap 358*b* associated with a head reinforcer 350*b*), and an illuminator 700. The description of the portion towards the projectile head (and including the projectile head) of FIGS. 60-71 is incorporated here. It should be noted, however, that alternative structure of the hybrid portion towards the projectile head (and including the projectile head) could be structure of the equivalent portions of the projectiles in FIGS. 33-47, FIGS. 48-59, and FIGS. 83-96, or combinations and variations thereof. The descriptions of the portion towards the projectile head (and including the projectile head) of FIGS. 33-47, FIGS. 48-59, and FIGS. 83-96 are incorporated here. Also, variations in features such as the specific projectile head, the specific connection structure, and illumination may be "mixed and matched" from other projectiles described herein as well as those known or yet to be discovered.

FIGS. 83-96 show a projectile in which the portion near the projectile head includes a tubular shaft 300, a bounce-back head 550, and a launcher engager 600 (shown as one hook). This structure is similar to the structure shown in and discussed in relation to FIGS. 33-47. The description of the portion towards the projectile head (and including the projectile head) of FIGS. 33-47 is incorporated here. It should be noted, however, that alternative structure of the portion towards the projectile head (and including the projectile head) could be structure of the equivalent portions of the projectiles in FIGS. 48-59, FIGS. 60-71, and FIGS. 72-82, or combinations and variations thereof. The descriptions of the portion towards the projectile head (and including the projectile head) of FIGS. 48-59, FIGS. 60-71, and FIGS. 72-82 are incorporated here. Also, variations in features such as the specific projectile head, the specific connection structure, and illumination may be "mixed and matched" from other projectiles described herein as well as those known or yet to be discovered.

FIGS. 97-112, for example, show a projectile having a mesh shaft 400, a suction head 500, a launcher engager 650 (shown as two slots), and an illuminator 700. Outer head casings 542 (shown as two halves each having a slot launcher engager 650) sandwich the head end 402, the suction head 500, and the illuminator 700 such that they are at least partially secured between the outer head casings 542. The two halves of the outer head casings 542 are shown as having at least one nub on one or both sides that interact with respective at least one cavity on the inner surface(s) of the respective half of the outer head casings 542 or other head connection structure. The shown mechanical fasteners, alternative mechanical fasteners, and/or adhesives may be used to secure the two halves of the outer head casings 542 to functionally and securely attach the suction head 500 to the mesh shaft 400.

The manner in which a "football" head design attaches to the shaft may vary and only one example is shown herein. FIGS. 113-120, for example, show a projectile having a rod shaft 200 and a "football" head 570. The body of the projectile head 570 may be sections, layers, or portions that may be made from materials such as foam, polyurethane, ethylene vinyl acetone (EVA) or a like polymer, thermal plastic (TPR), polyvinyl chloride (PVC), or any known or yet to be discovered material or combination of materials having properties suitable for its intended use. This "football" projectile head 570 may be connected in a manner similar to the other projectile heads 500, 550. There may be a paddle shaped extension 584 (with an optional weight 582) that extends a significant distance into the projectile head 570. Apertures 580*a* in the extension 584 and pins 580*b* (shown in FIG. 120 and together referred to as head connection structure 580) as well as adhesives (e.g. glue, sonic welding, and insert molding), mechanical devices, or other connection schemes may be used for connecting the sections, layers, or portions of the projectile head 570.

It should be noted that alternative structure, schemes, designs, and methods for attaching a head to a shaft include, but are not limited to, those shown and described in prior art incorporated herein by reference (and variations thereof) as well as other structure, schemes, designs, and methods known and yet to be discovered. Further, the structure, schemes, designs, and methods shown in one type of projectile described herein may be applied to other types of projectiles described herein.

For a shafted projectile to be used as a toy, the projectile head 500, 550, 570 would need to be soft enough not to cause injury or damage, although the "softness" characteristic may be determined by the intended use (e.g. a projectile head for a toy for outdoor use and/or older children could be harder than a projectile head for a toy for indoor use and/or younger children). The projectile head 500, 550, 570 may be made of materials including, but not limited to, foam, polyurethane, ethylene vinyl acetone (EVA) or a like polymer, thermal plastic (TPR), polyvinyl chloride (PVC), or any known or yet to be discovered material or combination of materials having properties suitable for its intended use (e.g. location, age group, and/or type of toy).

The outer head casings 512, 522, 542 may be made of materials including, but not limited to, plastic, acrylonitrile butadiene styrene (ABS), nylon, or any known or yet to be discovered material or combination of materials having properties suitable for its intended use (e.g. location, age group, and/or type of toy).

Launcher Engagers

A shafted projectile may be shot or launched with a slingshot, bow or similar device, or it may be thrown by hand. As discussed, a shafted projectile may include projectiles commonly referred to as an arrow, a rocket, or a dart. A "bow" is traditionally used to shoot an arrow. The tail end of the arrow traditionally includes a "slot" (called a "nock") that may be attached to the bow string. The release of tension caused by the release of the bow string pushes the arrow forward and out into a flight trajectory. An exemplary arrow and nock operating in such a fashion is described in U.S. Pat. No. 8,540,594 to Chu.

Exemplary projectiles described herein use one or two hook launcher engagers 600 or slot launcher engagers 650.

Projectiles having a single hook launcher engager 600 may be thought of as "rockets." Examples of one hook launcher engagers 600 are shown in FIGS. 33-47, FIGS. 48-59, and FIGS. 83-96. U.S. Pat. Design No. D698,872 to Cummings shows an additional projectile with a one hook launcher engager. For exemplary purposes only, projectiles with one hook launcher engagers 600 may be launched using launchers with a single elastic such as those described in U.S. Pat. No. 1,545,476 to Austerman, U.S. Pat. No. 3,390,480 to Turner, and U.S. Pat. No. 2,621,441 to Worden.

Projectiles having two hook launcher engagers 600 may be used with specialty launchers constructed similarly to a bow, but safer because they are designed to work with projectiles having two hook launcher engagers 600. Examples of two hook launcher engagers 600 are shown in FIGS. 1-10, FIGS. 11-21, FIGS. 22-32, FIGS. 60-71, and FIGS. 72-82. U.S. patent application Ser. No. 14/016,164 to Cummings, International Application No. PCT/US2012/031812 to Walterscheid, U.S. patent application Ser. No. 13/411,951 to Walterscheid, and U.S. Pat. No. 8,662,060 to Walterscheid et al. show additional projectiles with a two hook launcher engager. For exemplary purposes only, projectiles with two hook launcher engagers 600 may be launched using launchers such as those described in U.S. patent application Ser. No. 14/016,164 to Cummings, U.S. patent application Ser. No. 29/455,283 to Cummings et al., U.S. patent application Ser. No. 29/455,281 to Cummings et al., International Application No. PCT/US2012/031812 to Walterscheid, U.S. patent application Ser. No. 13/411,951 to Walterscheid, and U.S. Pat. No. 8,662,060 to Walterscheid et al. By using only one of the two hooks 600, projectiles having two hook launcher engagers 600 may be launched using the launchers described in relation to projectiles having only one hook launcher engager 600.

Projectiles having a pair of slot launcher engagers 650 may be used with specialty launchers constructed similarly to a sling shot, but safer because they only work with projectiles having the unique slot launcher engagers 650. The shown exemplary slingshot launchers (FIGS. 111 and 112) have a pair of "bungees," each bungee having a first end and a second end. The first end is attached to an arm of the slingshot launcher. The second end has a spherical slot engager. The result is that the spherical slot engagers are positioned near each other, but spaced so that the spherical slot engagers can engage the slot launcher engagers 650. Examples of slot launcher engagers 650 are shown in FIGS. 97-112. U.S. patent application Ser. No. 13/902,968 to Cummings, U.S. Pat. No. D622,325 to Walterscheid, U.S. Pat. No. 8,012,049 to Walterscheid, U.S. Pat. No. 7,001,292 to Rappaport, and U.S. Pat. No. 3,954,266 to Carrano et al. show additional projectiles with slot launcher engagers. For exemplary purposes only, projectiles with slot launcher engager 650 may be launched using launchers such as those described in U.S. patent application Ser. No. 13/773,615 to Walterscheid and U.S. Pat. No. 8,485,168 to Walterscheid.

It should be noted that the shown shapes of the launcher engagers 600, 650 are meant to be exemplary. Alternative shapes may be made for aesthetic purposes. Also, depending on the particular launcher, the shape of the launcher engagers 600, 650 may be modified. Further, launcher engagers 600, 650 may be interchanged among the shown projectiles or launcher engagers from references incorporated by reference may be used instead of the shown launcher engagers 600, 650. For example, the two hook launcher engagers 600 of FIGS. 1-10, FIGS. 11-21, FIGS. 22-32, FIGS. 60-71, and FIGS. 72-82 may be replaced by one hook launcher engagers 600 or slot launcher engagers 650. The one hook launcher engagers 600 as shown in FIGS. 33-47, FIGS. 48-59, and FIGS. 83-96 may be replaced by two hook launcher engagers 600 or slot launcher engagers 650. The slot launcher engagers 650 as shown in FIGS. 97-112 may be replaced with one or two hook launcher engagers 600. Finally, it should be noted that the positioning of the launch engagers 600, 650 is meant to be exemplary and may be modified. For example, the launch engagers 600, 650 may be embedded in the projectile head 500, 550, 570, adjacent to the projectile head 500, 550, 570, or along the length of the shaft 200, 300, 400, albeit relatively near the projectile head 500, 550, 570.

Tail Features

Some of the projectiles described herein have tail features that are associated with (including nearby) the tail end 204, 304, 404. In particular, some of the projectiles are shown as having adhered fletching (FIGS. 33-45, FIGS. 48-58, FIGS. 60-70, and FIGS. 83-95), some of the projectiles are shown as having mechanically attached fletching (FIGS. 1-10, FIGS. 11-21, FIGS. 22-32, FIGS. 72-82, FIGS. 113-120, and FIGS. 155-162), and some of the projectiles are shown as having a copter tail (FIGS. 83-96). Variations on the mechanically attached fletching, the shafts, and the fletching itself are shown in FIGS. 121-162.

A traditional way to apply fletching to a shaft is by adhering each fletching to the shaft with glue. Using glue to adhere the fletching is extremely time consuming. Moreover, as the primary purpose of the fletching is to assist in the aerodynamics of the arrow's flight, applying the fletching must be done in a precise manner. If there are flaws or errors in attaching the fletching, the arrow may not fly straight or will otherwise not fly as intended. The adhered fletching 320 shown in FIGS. 33-45, FIGS. 48-58, FIGS. 60-68, FIG. 70, and FIGS. 83-95 is adhered to the shaft 300 of the projectile.

The adhered fletching 320 and variations thereof are further shown and/or described in U.S. patent application Ser. No. 14/016,164 to Cummings, U.S. patent application Ser. No. 13/902,968 to Cummings, International Application No. PCT/US2012/031812 to Walterscheid, U.S. patent application Ser. No. 13/411,951 to Walterscheid, U.S. Pat. No. 8,662,060 to Walterscheid et al., U.S. Pat. Design No. D698,872 to Cummings, U.S. Pat. No. 8,485,168 to Walterscheid, U.S. Pat. No. 8,348,789 to Walterscheid, U.S. Pat. No. D622,325 to Walterscheid, and U.S. Pat. No. 7,874,947 to Wolfinbarger et al.

Alternative methods to attach the fletching to the shaft include inserting one or more fin sections into a longitudinal slot in the trailing end of the shaft, such as described in U.S. Pat. No. 2,882,055 to Meyer, U.S. Pat. No. 2,525,332 to Alger et al., and U.S. Pat. No. 613,386 to McKenney. Cutting a slot into the trailing end of the shaft may make the trailing end of the shaft fragile in that if the fletching bumps or catches on an exterior force, the half-strength (because it is cut in half) trailing end of the shaft may break. Methods that leave the trailing end of the shaft open such as the Meyer and McKenney references may also be less secure than desirable, as the fletching may fall out of the shaft end. The Alger reference describes a method of stapling the nock at the trailing end of the arrow shaft to act as a cap that secures the previously inserted fletching sections. This latter method contains small parts such as a wire staple that may be unsuitable for a children's toy. Further, it would be easy for this type of "cap" or other type of cap to fall off the end of the arrow shaft and, therefore, it is not particularly secure. Thus, an improved method for attaching fletching is desirable.

Mechanically attaching (which includes securing) fletching 220 to the rod shafts 200 (e.g. the tail end portions 206, 208, 210, 212) using fasteners (e.g. fasteners 244, 254, 262, 266, 272, 276, 278) as shown in FIGS. 1-10, FIGS. 11-21, FIGS. 22-32, FIGS. 72-82, FIGS. 113-120, FIGS. 121-127, and FIGS. 133-144 simplifies the assembly process and results in strong and durable mechanically attached fletching. The exemplary mechanical assembly process of connecting fasteners (or parts of a set of fasteners) together requires significantly fewer steps than the process of assembly used for adhering fletching. Further, the mechanical assembly process of connecting the fasteners together requires significantly less precision and less skill than the process of assembly used for adhering fletching (although the results are at least comparable). Other advantages include better quality control, more consistency, fewer defects, and automation is possible. Depending on the type of fasteners used in the mechanical assembly process, the connection between the fletching and the tail end portions may be significantly stronger and/or significantly more durable than the similar connection created in the process of assembly used for adhering fletching. Some mechanical assembly processes may use fasteners that are user removable and/or replaceable so that the fasteners and/or fletching can be removed and/or replaced should there be problems therewith (e.g. the fletching is damaged) and/or should the user decide alternative fasteners and/or fletching are desirable (e.g. the user wants a different color or style of fletching). User removal and/or replacement of fletching using the process of assembly used for adhering fletching would be impossible because of the complicated nature of the adhering process and the precision necessary therefor. Further, some materials that have excellent strength and durability properties (e.g. Polypropylene material (PP)) are extremely difficult to adhere (especially to certain types of shafts such as those made using ethylene vinyl acetone (EVA) (or polyethylene (PE)). Use of mechanical fasteners eliminates this problem.

FIGS. 1-32, 72-82, 113-120, 121-128, and 155-162 show a first exemplary double fletching 220 that includes two fins 230 (fletching) separated by an aperture or center section 231 (connection section). (FIGS. 149-154 show additional details about the simplified design of the first exemplary double fletching. Alternative exemplary double fletching designs are shown in FIGS. 129-132 and would have similar details, although the shape of the fin would be modified.) Apertures 221 (fletching connection structure) are shown as being defined in the center section 231. Although shown as apertures (and apertures are used as the generic term referring thereto), the fletching connection structure may take other forms including, but not limited to, those discussed herein, combinations of those connection structures mentioned and/or any connection structure known or yet to be discovered that may be engaged by a mechanical fastener. FIGS. 129-132 show second, third, fourth, and fifth exemplary double fletching 222, 224, 226, 228 that could be used in place of (or in combination with) the double fletching 220. The specific design of the fletching may be modified for specific purposes (e.g. for better or different types of flight). Each of the exemplary double fletching 222, 224, 226, 228 includes two fins 232, 234, 236, 238 separated by center section 233, 235, 237, 239 (that, in turn, has apertures 223, 225, 227, 229 defined therein). The discussion of the double fletching 220 is meant to include the alternative double fletching 222, 224, 226, 228. Further, although not shown, a single fletching having only a single fin with an adjacent aperture section (a connection section similar to the center section 231, but only bordered by one fin) is also contemplated. It should be noted, however, that using double fletching reduces the manufacturing steps by half.

As set forth, the exemplary rod shafts 200 shown in FIGS. 1-32, FIGS. 72-82, FIGS. 113-120, and FIGS. 155-162 each have a tail end 204 with double fletching 220. FIGS. 121-126 detail exemplary alternative preferred tail ends (labeled as 206 (FIG. 121), 208 (FIG. 122), 210 (FIG. 124), 212 (FIG. 126)) in which two sets of double fletching 220 are secured to the tail end portions 206, 208, 210, 212. (FIG. 127 details an alternative exemplary preferred rod shaft tail end portion 214 that has three sets of double fletching 220 secured thereto.) Each tail end portion 206, 208, 210, 212 has associated mechanical fastener structure (e.g. apertures or prongs) that interacts with at least one other mechanical fastener structure that together secure the double fletching 220 to the tail end portions 206, 208, 210, 212.

Several types of fasteners are shown and described including the fastener set 240 and 244, the fastener set 250 and 254, the fastener set 260, 262, and 264, the fastener set 270, 272, and 276, and the fastener set 280, 281, and 282. Alternative exemplary fasteners may use structure(s) similar to the structure(s) disclosed in U.S. Pat. No. 2,876,485 to Cowles, U.S. Pat. No. 2,555,420 to Richardson, U.S. Pat. No. 3,168,961 to Yates, U.S. Pat. No. 3,050,805 to Clyne, U.S. Pat. No. 4,369,013 to Abildgaard et al., U.S. Pat. No. 2,709,290 to Rosenthal, U.S. Pat. No. 8,287,034 to Smith et al., U.S. Patent Publication No. 2013/0031756 to Yuen, and U.S. Patent Publication No. 2012/0174345 to Scroggie et al. These fasteners are meant to be exemplary and are not meant to be limiting. Additional fasteners could include fasteners that are essentially combinations of the fasteners described herein (including those in references incorporated by reference) and/or fasteners yet to be discovered.

Although shown as "sets," alternative fasteners could be single components (e.g. projections that fold or bend outward similar to a "brad" that has a head and two legs that spread open to secure or projections that fold or bend inward similar to prong bases used for two hole punch folders). Although shown as separate elements, alternative fastener "sets" could be connected (e.g. one end of the one fastener is attached to one end of a mating fastener so that the mating fastener cannot be separated therefrom). Another option is that the fastener(s) may be attached to the rod shaft as attached fastener(s). FIGS. 139-141 show examples of attached fastener(s) in which one end of an exemplary attached fastener 244', 254', 294 is interconnected with the shaft tail end portion having the appropriate mating fastener(s) (e.g. integral projections 240, apertures 250, or a "single elongated prong" 290) such that the attached fastener 244', 254', 294 folds or bends down and mates with the appropriate mating fastener(s). FIG. 139 shows structure similar to that shown in FIG. 121 except for the attached fastener 244'. FIG. 140 shows structure similar to that shown in FIG. 122 except for the attached fastener 254'. FIG. 141 shows an elastic strap attached fastener 244' that attaches to the single elongated prong 290. The structure that attaches the attached fastener 244', 254', 294 to the shaft tail end may be a bend in the material, a score in the material, or a mechanical device (e.g. a hinge). (It should be noted that the connection section of the fletching would preferably have an elongated aperture to mate with the prong 290.) An advantage of connected fasteners include that they cannot be lost and that they cannot be swallowed by children.

Figure 96:
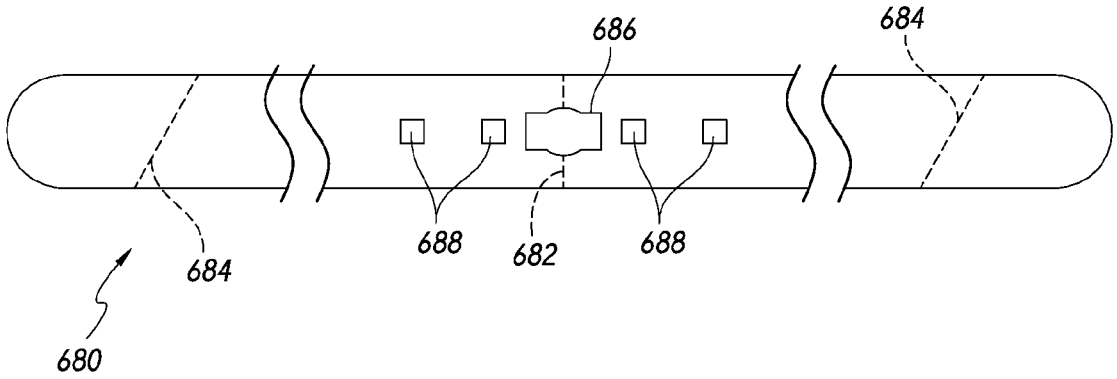
FIG. 96 is a plan view of an exemplary copter tail.
Figure 97:
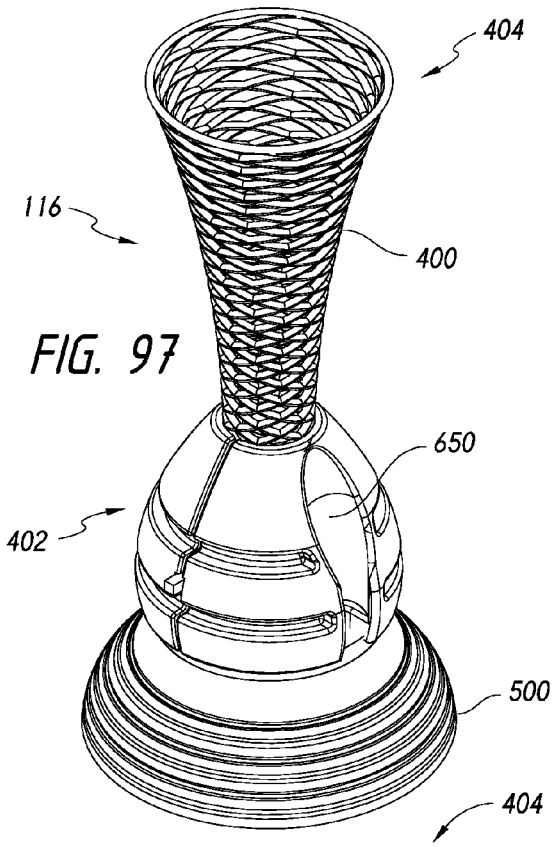
FIG. 97 is a perspective view, taken generally from the side, of a projectile in an expanded state having a mesh shaft, a suction head, two slots, and an illuminator.
Figure 98:
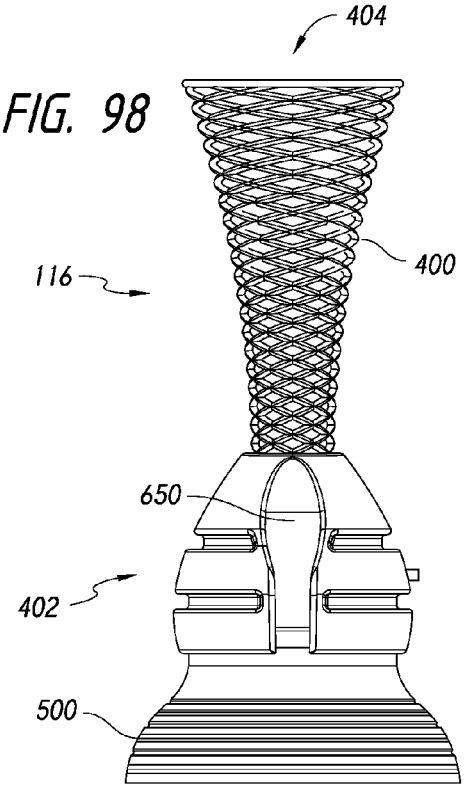
FIG. 98 is a side view of the projectile of FIG. 97 in the expanded state.
Figure 99:
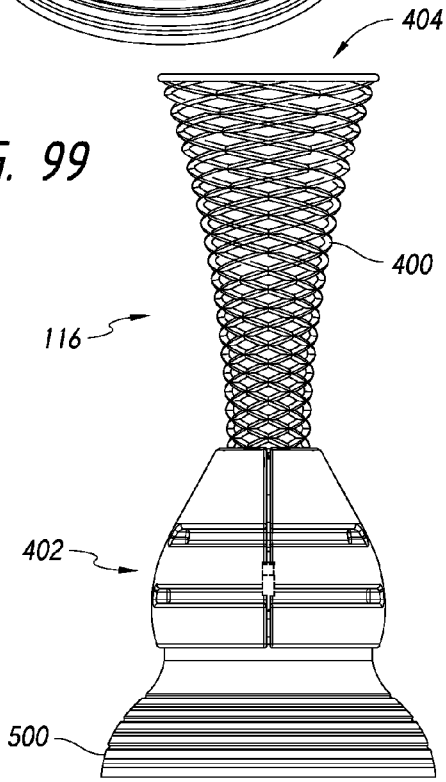
FIG. 99 is a front view of the projectile of FIG. 97 in the expanded state.
Figure 100:
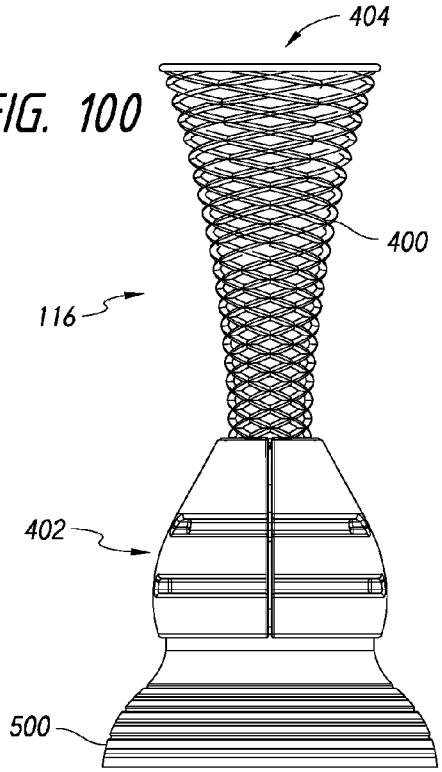
FIG. 100 is a back plan view of the projectile of FIG. 97 in the expanded state.
Figure 101:
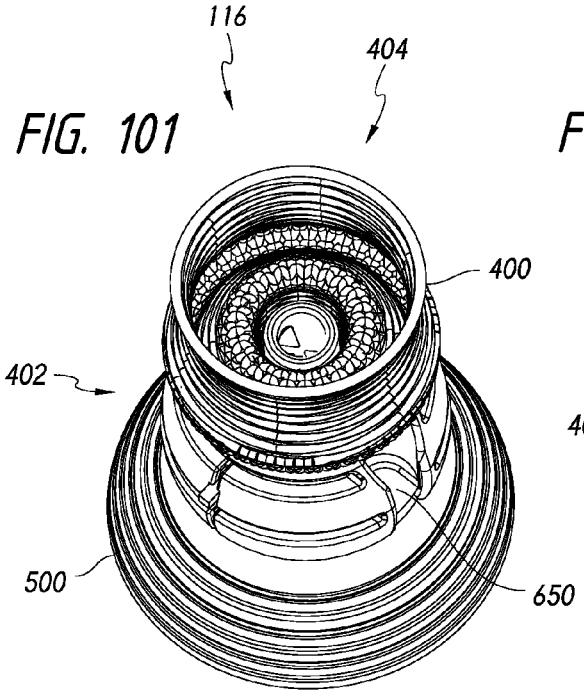
FIG. 101 is a perspective view, taken generally from the top and side, of the projectile of FIG. 97 in a collapsed state.
Figure 102:
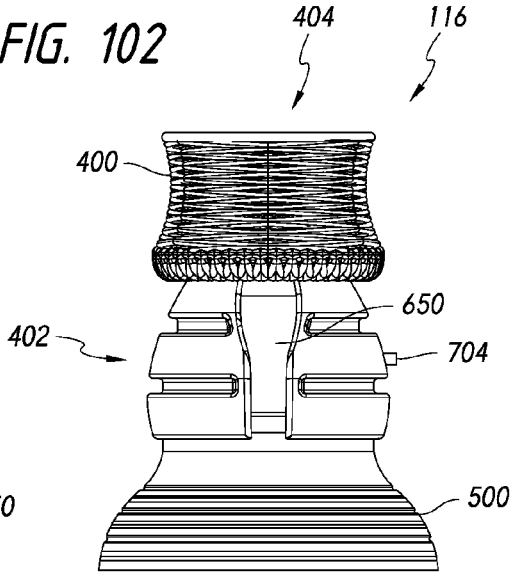
FIG. 102 is a side view of the projectile of FIG. 97 in the collapsed state.
Figure 103:
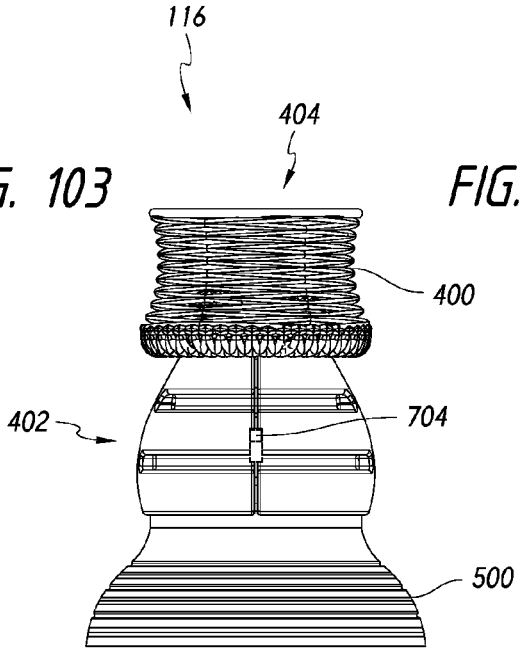
FIG. 103 is a front plan view of the projectile of FIG. 97 in the collapsed state.
Figure 104:
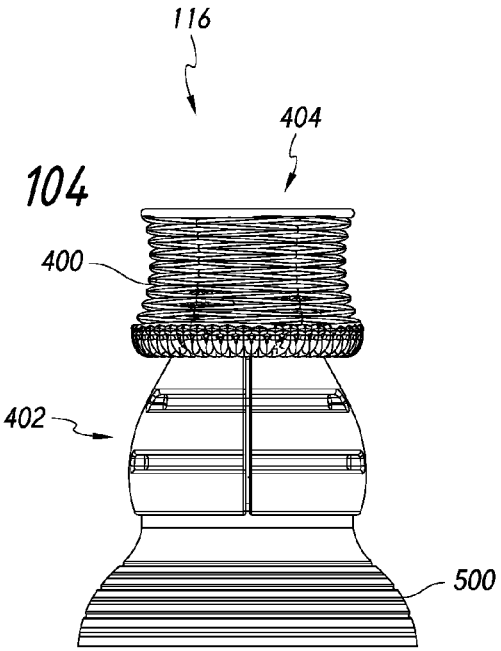
FIG. 104 is a back plan view of the projectile of FIG. 97 in the collapsed state.
Figure 105:
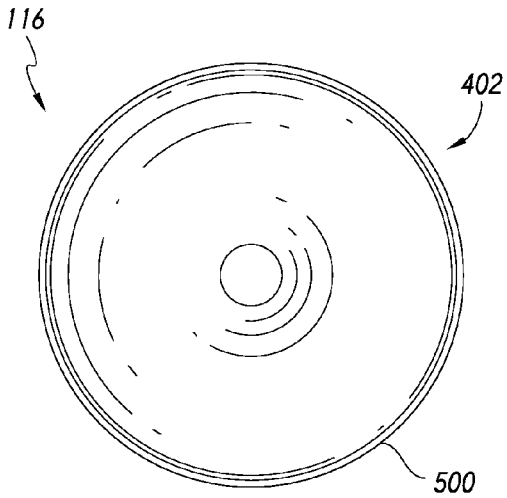
FIG. 105 is a bottom plan view of the projectile of FIG. 97.
Figure 106:
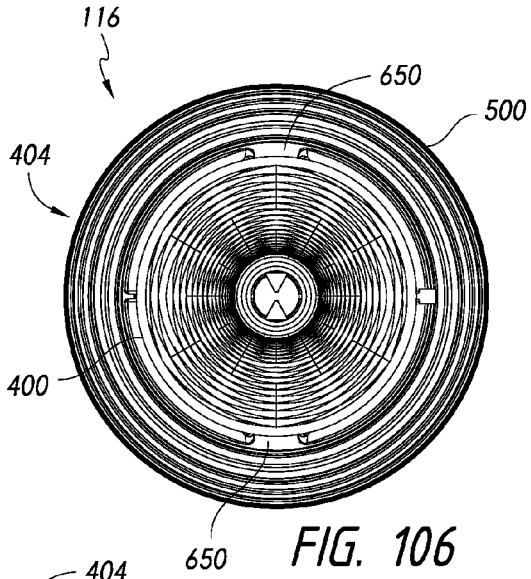
FIG. 106 is a top plan view of the projectile of FIG. 97.

It should be noted that any logical combination of shown and described rod shafts, tail ends (e.g. those labeled as 204, 206, 208, 210, and 212), double fletching (e.g. those labeled as 220, 222, 224, 226, and 228), and fasteners (e.g. those labeled as the fastener set 240 and 244, the fastener set 250 and 254, the fastener set 260, 262, and 264, and the fastener set 270, 272, and 276) is contemplated and the description herein is meant to be exemplary and not limiting. Although the fletching shown in FIGS. 33 to 96 is adhered fletching 320, various components (e.g. shafts, heads, and other features) of these figures may be incorporated into projectiles with mechanically attached double fletching 220. (For example, a tubular shaft 300 could be used in place of a rod shaft 200.) Further, the shown and described head(s), launcher engager(s), and illuminator(s) combinations are meant to be exemplary and not limiting.

FIG. 121 shows a first exemplary tail end 204 with a rod shaft tail end portion 206 and mechanically attached double fletching 220 (shown as a pair of double fletching 220). FIGS. 133-136 show various views of a portion of the rod shaft tail end portion 206. The rod shaft tail end portion 206 has an exterior surface. As set forth, the tail end portion 206 has at least one fastener 240 that interacts with at least one mating fastener 244 to secure the double fletching 220 to the rod shaft 200. To attach a double fletching 220, at least one fastener 240 is inserted through at least one aperture 221 in the center section 231 of the double fletching 220, and thereafter, mates with the mating fastener 244 to secure the double fletching 220 to the rod shaft tail end portion 206. (If alternative double fletching 222, 224, 226, 228 is used, the apertures 223, 225, 227, 229 would be defined in their respective center sections 233, 235, 237, 239.) This structure secures at least part of the double fletching 220 between the exterior surface of the rod shaft tail end portion 206 and the fastener 244.

FIGS. 122 and 123 show a second exemplary tail end 204 with a rod shaft tail end portion 208 and mechanically attached double fletching 220 (shown as a pair of double fletching 220). The rod shaft tail end portion 208 has an exterior surface. As set forth, the tail end portion 208 has at least one aperture 250 that interacts with at least one mating fastener 254 to secure the double fletching 220 to the rod shaft 200. To attach a double fletching 220, at least one mating fastener 254 is inserted through at least one aperture 221 in the center section 231 of the double fletching 220, and thereafter, is inserted into the aperture fastener 250 to secure the double fletching 220 to the rod shaft tail end portion 208. (If alternative double fletching 222, 224, 226, 228 is used, the apertures 223, 225, 227, 229 would be defined in their respective center sections 233, 235, 237, 239.) This structure secures at least part of the double fletching 220 between the exterior surface of the rod shaft tail end portion 208 and the mating fastener 254. As opposed to the square or rectangular cross-section of the rod shaft tail end portion 208, FIG. 127 shows a rod shaft tail end portion 214 having an alternative cross-section of a six-sided polygon, and every other side has a center section 231 of a double fletching 220 attached thereto using at least one fastener 258.

FIGS. 124 and 125 show a third exemplary tail end 204 with a rod shaft tail end portion 210 and mechanically attached double fletching 220 (shown as a pair of double fletching 220). The rod shaft tail end portion 210 has an exterior surface. As set forth, the tail end portion 210 has at least one aperture 260, each of which spans the distance between two opposite faces of the rod shaft tail end portion 210. Also shown in FIGS. 124 and 125 are a first part of a mating fastener 262 and a second part of a mating fastener 266 that interact to secure the double fletching 220 (shown securing two double fletching 220) to the rod shaft 200. To attach two double fletching 220, at least one first part of a mating fastener 262 is inserted through at least one aperture 221 in the center section 231 of a first double fletching 220, through at least one aperture 260 of the rod shaft tail end portion 210, through at least one aperture 221 in the center section 231 of a second double fletching 220, and then through apertures 268 in a second part of a mating fastener 266 to secure both the first and the second double fletching 220 to the rod shaft tail end portion 210. (If alternative double fletching 222, 224, 226, 228 is used, the apertures 223, 225, 227, 229 would be defined in their respective center sections 233, 235, 237, 239.) This structure secures at least part of the first double fletching 220 between the rod shaft tail end portion 210 and the pronged mating fastener 262 and at least part of the second double fletching 220 between the rod shaft tail end portion 210 and the apertured mating fastener 266.

FIG. 126 shows a fourth exemplary tail end 204 with a rod shaft tail end portion 212 and mechanically attached double fletching 220 (shown as a pair of double fletching 220). The rod shaft tail end portion 212 has an exterior surface. As set forth, the tail end portion 212 has at least one aperture 270, each of which spans the distance between two opposite faces of the rod shaft tail end portion 212. Also shown in FIG. 126 are three first parts of a mating fastener 272 and three second parts of a mating fastener 276 that interact to secure the double fletching 220 (shown securing two double fletching 220) to the rod shaft 200. To attach two double fletching 220, at least one first part of a mating fastener 272 is inserted through at least one aperture 221 in the center section 231 of a first double fletching 220, through at least one aperture 270 of the rod shaft tail end portion 212, through at least one aperture 221 in the center section 231 of a second double fletching 220, and then through apertures 278 in a second part of a mating fastener 276 to secure both the first and the second double fletching 220 to the rod shaft tail end portion 212. (If alternative double fletching 222, 224, 226, 228 is used, the apertures 223, 225, 227, 229 would be defined in their respective center sections 233, 235, 237, 239.) This structure secures at least part of the first double fletching 220 between the rod shaft tail end portion 212 and the pronged mating fasteners 272 and at least part of the second double fletching 220 between the rod shaft tail end portion 212 and the apertured mating fasteners 276.

The sets of fasteners discussed herein have primarily been ones that have one fastener component that is pushed through a second fastener component. FIGS. 142-144 show a rod shaft tail end portion 218 with a sliding relationship between two fastener components. The first part of a sliding mating fastener (a pronged mating fastener 280 having at least one trapezoidal-shaped prong fastener 281) and a second part of a sliding mating fastener (opposing channels 282 with generally trapezoidal cross-sections on opposite sides of the rod shaft tail end portion 218). The shown double fletching 220' has a center section 231' with at least one aperture 221' that is shaped to accommodate the trapezoidal-shaped prong fastener 281. (The general shape of the double fletching 220' may be similar to the double fletching designs shown in FIGS. 128-132 or may have another shape.) FIG. 142 shows the pronged mating fastener 280 prior to the at least one trapezoidal-shaped prong fastener 281 being inserted through the at least one aperture 221' of the double fletching 220'. The indicated step (1) inserts the at least one trapezoidal-shaped prong fastener 281 being inserted through the at least one aperture 221' of the double fletching 220'. The result of step (1) is shown in FIG. 143. Then, the combined pronged mating fastener 280 and double fletching 220' are slid (step (2)) through the channel 282 of the rod shaft tail end portion 218. More specifically, the tips of the at least one trapezoidal-shaped prong fastener 281 are slid (step (2)) through the channel 282 of the rod shaft tail end portion 218. The result of step (2) is shown in FIG. 144. Friction between the trapezoidal-shaped prong fastener(s) 281 and the channel 282 may secure the double fletching 220' to the rod shaft tail end portion 218 or there may be additional locking structure (not shown). This sliding structure may be used in place of other "insertion" structure described herein.

It should be noted that mechanically attached double fletching 220 and rod shafts 200 (for example, the tail end portions 206, 208, 210, 212 and fasteners 244, 254, 262, 266, 272, 276, 258 shown in FIGS. 1-10, FIGS. 11-21, FIGS. 22-32, FIGS. 72-82, FIGS. 113-120, and FIGS. 121-127) are not just an obvious variation of fletching attached with adhesive. Inventing the double fletching 220, tail end portions 206, 208, 210, 212, fasteners 244, 254, 262, 266, 272, 276, 258 is more than just a simple replacement of the adhesive with known mechanical fasteners. For projectiles to fly properly, weight, balance, and aerodynamics are critical. (For example, the head end should generally be heavier than the tail end.) Adhesive has almost no weight. Adding weight to the tail end of a projectile can significantly change the flight properties of the projectile. The mechanically attached fletching described herein compensates for the added weight of the fasteners by, for example, reducing the weight of the tail end portion of the projectile (e.g. by making it hollow and/or by defining voids (e.g. openings 246) in the tail end portion). Further, the use of double fletching that is not threaded through the shaft is unique. Again, for projectiles to fly properly, weight, balance, and aerodynamics are critical. Adding structure (e.g. fletching) to the outside of the shaft tail end of a projectile can significantly change the flight properties of the projectile. The mechanically attached fletching described herein compensates for the double fletching being on the exterior of the shaft by, for example, changing the shape of the tail end portion of the projectile. Further, it would be almost impossible to have four fins using two sets of double fletching that are threaded through the shaft (and there is no known prior art showing this) because there would be too much bulk threaded through the shaft and the tail end of the shaft itself would become too delicate. On the other hand, mechanically attaching two sets of double fletching to the exterior of the shaft allows for four "fins" and attaching three sets of double fletching to the exterior of the shaft allows for six "fins."

A tail feature shown in FIGS. 83-96 is the copter 680 (or copter tail). The general idea of a copter tail can be found in helicopter toys (e.g. an ARROWCOPTER™ toy) that are thrown into the air and, when they reach the upper limit of their flight, reverse and come downward. During the decent, the folded wing material causes the helicopter toy to rotate (like helicopter blades). U.S. Pat. No. 1,545,476 to Austerman is directed to a toy arrow that, in one version, may be used with a toy parachute. As the arrow is shot upwardly into the air, the parachute is carried along. When the arrow has reached the upper limit of its flight, it reverses and comes downward. This releases the parachute that then opens and descends independently of the arrow. Unlike the copter tail described herein that changes the decent of the projectile, the Austerman parachute does not effect the decent of the Austerman arrow. U.S. Pat. No. 3,390,480 to Turner is directed to an arrow-helicopter toy that may be propelled upwardly into a first flight mode of flight as an arrow, and then will descend as a helicopter. The Turner reference discloses a "toy" with a relatively hard weighted tip (not necessarily "pointed," but nonetheless too dangerous for a child's toy). To launch the Turner device, a rubber band (that is attached to a stick or handle) is attached to a hook on the arrow, the wing members are grabbed and pulled relative to the stick, and then the wing members are released to let the arrow "fly." Grabbing the wings can easily damage the wings, but grabbing the rudder would be (at the very least) awkward. Finally, because the Turner reference uses only a hole and stud configuration to secure the wings to the shaft, it is probable that the connection therebetween will not be sufficient for today's rough-and-tumble kids. U.S. Pat. No. 2,621,441 to Worden is directed to a torpedo-shaped whistling toy aerial projectile that may be propelled upwardly into a first flight mode of flight as an arrow, and then will descend as a helicopter. To launch the Worden device, a rubber band (that is attached to a stick) is attached to a hook on the projectile, the wing members are grabbed and pulled relative to the stick, and then the wing members are released to let the arrow "fly." Grabbing the wings can easily damage the wings. Finally, the wings of the Worden reference appear to be permanent. If the wings are damaged, the toy would be useless.

Figure 95:
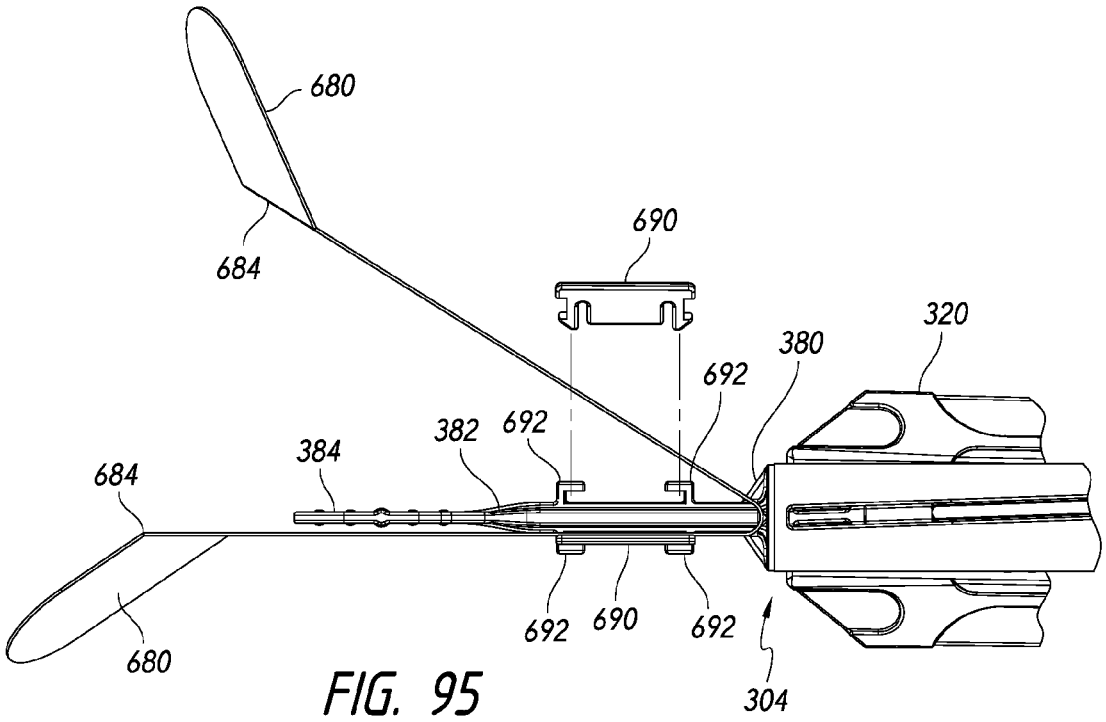
FIG. 95 is a perspective view of an exemplary copter tail with one side of the exemplary copter tail in an at least partially opened position.

The copter 680, as shown in detail in FIG. 96, is an elongate piece of flexible plastic (or other suitable material). It may be folded 682 substantially at its middle point and have two folds or bends 684 between the fold 682 and the distal ends (but more towards the distal ends). The copter 680 is shown as having a central aperture 686 (shown as spanning the fold 682) through which the copter shaft 382 may be inserted. On both sides of the central aperture 686 are attachment apertures 688 (shown as two apertures 688 on each side). FIG. 95 also shows first copter attachment mechanisms (attachment clips 690) that attach to second copter attachment mechanisms (shown as a pair of claw fingers 692 on both sides of the copter shaft 382). When assembled with the copter 680 folded over the copter shaft 382, the claw fingers 692 extend through the attachment apertures 688 and the attachment clips 690 engage respective pairs of claw fingers 692.

Illuminators

Referring to the figures and disclosed herein, are various types of illuminated projectiles 102, 108, 110, 112, 116, 120, 122, 124, 126 having a shaft 200, 300, 400, the shaft having a head end 202, 216, 216*a*-216*d*, 302, 402 and a tail end 204, 206, 208, 210, 212, 304, 404, the head end having a head 500, 550, 570. The illuminated projectile preferably includes (a) at least one illumination system 700 having at least one source of illumination 702, at least one power source 706, and circuitry 708; (b) the at least one source of illumination positioned generally within the projectile at least near the head end; (c) the at least one source of illumination directed generally toward the tail end; and (d) the shaft functioning as a light pipe such that light from the at least one source of illumination travels along the shaft and at least partially illuminates the shaft.

It has been recognized that it is advantageous to light or illuminate a projectile. This feature is desirable, for example, to help locate or recover the projectile if it is flown at night or is lost in dense brush, leaves, or the like. Known projectiles have an illuminated head or tail. Known projectiles also have external illumination that may illuminate part of the shaft from an external source (the source being physically adjacent to or in parallel with the shaft or head, but not in line or in serial with the shaft or head). Known projectiles use chemicals or luminescent material for illumination. Most known projectiles with light sources position the light sources near the rear of the projectile, such as in the nock.

Unlike the known projectiles, the projectiles disclosed herein may include an illuminator housed at or near the head end (e.g. generally near the head end of the shaft, near the head, and/or between the head end of the shaft and the head), but directed toward the tail end of the shaft so that the shaft itself is at least partially (and preferably generally and/or substantially) internally illuminated. This may be accomplished using preferred shafts that have fiber optic-like properties in that they may be able to function as a light wave guide or "light pipe." This is also accomplished using illumination systems (also referred to as "illuminators" 700) that preferably include at least one source of illumination 702, an activator 704, a power source 706, and circuitry 708. The illuminators 700 are preferably positioned generally within the projectile in that they are generally within the head and/or the head end of the shaft. Some configurations have a physical switch activator 704 that may be external to the head and/or the head end of the shaft. Some configurations have gap between the head and the head end of the shaft such that a portion of the illuminator 700 is not technically internal to the head and/or the head end of the shaft, but the illuminator 700 is in line (in serial) with the head and/or the head end of the shaft. Finally, this is also accomplished using appropriate protection (e.g. cushioning and shop absorption structure) to protect the relatively delicate components from damage caused by use of a projectile.

The rod shaft 200 of FIGS. 11-21 is preferably made of a solid shaft (although cross-sections may be of many different shapes including those shown in FIGS. 145-148) that is able to function as a light wave guide or "light pipe." In other words, the light from the source of illumination 702 travels along and at least partially illuminates the shaft. The material from which the rod shaft 200 is made may be, for example, acrylonitrile butadiene styrene (ABS), polypropylene (PP), polyethylene (PE), a combination of PP and PE, combination of ABS and PPS, nylon, styrene-butadiene copolymers (e.g. K Resin®), and/or any material known or yet to be discovered that can function as a light wave guide or "light pipe." The tubular shafts 300 of FIGS. 48-59 and 60-71 is preferably hollow, but the exterior periphery is made from a material (such as acrylonitrile butadiene styrene (ABS), polypropylene (PP), polyethylene (PE), a combination of PP and PE, combination of ABS and PPS, nylon, styrene-butadiene copolymers (e.g. K Resin®), and/or any material known or yet to be discovered that has the appropriate characteristics) that is at least partially translucent or semitransparent. The tubular shafts 300 are able to function as a light wave guide or "light pipe." Unlike the other shafts 200, 300, the mesh shaft 400 of FIGS. 97-112 are not particularly designed to function as a light wave guide or "light pipe," but instead has both solid portions and gaps defined between the solid portions. Light viewable from the gaps created by solid portions makes interesting patterns and has a unique effect.

Exemplary projectiles of FIGS. 11-21, 48-59, 60-71, 72-82, and 97-112 are shown as including at least one exemplary source of illumination 702. The source of illumination 702 acts as a starting point, but also emits a beam of light that is either directional or may be directed in a particular direction. Projectiles in other figures may be adapted to include at least one source of illumination 702. The at least one source of illumination 702 may be at least one light-emitting diode (LED), at least one laser diode, at least one bulb (incandescent or fluorescent), or any other known light source having the requisite illumination and durability characteristics. The requisite illumination characteristic is that it must be bright enough or project enough light to at least partially illuminate the shaft. The requisite durability characteristic is that it must be able to withstand use in the head of a projectile used as an arrow, rocket, or dart (and, therefore, able to endure repeated impact) albeit with appropriate cushioning and/or shock absorption structure.

Exemplary projectiles of FIGS. 11-21, 48-59, 60-71, 72-82, and 97-112 are shown as including at least one exemplary manual or automated activator 704. Projectiles in other figures that have been adapted to include at least one source of illumination 702 would also include an activator 704. The at least one activator 704 may be at least one switch (as shown), at least one button, at least one linear induction structure, at least one automated activator (e.g. activated by motion or acceleration), or any other known activator having the requisite activating and durability characteristics. The requisite activating characteristic is that it must be able to selectively activate the at least one source of illumination 702. The requisite durability characteristic is that it must be able to withstand use in the head of a projectile used as an arrow, rocket, or dart (and, therefore, able to endure repeated impact) albeit with appropriate cushioning and/or shock absorption structure.

Exemplary projectiles of FIGS. 11-21, 48-59, 60-71, and 97-112 are shown as including at least one exemplary power source 706. Projectiles in other figures that have been adapted to include at least one source of illumination 702 would also include a power source 706. The at least one power source 706 may be at least one battery (as shown), at least one solar energy source, at least one capacitor, or any other known power source having the requisite power and durability characteristics. The requisite power characteristic is that it must provide enough power to power the at least one source of illumination 702. The requisite durability characteristic is that it must be able to withstand use in the head of a projectile used as an arrow, rocket, or dart (and, therefore, able to endure repeated impact) albeit with appropriate cushioning and/or shock absorption structure.

Exemplary projectiles of FIGS. 11-21, 48-59, 60-71, and 97-112 are shown as including circuitry 708. Projectiles in other figures that have been adapted to include at least one source of illumination 702 would also include circuitry 708. The at least one circuitry 708 may be all or part of a printed circuit board (or other control structure), conductive structure (e.g. wires, springs, contacts), direct connections, or any other known circuitry having the requisite functional and durability characteristics. The requisite functional (e.g. control and/or conductive) characteristic is that it must be able to control and/or conduct power from the power source 706 to the source of illumination 702 when the activator 704 activates the at least one illuminator 700. The requisite durability characteristic is that it must be able to withstand use in the head of a projectile used as an arrow, rocket, or dart (and, therefore, able to endure repeated impact) albeit with appropriate cushioning and/or shock absorption structure.

Cushioning and/or shock absorption structure is a significant component of projectiles having at least one illuminator 700. Most traditional arrow, rocket, or dart projectiles do not have cushioning and/or shock absorption and could not have cushioning and/or shock absorption because it would defeat the purpose of the projectile. For example, a traditional arrow (e.g. one used for hunting or target practice) would not be usable for intended purpose if its head included cushioning and/or shock absorption structure. Perhaps it is for that reason that illuminators associated with traditional arrows are positioned within the tail end (although, arguably if the traditional arrow were designed for piercing, the head would be buried and having an illuminator in the head would defeat the illuminator's purpose). Known toy projectiles that have illuminators do not rely upon cushioning and/or shock absorption structure, but take other steps to protect the illuminator including, but not limited to, (1) avoiding having the illuminator at or near the head end, (2) using parachutes or helicopter structure to slow decent such that the toy projectiles would not be considered to be arrows, rockets, or darts that must endure repeated impact, and/or (3) uses a light source that is physically adjacent to or in parallel with the shaft, but not in line or in serial with the shaft.

Many of the projectiles described herein that have at least one illuminator 700 or could be adapted to have at least one illuminator 700 are designed to be used as arrows, rockets, or darts that must endure repeated impact. But having the illuminator at or near the head end in line with or in serial with the shaft produces a particular effect that is highly desirable. For example, this configuration may produce a shooting star-like effect with a brighter spot followed by a trail of light (the illuminated shaft). Bulky cushioning and/or shock absorption structure, however, would be aesthetically displeasing. The suction heads and bounce-back heads, however, preferably have at least some cushioning and/or shock absorption properties. In addition, the head and/or head end may include sturdy or protecting or cocooning structure to insulate the illuminator 700 from repeated impact. For example, isolating or restraining (e.g. using walls, springs, or other structure between the relatively heavy power source 706 and the rest of the components of the illuminator 700) the power source 706 prevents the power source 706 from acting as an internal missile that could damage the rest of the components of the illuminator 700.

The projectiles shown in FIGS. 48-59 and 60-71 also include a cap 358*a*, 358*b* that has been shown (though experimentation) to have significant cushioning and/or shock absorption properties. The cap 358*a*, 358*b* acts as an additional cushion and/or shock absorber that reduces impact on the source of illumination 702 and/or the power source 706. The shown caps 358*a*, 358*b*, when associated with the casings (head reinforcers 350*a*, 350*b*), may have a small gap (e.g. an air pocket) therebetween that provides additional cushioning and/or shock absorption properties. For example, the air pocket may at least partially absorb the impact force when the projectile contacts the ground or another object. The shown caps 358*a*, 358*b* fit 360 degrees around the casings (head reinforcers 350*a*, 350*b*), thereby protecting the illuminators 700, but alternative caps may take other configurations. The shown caps 358*a*, 358*b* having ribbing (shown as three at least partial annular ridges) or texture on its exterior surface to grip the interior surface of the head 550. The cap 358*a*, 358*b* may also incorporate one or more launcher engager (e.g. a hook) 600. The cap 358*a*, 358*b* may also include removable/replaceable structure (e.g. threading) that works with mating removable/replaceable structure (e.g. threading) of the casings (head reinforcers 350*a*, 350*b*).

Method for Construction

Referring to the figures and disclosed herein, are various methods for mechanically attaching fletching (shown as double fletching 220, 222, 224, 226, 228) to a shaft 200, 300 of a projectile 100, 102, 104, 112, 118, 120, 126, the shaft having a head end 202, 216, 216*a*-216*d*, 302, 402 and a tail end 204, 206, 208, 210, 212, 304, 404, the shaft having an exterior surface. The method comprising the steps of: (a) aligning at least one double fletching having a connection section 231, 231', 233, 235, 237, 239 such that fletching connection structure 221, 221', 223, 225, 227, 229, and the elongate aperture that would be used in FIG. 141, associated with the connection section is aligned with the tail end of the shaft; (b) aligning at least one mechanical fastener 240, 241, 244, 244', 250, 254, 254', 262, 266, 272, 276, 280, 282, 290, 294 with the connection section and the tail end of the shaft; and (c) fastening the at least one mechanical fastener to attach the at least one double fletching to the exterior surface of the shaft via the fletching connection structure.

Depending on the particular structure of the elements, the step of aligning at least one mechanical fastener with the connection section and the tail end of the shaft may be characterized in one or more of the following ways:

- aligning at least one prong of the at least one mechanical fastener with at least one aperture of the connection section and the tail end of the shaft;
- aligning at least one prong projecting from the tail end of the shaft with at least one aperture of the connection section;
- aligning at least one split-prong projecting from the tail end of the shaft with at least one aperture of the connection section; and
- aligning at least one split-prong projecting outwardly from the tail end of the shaft with at least one aperture of the connection section.

These are meant to be exemplary and are not meant to exclude alternatives described herein.

Depending on the particular structure of the elements, the step of fastening the at least one mechanical fastener to attach the at least one double fletching to the exterior surface of the shaft may be characterized in one or more of the following ways:

- inserting at least one prong through the at least one aperture and fastening the at least one prong;
- inserting at least one prong through the at least one aperture and fastening the at least one prong to a mating apertured fastener;
- inserting at least one split-prong through the at least one aperture and fastening the at least one split-prong; and
- inserting at least one split-prong through the at least one aperture and fastening the at least one split-prong to a mating apertured fastener.

These are meant to be exemplary and are not meant to exclude alternatives described herein.

Design Aspects:

Although many of the features disclosed and discussed herein are functional, there are also ornamental aspects for the specific implementations. For example, FIGS. 149-154 show various views of exemplary double fletching. FIGS. 163-169 show various views of a projectile having a rod shaft, a suction head, two hooks, mechanically attached fletching, and an illuminator. FIGS. 170-177 show various views of a projectile having a tubular shaft, a bounce-back head, one hook, adhered fletching, and an illuminator. FIGS. 178-185 show various views of a projectile having a tubular shaft, a bounce-back head, two hooks, adhered fletching, and an illuminator. FIGS. 186-193 show various views of a projectile having a hybrid (both a tubular shaft and a rod shaft) shaft, a bounce-back head, two hooks, a cap, mechanically attached fletching, and an illuminator.

It should be noted that alternative ornamental designs could include variations on the specifically shown projectiles. For example, alternative ornamental designs for projectiles shown with a suction head may have a bounce-back head and, similarly, alternative ornamental designs for projectiles shown with a bounce-back head may have a suction head. Other alternative designs would include replacing the shown fletching with other fletching (e.g. replacing the fletching of FIGS. 170-177 with FIGS. 178-185 or, similarly, replacing the fletching of FIGS. 178-185 with FIGS. 170-177). Still other alternative designs would include replacing the shown single hook with two hooks or, similarly, the shown two hooks with a single hook.

It should further be noted that some of the individual components have additional and/or separate design elements. For example, the various heads, hooks, fletching, and illuminators may have ornamental aspects alone or in combination. Finally, figures other than those specifically mentioned as having design elements may have design elements that are not specifically called out here.

Definitions

Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

- The term "interact" is defined to mean mechanically engage either directly or indirectly. For example, a prong fastener that interacts with an aperture may be inserted through the aperture. Another example is that nub(s) may interact with the inner surface(s) of cavity(s) when the nub(s) is/are positioned therein. The resulting interaction may result in fastening (e.g. two fasteners may "interact" by fastening with each other), engagement, and/or attachment.
- The term "associated" is defined to mean integral or original, retrofitted, attached, connected (including functionally connected), positioned near, and/or accessible by.
- The term "via" is defined to mean "by means of," "using," or "by way of." For example, at least one mechanical fastener may be used for attaching fletching to the exterior surface of a shaft "via" the connection section associated with at least one fin. If the connection section has at least one aperture defined therein and the mechanical fastener is at least one projecting prong fastener, the term "via" might narrowly mean "through," but would also more broadly be interpreted to mean "by means of," "using," or "by way of."
- It should be noted that relative terms are meant to help in the understanding of the technology and are not meant to limit the scope of the invention. Similarly, unless specifically stated otherwise, terms such as "first," "second," and "third" are meant solely for purposes of designation and not for order or limitation.
- It should be noted that some terms used in this specification are meant to be relative. For example, the term "top" (used herein in relation to the head or tip of the projectile) is meant to be relative to the term "bottom" (used herein in relation to the tail of the projectile). The term "front" is meant to be relative to the term "back," and the term "side" is meant to describe a "face" or "view" that connects the "front" and the "back." Rotation of the system or component that would change the designation might change the terminology, but not the concept.
- The terms "may," "might," "can," and "could" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation.
- Unless specifically stated otherwise, the term "exemplary" is meant to indicate an example, representative, and/or illustration of a type. The term "exemplary" does not necessarily mean the best or most desired of the type.
- It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the terms "includes" and "has" mean "comprises" (e.g. a device that includes, has, or comprises A and B contains A and B, but optionally may contain C or additional components other than A and B). It should be noted that, unless otherwise specified, the singular forms "a," "an," and "the" refer to one or more than one, unless the context clearly dictates otherwise.

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not.

All references (including, but not limited to, foreign and/or domestic publications, patents, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. An illuminated projectile having a shaft, said shaft having a head end and a tail end, said head end having a head, said illuminated projectile comprising:

(a) at least one illumination system having at least one source of illumination, at least one power source, and circuitry;

(b) said at least one source of illumination positioned generally within said projectile at least near said head end;

(c) said at least one source of illumination directed generally toward said tail end; and (d) the majority of said shaft being a solid shaft, said shaft functioning as a light pipe such that light from said at least one source of illumination travels along said shaft and at least partially illuminates said shaft.

2. The illuminated projectile of claim 1, at least part of said shaft being a tubular shaft.

3. The illuminated projectile of claim 1, said shaft being translucent.

4. The illuminated projectile of claim 1, said shaft being semitransparent.

5. The illuminated projectile of claim 1, said at least one source of illumination being in line with or in serial with said shaft.

6. The illuminated projectile of claim 1, said shaft having an exterior surface, said tail end having mechanically attachable fletching, said mechanically attachable fletching comprising:

(a) at least one fin;

(b) a connection section bordering said at least one fin; and (c) at least one mechanical fastener for attaching said fin to said exterior surface of said shaft via said connection section.

7. The illuminated projectile of claim 1:

(a) said head having a plurality of layers, said head end associated with at least one layer of said head; and (b) at least one fin attached to said tail end.

8. The illuminated projectile of claim 1, said shaft being solid between said at least one source of illumination and said tail end.

9. The illuminated projectile of claim 1 further comprising at least one launch engager, said at least one launch engager connected to said shaft.

10. The illuminated projectile of claim 1 further comprising:

(a) said shaft being a generally solid shaft; and (b) at least one launch engager, said at least one launch engager connected to said shaft.

11. An illuminated projectile having a shaft, said shaft having a head end and a tail end, said head end having a head, said illuminated projectile comprising:

(a) at least one illumination system having at least one source of illumination, at least one power source, and circuitry;

(b) said at least one source of illumination positioned generally within said projectile at least near said head end;

(c) said at least one source of illumination directed generally toward said tail end; and (d) said shaft being a generally solid shaft, said shaft functioning as a light pipe such that light from said at least one source of illumination travels along said shaft and at least partially illuminates said shaft.

12. The illuminated projectile of claim 11, at least part of said shaft being a tubular shaft.

13. The illuminated projectile of claim 11, said shaft being translucent.

14. The illuminated projectile of claim 11, said shaft being semitransparent.

15. The illuminated projectile of claim 11, said at least one source of illumination being in line with or in serial with said shaft.

16. The illuminated projectile of claim 11, said shaft having an exterior surface, said tail end having mechanically attachable fletching, said mechanically attachable fletching comprising:

(a) at least one fin;

(b) a connection section bordering said at least one fin; and (c) at least one mechanical fastener for attaching said fin to said exterior surface of said shaft via said connection section.

17. The illuminated projectile of claim 11:

(a) said head having a plurality of layers, said head end associated with at least one layer of said head; and (b) at least one fin attached to said tail end.

18. The illuminated projectile of claim 11, said shaft being solid between said at least one source of illumination and said tail end.

19. The illuminated projectile of claim 11 further comprising at least one launch engager, said at least one launch engager connected to said shaft.

20. A projectile comprising:

(a) a generally solid shaft, said shaft having a head end and a tail end;

(b) at least one source of illumination positioned generally within said projectile at least near said head end, said at least one source of illumination directed generally toward said tail end; and (c) at least one fin attached to said tail end.

21. The projectile of claim 20 further comprising at least one launch engager, said at least one launch engager connected to said shaft.

22. The projectile of claim 20, the majority of said shaft being a solid shaft.

23. The projectile of claim 20, said shaft being solid between said at least one source of illumination and said tail end.

24. The projectile of claim 20, at least part of said shaft being a tubular shaft.

25. The projectile of claim 20, said shaft being translucent.

26. The projectile of claim 20, said shaft being semitransparent.

27. The projectile of claim 20, said at least one source of illumination being in line with or in serial with said shaft.

28. The projectile of claim 20, said shaft having an exterior surface, said tail end having mechanically attachable fletching, said mechanically attachable fletching comprising:

(a) at least one fin;

(b) a connection section bordering said at least one fin; and (c) at least one mechanical fastener for attaching said fin to said exterior surface of said shaft via said connection section.

29. The projectile of claim 20:

(a) said head end having a head, said head having a plurality of layers, said head end associated with at least one layer of said head; and (b) at least one fin attached to said tail end.

30. The projectile of claim 20, said shaft being solid between said at least one source of illumination and said tail end.

* * * * *